US008387823B2

(12) United States Patent
Davis, Jr.

(10) Patent No.: US 8,387,823 B2
(45) Date of Patent: Mar. 5, 2013

(54) DISPENSING APPARATUS SYSTEM AND METHOD

(76) Inventor: Clifford H. Davis, Jr., Tuskegee, AL (US)

( * ) Notice: Subject to any disclaimer, the term of this patent is extended or adjusted under 35 U.S.C. 154(b) by 0 days.

(21) Appl. No.: 12/929,725

(22) Filed: Feb. 11, 2011

(65) Prior Publication Data

US 2011/0204075 A1 Aug. 25, 2011

Related U.S. Application Data

(63) Continuation of application No. 11/987,460, filed on Nov. 30, 2007, now Pat. No. 7,909,206.

(51) Int. Cl.
*B65H 3/44* (2006.01)

(52) U.S. Cl. ..... 221/124; 221/97; 221/102; 221/123; 221/127; 221/191

(58) Field of Classification Search ..... 221/113, 221/119, 218, 253, 123, 127, 97, 102
See application file for complete search history.

(56) References Cited

U.S. PATENT DOCUMENTS

| | | | | |
|---|---|---|---|---|
| 4,483,459 | A * | 11/1984 | Taylor et al. | 221/14 |
| 5,385,265 | A * | 1/1995 | Schlamp | 221/7 |
| 6,170,702 | B1 * | 1/2001 | Zettler et al. | 221/192 |
| 6,694,217 | B2 * | 2/2004 | Bloom | 700/215 |
| 7,228,200 | B2 * | 6/2007 | Baker et al. | 700/236 |
| 7,591,397 | B2 * | 9/2009 | Leonetti | 221/133 |

* cited by examiner

*Primary Examiner* — Timothy Waggoner
(74) *Attorney, Agent, or Firm* — Breiner & Breiner, LLC

(57) ABSTRACT

An automatic dispensing apparatus system and method for dispensing predetermined objects is disclosed. More particularly, the invention is an automatic bottled water dispensing apparatus system and method having a housing which houses various sizes of bottled water and a conveyor system for transporting the bottled water to a dispensing member for a customer. The dispensing apparatus system also includes a return machine for returning empty bottles, a plurality of selection members, a payment member and an inventory monitoring member.

10 Claims, 129 Drawing Sheets

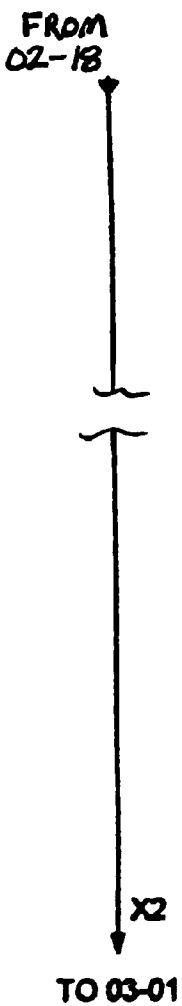
FIG. 6A (CONT'D)
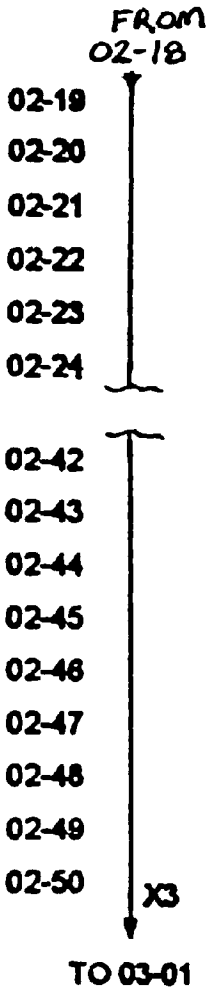

FROM 05-15
TO 05-33
INPUT 5
INPUT 6
INPUT 7
INPUT 8
INPUT 9
18
19
20
21
22
SIGNAL FROM MACHINE
1 GALLON PRODUCT SELECTED
3 GALLON ON GRAVITY CONVEYOR
BELT RUNNING
3 GALLON PRODUCT AT SECURITY DOOR 20
EYE IS CLEAR
SECURITY DOOR CLOSED
LIMIT SWITCH IS MADE
SECURITY DOOR OPEN
LIMIT SWITCH IS MADE
CR-205
PE-520
PE-523
LS-527
LS-530
X2
X3
05-16
05-17
05-18
05-19
05-20
05-21
05-22
05-23
05-24
05-25
05-26
05-27
05-28
05-29
05-30
05-31
05-32

FROM 06-15
TO 06-33
INPUT 5
INPUT 6
INPUT 7
INPUT 8
INPUT 9
34
35
36
37
38
3 GALLON READY FOR PURCHASE
EYE IS CLEAR
PRODUCT SAFETY PLATE TRIPPED
LIMIT SWITCH IS MADE
SIGNAL FROM MACHINE
5 GALLON PRODUCT SELECTED
1 GAL PRODUCT MOVING INTO PURCHASE AREA
EYE IS CLEAR
3 GAL PRODUCT MOVING INTO PURCHASE AREA
EYE IS CLEAR
PE-617
PE-827
PE-630
LS-620
CR-211
X2
X3
06-16
06-17
06-18
06-19
06-20
06-21
06-22
06-23
06-24
06-25
06-26
06-27
06-28
06-29
06-30
06-31
06-32

FROM 07-50
X2
X2
X2
X2
X2
X2
TO 08-17
CR-803
CR
ASOL-806
ASOL-809
CR-812
CR
ASOL-815
113 TURN ON CONVEYOR BELT 3 GALLON
114 SECURITY DOOR DOWN 3 GALLON
115 PRODUCT DOOR DOWN 3 GALLON
116 SIGNAL TO MACHINE OK TO VEND 3 GAL (BOTTLE ACCEPTED)
117 SECURITY DOOR UP 3 GALLON
AB 1769-OW16 RELAY OUTPUTS RACK 0; SLOT 4
VDC 0
OUTPUT 0
OUTPUT 1
OUTPUT 2
OUTPUT 3
OUTPUT 4
802
3A
FROM 07-50
X3A
X3A
TO 08-17
FROM 07-50
X3
TO 08-17
08-01
08-02
08-03
08-04
08-05
08-06
08-07
08-08
08-09
08-10
08-11
08-12
08-13
08-14
08-15
08-16

FROM 08-16
TO 08-35
X2
ASOL-818
CR-821
CR
ASOL-824
ASOL-827
CR-830
ASOL-833
118 PRODUCT DOOR UP
3 GALLON
119 TURN ON CONVEYOR BELT
5 GALLON
120 SECURITY DOOR DOWN
5 GALLON
121 PRODUCT DOOR DOWN
5 GALLON
122 SIGNAL TO MACHINE
OK TO VEND 5 GAL (BOTTLE ACCEPTED)
123 SECURITY DOOR UP
5 GALLON
OUTPUT 6
OUTPUT 7
VDC 0
OUTPUT 8
OUTPUT 9
OUTPUT 10
826
3A
X3A
08-17
08-18
08-19
08-20
08-21
08-22
08-23
08-24
08-25
08-26
08-27
08-28
08-29
08-30
08-31
08-32
08-33
08-34

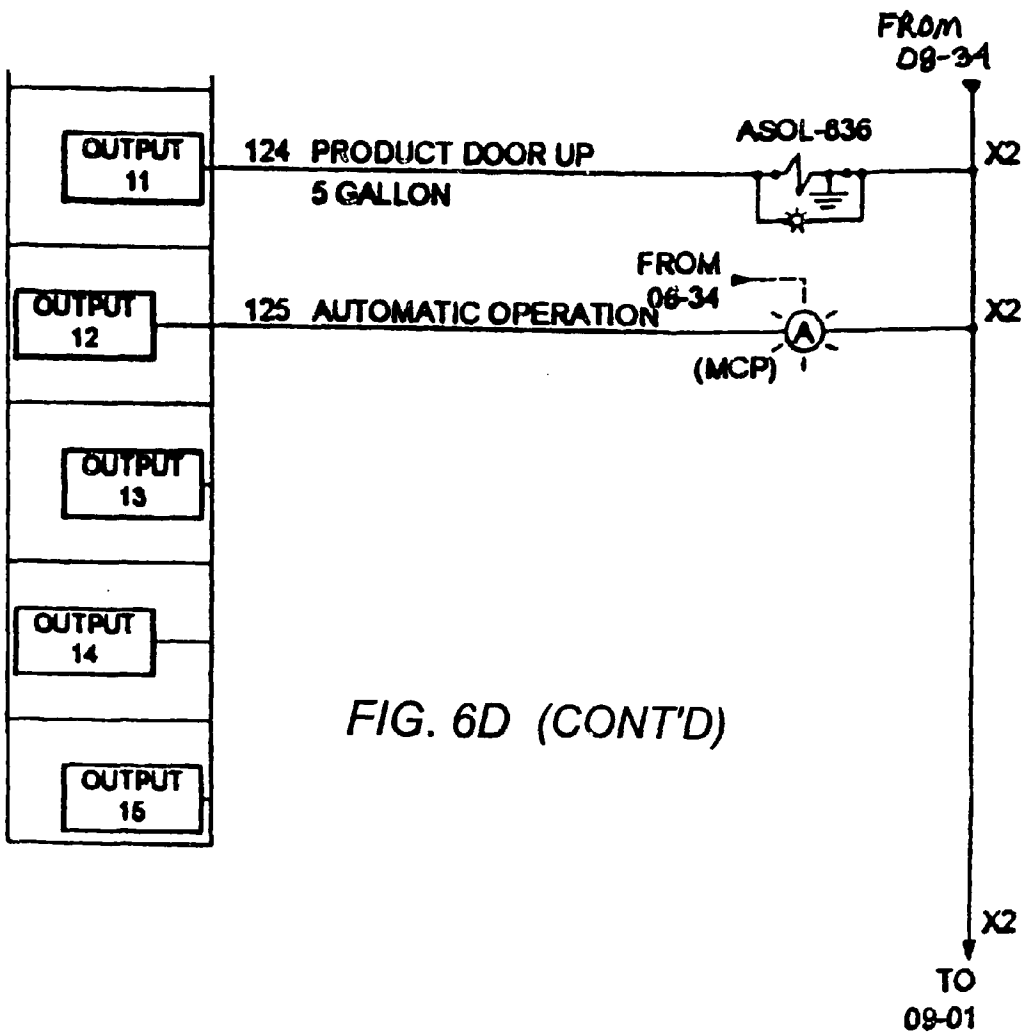
FIG. 6D (CONT'D)
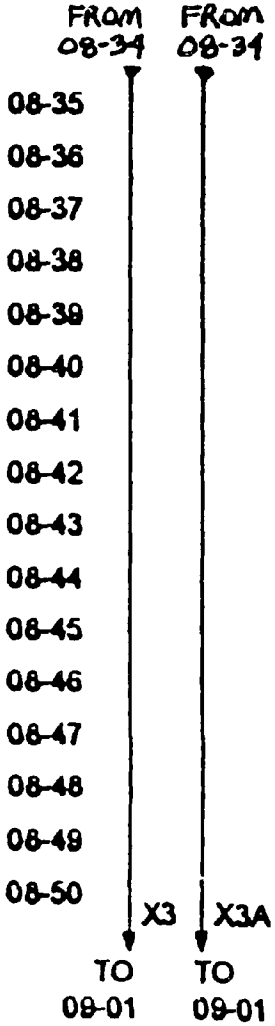

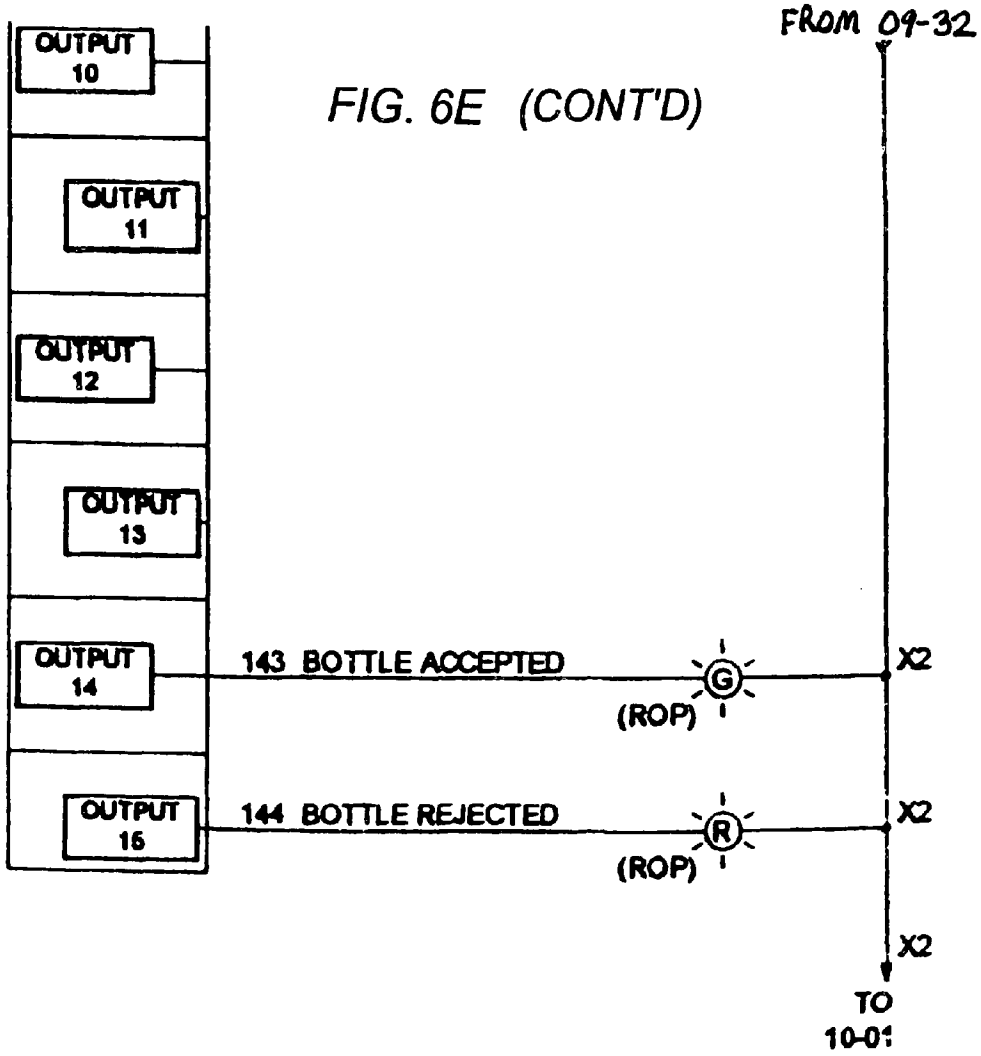
FIG. 6E (CONT'D)
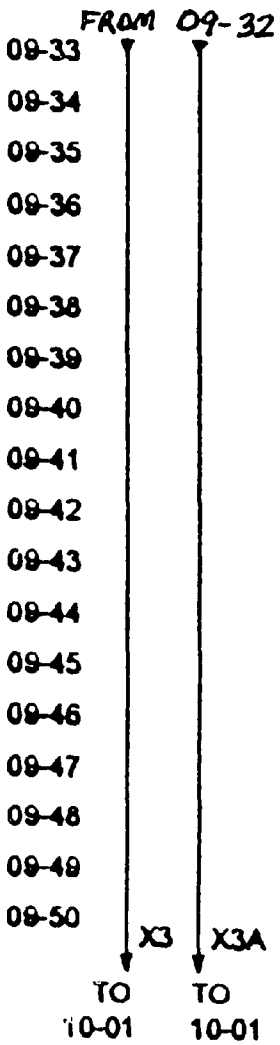

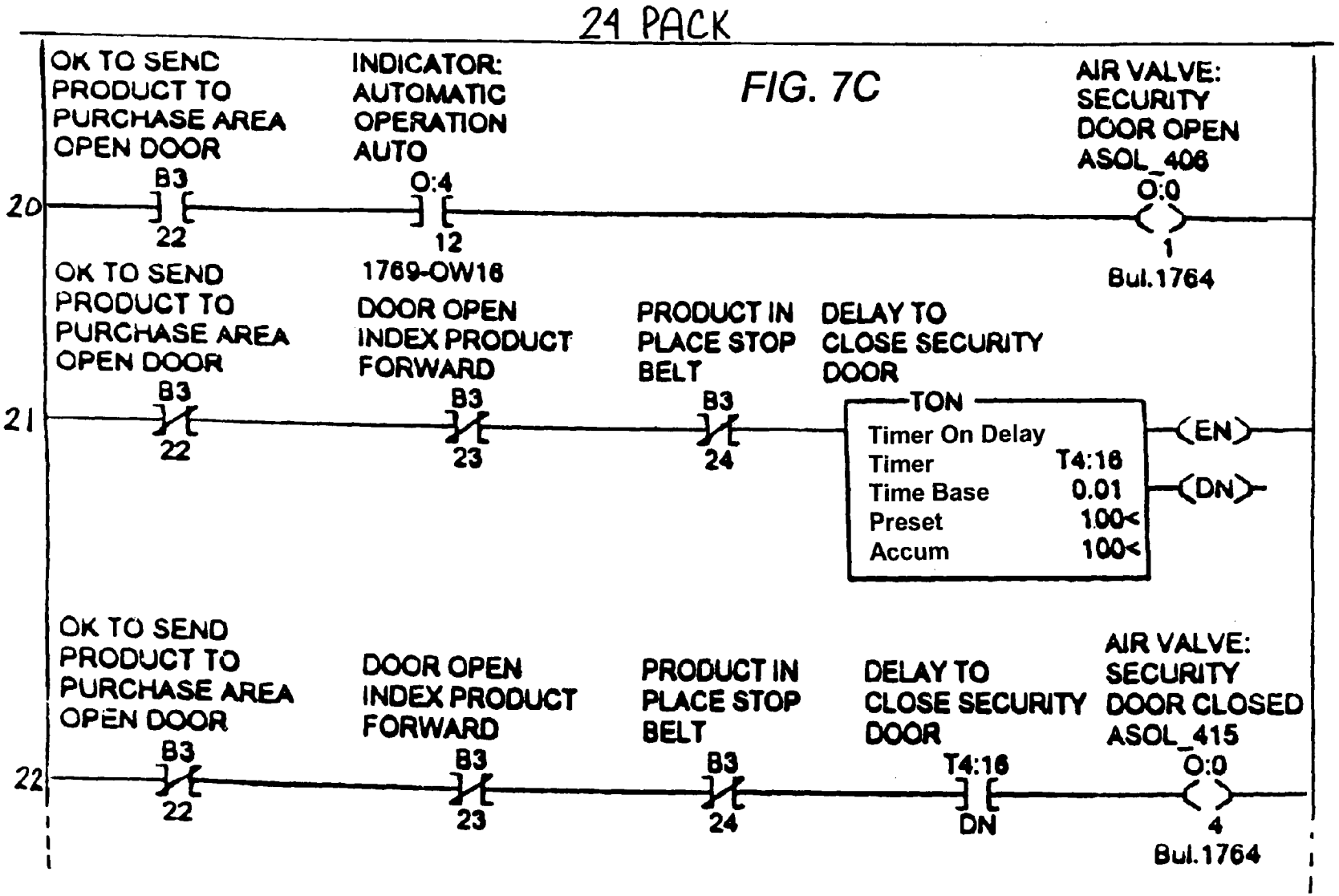
24 PACK
FIG. 7C
OK TO SEND PRODUCT TO PURCHASE AREA OPEN DOOR
B3
22
INDICATOR: AUTOMATIC OPERATION AUTO
O:4
12
AIR VALVE: SECURITY DOOR OPEN ASOL_406
O:0
1
Bul.1764
20
OK TO SEND PRODUCT TO PURCHASE AREA OPEN DOOR
B3
22
1769-OW16
DOOR OPEN INDEX PRODUCT FORWARD
B3
23
PRODUCT IN PLACE STOP BELT
B3
24
DELAY TO CLOSE SECURITY DOOR
TON
Timer On Delay
Timer
Time Base
Preset
Accum
T4:16
0.01
100<
100<
EN
DN
21
OK TO SEND PRODUCT TO PURCHASE AREA OPEN DOOR
B3
22
DOOR OPEN INDEX PRODUCT FORWARD
B3
23
PRODUCT IN PLACE STOP BELT
B3
24
DELAY TO CLOSE SECURITY DOOR
T4:16
DN
AIR VALVE: SECURITY DOOR CLOSED ASOL_415
O:0
4
Bul.1764
22

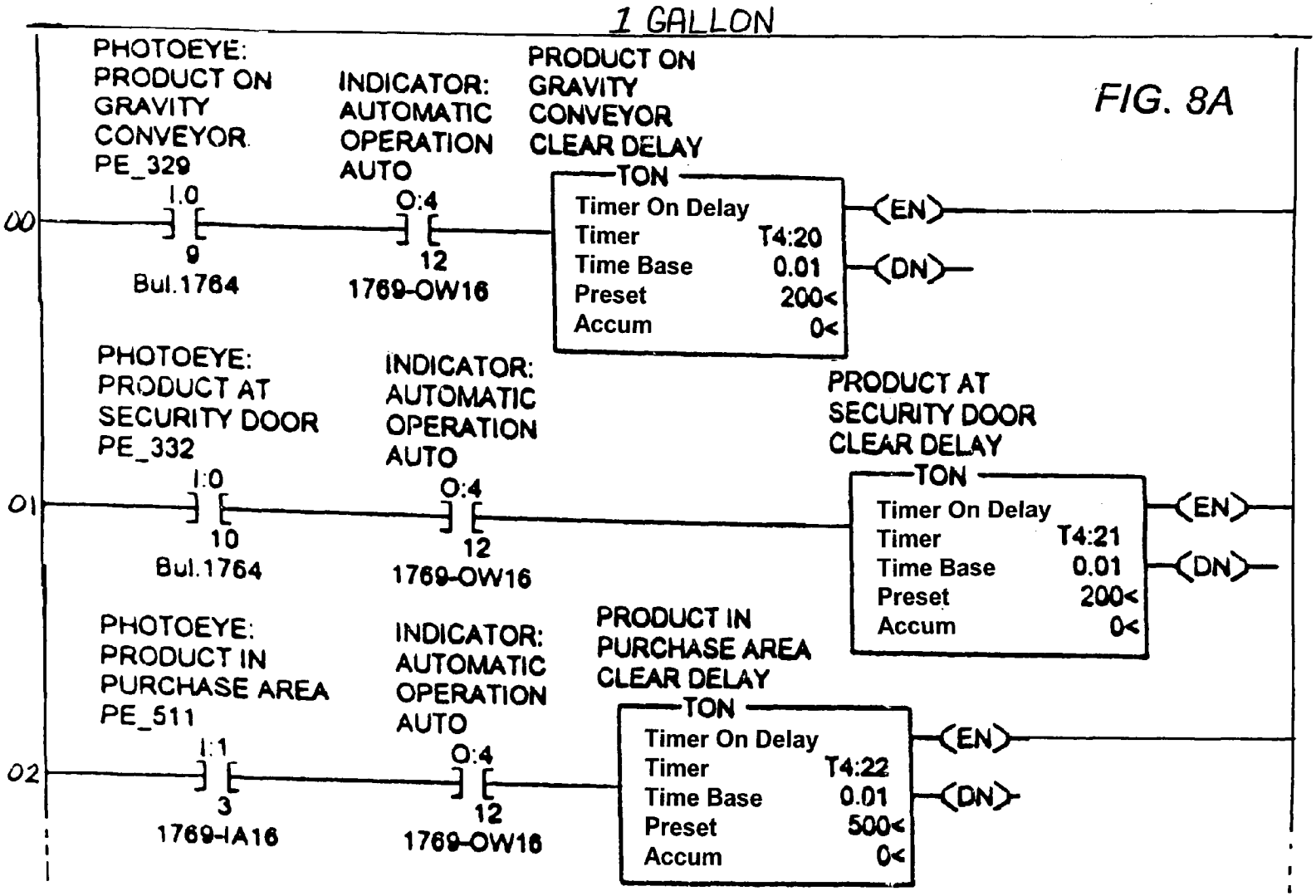
1 GALLON
FIG. 8A
00
01
02
PHOTOEYE: PRODUCT ON GRAVITY CONVEYOR PE_329
I:0
9
Bul.1764
INDICATOR: AUTOMATIC OPERATION AUTO
O:4
12
1769-OW16
PRODUCT ON GRAVITY CONVEYOR CLEAR DELAY
TON
Timer On Delay
Timer
Time Base
Preset
Accum
T4:20
0.01
200<
0<
EN
DN
PHOTOEYE: PRODUCT AT SECURITY DOOR PE_332
I:0
10
Bul.1764
INDICATOR: AUTOMATIC OPERATION AUTO
O:4
12
1769-OW16
PRODUCT AT SECURITY DOOR CLEAR DELAY
TON
Timer On Delay
Timer
Time Base
Preset
Accum
T4:21
0.01
200<
0<
EN
DN
PHOTOEYE: PRODUCT IN PURCHASE AREA PE_511
I:1
3
1769-IA16
INDICATOR: AUTOMATIC OPERATION AUTO
O:4
12
1769-OW16
PRODUCT IN PURCHASE AREA CLEAR DELAY
TON
Timer On Delay
Timer
Time Base
Preset
Accum
T4:22
0.01
500<
0<
EN
DN

1 GALLON

PRODUCT ON GRAVITY CONV OK TO RUN BELT
B3
50
PRODUCT AT SECURITY DOOR CLEAR DELAY
T4:21
DN
DOOR OPEN INDEX PRODUCT FORWARD
B3
53
INDICATOR: AUTOMATIC OPERATION AUTO
O:4
12
1769-OW16
RELAY: TURN ON CONVEYOR BELT CR_421
O:0
6
Bul.1764
OK TO SEND PRODUCT TO PURCHASE AREA OPEN DOOR
B3
52
INDICATOR: AUTOMATIC OPERATION AUTO
O:4
12
1769-OW16
AIR VALVE: SECURITY DOOR OPEN ASOL_424
O:0
7
Bul.1764
19
20

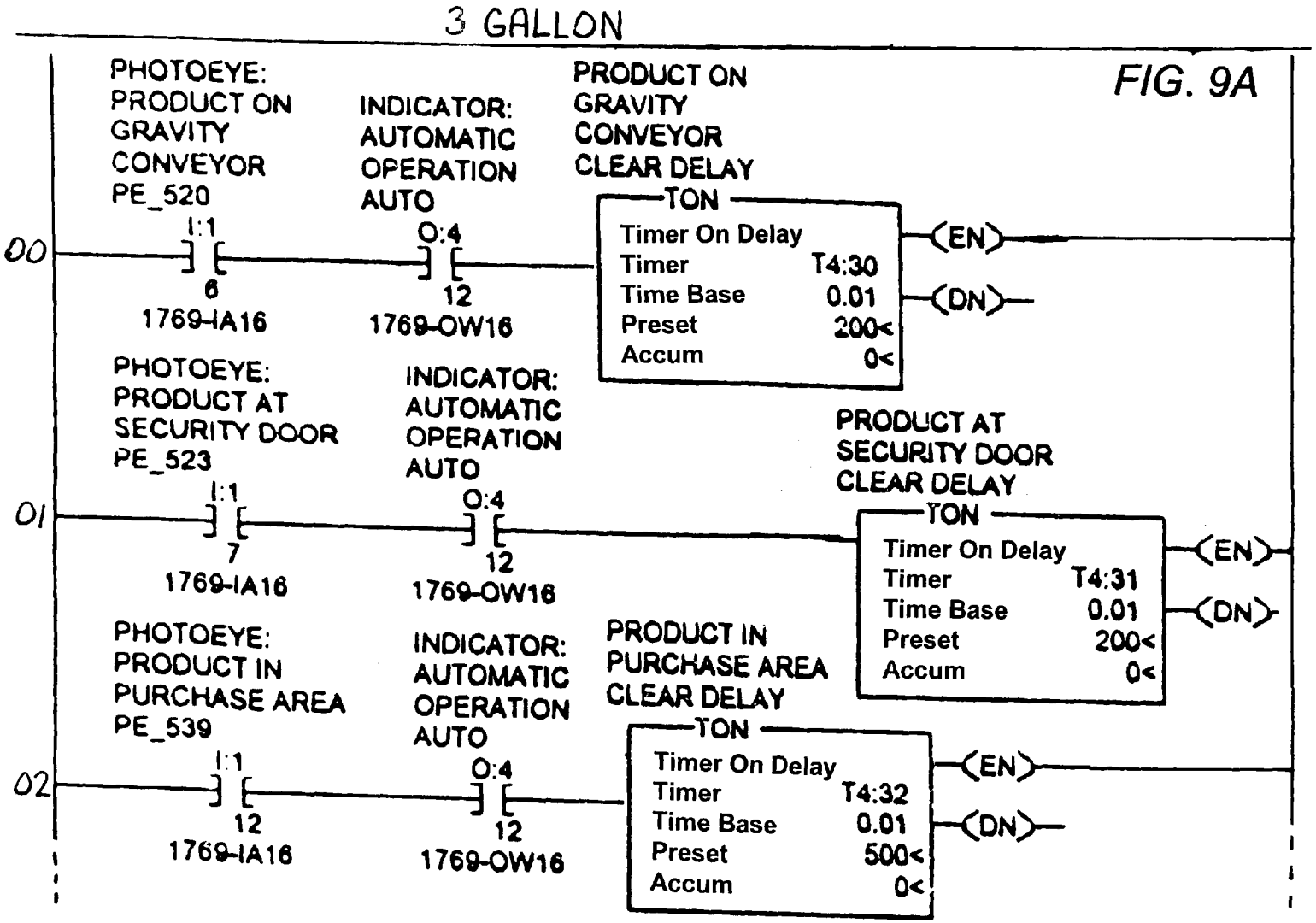
3 GALLON
FIG. 9A
00
PHOTOEYE: PRODUCT ON GRAVITY CONVEYOR PE_520
1:1
6
1769-IA16
INDICATOR: AUTOMATIC OPERATION AUTO
O:4
12
1769-OW16
PRODUCT ON GRAVITY CONVEYOR CLEAR DELAY
TON
Timer On Delay
Timer T4:30
Time Base 0.01
Preset 200<
Accum 0<
EN
DN
01
PHOTOEYE: PRODUCT AT SECURITY DOOR PE_523
1:1
7
1769-IA16
INDICATOR: AUTOMATIC OPERATION AUTO
O:4
12
1769-OW16
PRODUCT AT SECURITY DOOR CLEAR DELAY
TON
Timer On Delay
Timer T4:31
Time Base 0.01
Preset 200<
Accum 0<
EN
DN
02
PHOTOEYE: PRODUCT IN PURCHASE AREA PE_539
1:1
12
1769-IA16
INDICATOR: AUTOMATIC OPERATION AUTO
O:4
12
1769-OW16
PRODUCT IN PURCHASE AREA CLEAR DELAY
TON
Timer On Delay
Timer T4:32
Time Base 0.01
Preset 500<
Accum 0<
EN
DN

3 GALLON

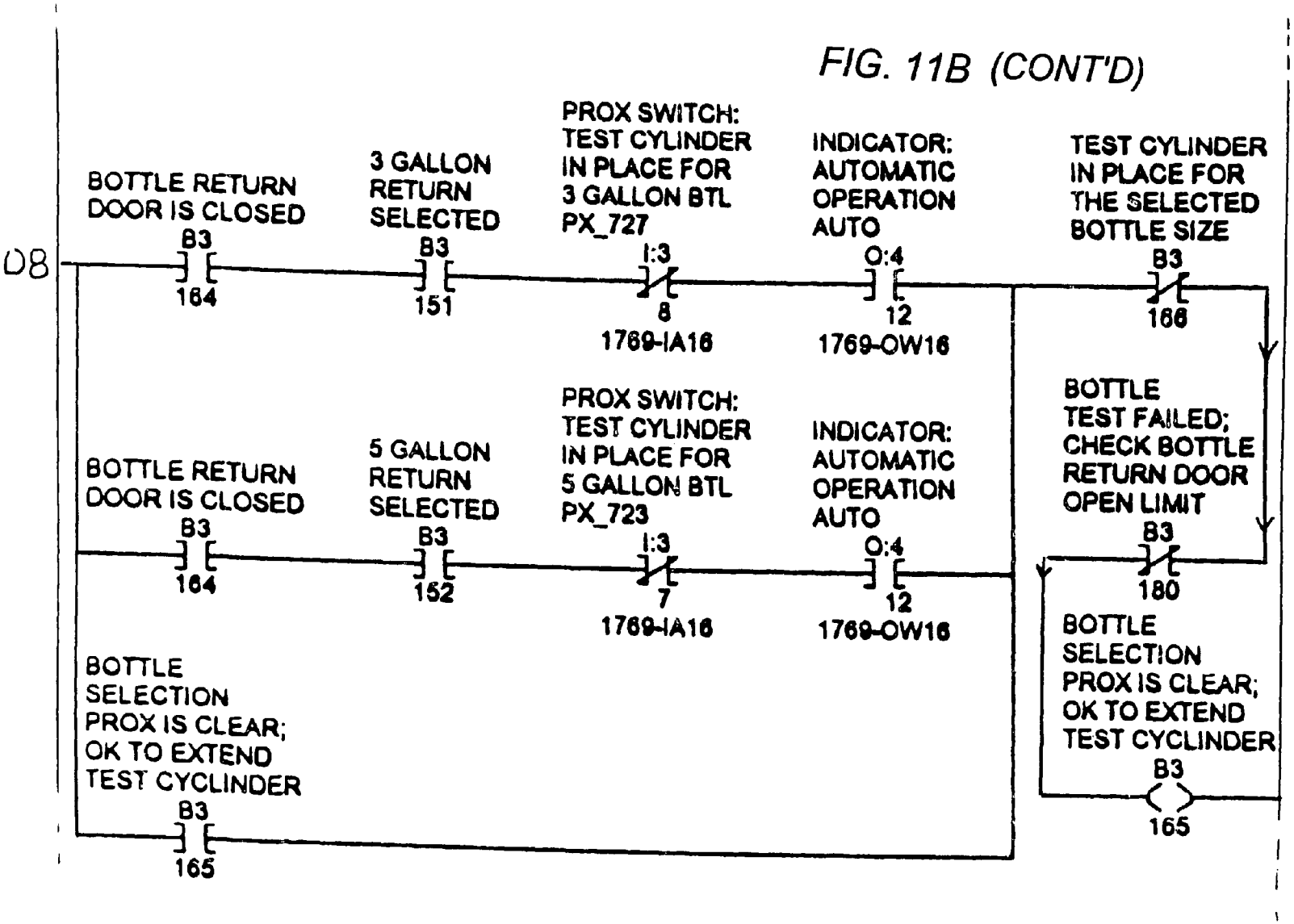
FIG. 11B (CONT'D)
TEST CYLINDER IN PLACE FOR THE SELECTED BOTTLE SIZE
B3
166
BOTTLE TEST FAILED; CHECK BOTTLE RETURN DOOR OPEN LIMIT
B3
180
BOTTLE SELECTION PROX IS CLEAR; OK TO EXTEND TEST CYCLINDER
B3
165
INDICATOR: AUTOMATIC OPERATION AUTO
O:4
12
1769-OW16
INDICATOR: AUTOMATIC OPERATION AUTO
O:4
12
1769-OW16
PROX SWITCH: TEST CYLINDER IN PLACE FOR 3 GALLON BTL PX_727
I:3
8
1769-IA16
PROX SWITCH: TEST CYLINDER IN PLACE FOR 5 GALLON BTL PX_723
I:3
7
1769-IA16
3 GALLON RETURN SELECTED
B3
151
5 GALLON RETURN SELECTED
B3
152
BOTTLE RETURN DOOR IS CLOSED
B3
164
BOTTLE RETURN DOOR IS CLOSED
B3
164
BOTTLE SELECTION PROX IS CLEAR; OK TO EXTEND TEST CYCLINDER
B3
165
D8

10

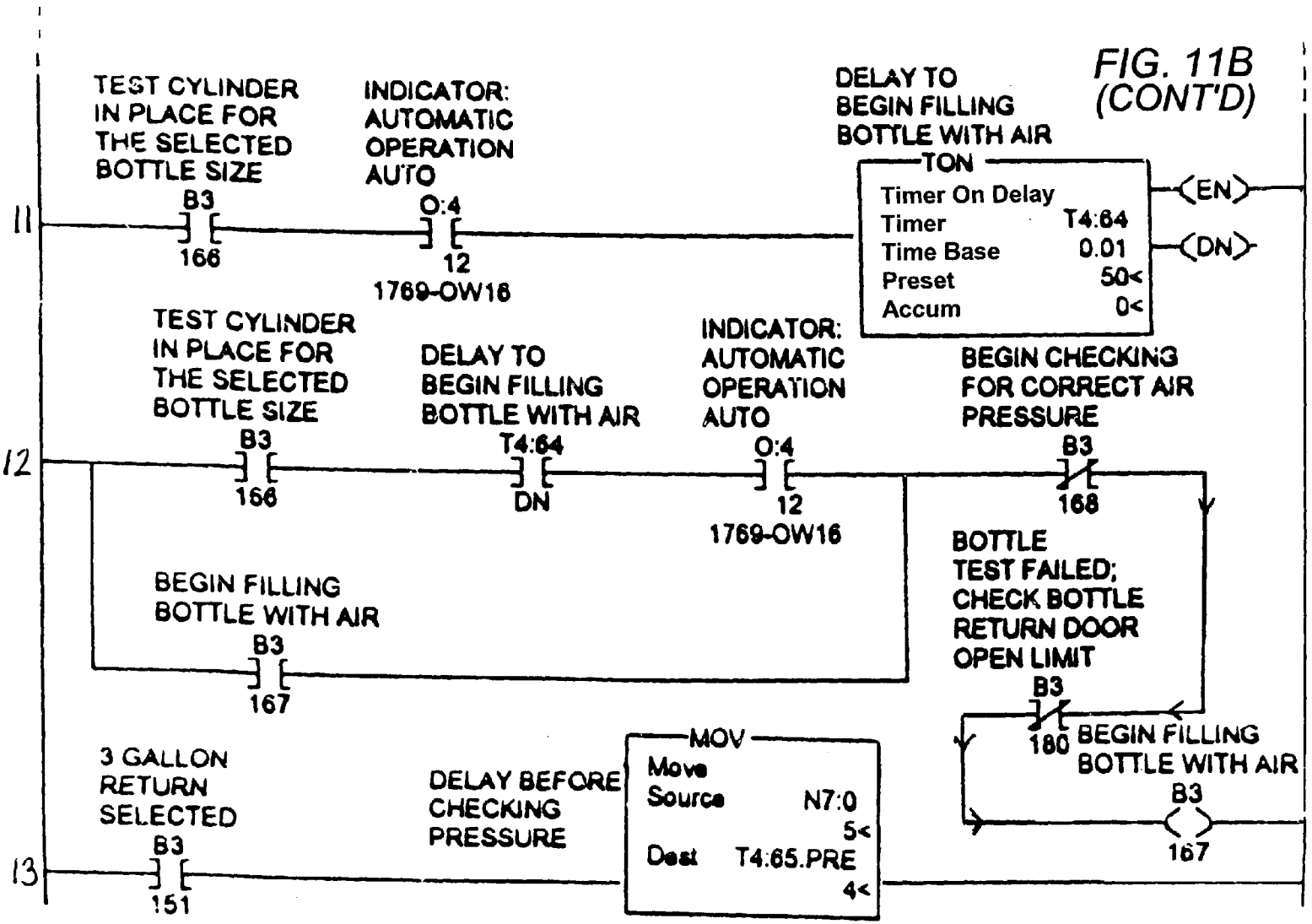
FIG. 11B
(CONT'D)
DELAY TO
BEGIN FILLING
BOTTLE WITH AIR
TON
Timer On Delay
Timer
Time Base
Preset
Accum
T4:64
0.01
50<
0<
EN
DN
BEGIN CHECKING
FOR CORRECT AIR
PRESSURE
B3
168
BOTTLE
TEST FAILED;
CHECK BOTTLE
RETURN DOOR
OPEN LIMIT
B3
180
BEGIN FILLING
BOTTLE WITH AIR
B3
167
INDICATOR:
AUTOMATIC
OPERATION
AUTO
O:4
12
1769-OW16
MOV
Move
Source
N7:0
5<
Dest
T4:65.PRE
4<
INDICATOR:
AUTOMATIC
OPERATION
AUTO
O:4
12
1769-OW16
DELAY TO
BEGIN FILLING
BOTTLE WITH AIR
T4:64
DN
DELAY BEFORE
CHECKING
PRESSURE
TEST CYLINDER
IN PLACE FOR
THE SELECTED
BOTTLE SIZE
B3
166
TEST CYLINDER
IN PLACE FOR
THE SELECTED
BOTTLE SIZE
B3
166
BEGIN FILLING
BOTTLE WITH AIR
B3
167
3 GALLON
RETURN
SELECTED
B3
151
11
12
13

21

36

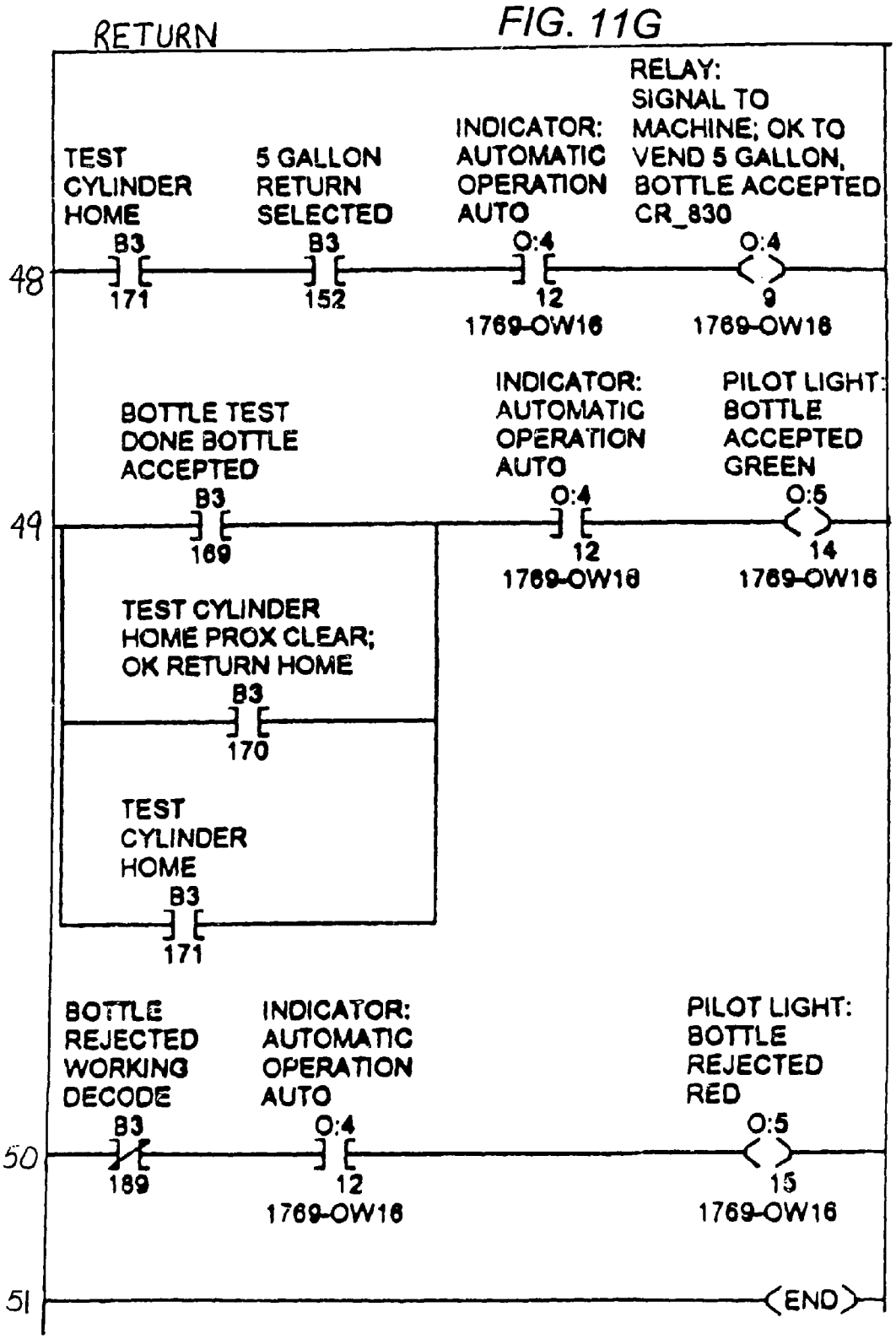
RETURN
FIG. 11G
48
TEST CYLINDER HOME
B3
171
5 GALLON RETURN SELECTED
B3
152
INDICATOR: AUTOMATIC OPERATION AUTO
O:4
12
1769-OW16
RELAY: SIGNAL TO MACHINE; OK TO VEND 5 GALLON, BOTTLE ACCEPTED CR_830
O:4
9
1769-OW16
49
BOTTLE TEST DONE BOTTLE ACCEPTED
B3
169
INDICATOR: AUTOMATIC OPERATION AUTO
O:4
12
1769-OW16
PILOT LIGHT: BOTTLE ACCEPTED GREEN
O:5
14
1769-OW16
TEST CYLINDER HOME PROX CLEAR; OK RETURN HOME
B3
170
TEST CYLINDER HOME
B3
171
50
BOTTLE REJECTED WORKING DECODE
B3
189
INDICATOR: AUTOMATIC OPERATION AUTO
O:4
12
1769-OW16
PILOT LIGHT: BOTTLE REJECTED RED
O:5
15
1769-OW16
51
END

DISPENSING APPARATUS SYSTEM AND METHOD

RELATED APPLICATION

This is a continuation of and claims benefit under 35 U.S.C. §120 of U.S. application Ser. No. 11/987,460 filed Nov. 30, 2007, now U.S. Pat. No. 7,909,206 entitled DISPENSING APPARATUS SYSTEM AND METHOD, which application is incorporated herein by reference in its entirety.

FIELD OF INVENTION

The present invention relates to an automatic dispensing apparatus system and method for dispensing predetermined objects. More particularly, the invention relates to an automatic bottled water dispensing apparatus system having a housing which houses various sizes of bottled water and a conveyor system for transporting the bottled water to a dispensing member for a customer.

BACKGROUND OF INVENTION

Many people purchase bottled water for home and office use. As such, bottled water is a desired commodity which people want to have available at any time such as water is available from a tap. However, large quantities of bottled water may not be readily available at any desired time because, for example, a grocery store or a bottled water dispensing company may be closed for the day, weekend, holiday, etc. Accordingly, there is a desire to have large quantities of bottled water readily available on demand.

Various types of dispensing apparatus are known. For example, U.S. Pat. No. 6,253,956 B1 discloses an apparatus for the automated retailing of refreshments to a vehicle occupant as the vehicle passes through an automated retail product dispensing station. A vehicle occupant places a retail product order through an automated interface and drives within reach of an automated retail product dispenser and the retail product is dispensed by a mechanism that places it within reach of the vehicle driver.

U.S. Pat. No. 6,065,568 discloses a drive-up vending machine that allows automated selection of the product and payment. The machine is for smaller size products.

U.S. Pat. No. 3,647,026 discloses an automatic drive-in store. A motorist drives into the store and may order retail objects from the vehicle automatically and have the objects delivered through a delivery system of conveyors to the automobile.

U.S. Pat. No. 5,113,974 discloses a timed cycle single-stop shopping facility. It includes the ability to purchase gas and while purchasing gas automatically selecting objects and having them delivered to a loading station adjacent to the vehicle.

U.S. Pat. No. 4,893,727 discloses an automated delivery system. It includes a specific means of inventorying the products and delivering the products to the customer.

U.S. Pat. No. 5,890,136 discloses a quick stop mass retail system for ordering and purchasing articles from a remote location for pick-up at an article pick-up area at an automated store. The system includes a system for communicating a customer's purchase order; a host computer adapted for receiving the purchase order; processing the order and storing the customer's purchase order in a database; a system for retrieving the article ordered from a storage location in response to the customer order, and a system for delivering the article to a pick-up area.

U.S. Pat. No. 5,186,281 discloses a system for article selection and purchase in a retail establishment and having the articles then delivered to a customer vehicle check-out area.

U.S. Pat. No. 6,684,200 B1 discloses a cashless vending machine.

Japanese Publication No. 05120521A generally discloses in the Abstract an unmanned shop system whereby goods are ordered automatically and delivered by a conveyor to a dispenser.

U.S. Pat. Nos. 3,143,247; 5,791,512 and 5,271,703 disclose various apparatus for conveying goods to a dispenser.

These devices and methods have various shortcomings which, along with other shortcomings, are addressed by the present invention.

OBJECTS AND SUMMARY OF INVENTION

The present invention relates to an automatic dispensing apparatus system and method for dispensing predetermined objects. More particularly, the invention relates to an automatic bottled, water dispensing apparatus system having a housing which houses various sizes of bottled water and a conveyor system for transporting the bottled water to a dispensing member for a customer. The dispensing apparatus system also includes a return machine for returning empty bottles, a plurality of selection members, a payment member and an inventory monitoring member.

In the dispensing apparatus system, the housing houses the predetermined objects for distribution and the conveyor system which conveys the objects to a dispensing member for a customer. The objects to be housed and dispensed include bottled water in various sizes including 1 gallon bottles, 3 gallon bottles, 5 gallon bottles, and cases of bottled water of various sizes of bottles including, but not limited to, 12 ounce bottles, 16.9 ounce bottles, 20 ounce bottles, 24 ounce bottles and the like. The housing also houses the conveyor system which transports the selected objects, e.g., bottled water, from the storage area to the dispensing member where the customer removes the object, e.g., bottled water.

The dispensing apparatus system is operated by a customer selecting the desired size and quantity of objects, e.g., bottled water, from a plurality of selection members and paying for the desired size and quantity of object(s), e.g., bottled water, with cash or a credit card at the payment member. The payment member may allow a credit card payment to be sent directly to the bank of the supplier. Once the customer makes the selection and the payment is received, the selected object, e.g., bottled water, is dispensed to the customer via the dispensing member. In one embodiment the dispensing member may include a turnstile type element.

The inventory monitoring member may be any suitable inventory monitoring member which monitors the sales of the products in order to alert the supplier when a product needs to be replaced. The inventory monitoring member may alert the supplier of product sold at predetermined times including, but not limited to, as a product is sold, on a daily basis, on a weekly basis, on a monthly basis or any other suitable predetermined time period.

The return machine may be any suitable bottle return machine and is preferably automated and enables a customer to return empty bottles, such as 1 gallon bottles, 3 gallon bottles, 5 gallon bottles or the like.

Also, a customer in a car may be able to drive up to the dispensing apparatus system to obtain the product. The dispensing apparatus system may be stationary in a building or mobile in a mobile housing unit, such as a trailer. The dispensing apparatus system is preferably fully automated and, as such, will be available to a customer 24 hours a day and be on demand.

A primary object of the dispensing apparatus system is to provide a large volume of bottled water to a customer at any time via a conveyor system and a dispensing member.

Another primary object of the dispensing apparatus system is to provide a profit to a supplier by providing a price break over buying bottled water from a retail system because of the volume and the automated nature of the system.

Another primary object of the dispensing apparatus system is to provide convenience for the customer by being able to drive up to the system at any time and access a fully automated system.

These primary and other objects of the invention will be apparent from the following description of the preferred embodiments of the invention and from the accompanying drawings.

BRIEF DESCRIPTION OF THE DRAWINGS

Referring to the drawings:

FIGS. 11A-11G illustrate a circuit diagram of a dispensing apparatus system of the present invention for returning empty bottles.

DETAILED DESCRIPTION OF THE PREFERRED EMBODIMENTS

Figure 1:
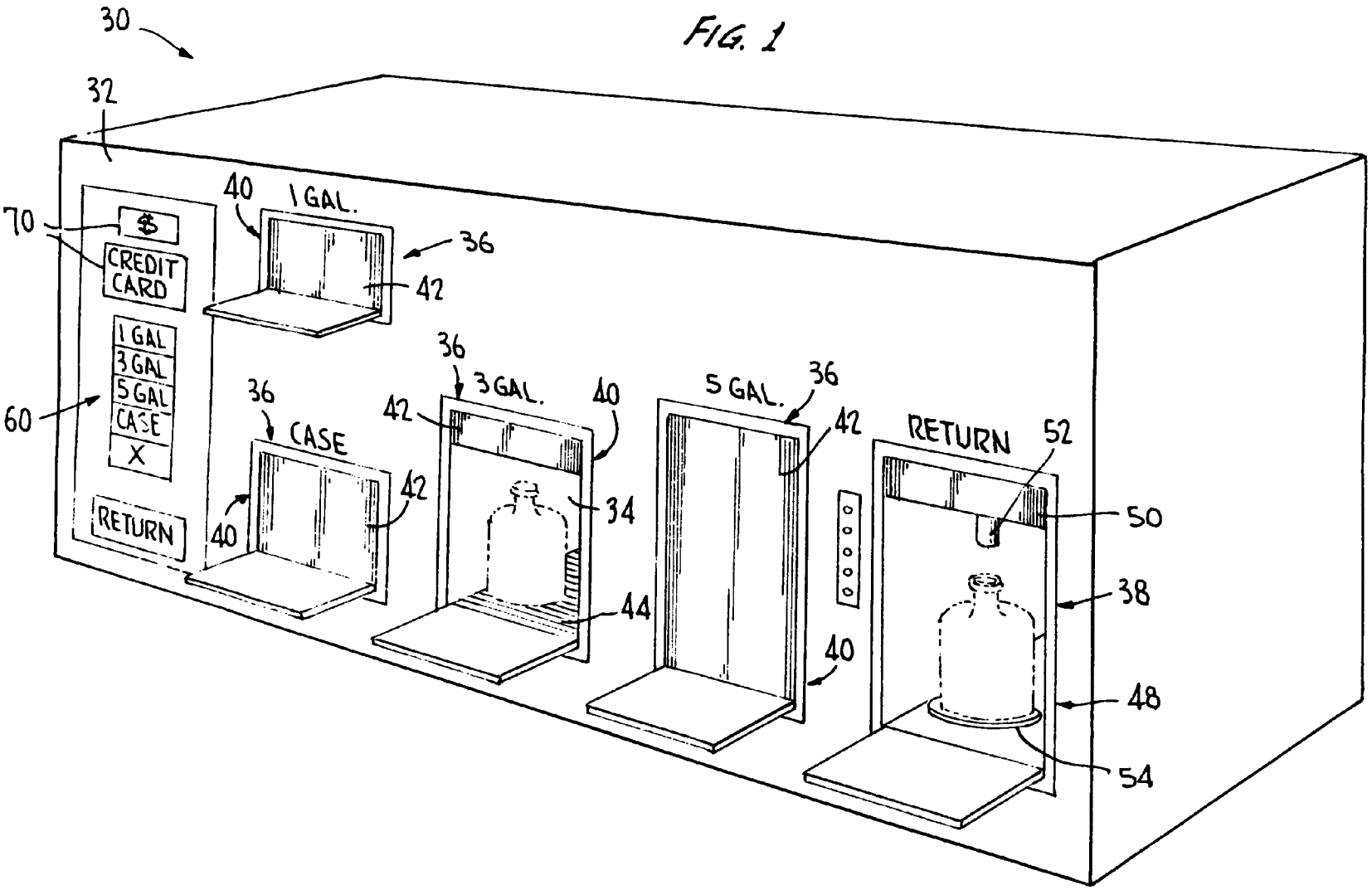
FIG. 1 illustrates a perspective view of a first embodiment of a dispensing apparatus system of the present invention.

Referring to FIGS. 1-15, the present invention relates to an automatic dispensing apparatus system 30 and method for dispensing predetermined objects and/or products. More particularly, the present invention relates to an automatic bottled water dispensing apparatus system 30 having a housing 32 which houses the products, e.g., various sizes of bottled water, a conveyor system 34 for transporting the products, e.g., bottled water, a plurality of dispensing members 36 for dispensing the products, e.g., bottled water, to a customer, a return machine 38 for returning empty bottles, a plurality of selection members 60 for selecting the type, size and quantity of products and a payment member 70 for paying for the selected products. The dispensing apparatus system 30 may also include an inventory monitoring member for monitoring the products sold.

In the dispensing apparatus system 30, the housing 32 houses the predetermined objects or products for distribution and the conveyor system 34 which conveys the objects or products to a dispensing member 36 for a customer. Preferably, the objects or products dispensed by the dispensing apparatus system 30 of the present invention are bottles of water. However, the present invention is not limited in scope by the objects or products dispensed and may dispense other objects including, but not limited to, food, produce, beverages, paper products, and the like. The same principles and description of the invention apply to these and other objects; While various objects may be dispensed, the present invention will be described hereinafter in terms of the dispensing apparatus system 30 dispensing various sizes of bottled water.

Figure 2:
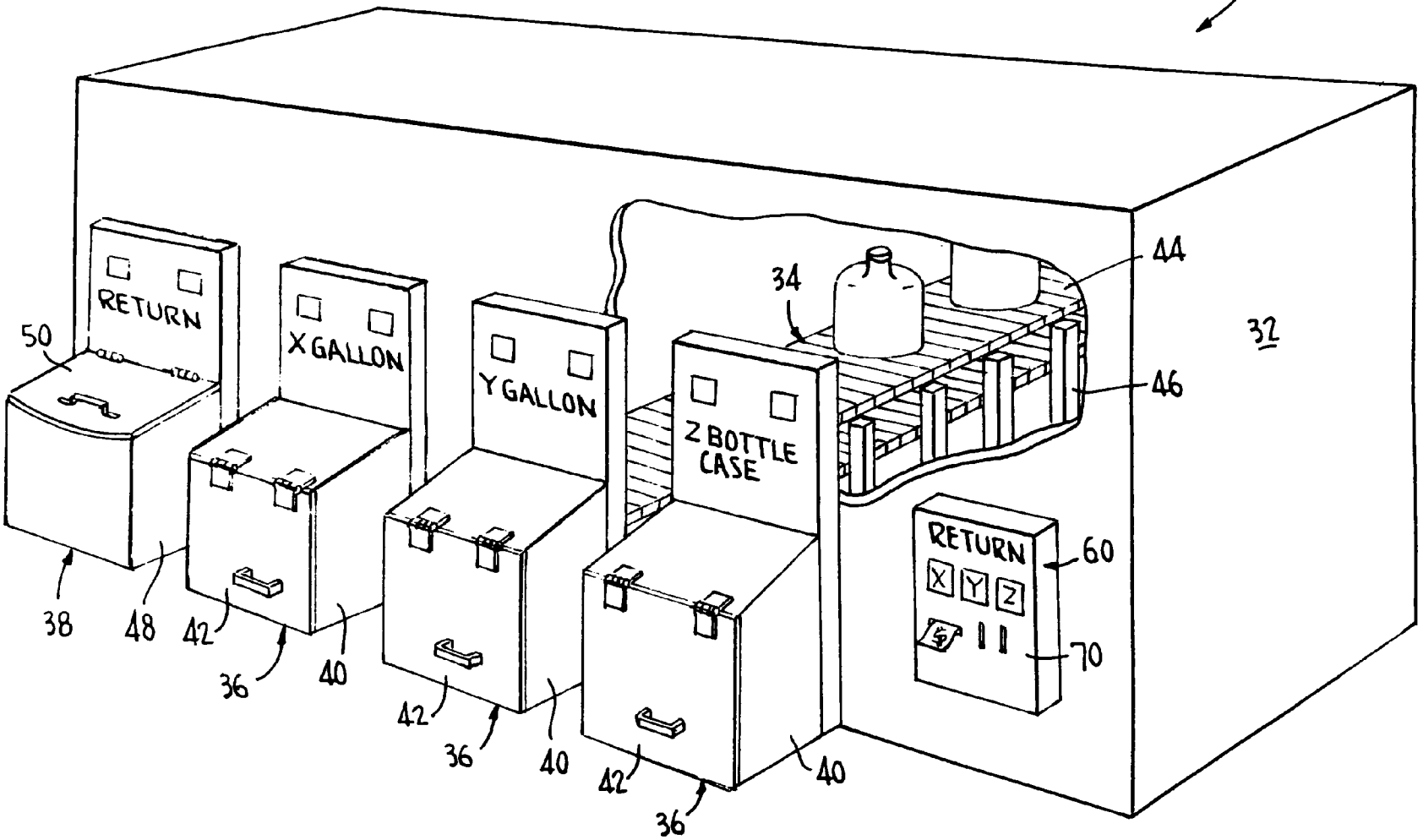
FIG. 2 illustrates a perspective view of a second embodiment of a dispensing apparatus system of the present invention.
Figures 3, 12:
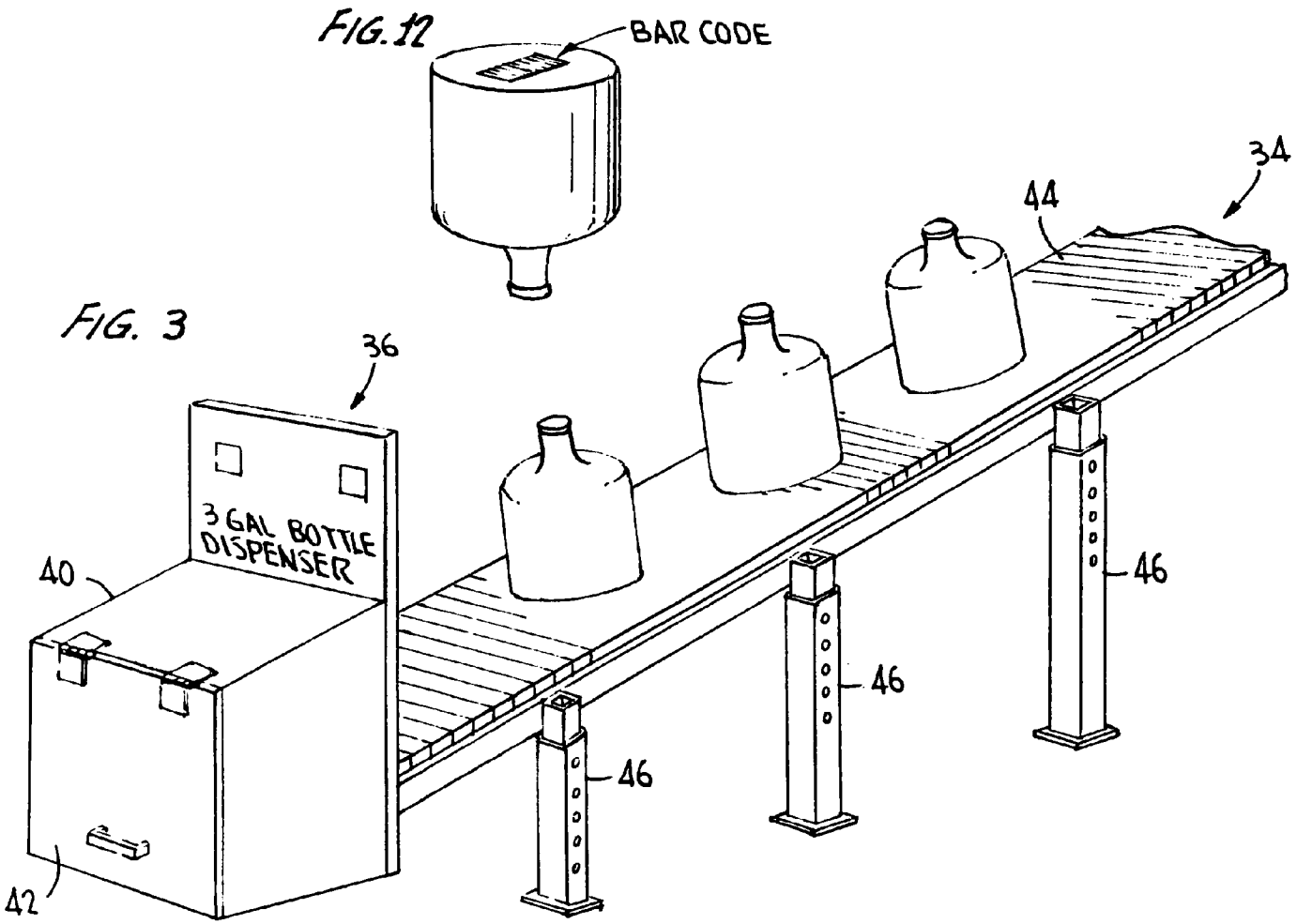
FIG. 3 illustrates a perspective view of a first embodiment of a conveyor system and a dispensing member of the present invention.
FIG. 12 illustrates an embodiment of a water bottle having a bar code thereon.
Figure 4:
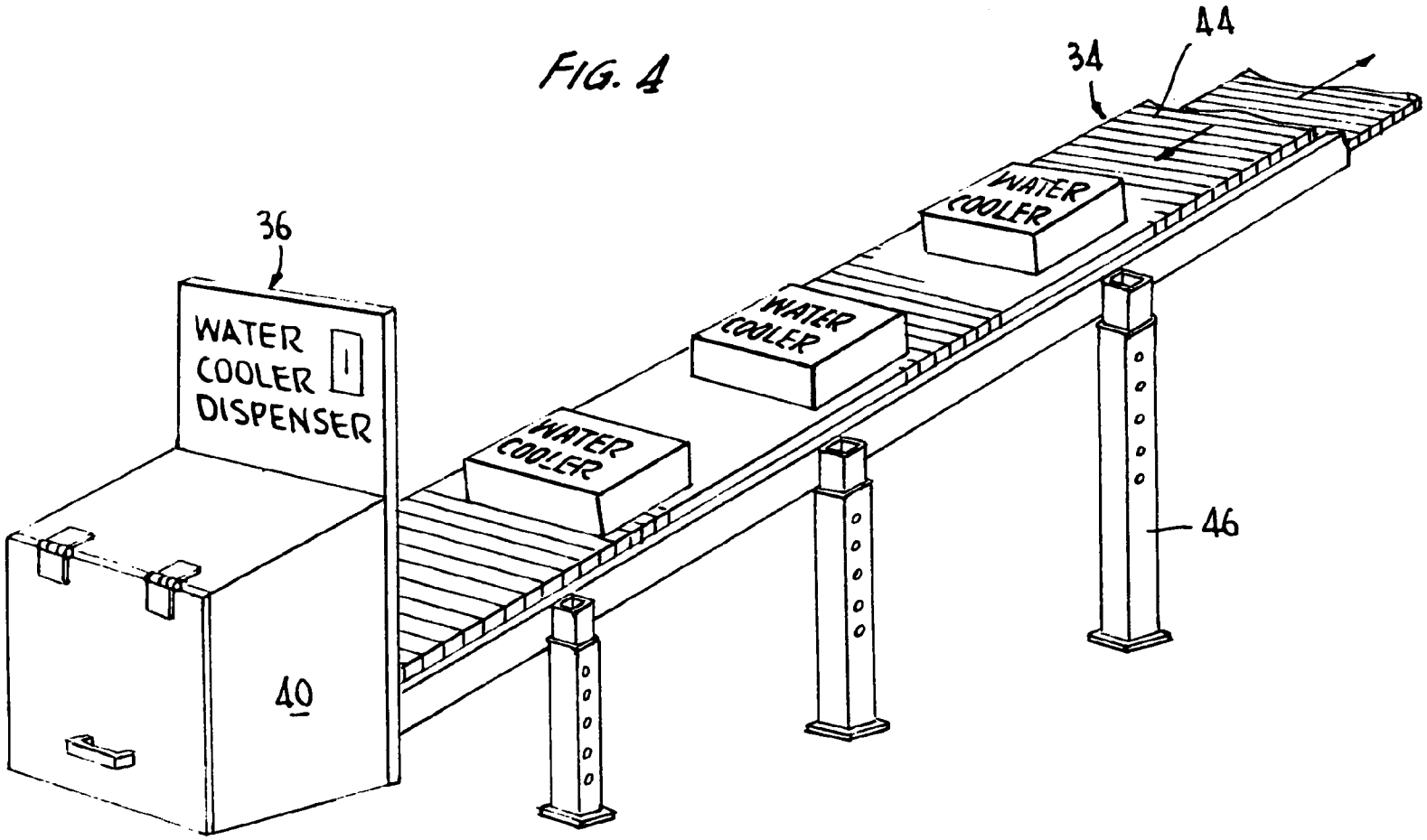
FIG. 4 illustrates a perspective view of a second embodiment of a conveyor system and a dispensing member of the present invention.
Figure 5:
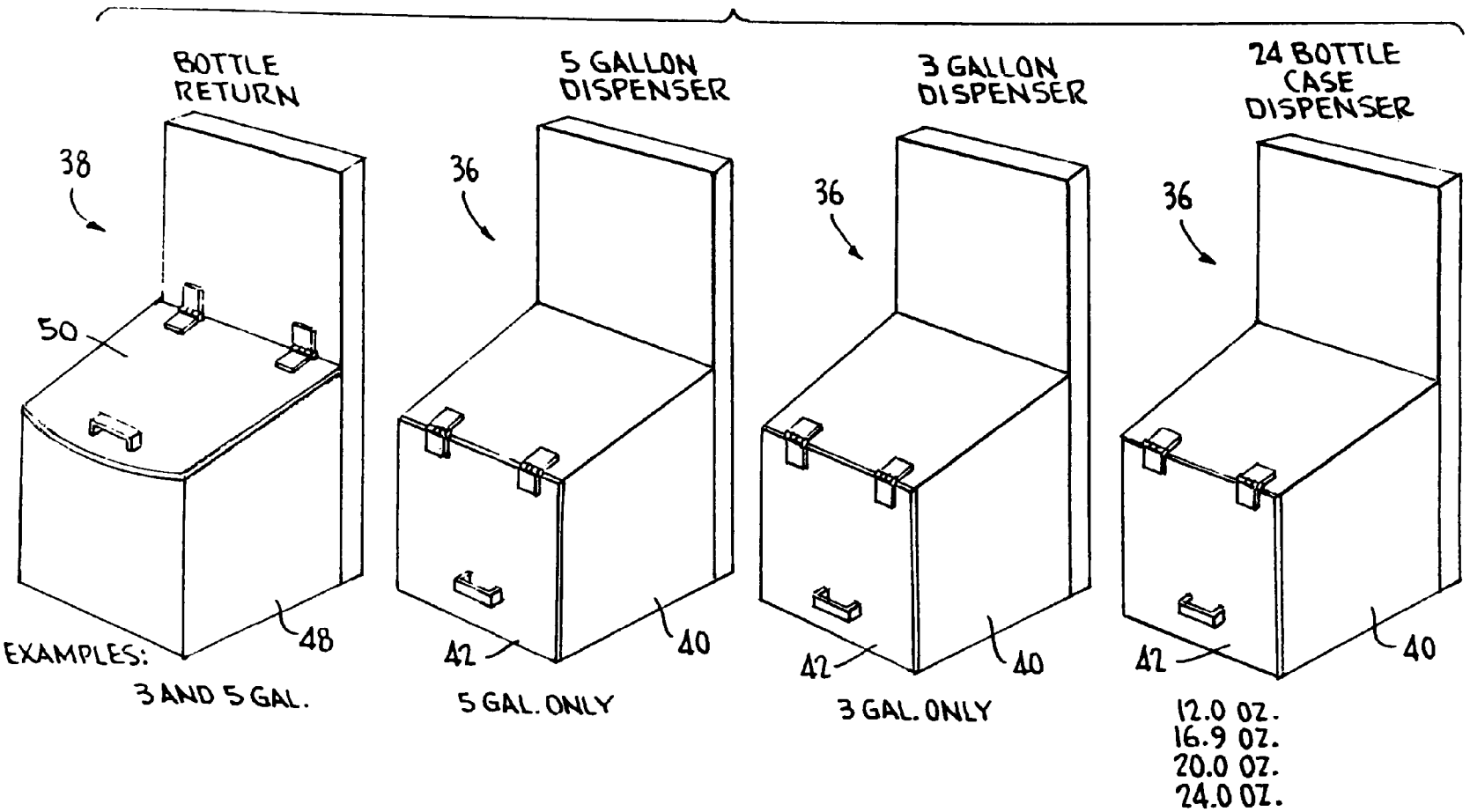
FIG. 5 illustrates perspective views of embodiments of dispensing members and a return machine which may be utilized in the dispensing apparatus system of the present invention.
Figure 6A:
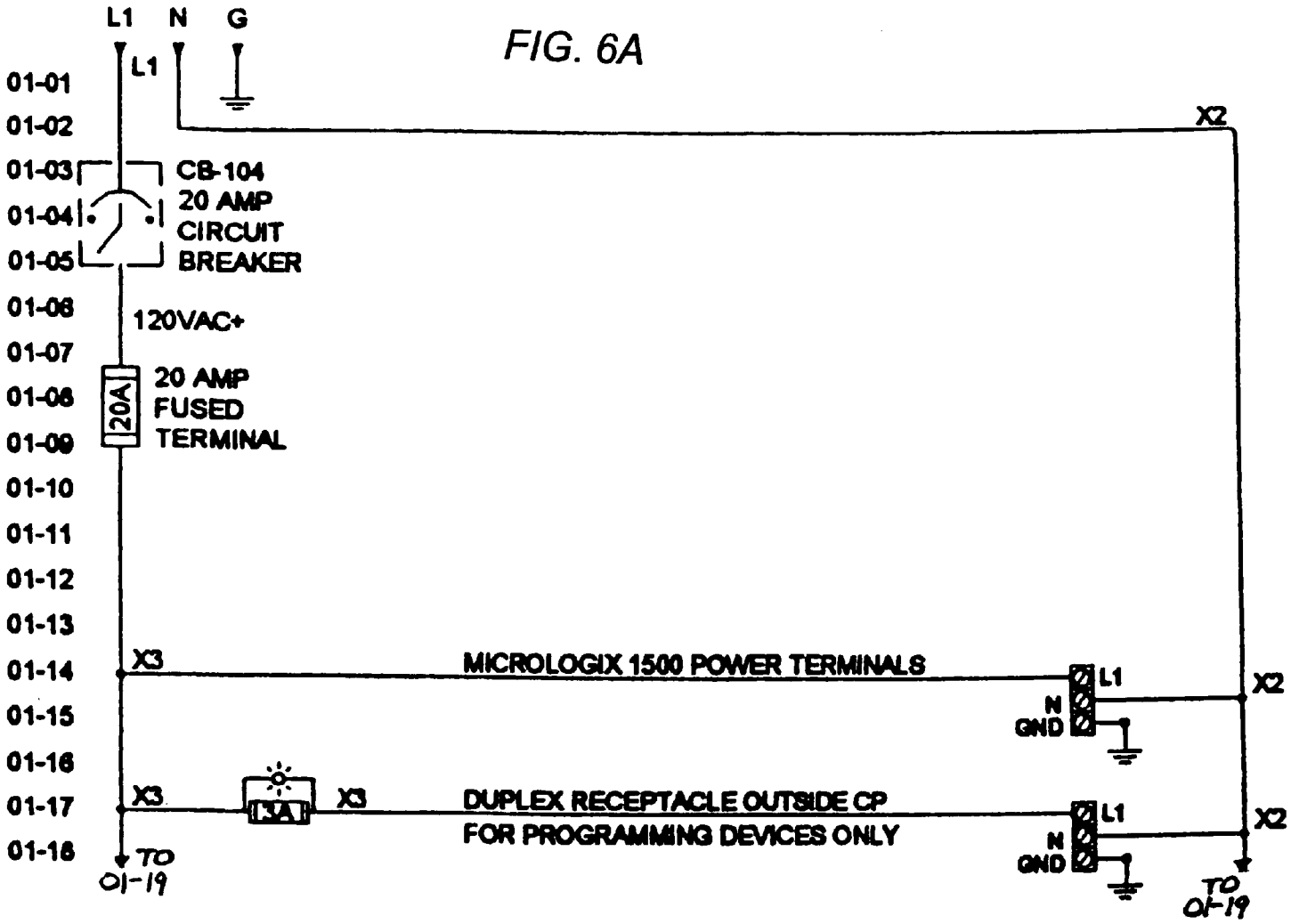
FIGS. 6A-6E illustrate a circuit diagram of a dispensing apparatus system of the present invention.
Figure 6A:
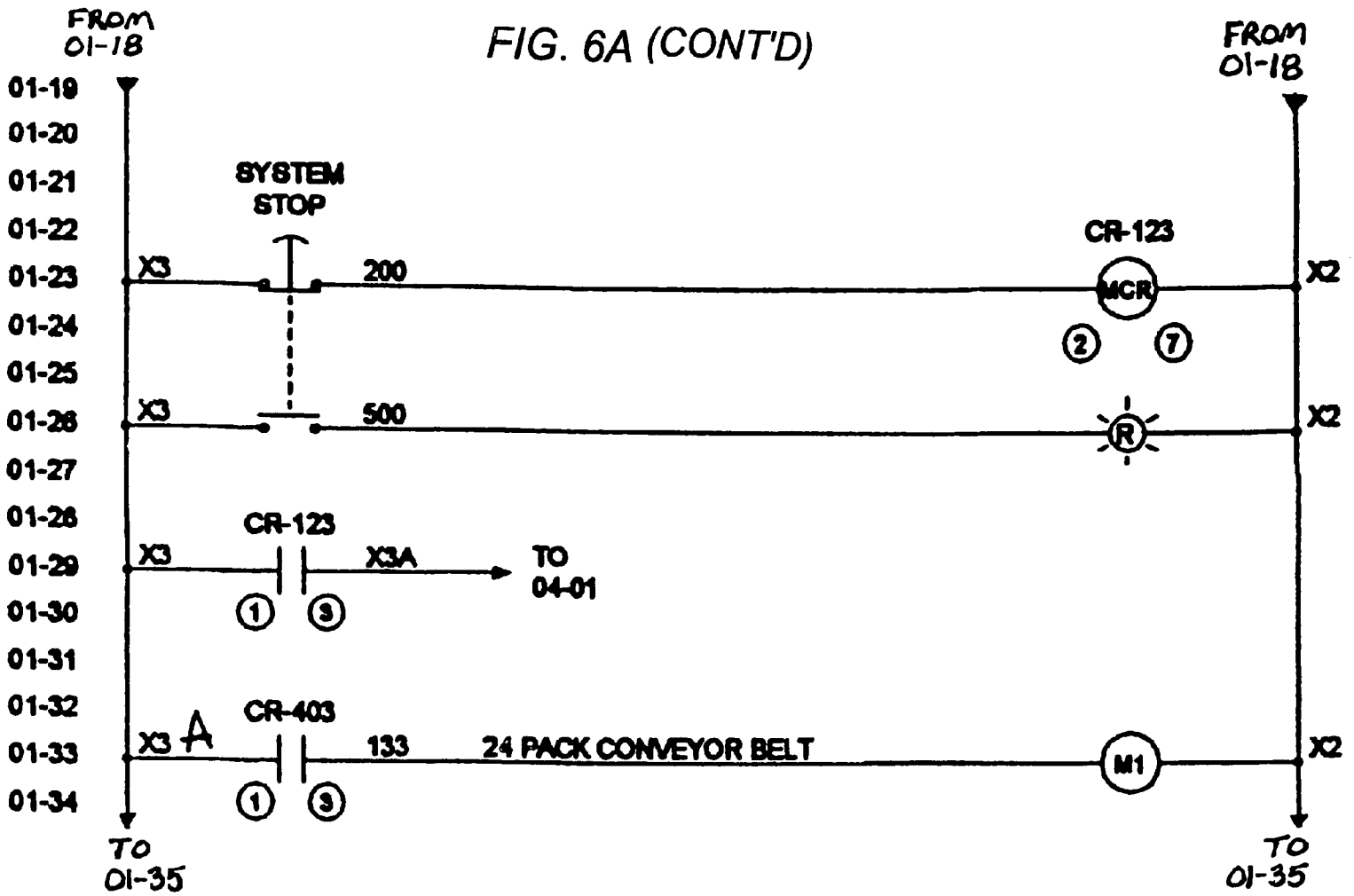
Figure 6A:
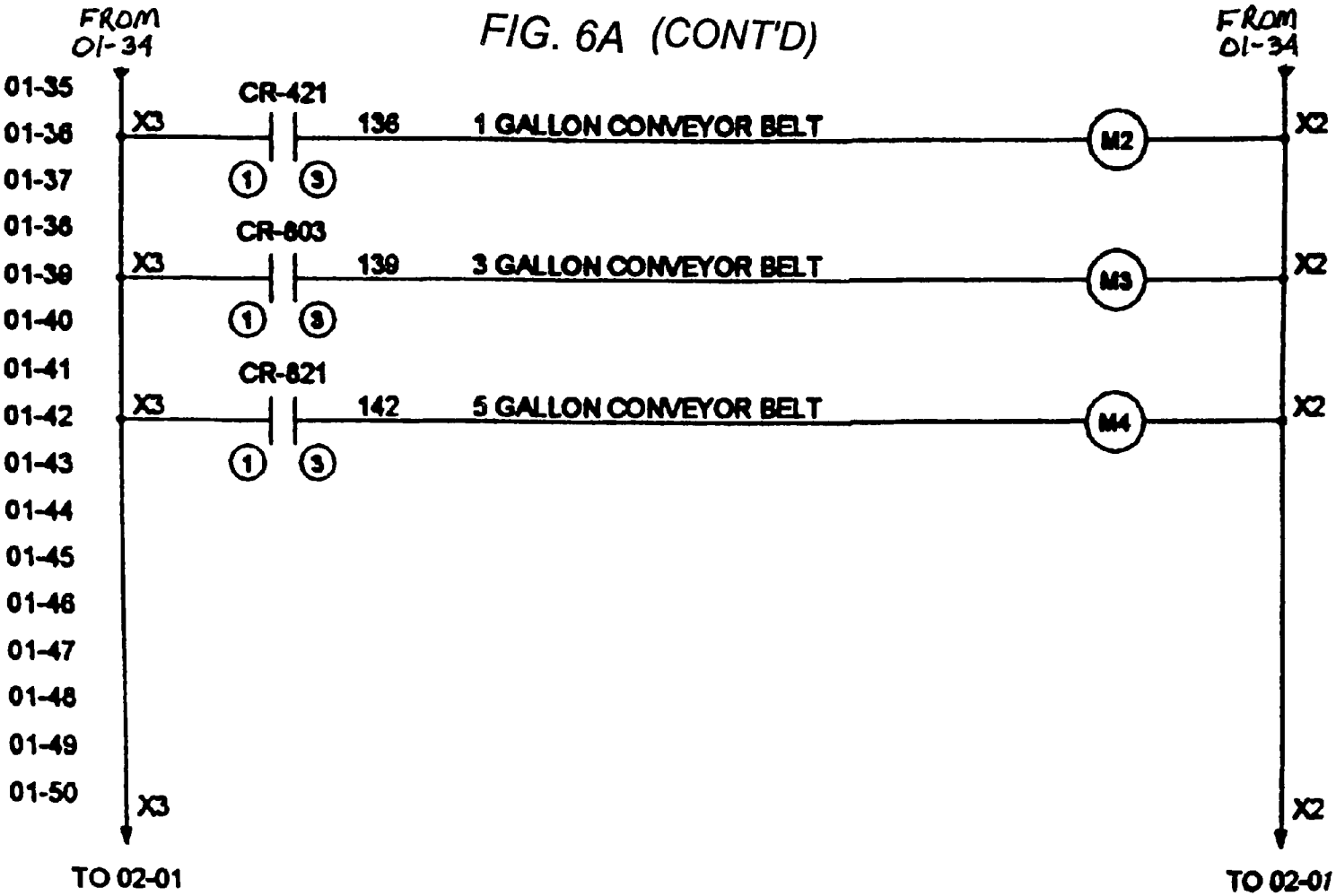
Figure 6A:
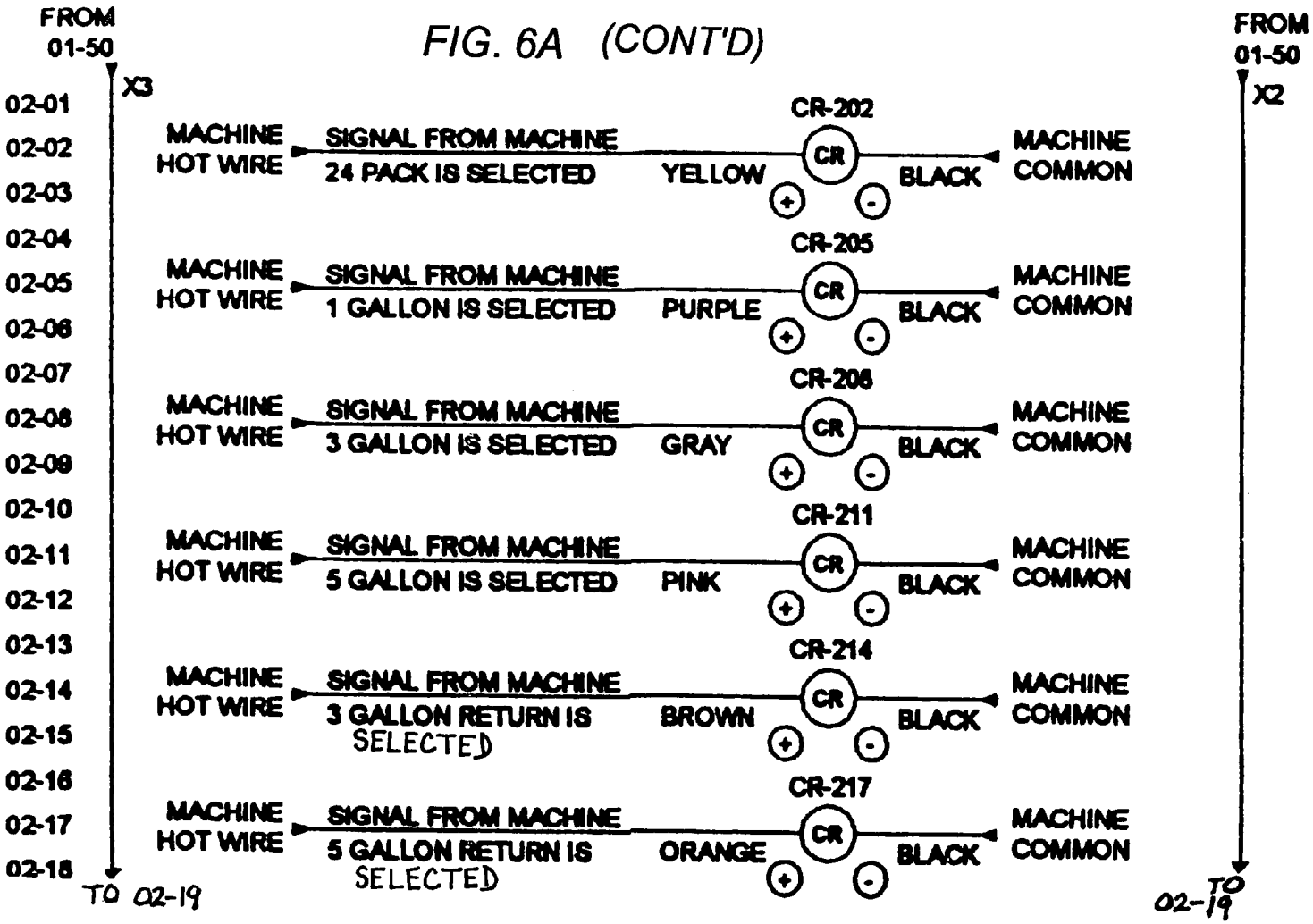
Figure 6B:
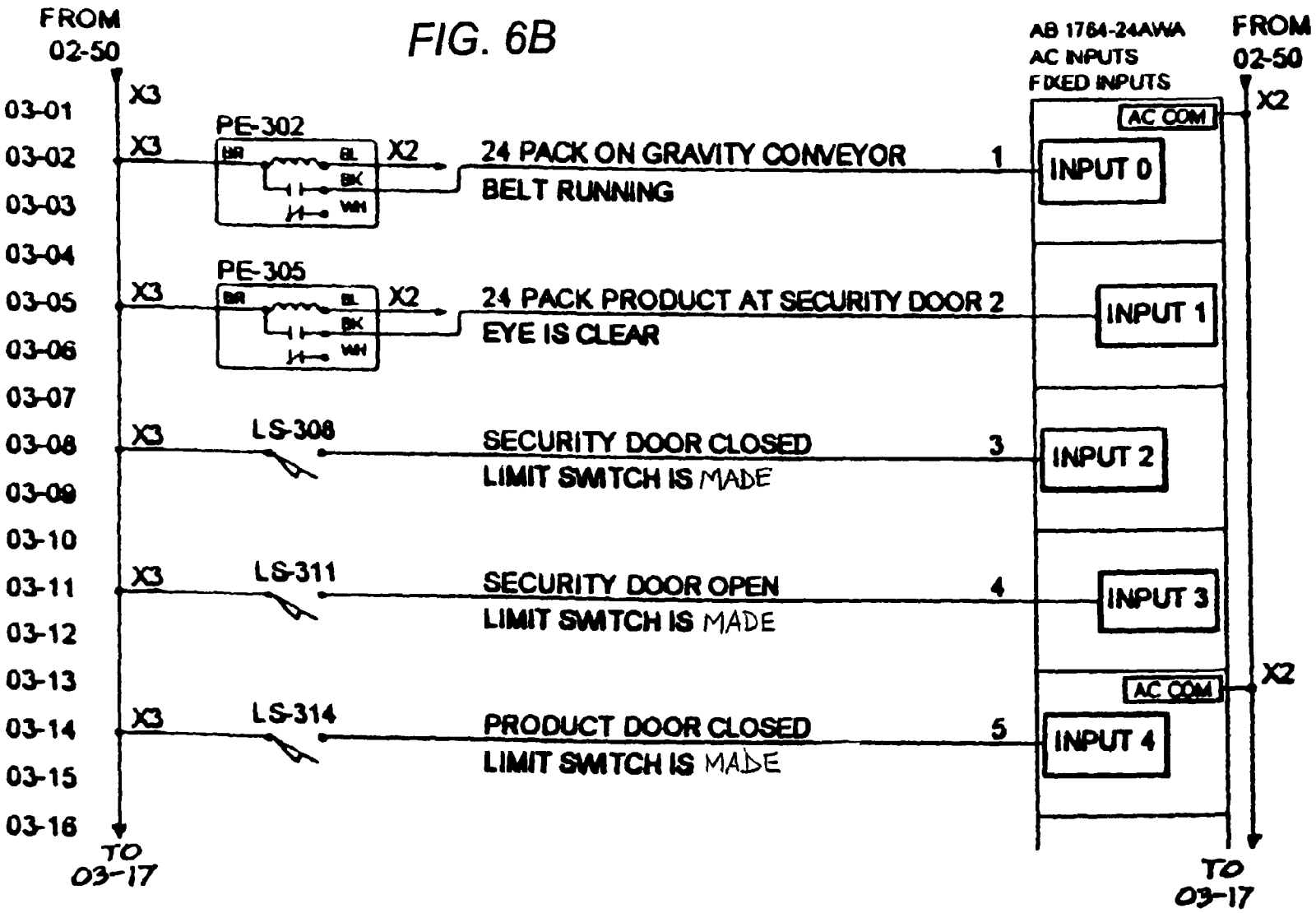
Figure 6B:
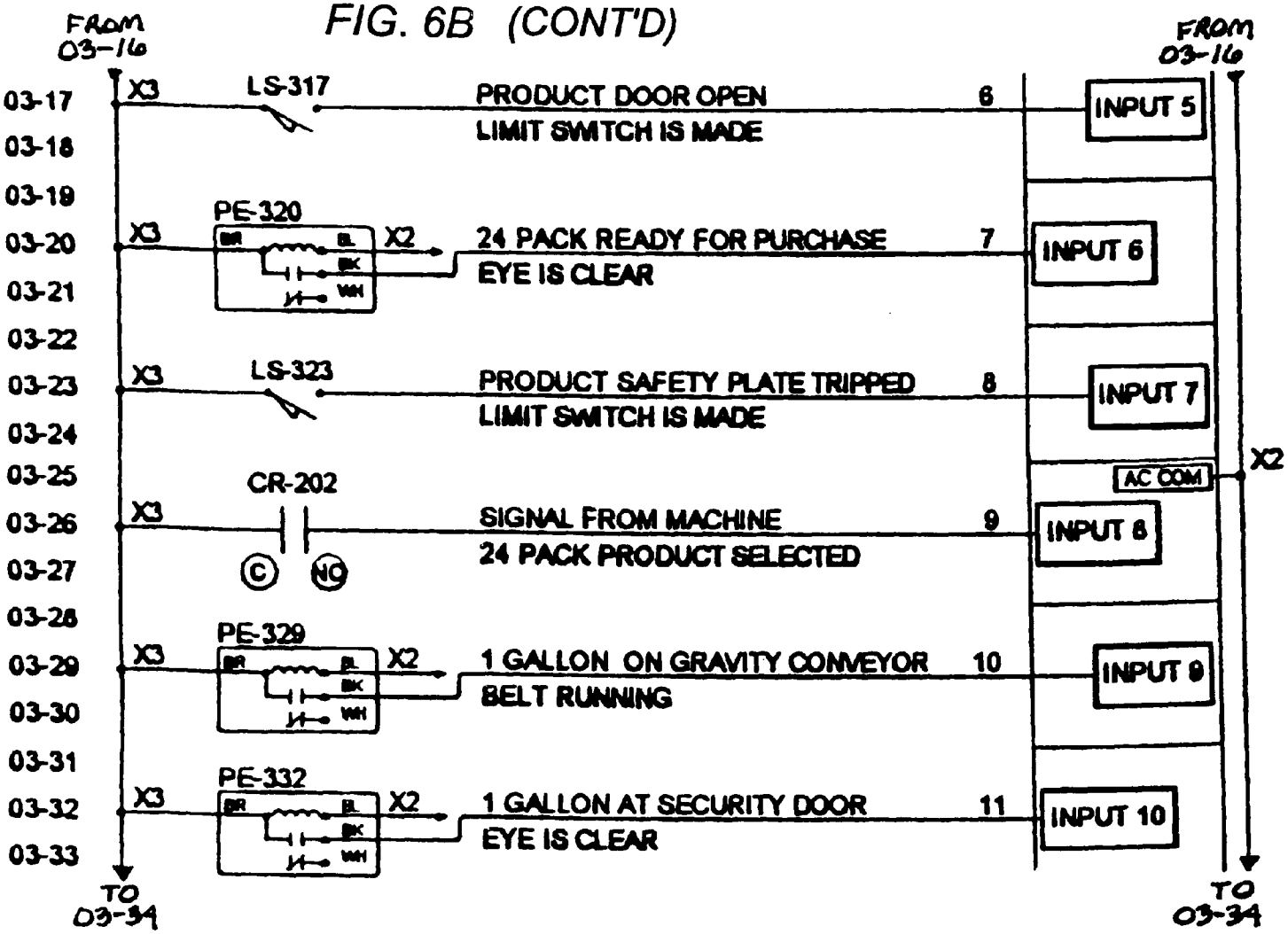
Figure 6B:
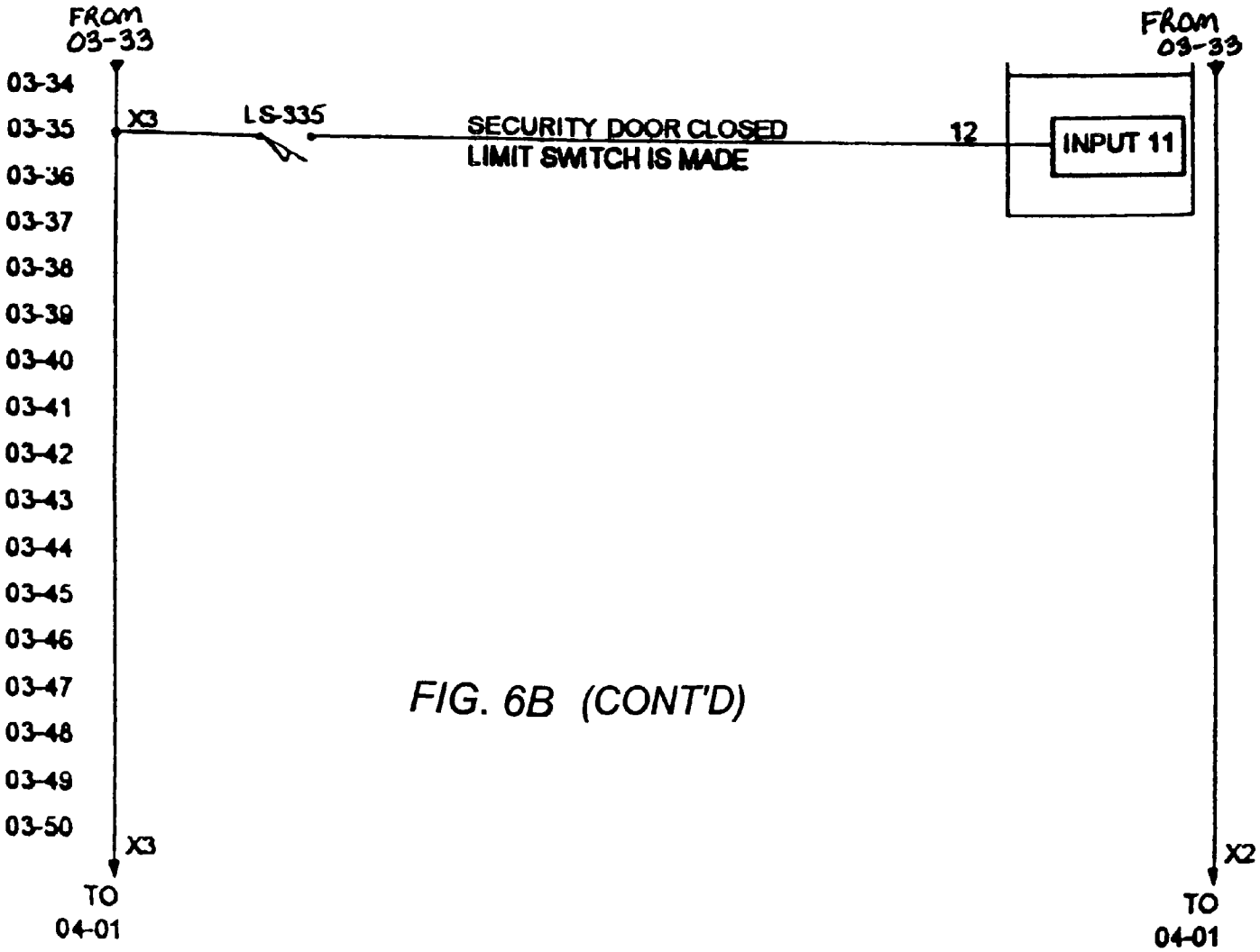
Figure 6B:
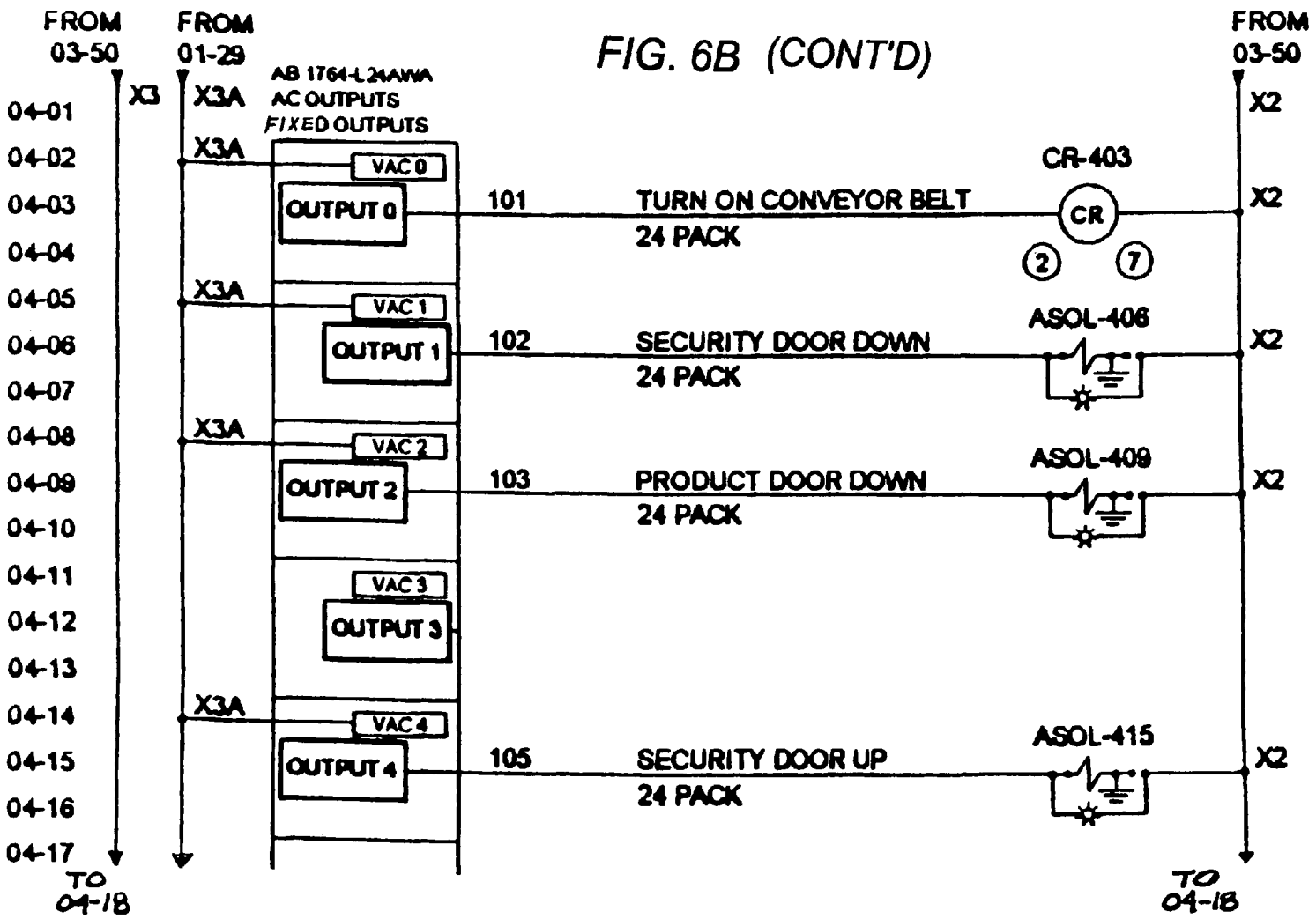
Figure 6B:
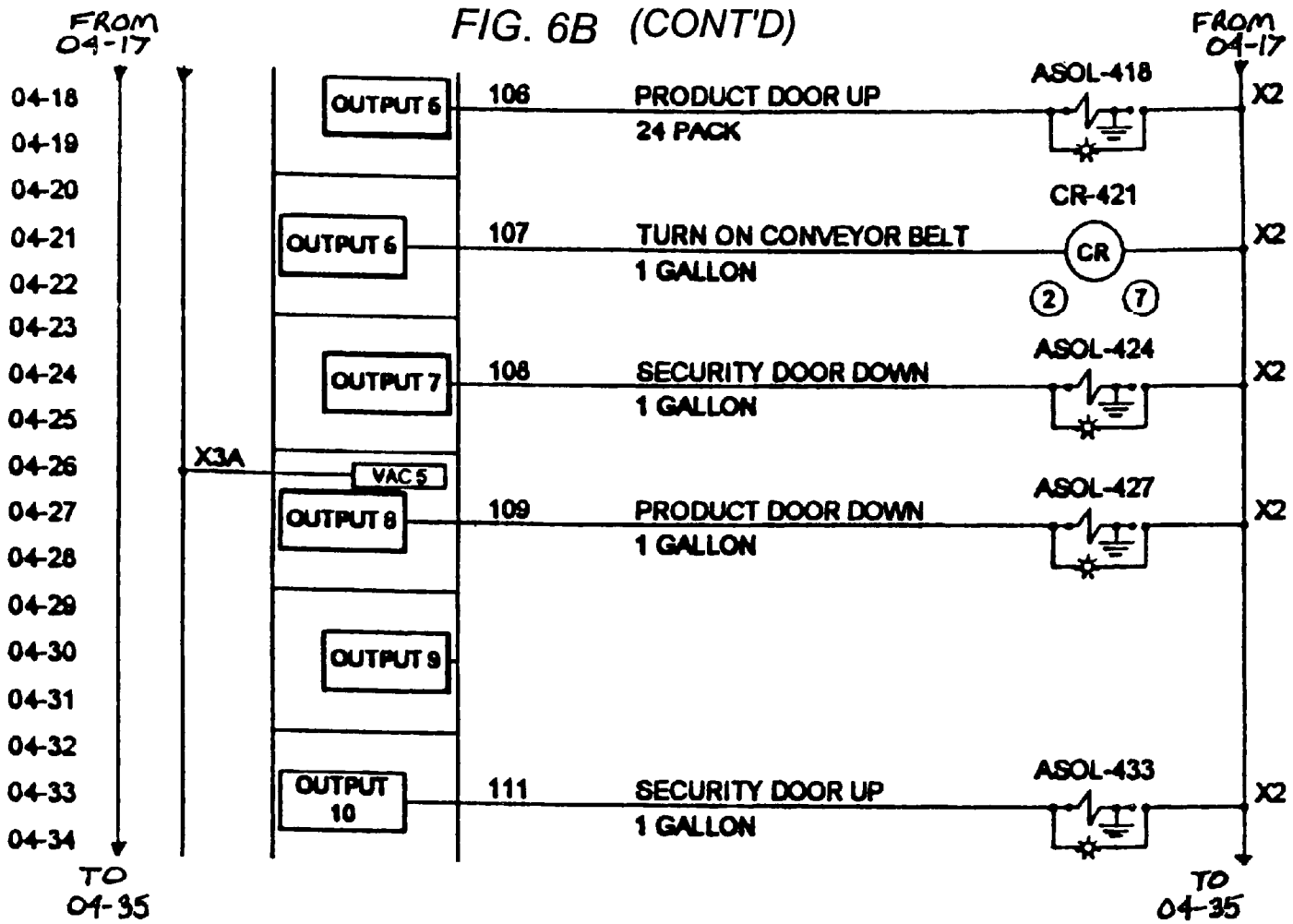
Figure 6B:
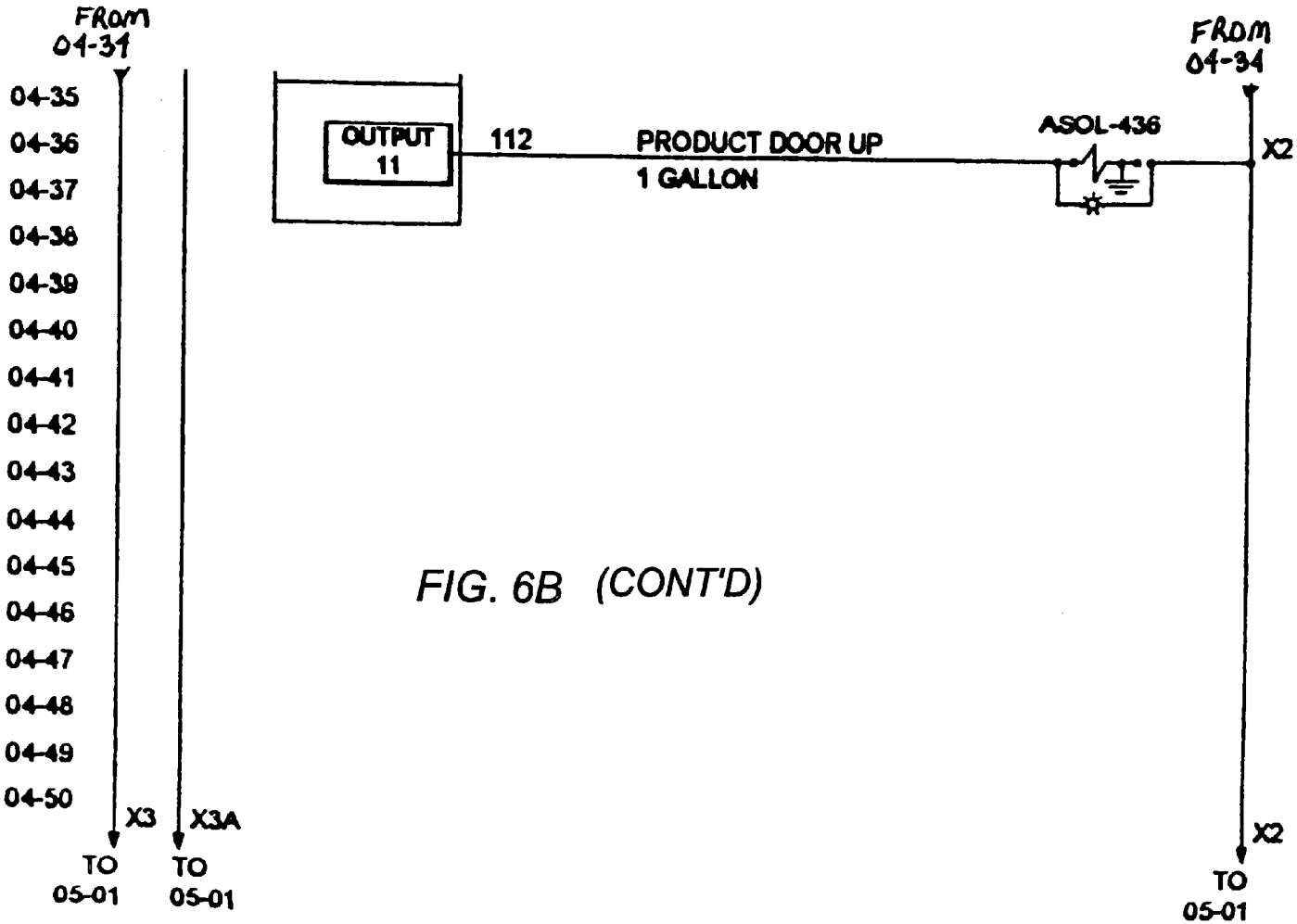
Figure 6C:
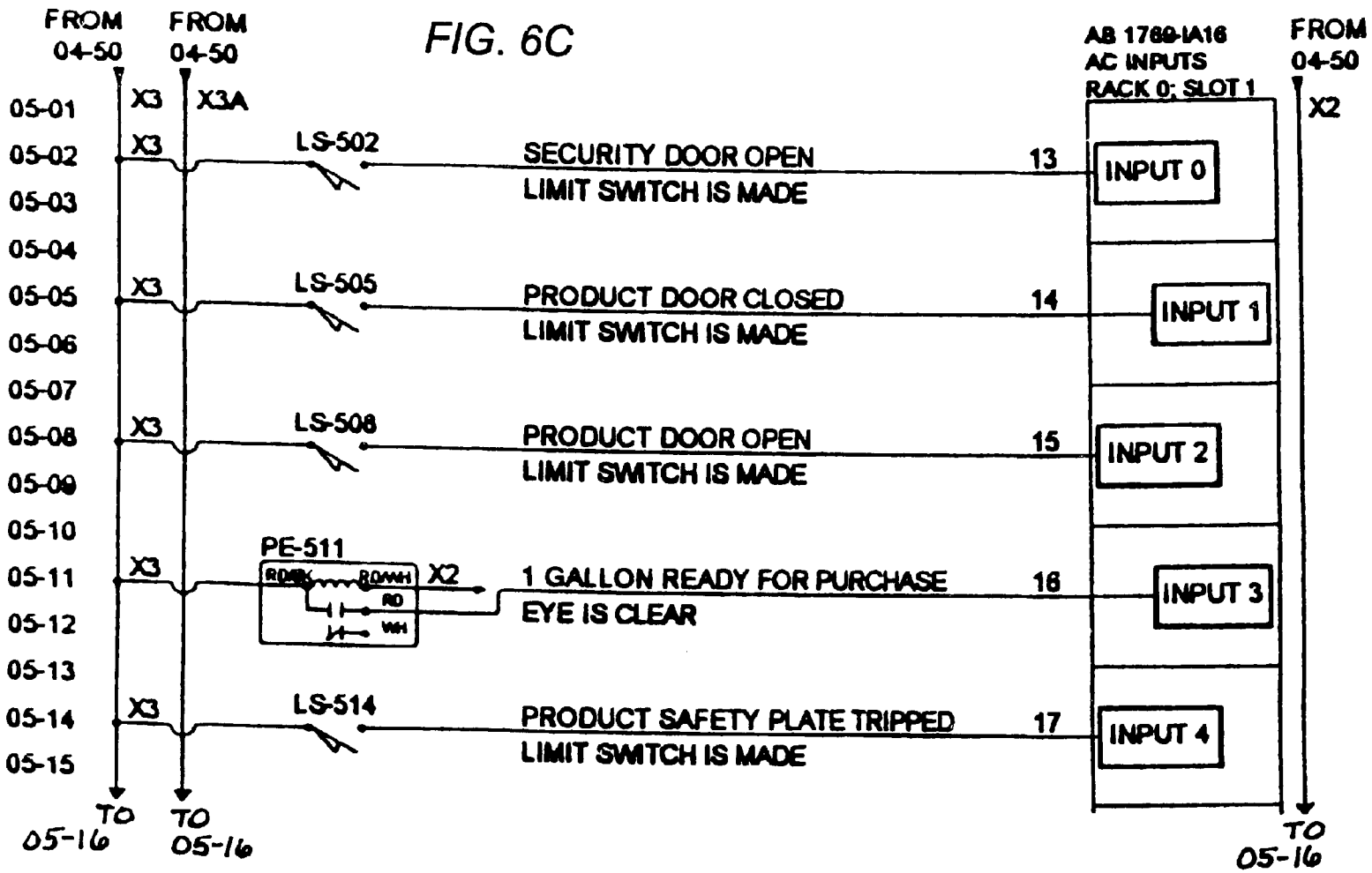
Figure 6C:
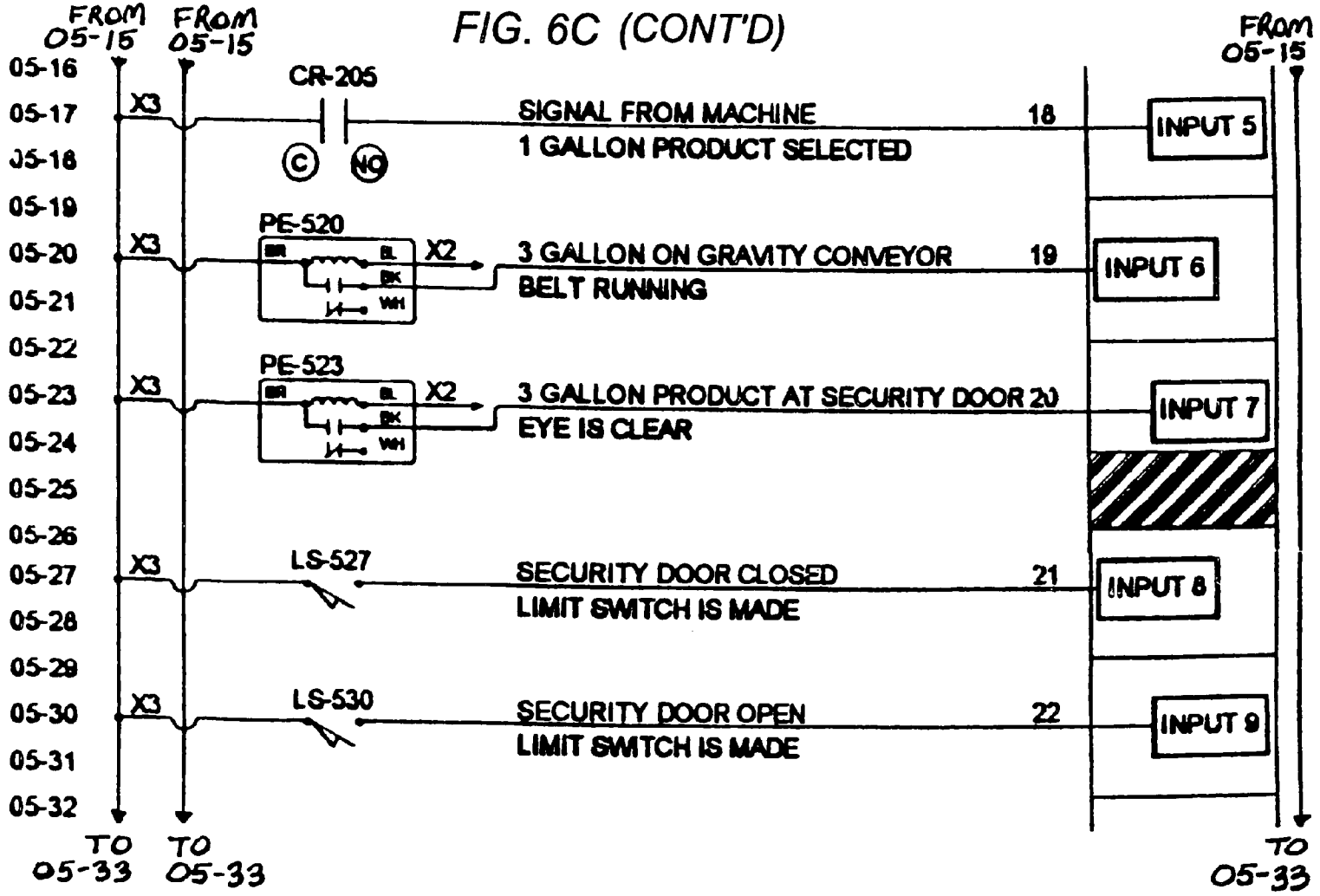
Figure 6C:
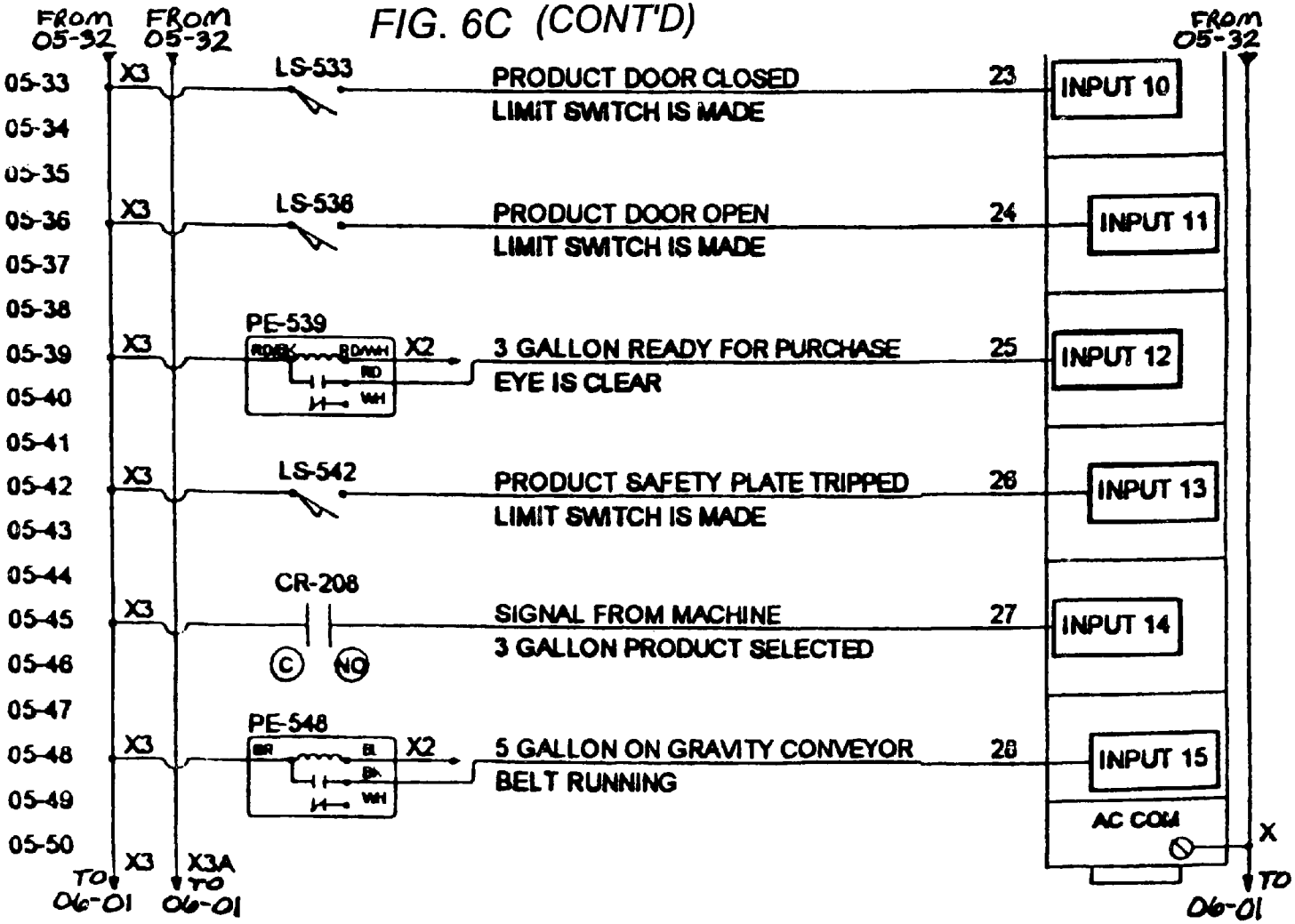
Figure 6C:
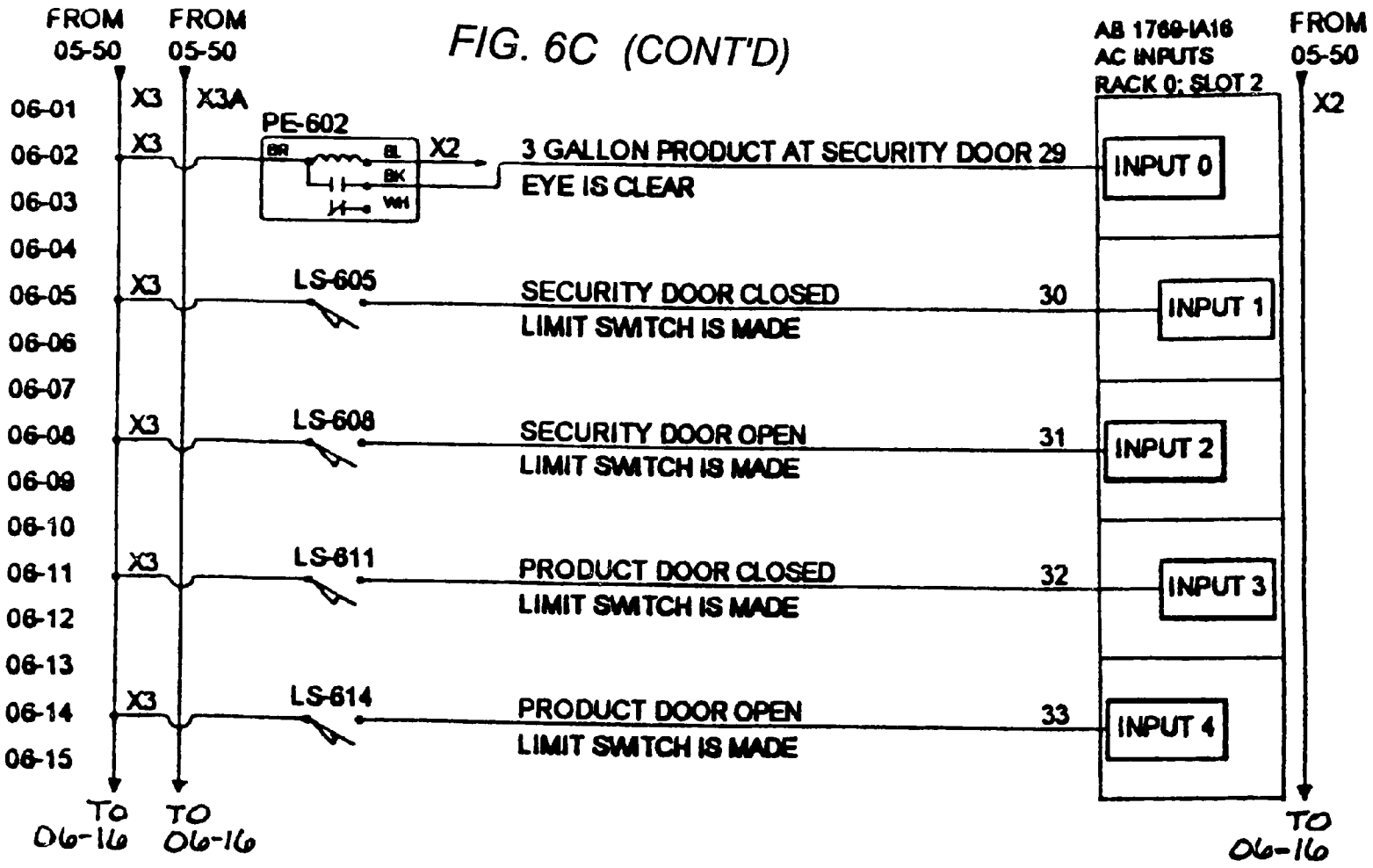
Figure 6C:
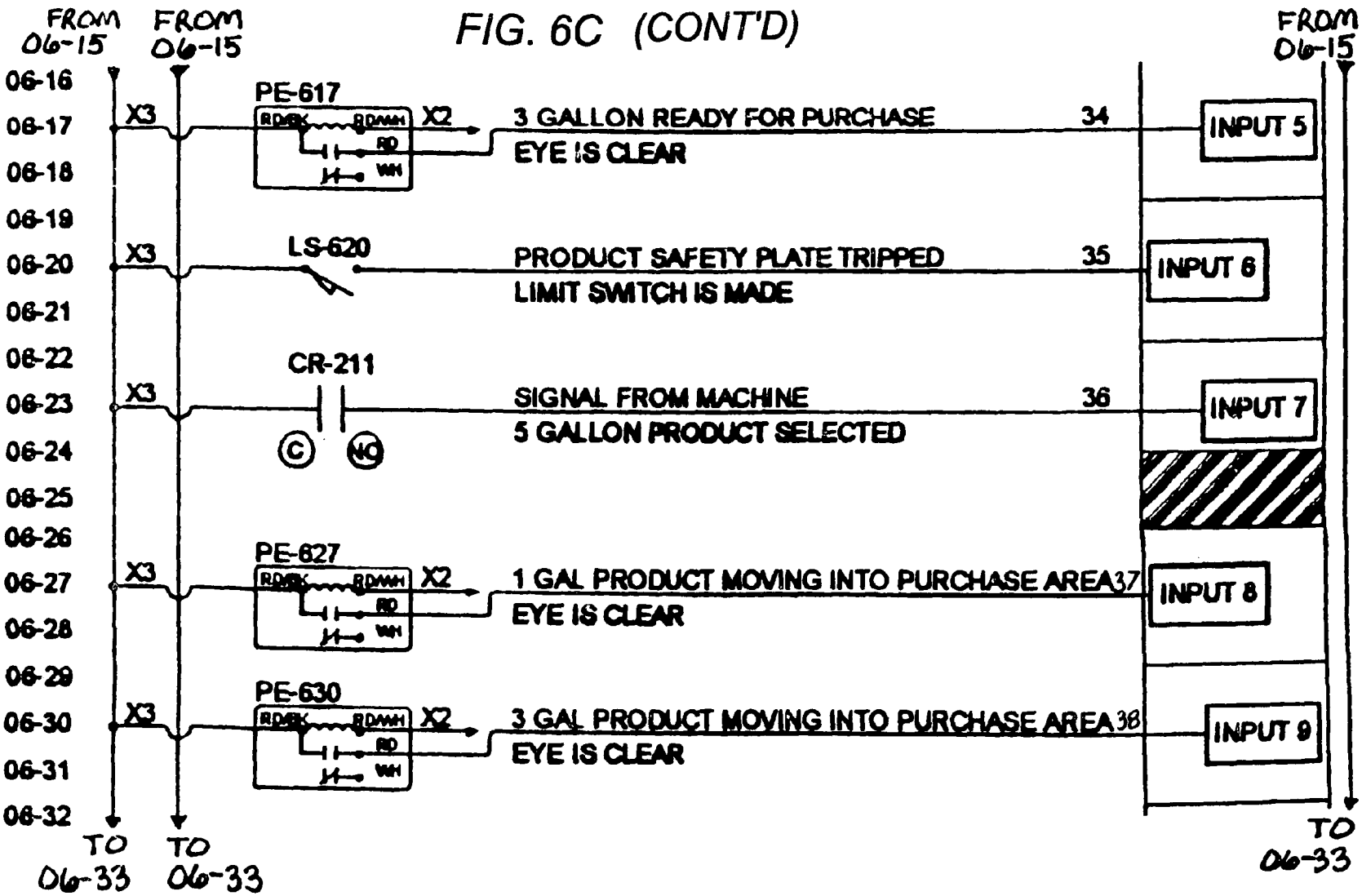
Figure 6C:
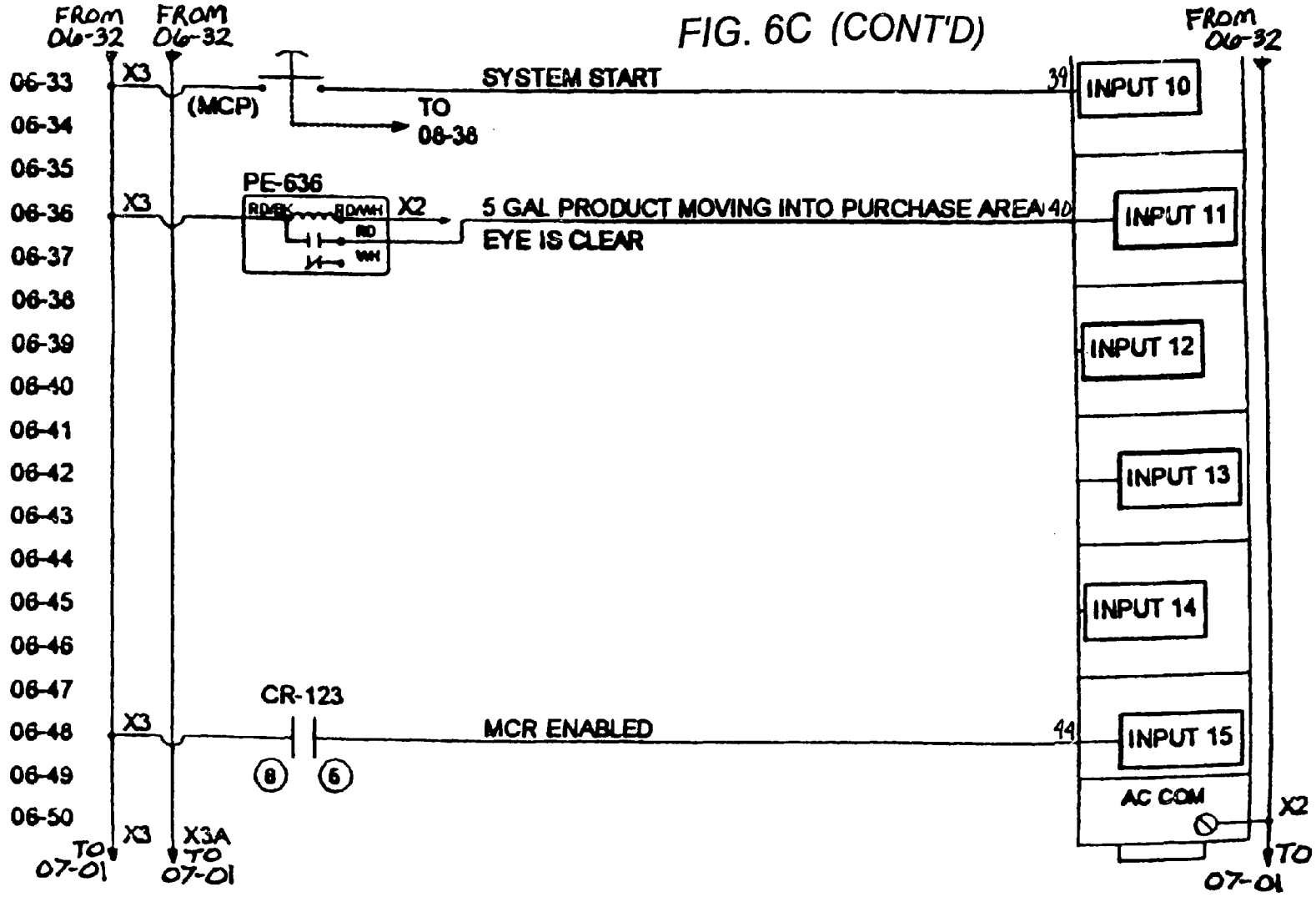
Figure 6D:
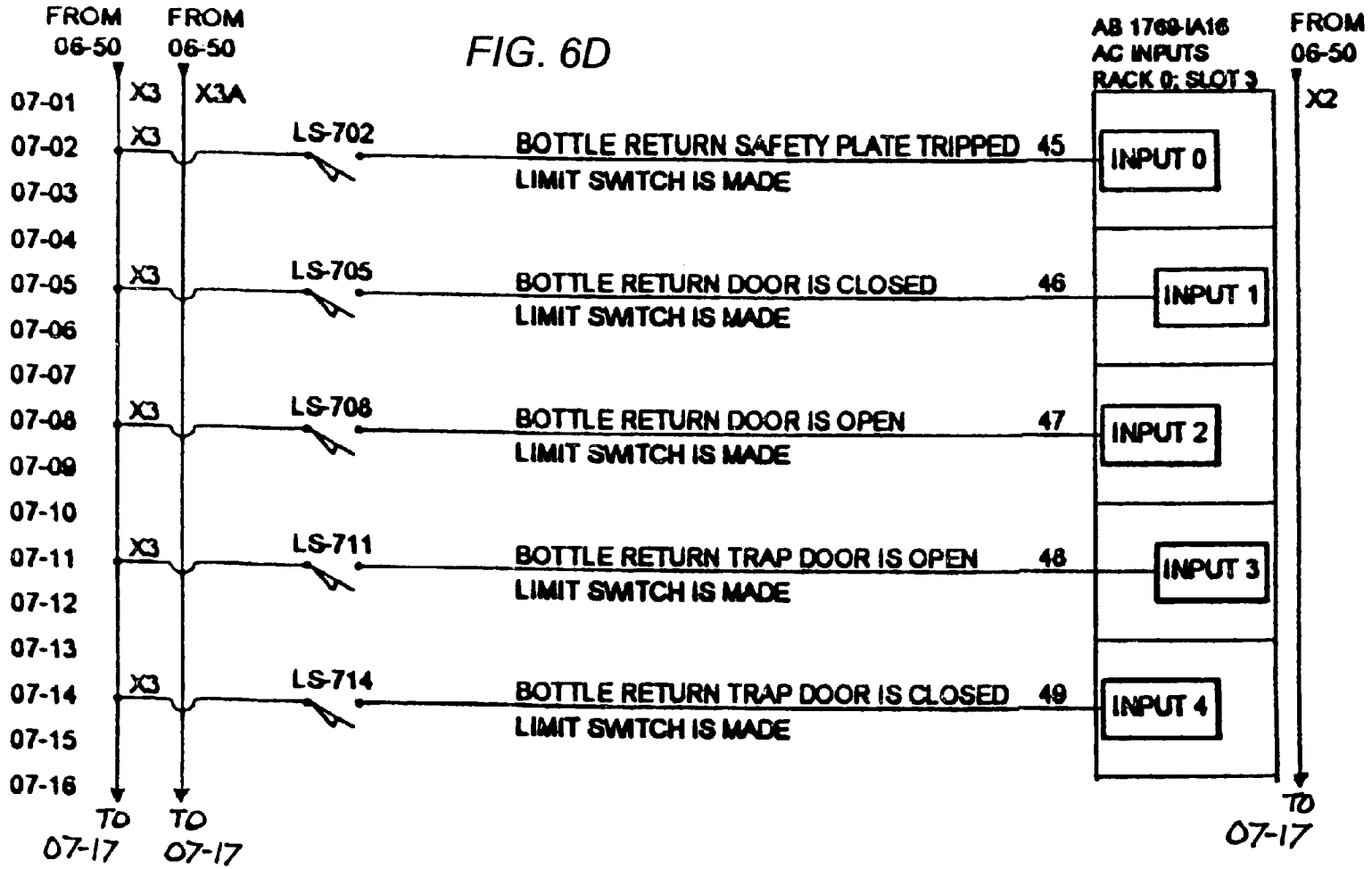
Figure 6D:
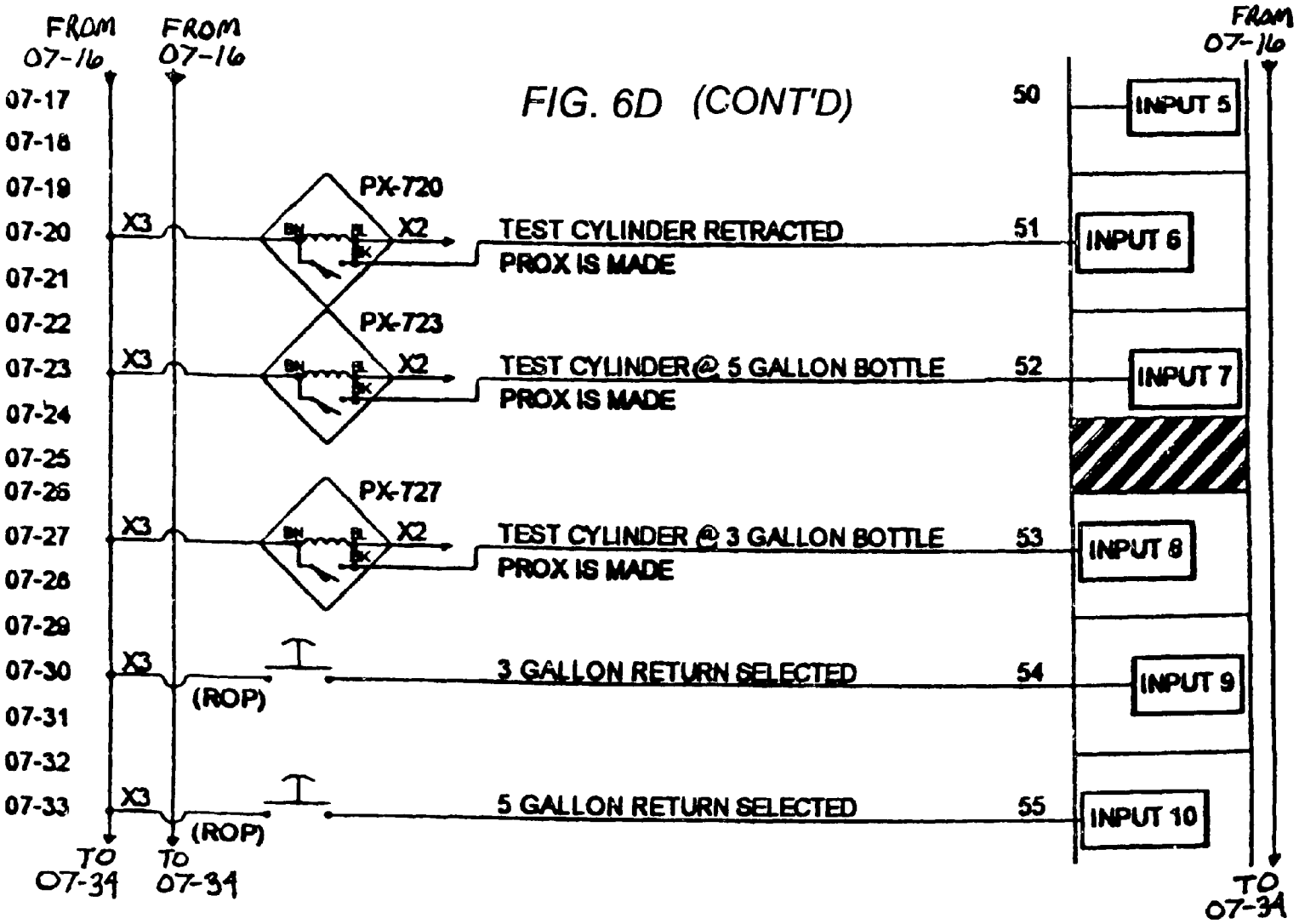
Figure 6D:
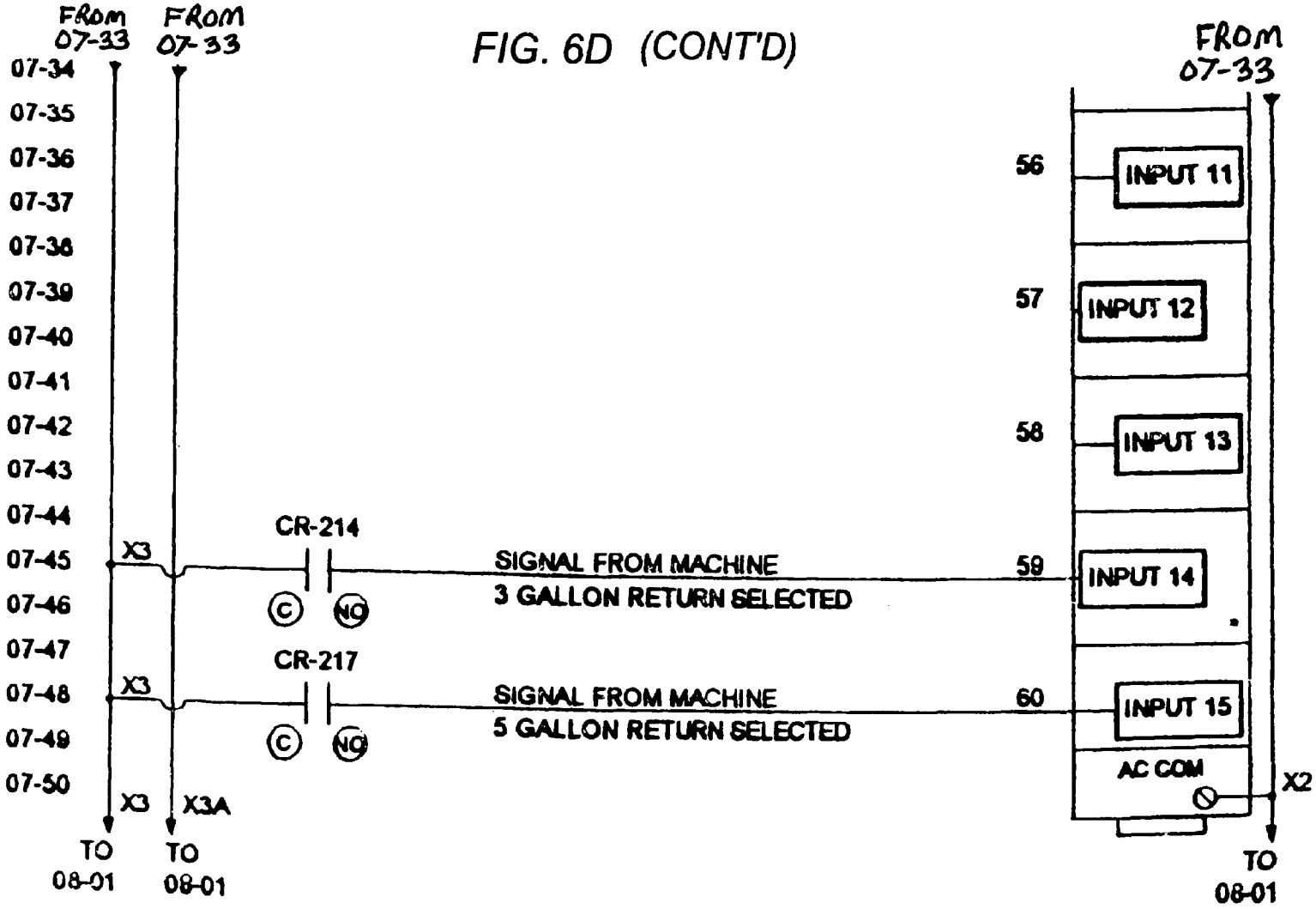
Figure 6D:
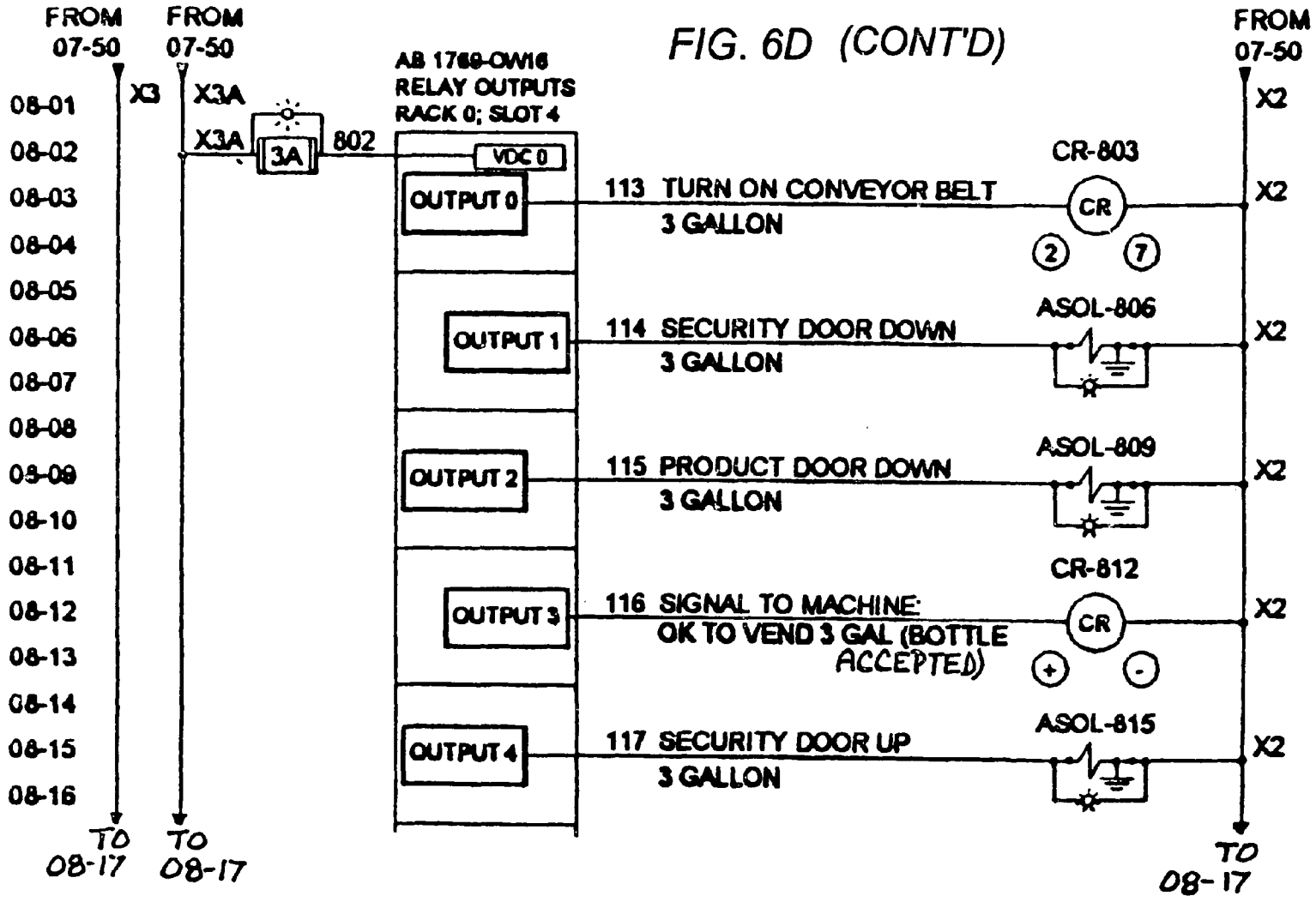
Figure 6D:
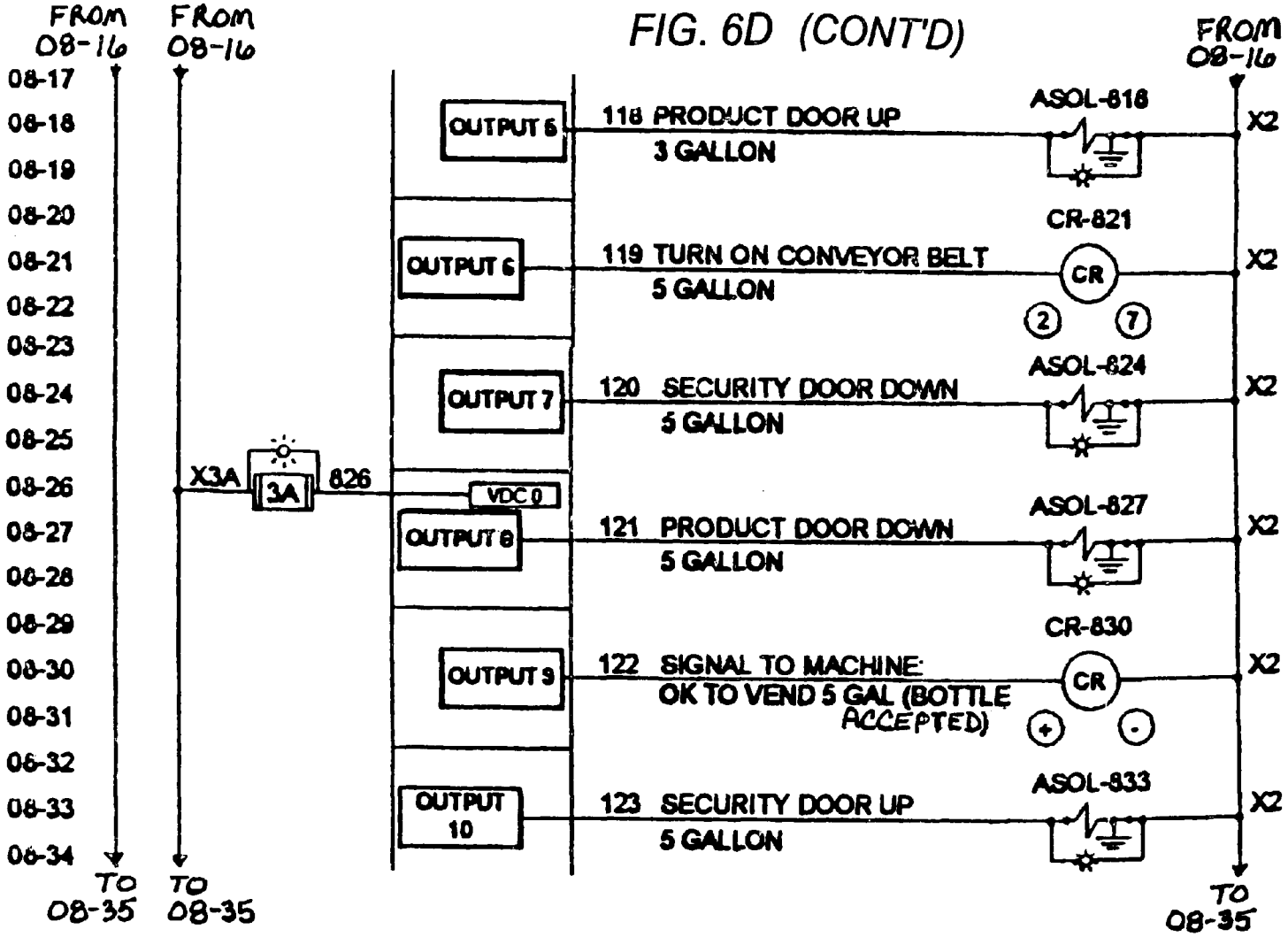
Figure 6E:
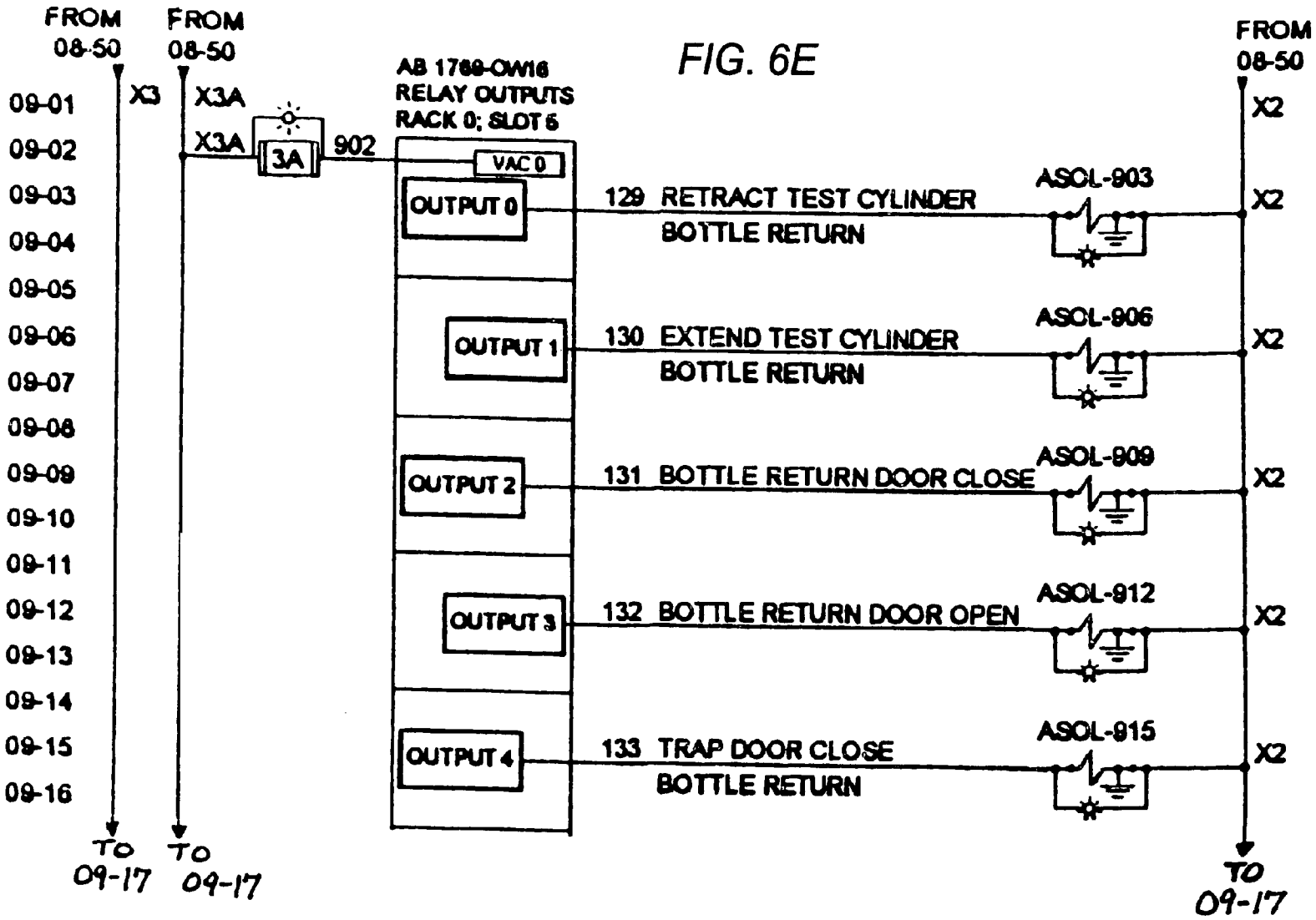
Figure 6E:
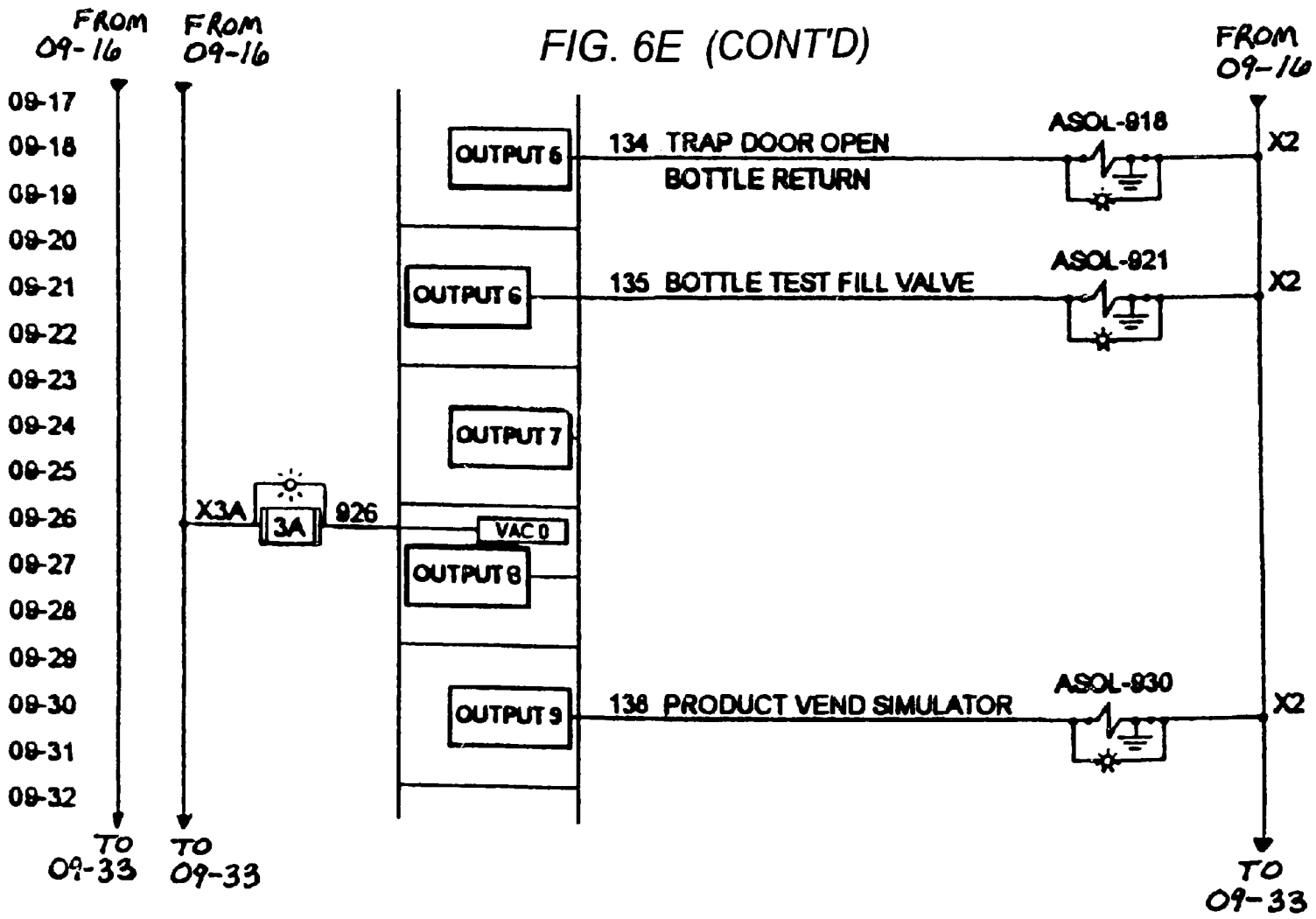
Figure 6E:
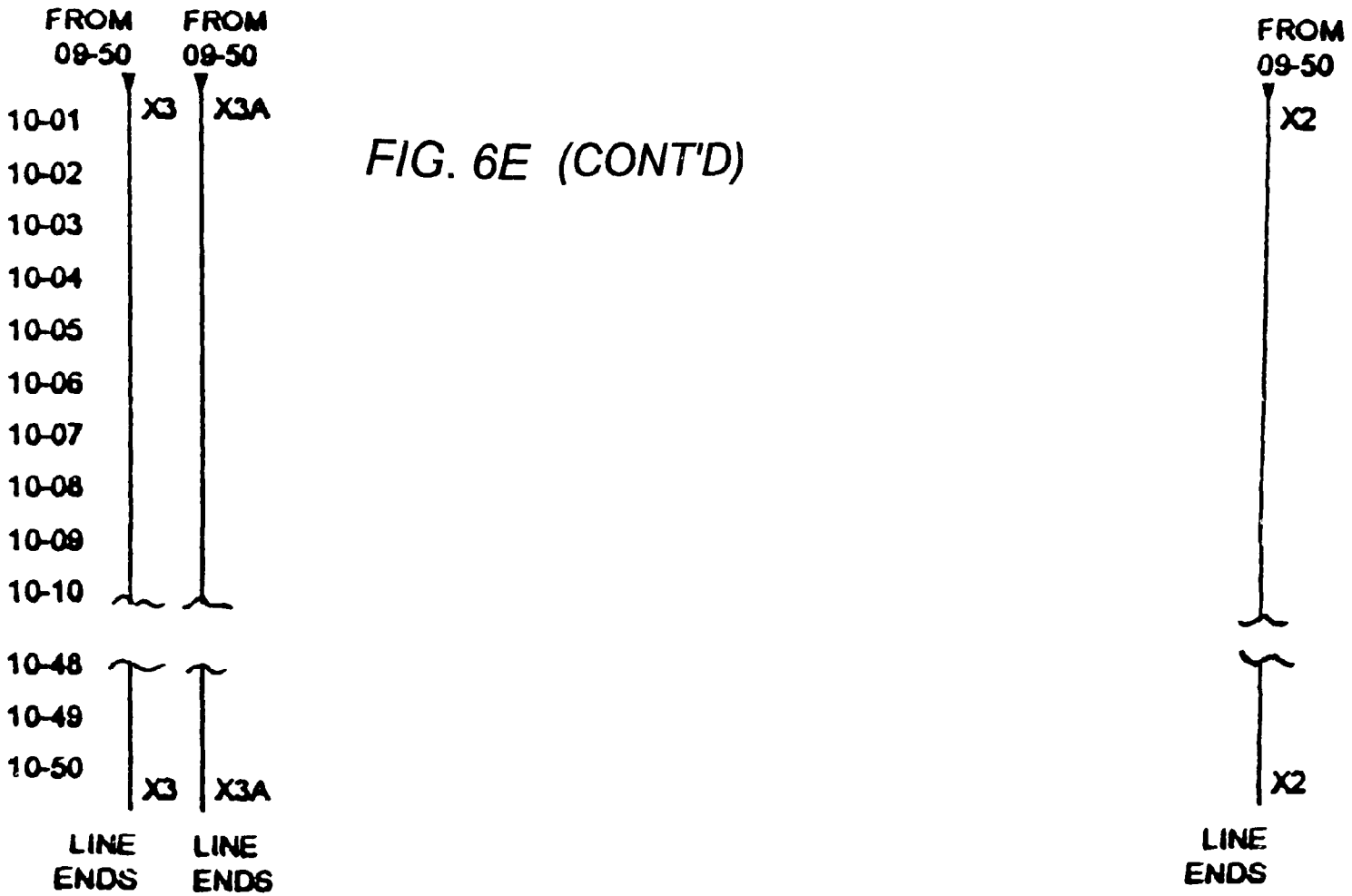
Figure 7A:
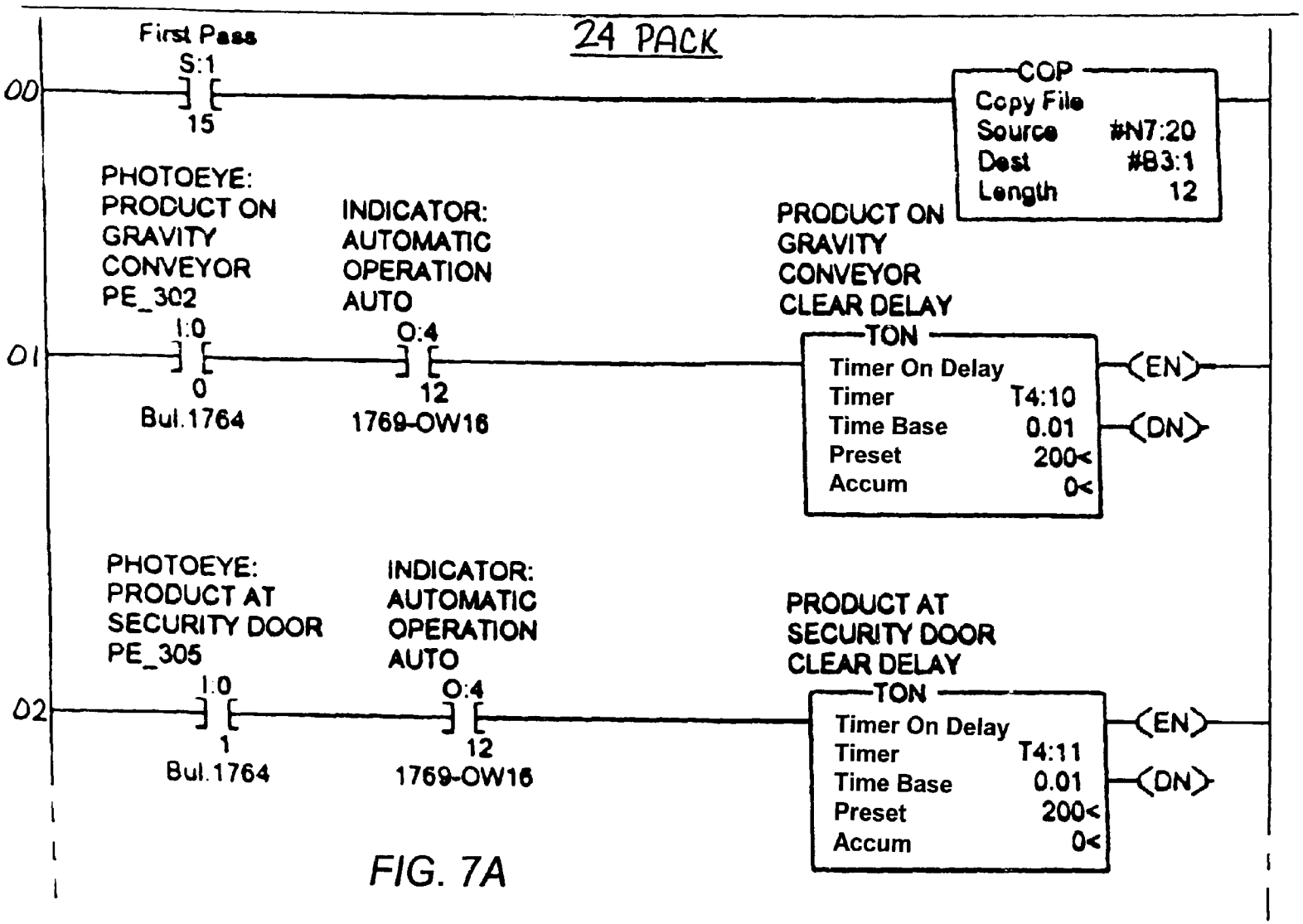
FIGS. 7A-7E illustrate a circuit diagram of a dispensing apparatus system for dispensing a 24 pack of bottles.
Figure 7A:
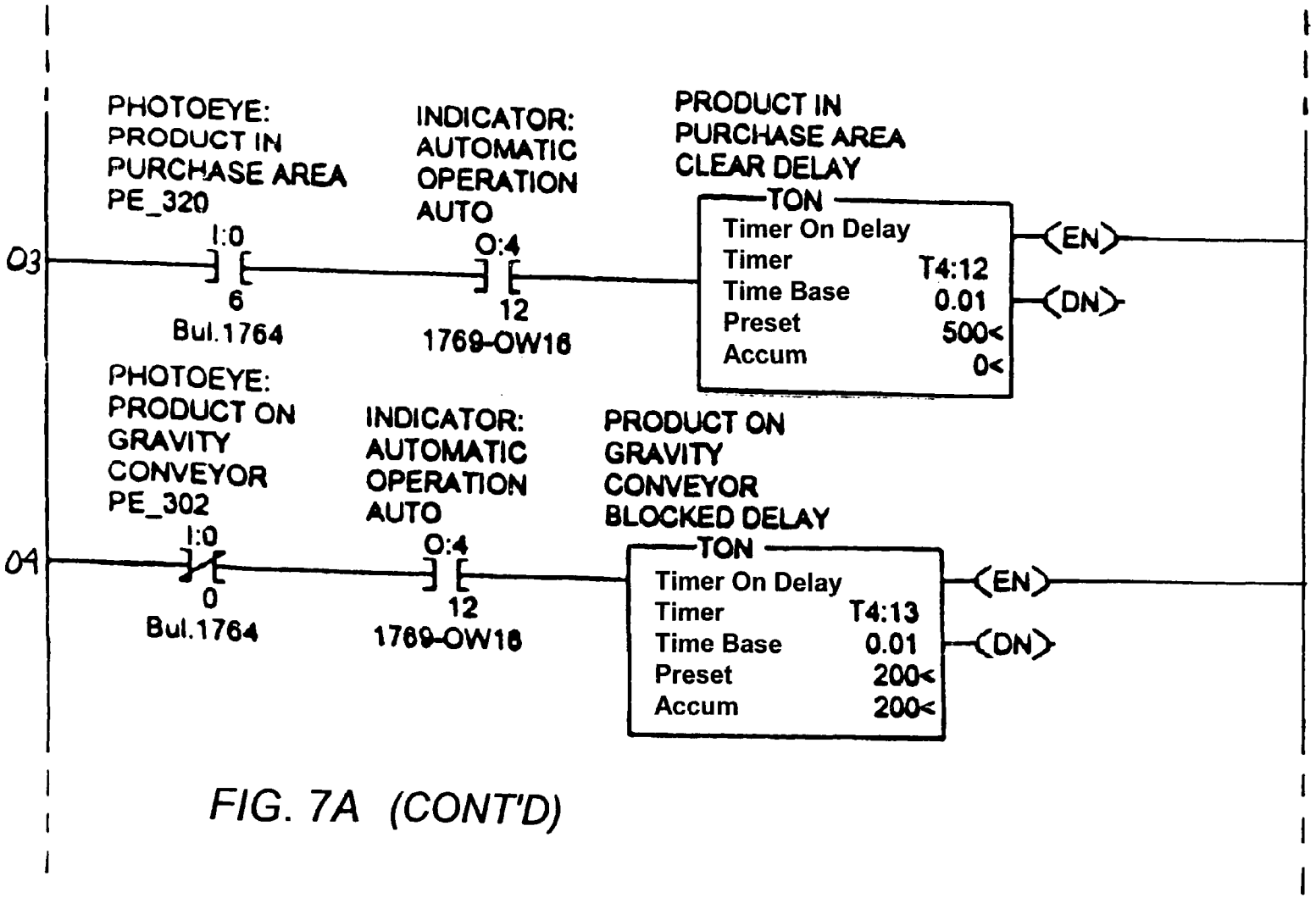
Figure 7A:
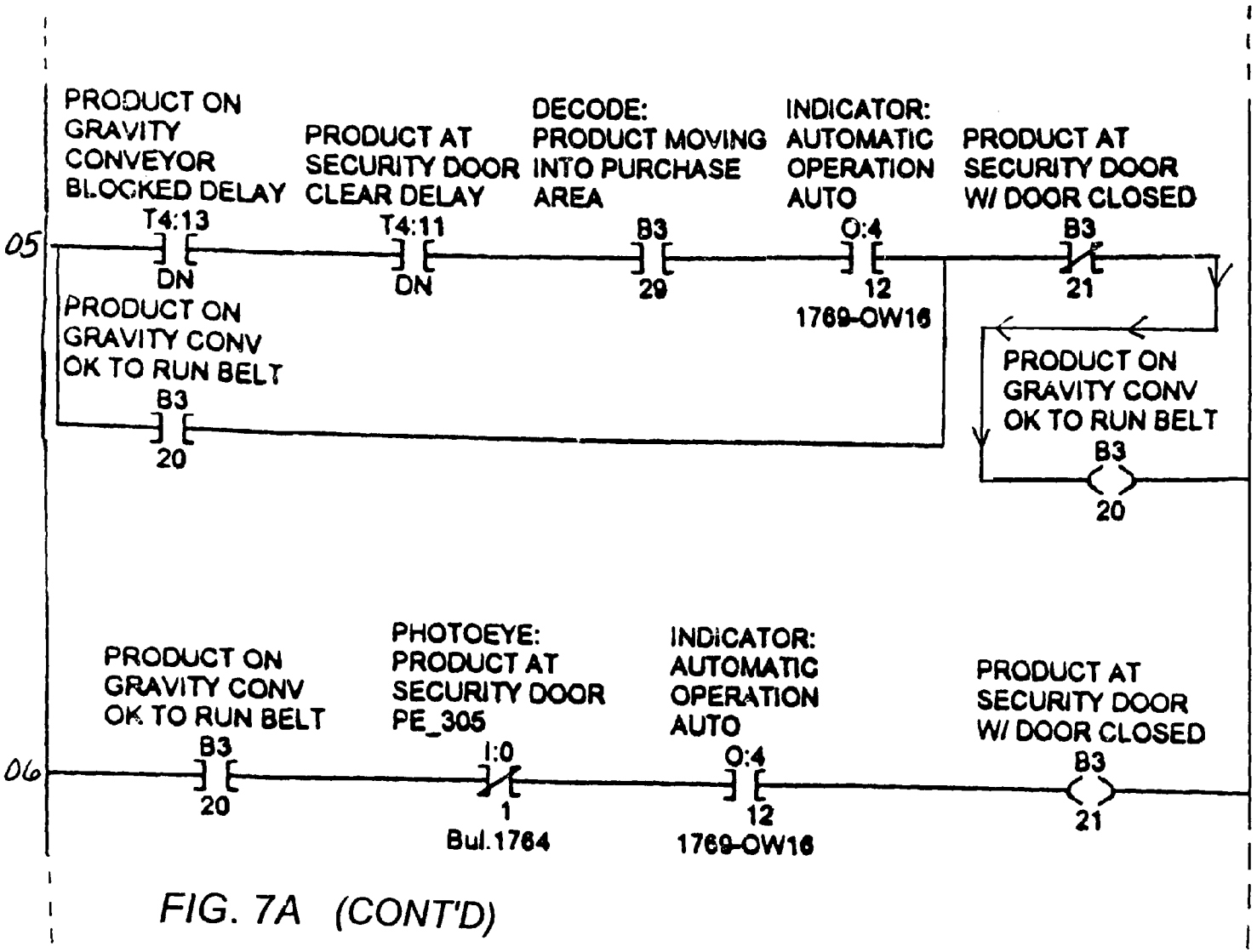
Figure 7A:
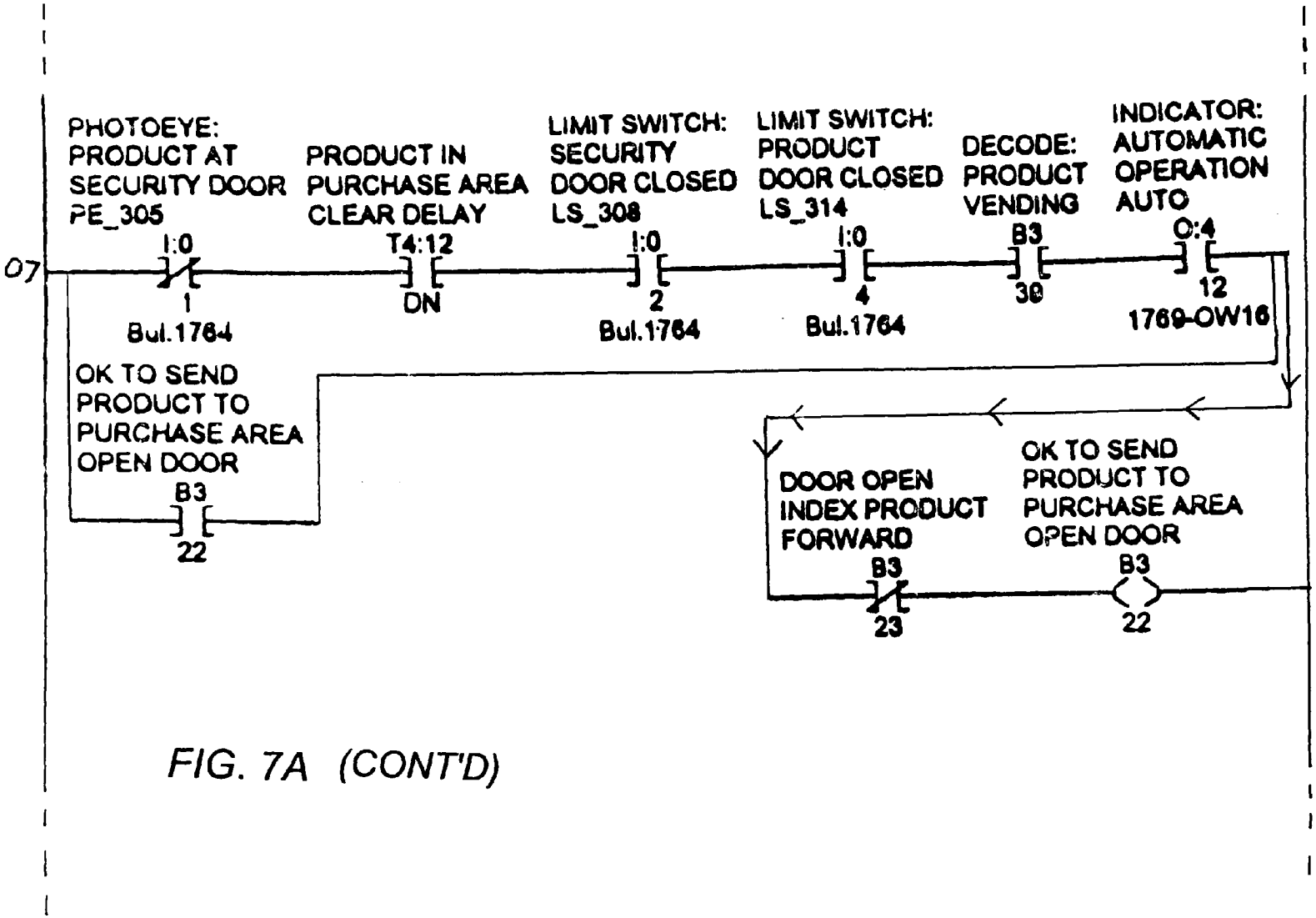
Figure 7A:
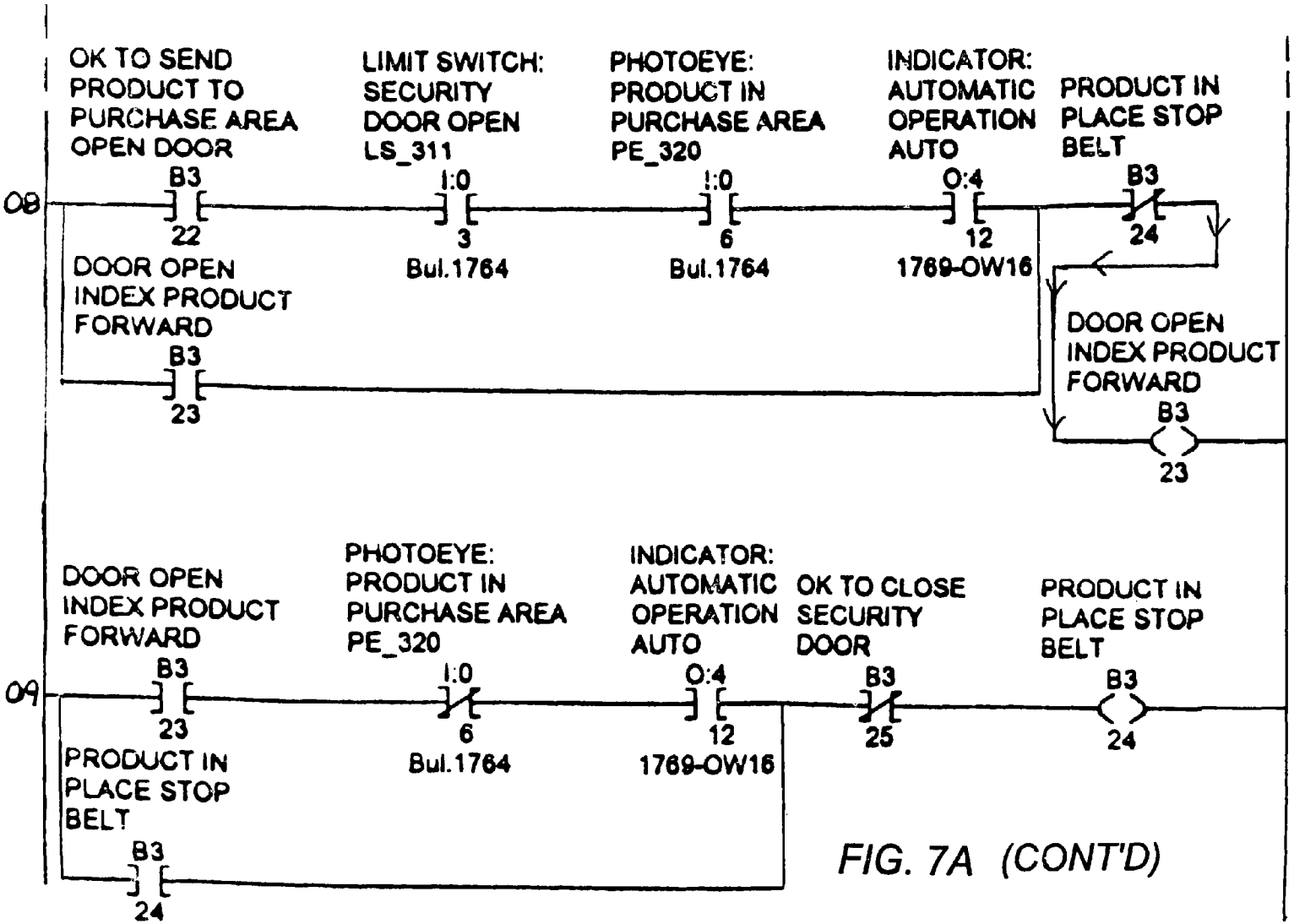
Figure 7B:
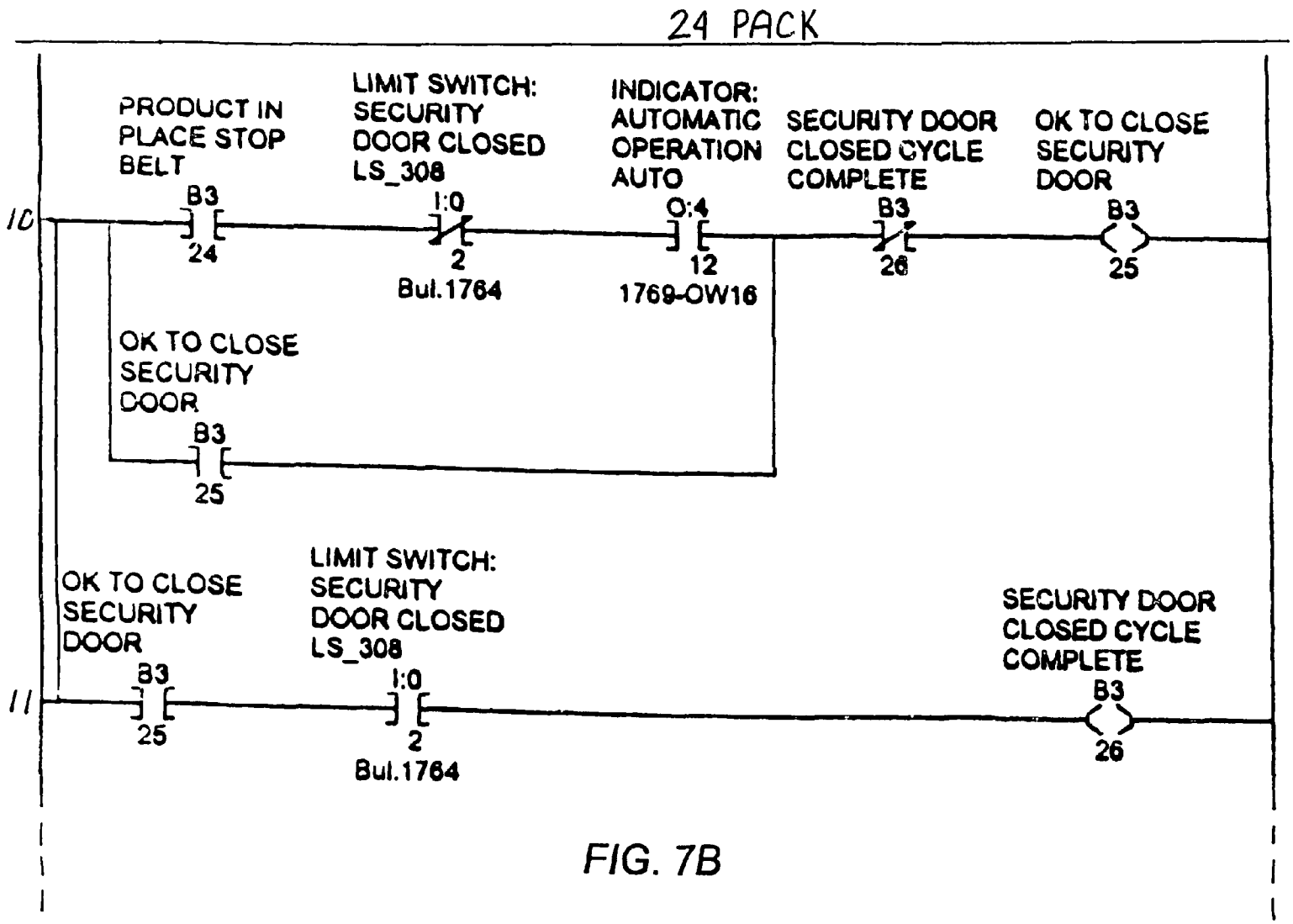
Figure 7B:
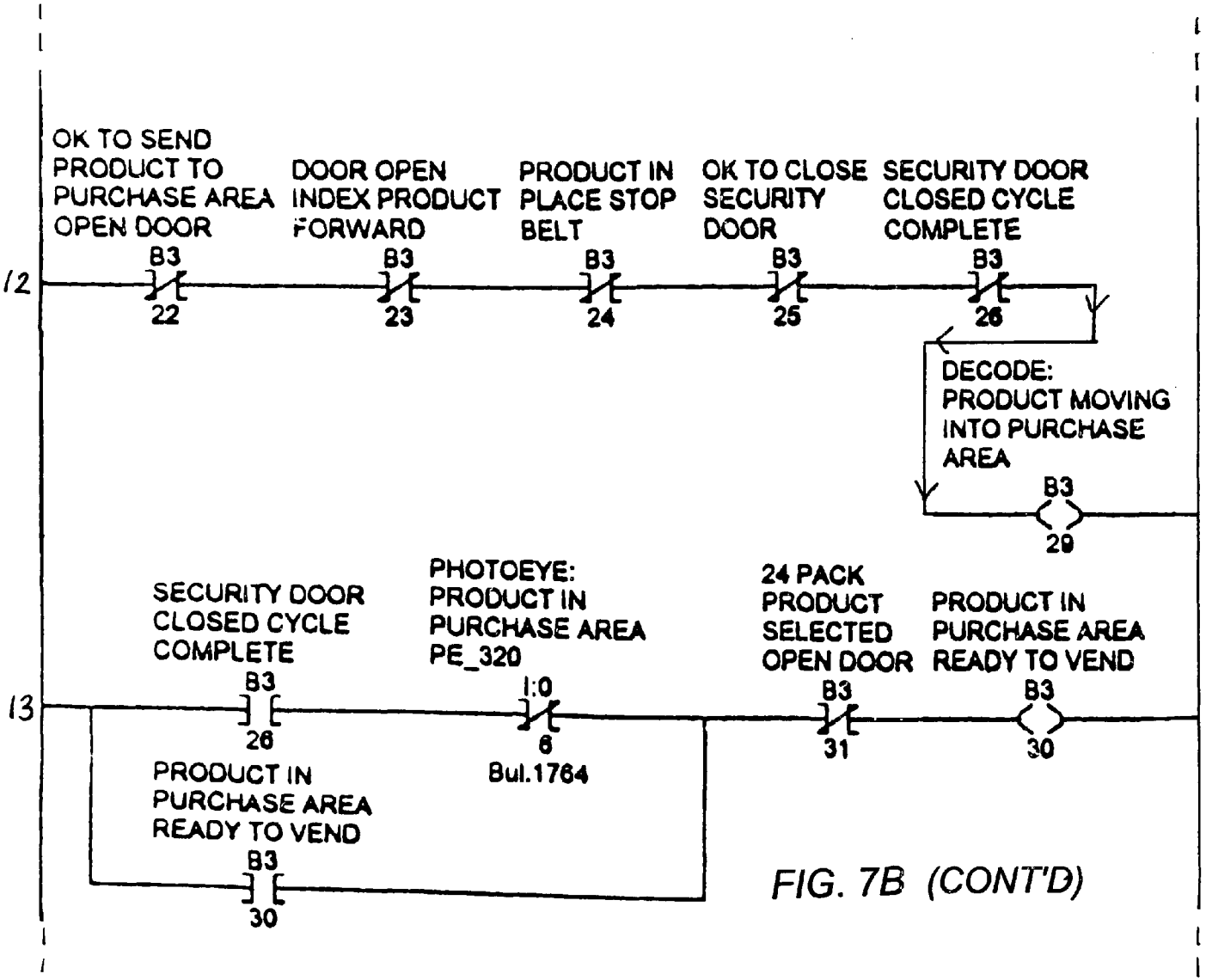
Figure 7B:
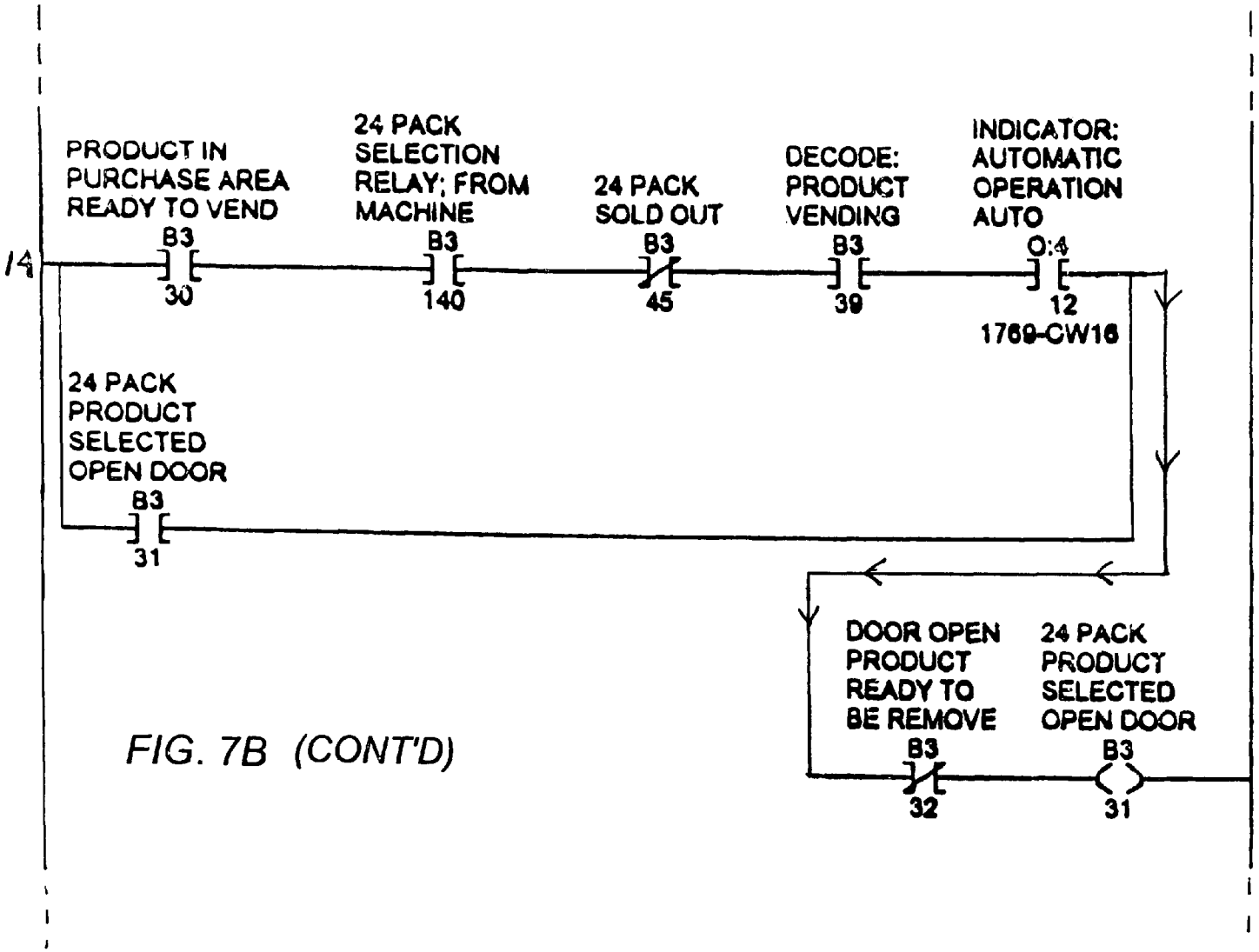
Figure 7B:
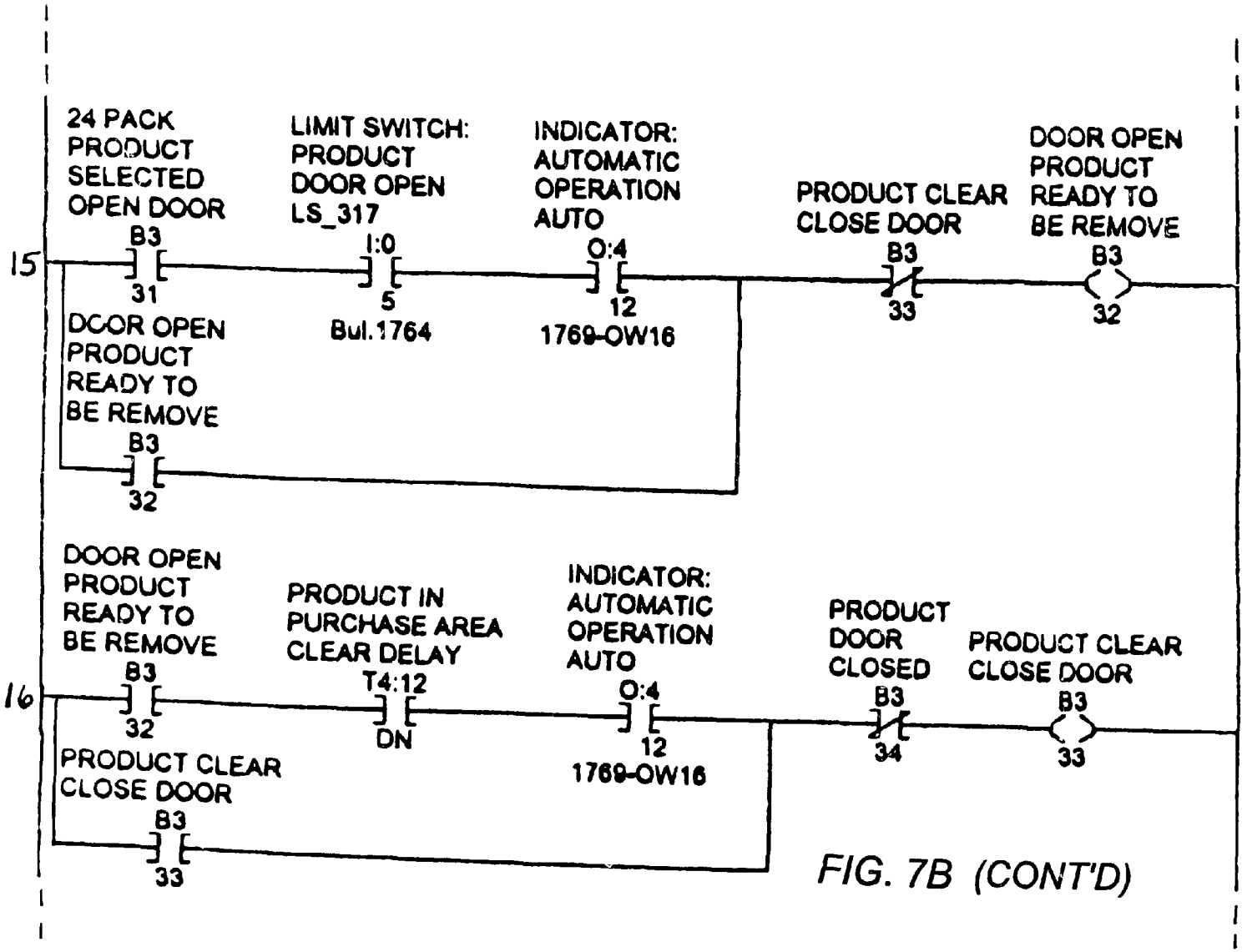
Figure 7B:
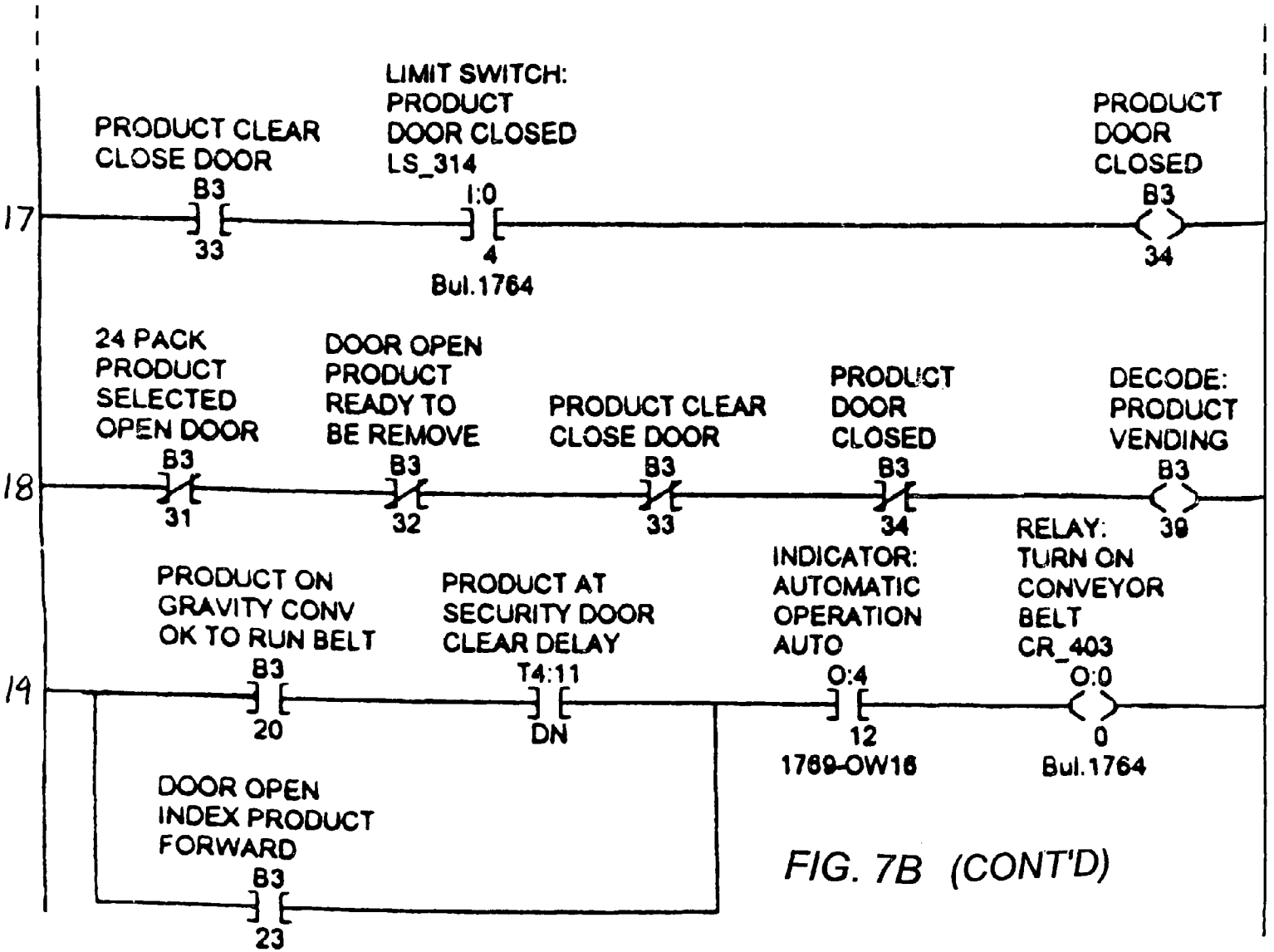
Figure 7C:
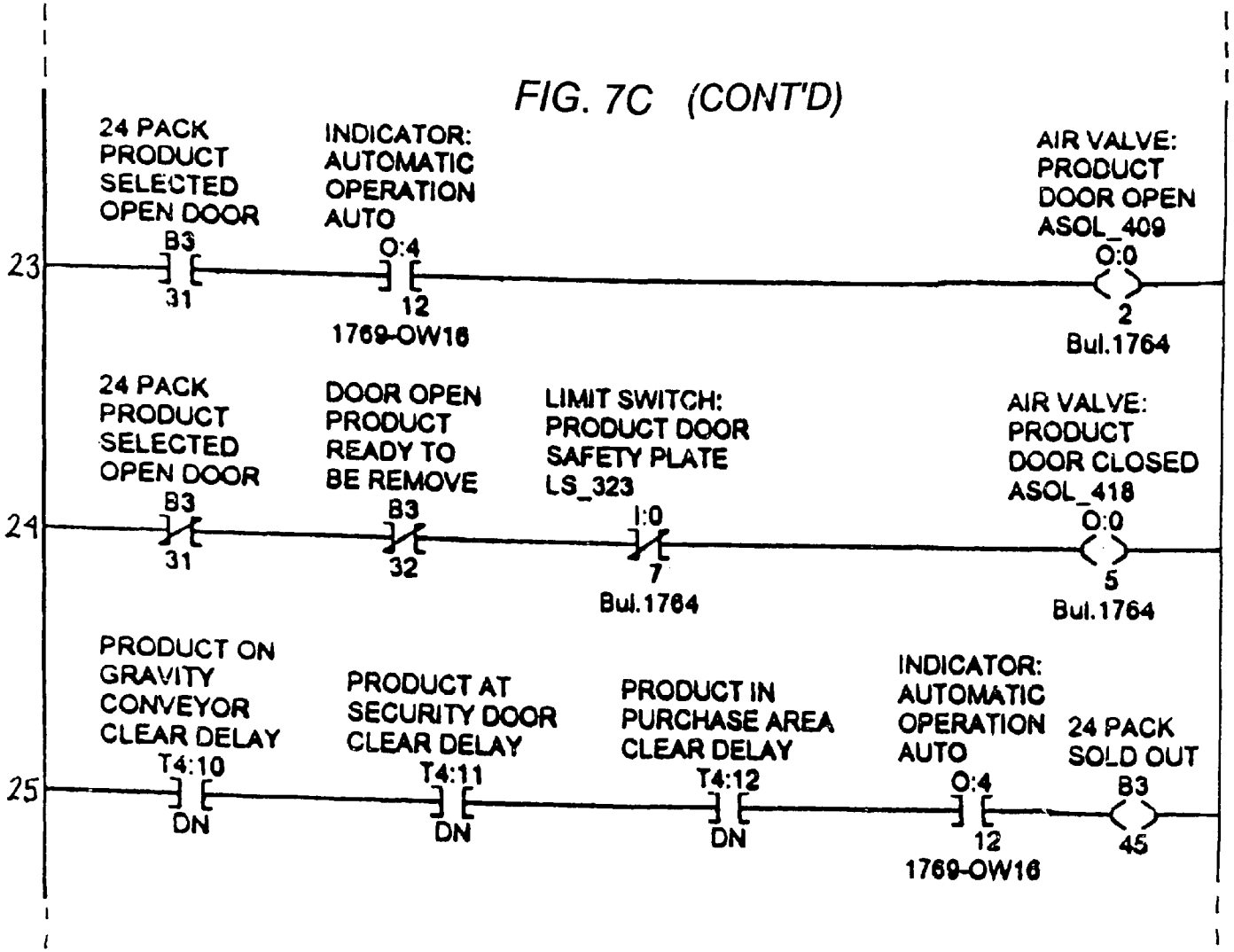
Figure 7C:
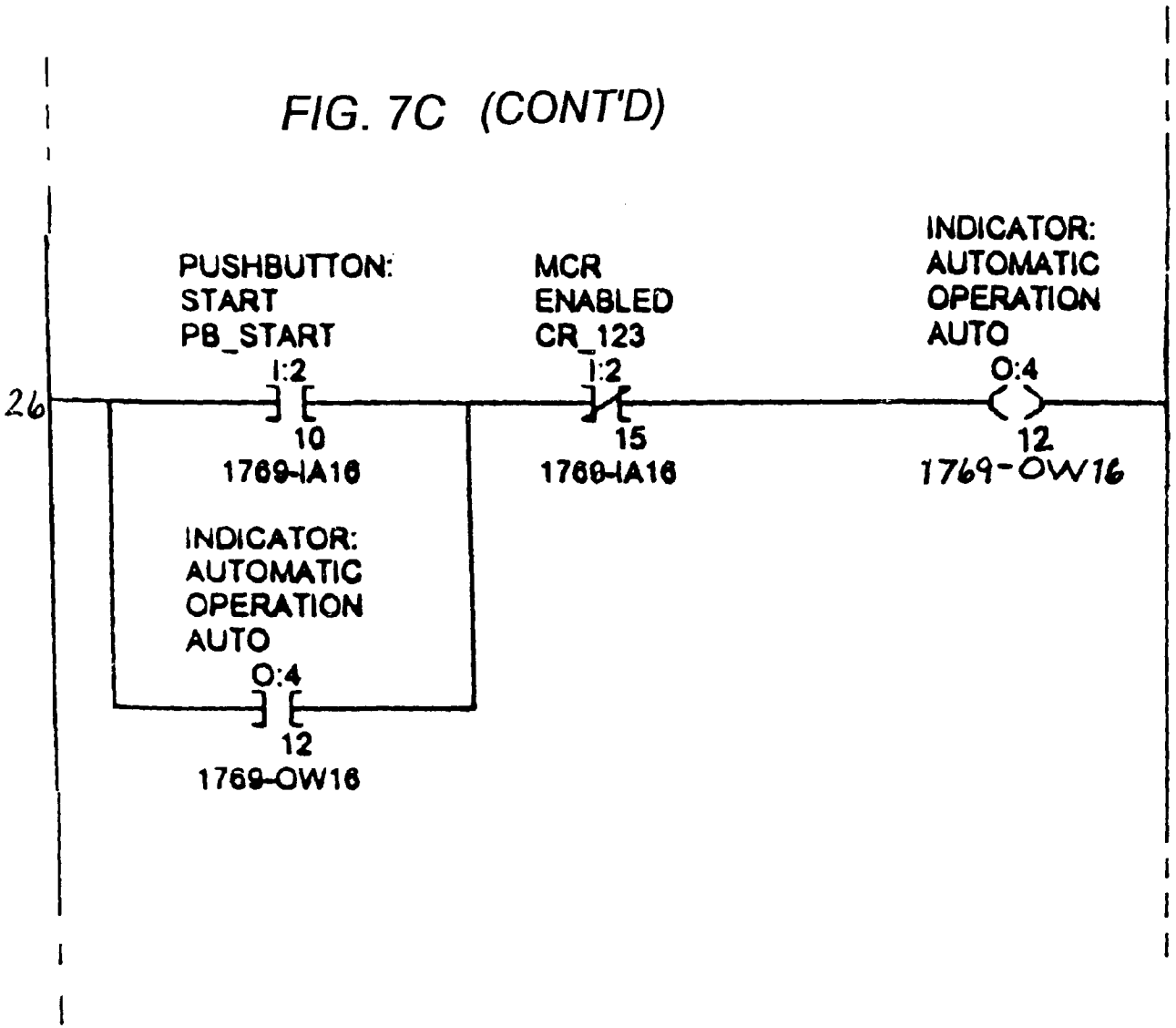
Figure 7C:
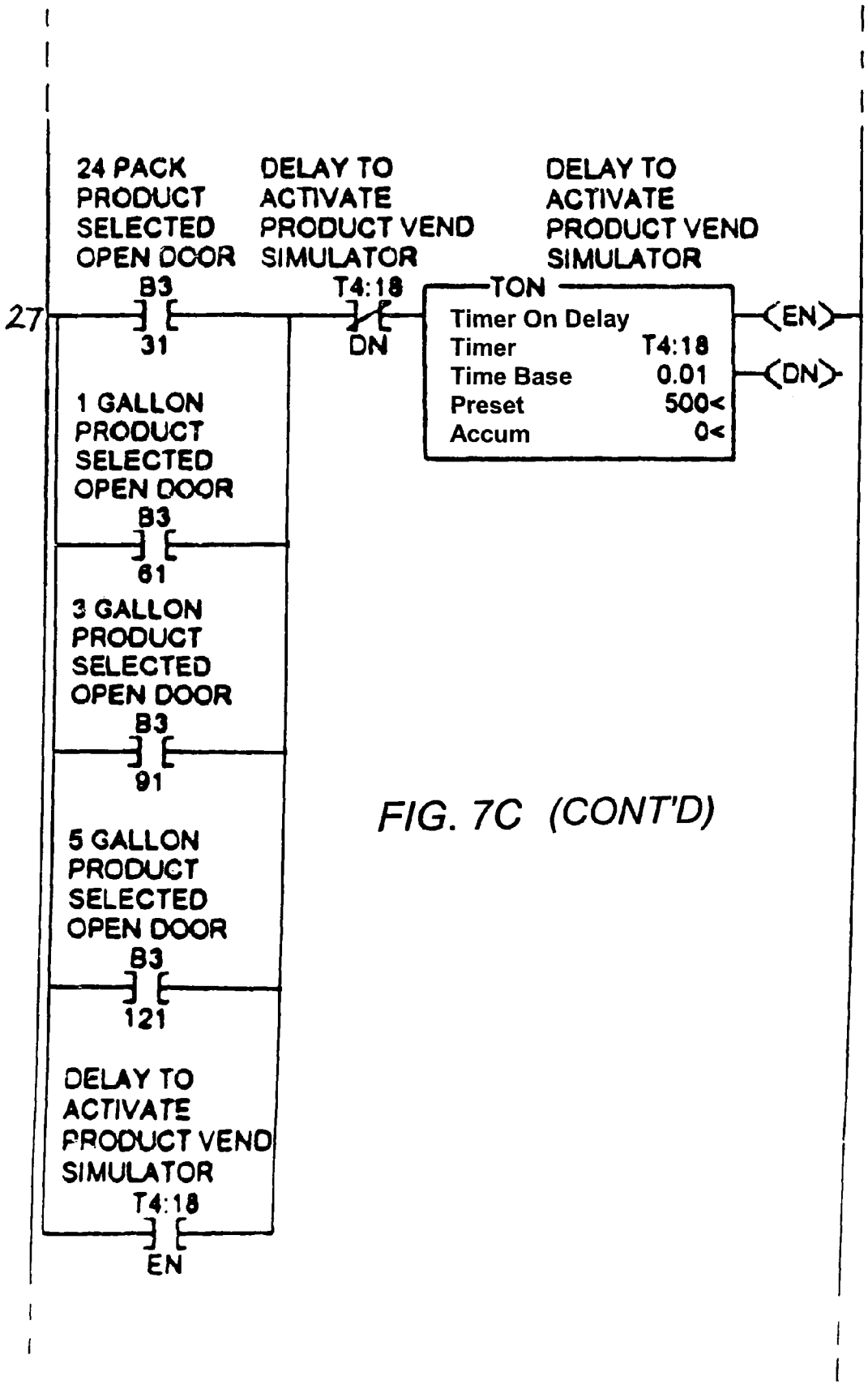
Figure 7C:
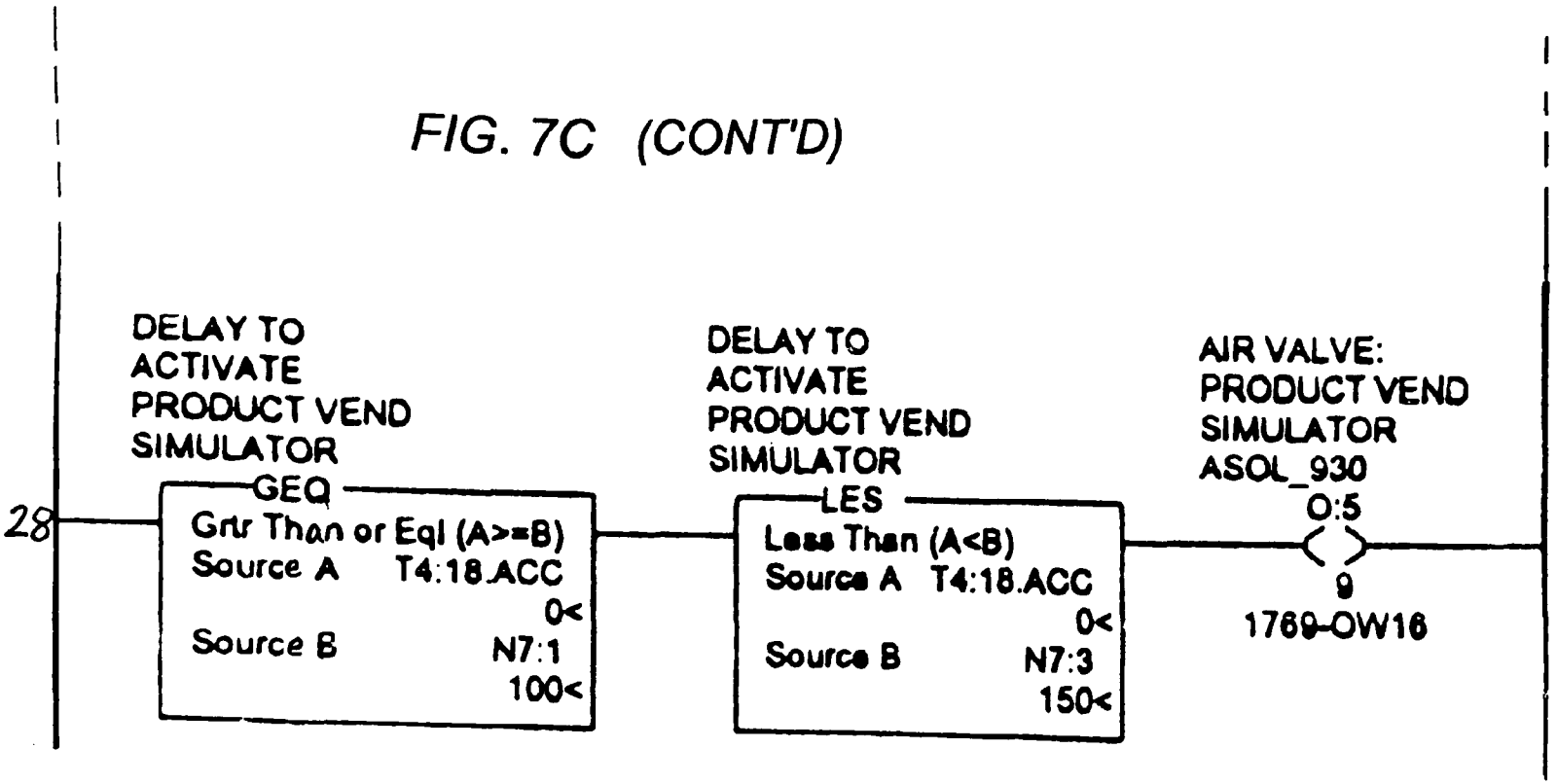
Figure 7D:
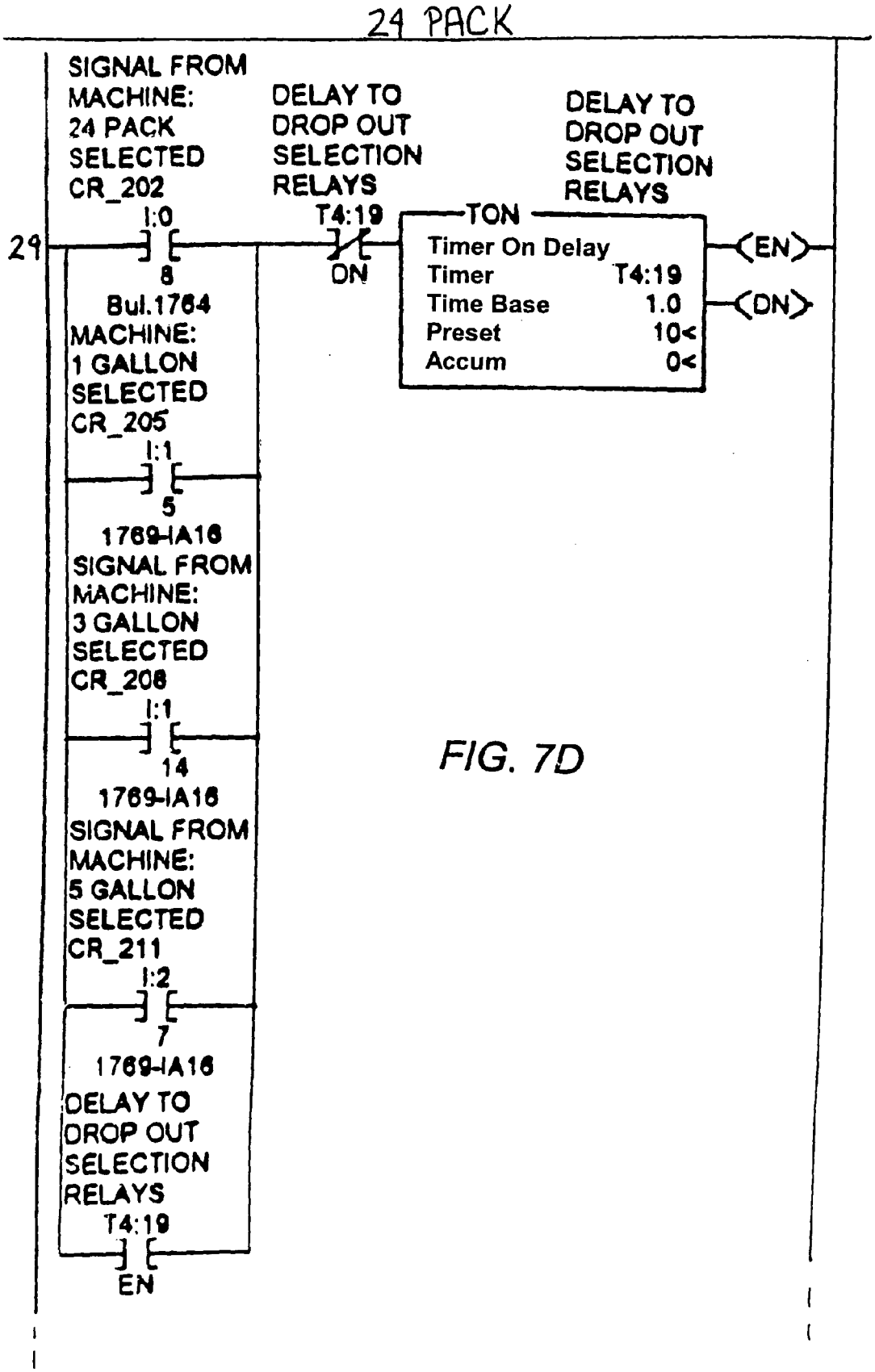
Figure 7D:
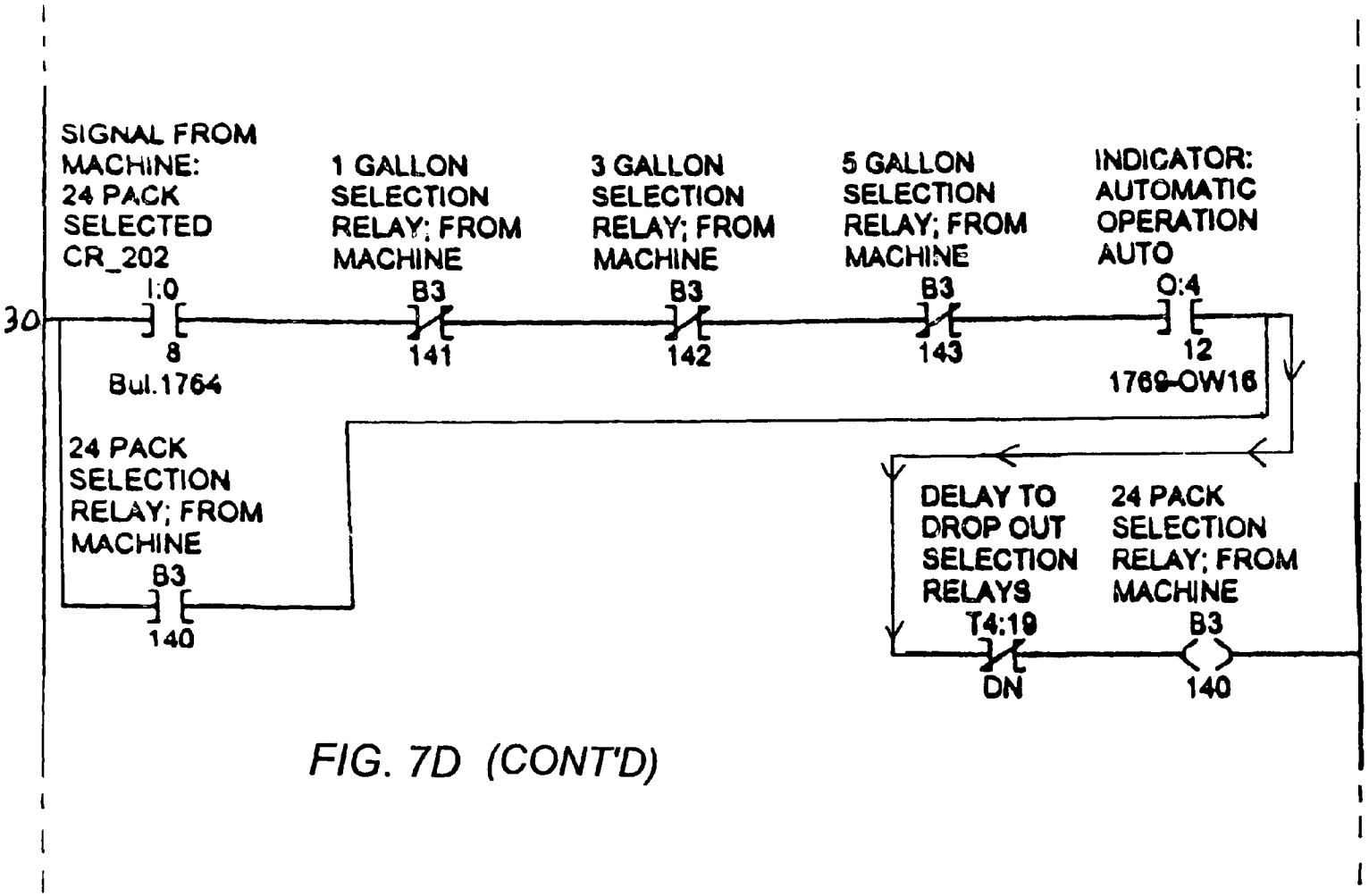
Figure 7D:
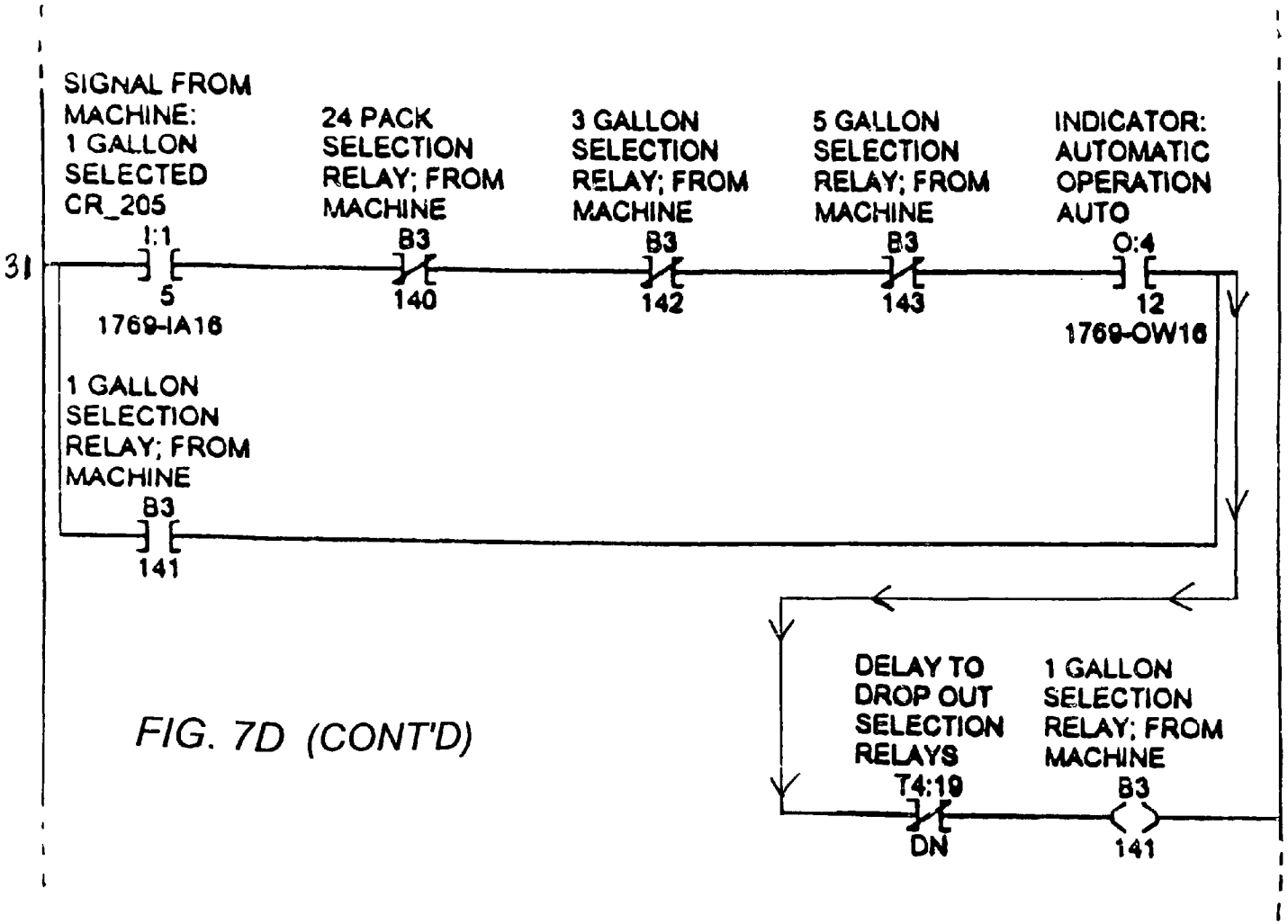
Figure 7D:
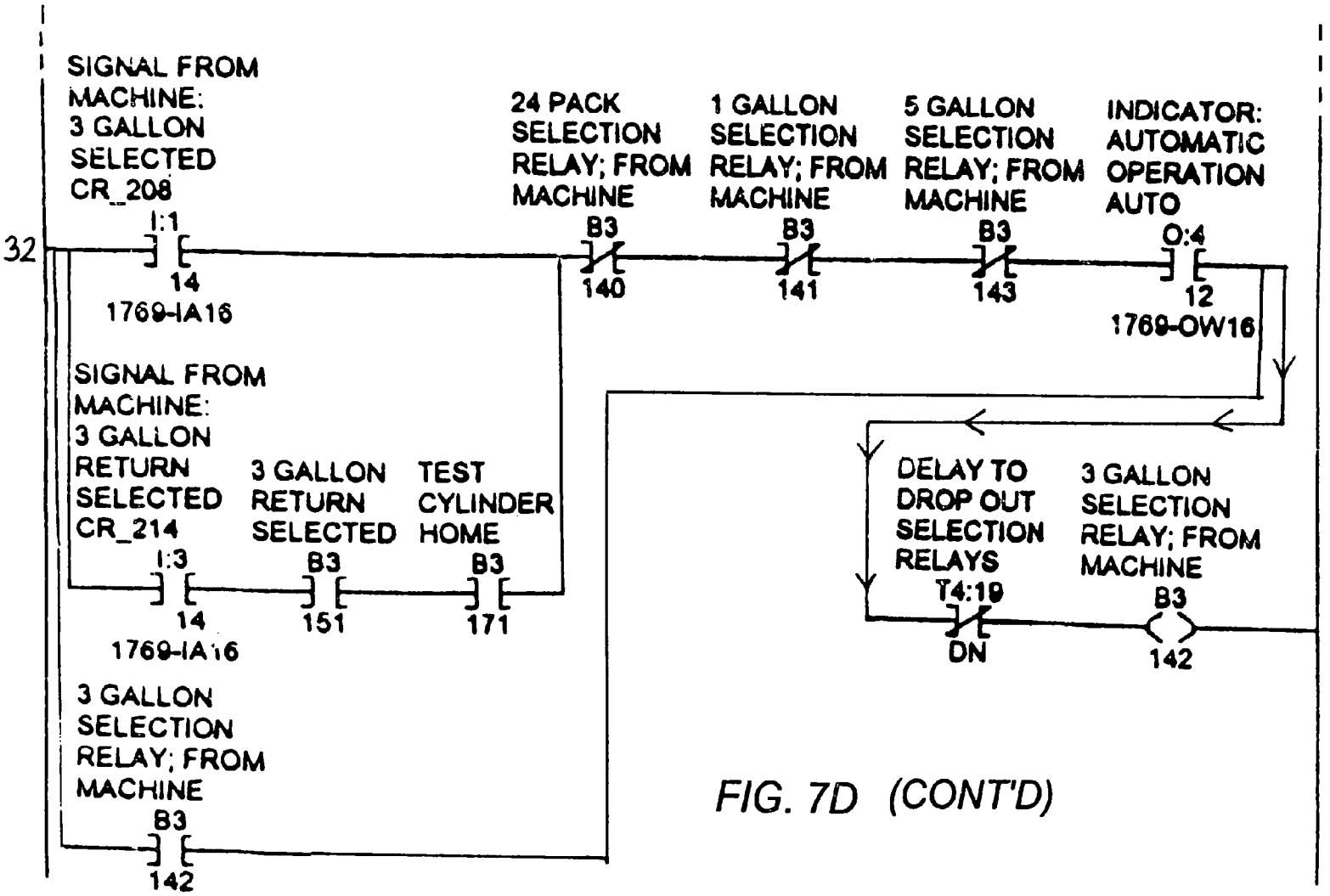
Figure 7E:
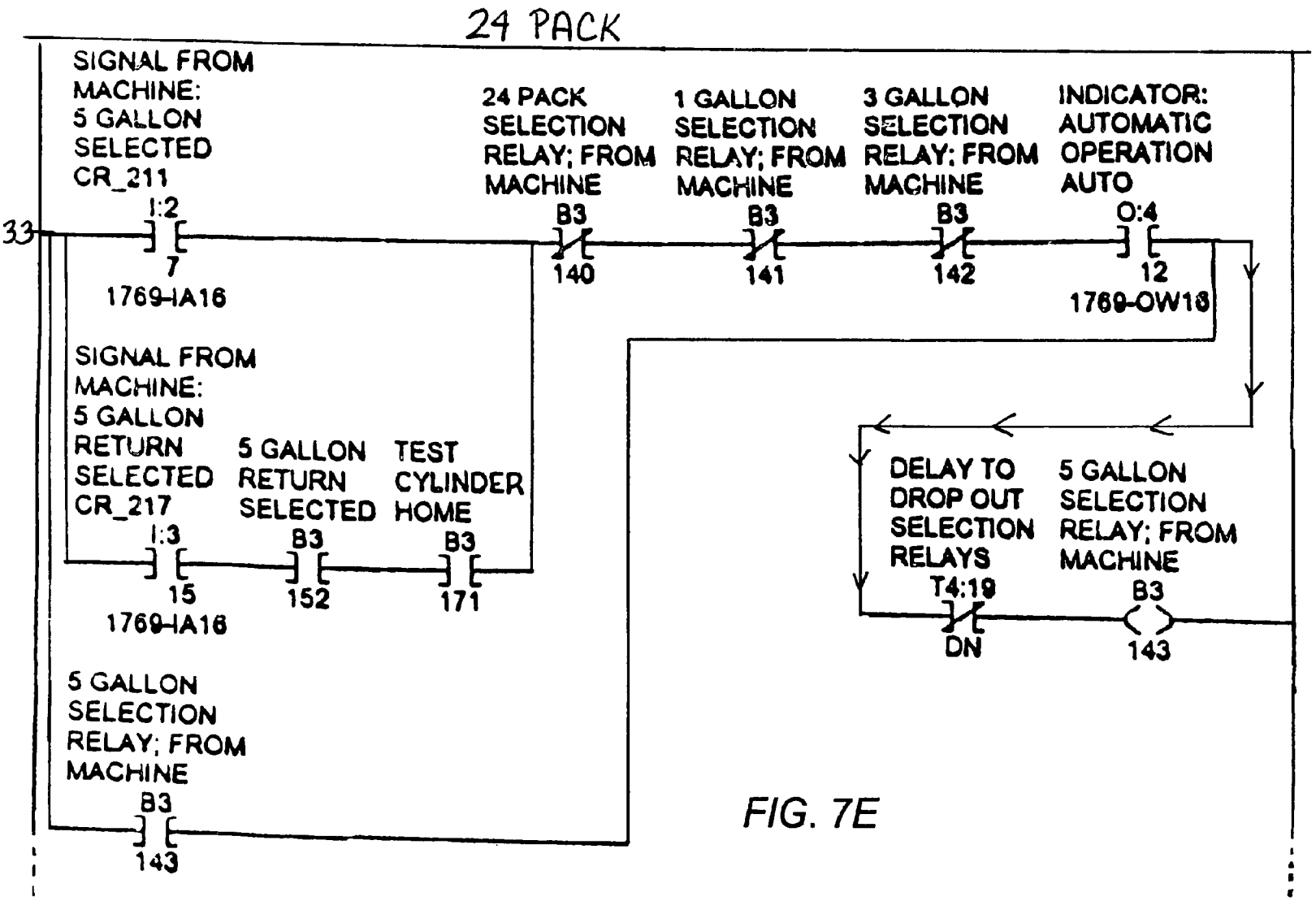
Figure 7E:
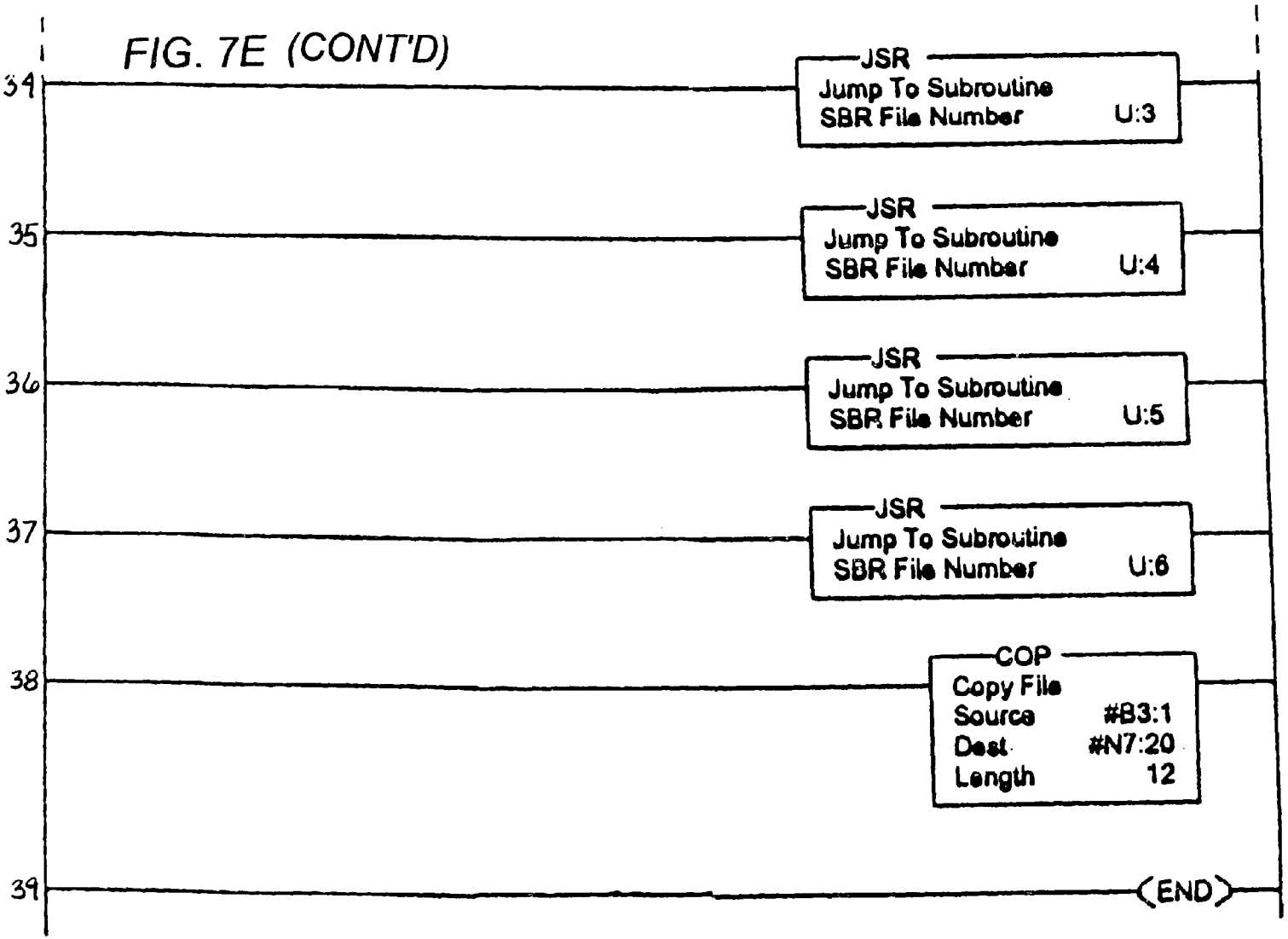

As shown for example in FIGS. 1 and 2, the dispensing apparatus system 30 includes a housing 32 for storing the objects to be dispensed. In a preferred embodiment, the housing 32 stores bottled water in various sizes including 1 gallon bottles, 3 gallon bottles, 5 gallon bottles, and cases of bottled water of various sizes of bottles including, but not limited to, 12 ounce bottles, 16.9 ounce bottles, 20 ounce bottles, 24 ounce bottles and the like. The housing 32 also houses the conveyor system 34 which transports the selected bottled water from the storage area in the housing 32 to the predetermined dispensing member 36 where the customer may take the purchased bottled water.

The conveyor system 34 preferably includes a plurality of conveyor belts 44 having legs 46 to provide support to the conveyor belts 44. In a preferred embodiment, the legs 46 may be adjustable and be any suitable length. Each conveyor belt 44 preferably extends from the products in the storage area to a predetermined dispensing member 36 and transports a predetermined size of bottled water from the storage area to a predetermined dispensing member 36 for dispensing the predetermined size of bottled water to a customer. Each dispensing member 36 preferably includes a body 40 and a door 42 on an exterior of the housing 32.

In one embodiment, the conveyor system 34 may include a security door along each of the conveyor belts 44 between the storage area of the bottled water and each of the dispensing members 36 or one security door operatively positioned along the conveyor system 34 between the stored bottled water and the dispensing members. The security door provides another check to ensure the product selected by the customer is properly transported and payment is received before being dispensed to the customer.

The plurality of selection members 60 may be any suitable type of selection members for selecting the type, size and/or quantity of product to be dispensed or returned. Circuitry connects the selection members 60 with the conveyor system 34 to send signals thereto to activate the components of the dispensing apparatus system 30.

The payment member 70 may be any suitable type of payment device that accepts cash and/or credit cards for payment.

The plurality of selection members 60 and payment member 70 may be operatively positioned in any suitable location on the housing 32. In a preferred embodiment, the plurality of selection members 60 and payment member 70 may be operatively positioned adjacent or near the dispensing members 36, as shown for example in FIGS. 1 and 2.

The inventory monitoring member monitors the sales of the products in order to alert the supplier when a product needs to be replaced. The inventory monitoring member may alert the supplier of product sold at predetermined times including, but not limited to, as the product is sold, on a daily basis, on a weekly basis, on a monthly basis or any other suitable predetermined time period.

The return machine 38 is preferably any suitable bottle return machine and is preferably automated for a customer to return empty bottles, such as 1 gallon bottles, 3 gallon bottles, 5 gallon bottles or the like. The return machine 38 preferably includes a body 48, a door 50, a nozzle 52 and a base 54. In returning an empty bottle to the return machine 38, a customer selects a predetermined return button from the plurality of selection members 60. The door 50 of the return machine 38 opens and an empty 1 gallon, 3 gallon or 5 gallon water bottle is placed through the door 50 inside of the body 48 on the base 54 of the return machine 38, such as shown for example in FIG. 1.

A nozzle 52 is then inserted into the neck of the empty bottle enough to seal the opening thereof. The door 50 of the return machine 38 is then closed. The nozzle 52 inside of the return machine 38 holds the bottle in place and causes a predetermined amount of air, e.g., 30 pounds of air, to be injected into the bottle. If air pressure is sustained for a predetermined amount of time, e.g., 1 minute, and a bar code on the bottom of the bottle is recognized, the bottle is accepted and drops into a bin below or near the return machine 38. The return machine 38 will then release a coin or send a signal to the payment member 70 for the customer to receive a credit or a partial credit towards the purchase of another 1 gallon, 3 gallon or 5 gallon bottle of water from the dispensing apparatus system 30. When the coin is inserted into or the signal is received by the payment member 70 of the dispensing apparatus system 30 for the purchase of a 1 gallon, 3 gallon or 5 gallon bottle of water, the price of the bottled water may be reduced by a predetermined percentage or amount. A credit card or cash may be used to pay the remaining balance as detailed above. Then, the dispensing apparatus system 30 will dispense a new bottle of water as detailed above.

If the air pressure is not sustained in the empty water bottle, e.g., a hole is in the bottle, or the bar code on the bottle is not recognized, the door 50 of the return machine 38 will open and the empty bottle is returned to the customer and no credit is given for the empty bottle.

The dispensing apparatus system 30 is preferably operated by a customer selecting the desired size and quantity of bottled water from a plurality of selection members 60. The customer then pays for the desired size and quantity of bottled water with cash or a credit card at the payment member 70. The payment member 70 may allow the credit card payment to be sent directly to the bank of the supplier. Once the customer makes the desired product selection and the payment is received, the selected bottled water is dispensed to the customer via the predetermined dispensing member 36. More particularly, the selected size and quantity of bottled water is transported from the storage area in the housing 32 along the predetermined conveyor belt 44 for the selected size of bottled water to the predetermined dispensing member 36 for the selected size of bottled water.

The door 42 of the predetermined dispensing member 36 remains closed until the selected bottled water reaches a predetermined distance therefrom. Once the selected bottled water reaches that predetermined distance from the door 42 of the dispensing member and the dispensing apparatus system 30 recognizes that payment has been received, the door 42 for the dispensing member 36 opens and the selected bottled water advances therethrough for the customer to remove. The doors for the other dispensing members remain closed at this time. Once the customer removes the selected bottled water, the door 42 of that dispensing member 36 closes and the dispensing apparatus system 30 is ready for the next customer.

In one embodiment the dispensing member may include a turnstile type element.

Figure 14:
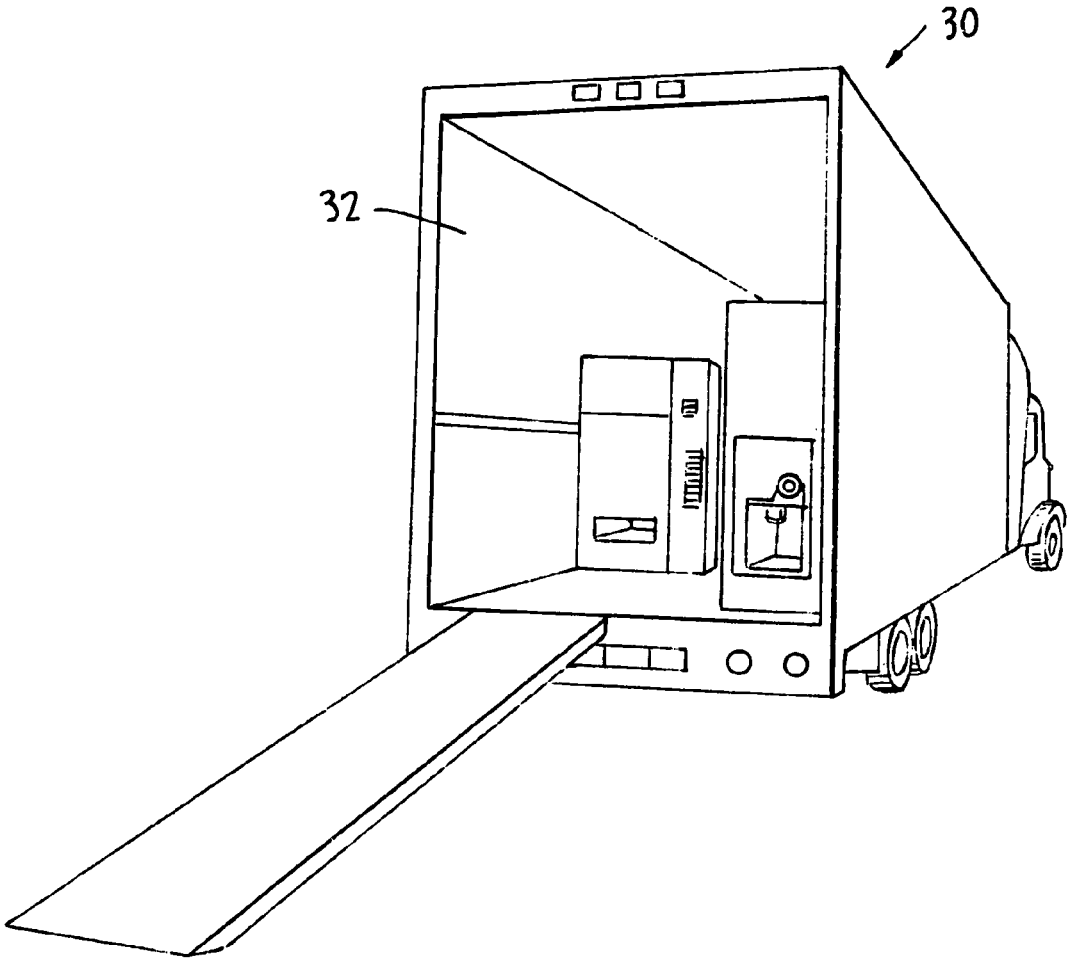
FIGS. 14-15 illustrate an embodiment of a mobile dispensing apparatus of the present invention.
Figure 15:
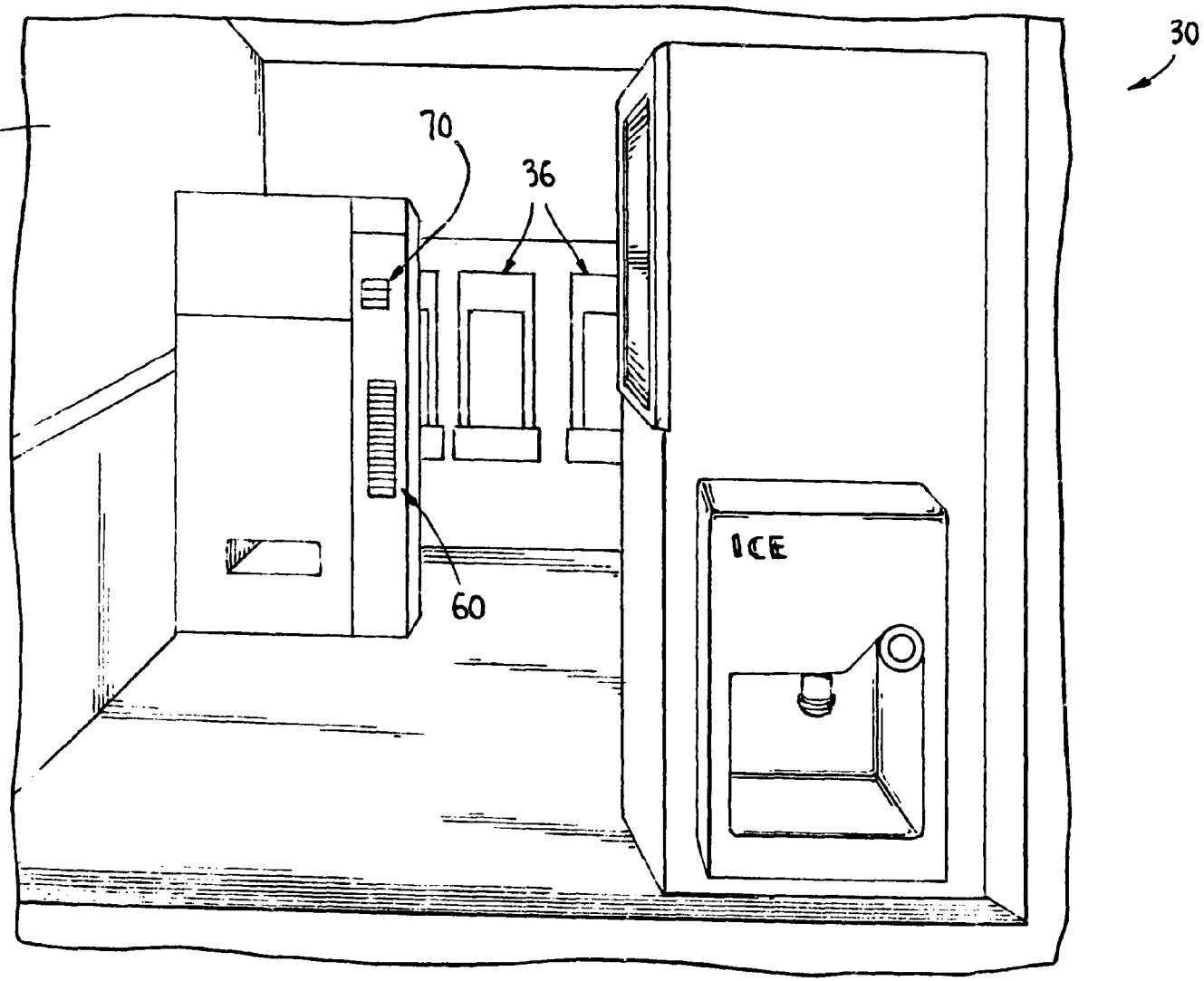

For example, a car can drive up the dispensing apparatus system 30 to obtain the product. The dispensing apparatus system 30 may be stationary in a building or mobile in a mobile housing unit, such as a trailer, such as shown in FIGS. 14 and 15. The dispensing apparatus system 30 is preferably fully automated and, as such, will be available to a user 24 hours a day and be on demand.

The dispensing apparatus system 30 may provide a large quantity of bottled water to a customer at any time on demand. The dispensing apparatus system 30 may also provide a profit to a supplier by providing a price break over buying bottled water from a retail system because of the volume and the automated nature of the system. The dispensing apparatus system 30 also provides convenience for the customer by being able to drive up to the system at any time and access a fully automated system and may be performed without any human assistance or presence. The system cycle is repetitive within a minimum amount of time.

As shown for example in FIGS. 1-4, bottles of water travel along the conveyor system 34 to the predetermined dispensing member 36. In one embodiment, the conveyor system 34 preferably includes a conveyor belt and a plurality of legs which may be of the same or different size and may be adjustable. Upon proper payment being recognized by the payment member 70, a predetermined number of bottles of water are dispensed from the storage area, along the conveyor system 34 and to the predetermined dispensing member 36. The selected bottled water remains in the body 40 of the dispensing member 36 until the door 42 of the dispensing member 36 opens and the customer removes the bottled water that was purchased. The door 42 of the selected dispensing member 36 then closes and the system 30 is ready for the next customer.

In one embodiment, the product may have to pass through an intermediate security door in the housing 32 before reaching the door 42 of the dispensing member 36.

FIGS. 6A-6E illustrate a circuit diagram of the operation of the dispensing apparatus system 30 of the present invention. When a customer selects a size of bottled water for purchase, a signal is sent to the appropriate conveyor belt 44. For example, the dispensing apparatus system 30 includes a conveyor belt 34 for each of the sizes of bottled water including, but not limited to, a 24 pack case conveyor belt, a 1 gallon conveyor belt, a 3 gallon conveyor belt, a 5 gallon conveyor belt and the like. When a selection is made by a customer to purchase a predetermined size of bottled water, a signal from the appropriate selection member is sent to the corresponding conveyor belt to signal activation of that conveyor belt. These selection members may include, but are not limited to, 24 pack case selection, 1 gallon selection, 3 gallon selection, 5 gallon selection or any other suitable selection. Also, a 1 gallon return, a 3 gallon return and/or a 5 gallon return may also be included in the selection members. Once the signal is sent to the corresponding predetermined conveyor belt in the storage area, the appropriate size bottled water is placed on that conveyor belt such as by gravity or any suitable mechanical mechanism. In another embodiment, the bottled water may be stored on the predetermined conveyor belt. The bottled water on the conveyor belt is then advanced.

For example, a 24 pack case of bottled water may be placed on the 24 pack case conveyor belt by gravity or any suitable means and the conveyor belt begins to run. another embodiment, a 24 pack case or cases may already be positioned on the conveyor belt and is advanced forward. The 24 pack case of bottled water is then transported along the conveyor belt to the door 42 of the dispensing member 36 which is closed. When the water product reaches the door 42 of the predetermined dispensing member 36 and all predetermined conditions are met, the door 42 of the predetermined dispensing member 36 opens and the water product advances through the door 42 of the predetermined dispensing member 36 for the customer. The water product is then ready for the customer to take with them. Not until all predetermined conditions are met, including payment being received, does the door 42 of the dispensing member 36 unlock and/or open so the bottle water may advance to an area where the bottled water product can be removed by the customer.

The above process occurs for each type and size of water product as indicated when the appropriate signal is sent from the predetermined selection member to the predetermined conveyor belt in the housing 32.

A similar process occurs for the return of empty bottles such as set forth above. For example, the door 50 on the return machine 38 is in a closed position until the appropriate signal is sent from the selection member. Upon receiving the appropriate signal, the door 50 of the return machine 38 opens. The empty bottle is then inserted into the body 48 of the return machine 38 and is held in place by the nozzle 52. A seal is then formed between the nozzle 52 and the neck of the bottle opening. The door 50 is then closed and a predetermined amount of air pressure for a predetermined amount of time is activated. The return machine 38 also reads a bar code which has been previously installed on the bottom of the bottle for identification purposes.

If the empty bottle passes the air pressure test and the bar code is read, the return machine 38 releases the bottle into a return holding area and also releases a token to the customer or sends a credit signal to the payment member. This token or credit may be used for a partial payment towards another bottle of water of the same or different size. If the empty bottle is accepted, the empty bottle is sent to the return area in, the housing 32. If the empty bottle is not accepted, the door 50 of the return machine 38 opens, the empty bottle is returned to the customer and no credit is given towards another purchase. In another embodiment, the customer may leave the unaccepted empty bottle at the dispensing apparatus system 30, but no credit is given towards another purchase.

FIGS. 7A-7E illustrate a circuit diagram for the operation for a 24 pack of bottled water being dispensed by the dispensing apparatus system 30 of the present invention. For example, the product may be placed by gravity or any suitable mechanical means on a conveyor belt if not already on the conveyor belt. The product then moves along the conveyor belt to a door of the dispensing member and into the product purchase area.

In operation of moving the 24 pack product from the storage area to the product purchase area in the dispensing member, various signals and/or indicators may be received and sent throughout the dispensing apparatus system 30. For example, these signals and/or indicators may include, but are not limited to, the following: product on gravity conveyor; automatic operation auto; product on gravity conveyor clear delay; product at security door; product at security door clear delay; product in purchase area; product in purchase area clear delay; product on gravity conveyor blocked delay; product moving into purchase area; product at security door with door closed; product on gravity conveyor okay to run belt; security door closed; product door closed; product vending; door open index product forward; okay to send product to purchase area open door; product in place stop belt; okay to close security door; security door closed cycle complete; 24 pack product selected open door; product in purchase area ready to vend; 24 pack product selection relay from machine; 24 pack product sold out; door open product ready to be removed; product door open; product clear close door; product in purchase area clear delay; product door closed; air valves security door open; air valves security door closed; air valves product door open; air valves product door closed; push button start; delay to activate product vend simulator; signal from machine 24 pack product selected; delay to drop out selection relays; 24 pack product selection relay from machine, and/or any other suitable signal or indicator.

Figure 8A:
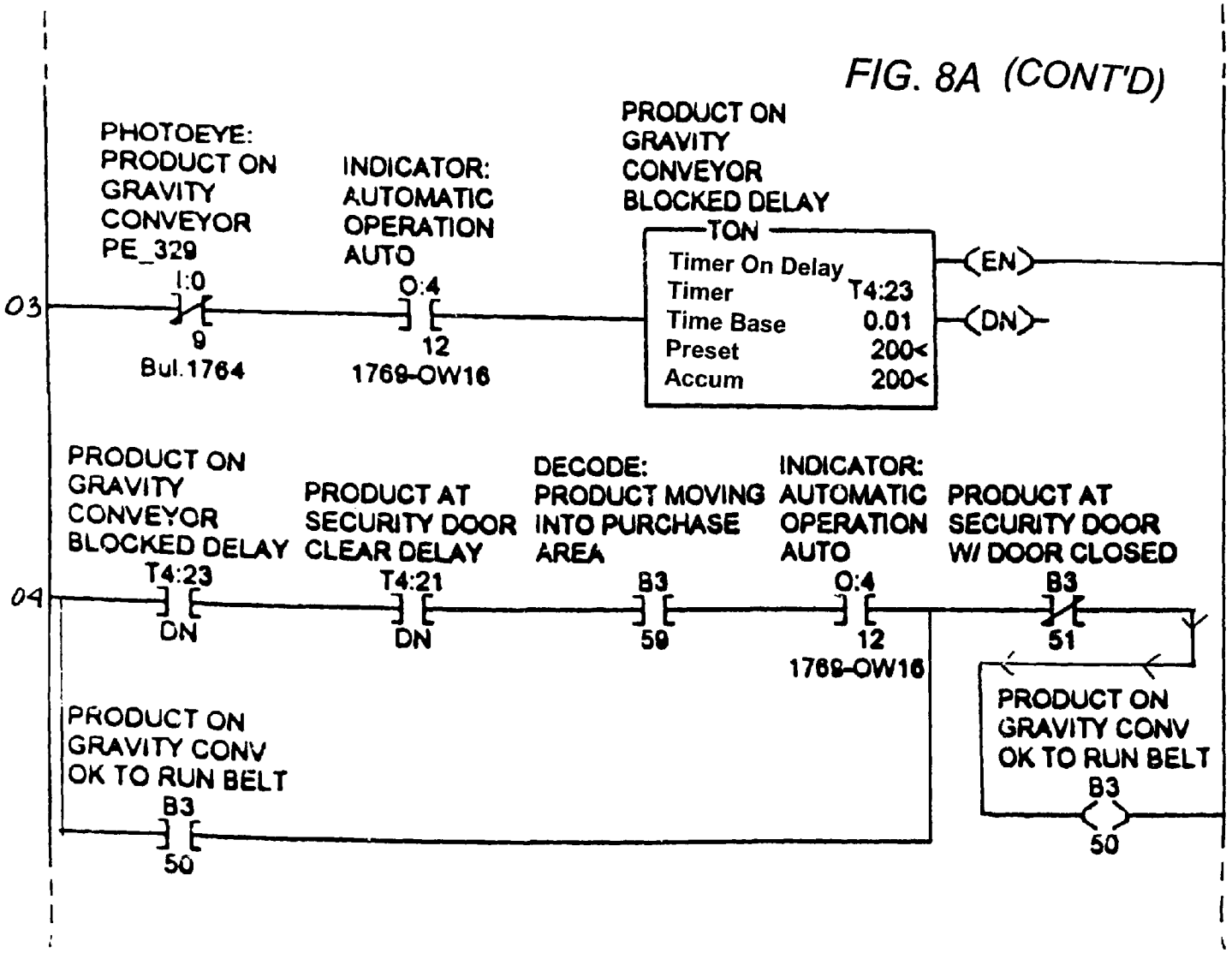
FIGS. 8A-8C illustrate a circuit diagram of a dispensing apparatus system for dispensing 1 gallon bottles.
Figure 8A:
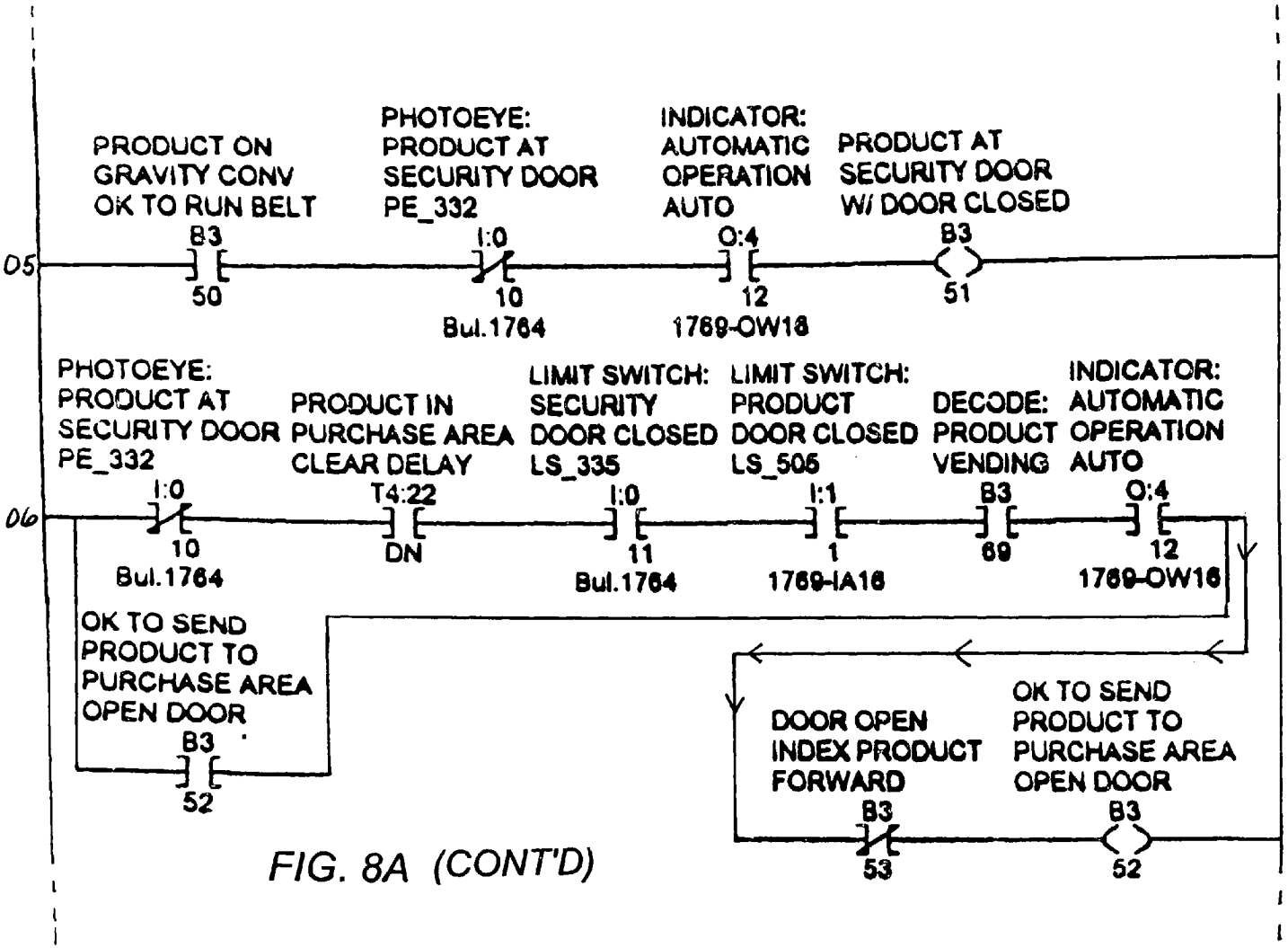
Figure 8A:
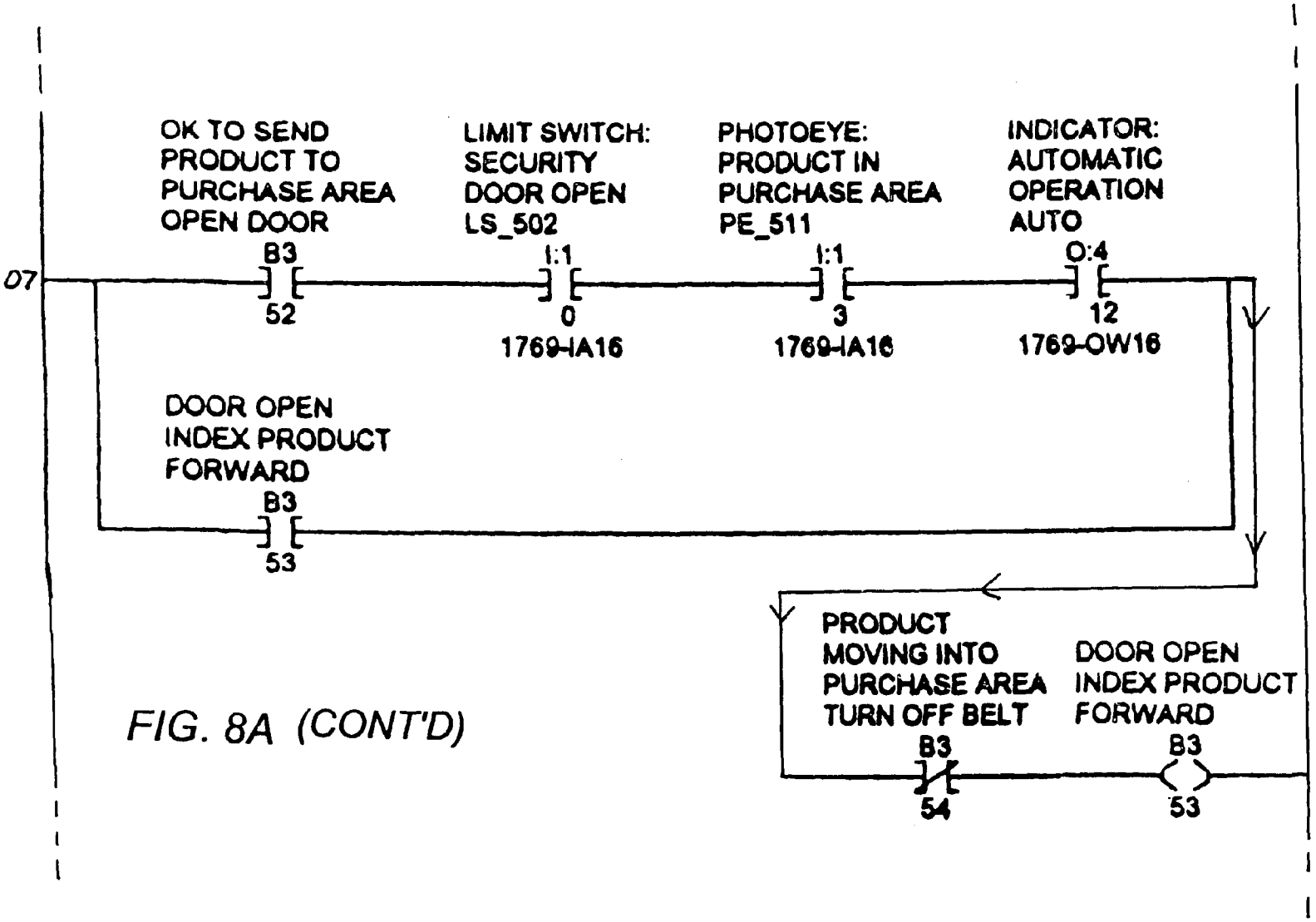
Figure 8A:
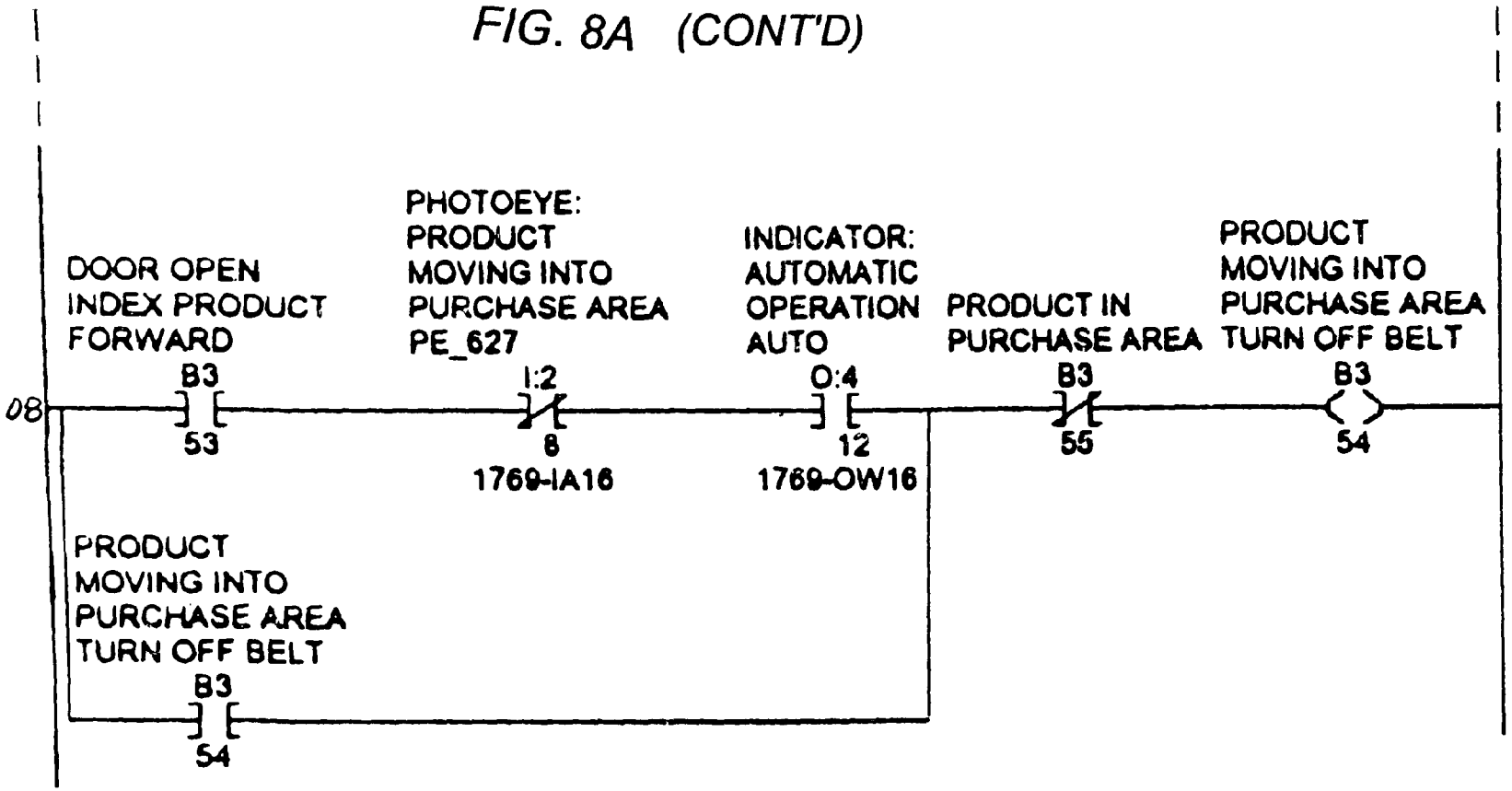
Figure 8B:
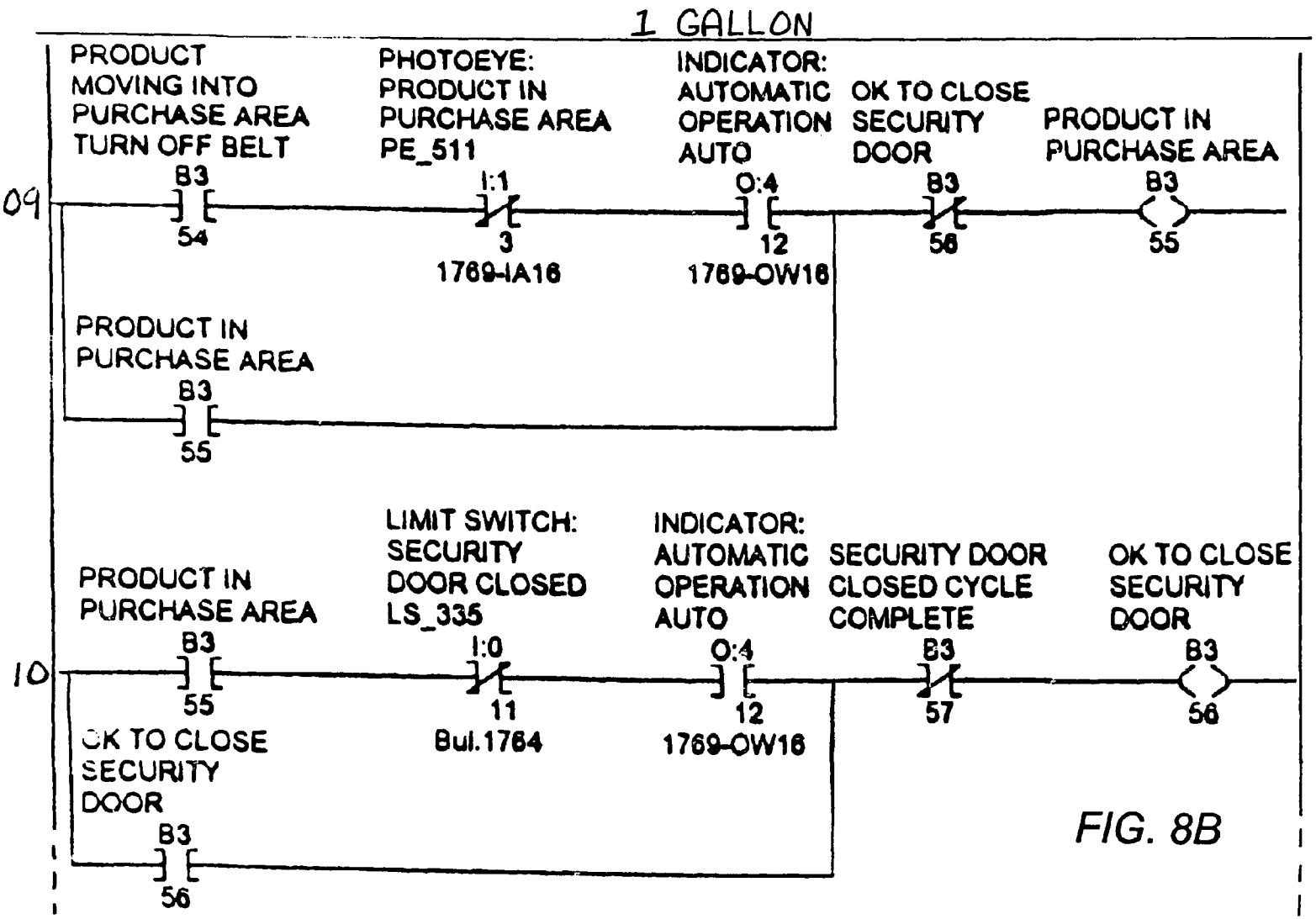
Figure 8B:
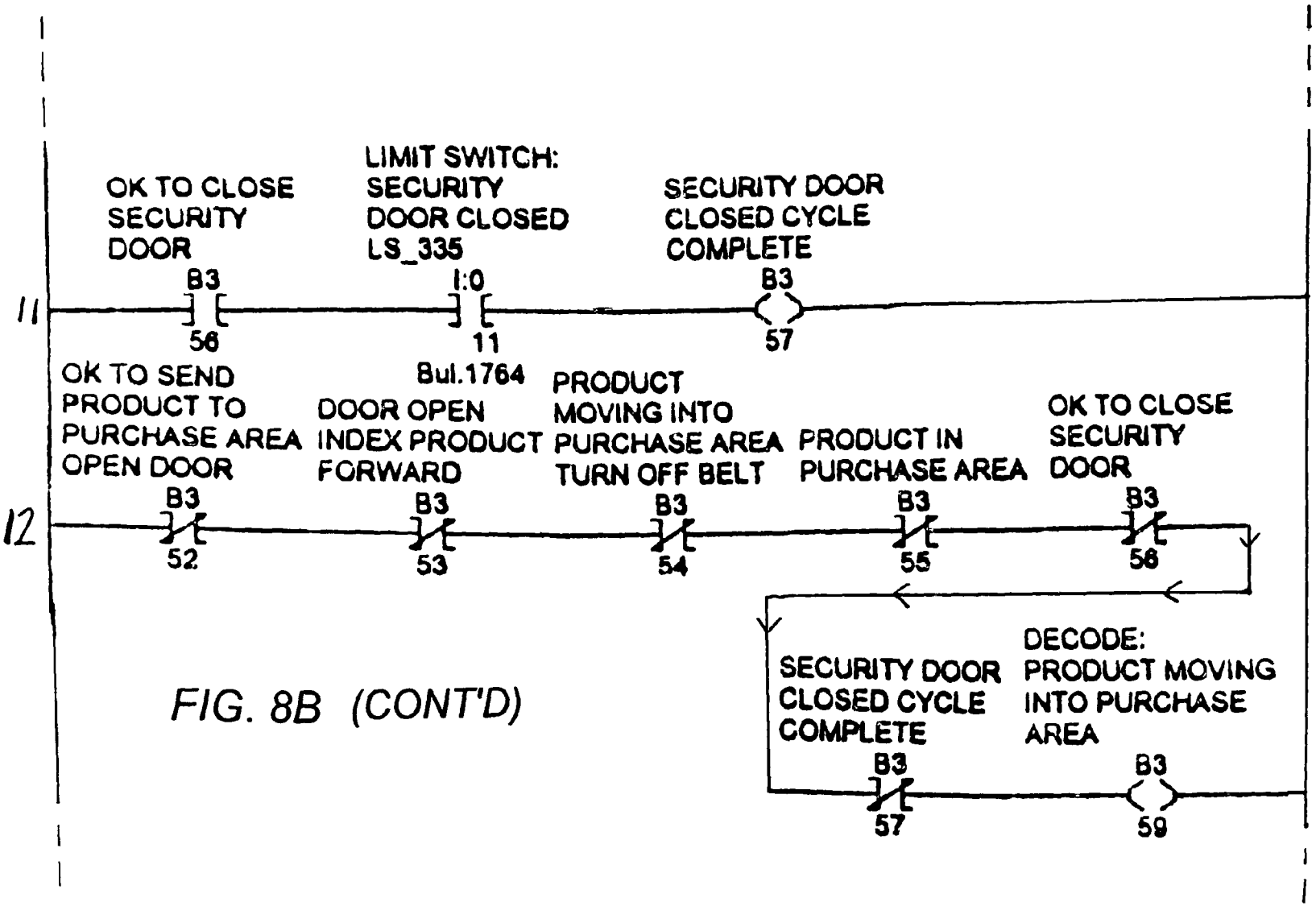
Figure 8B:
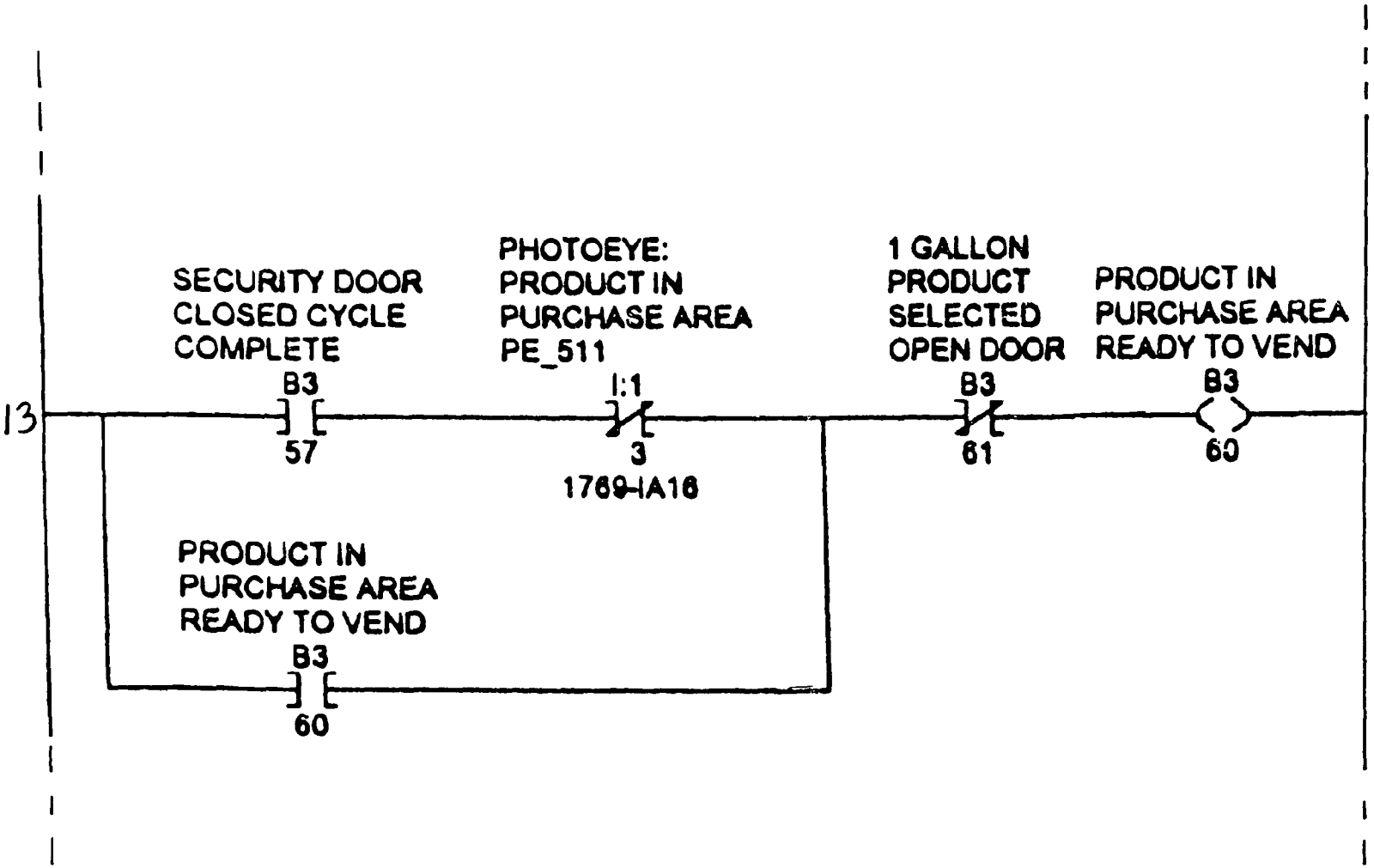
Figure 8B:
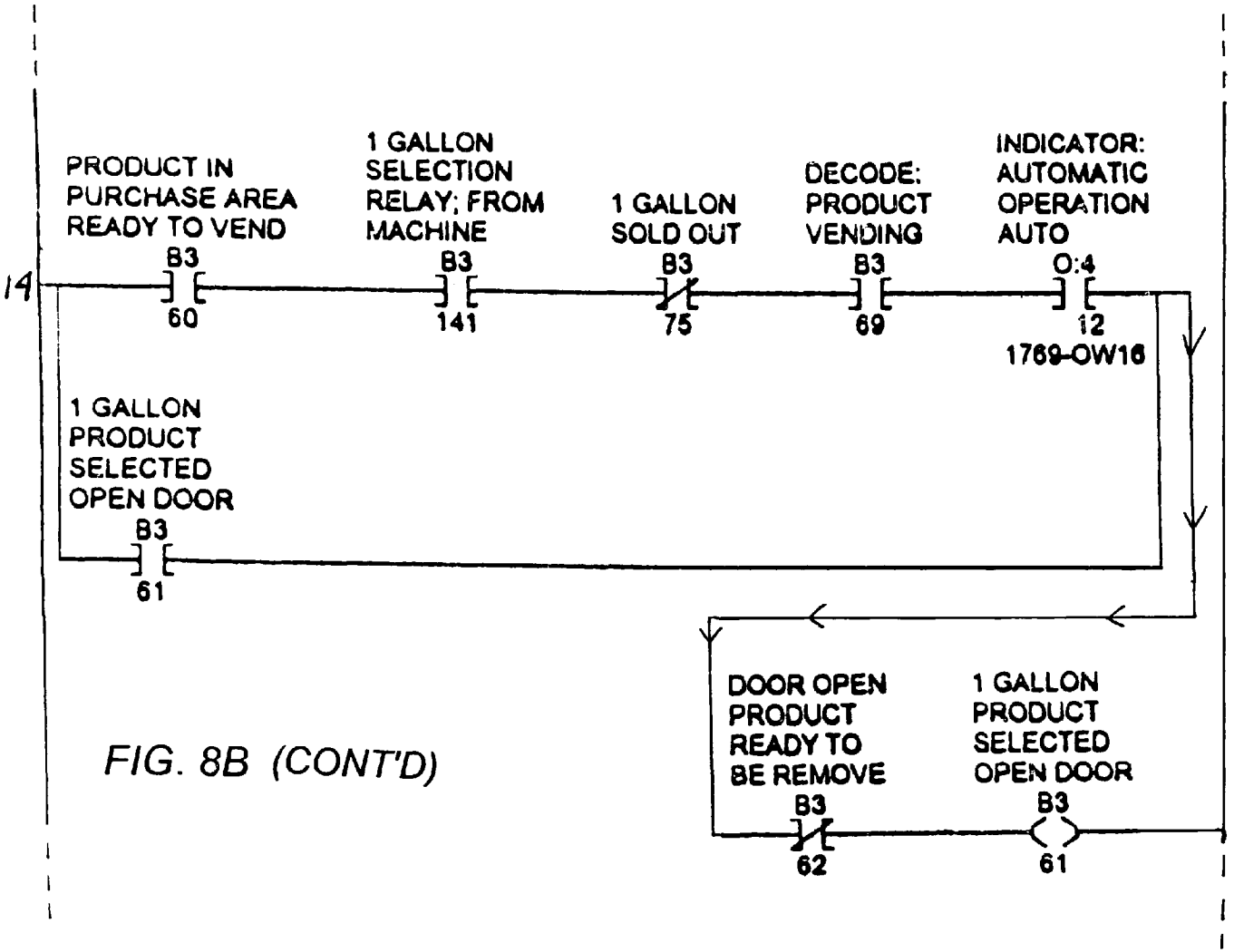
Figure 8B:
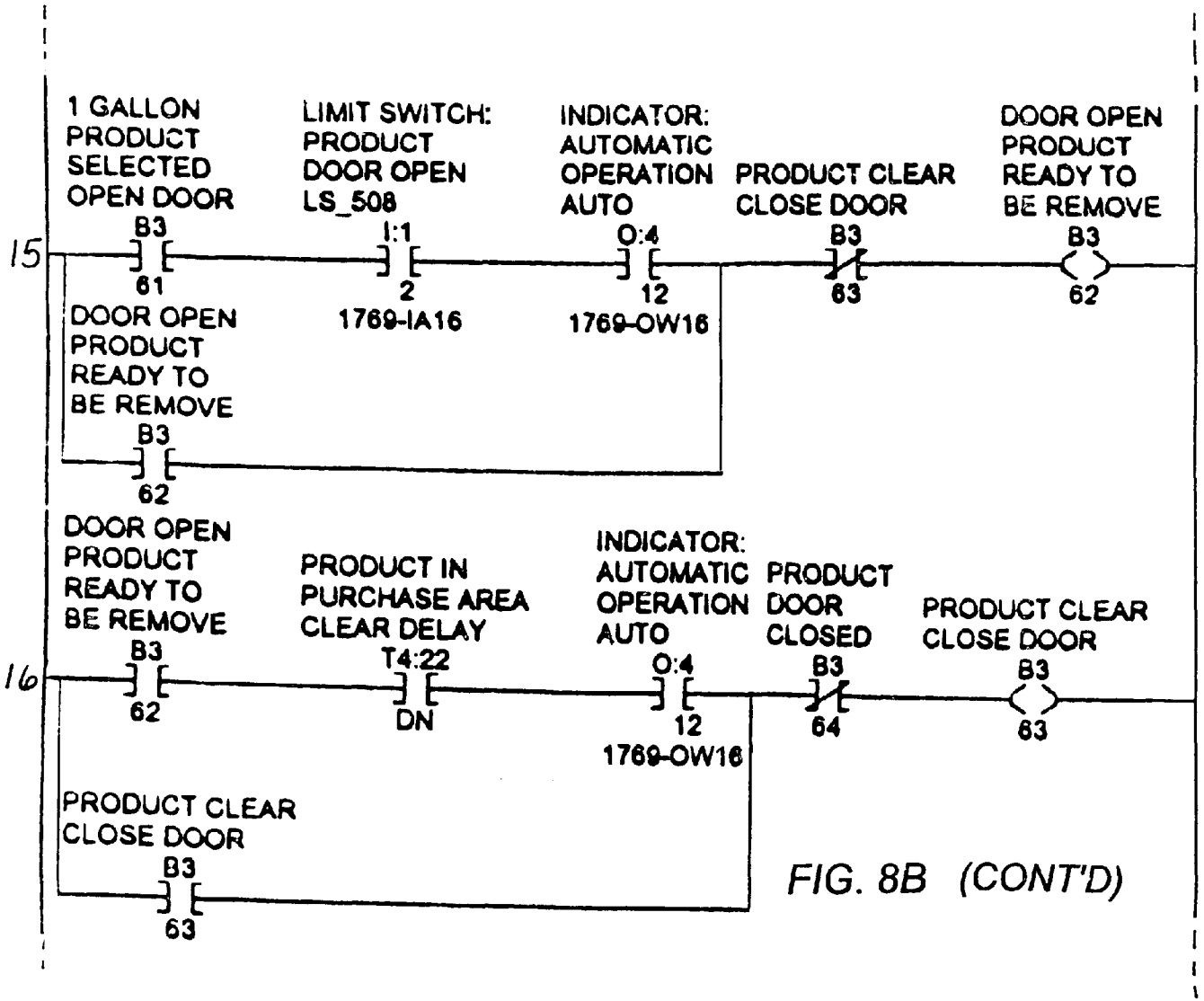
Figure 8B:
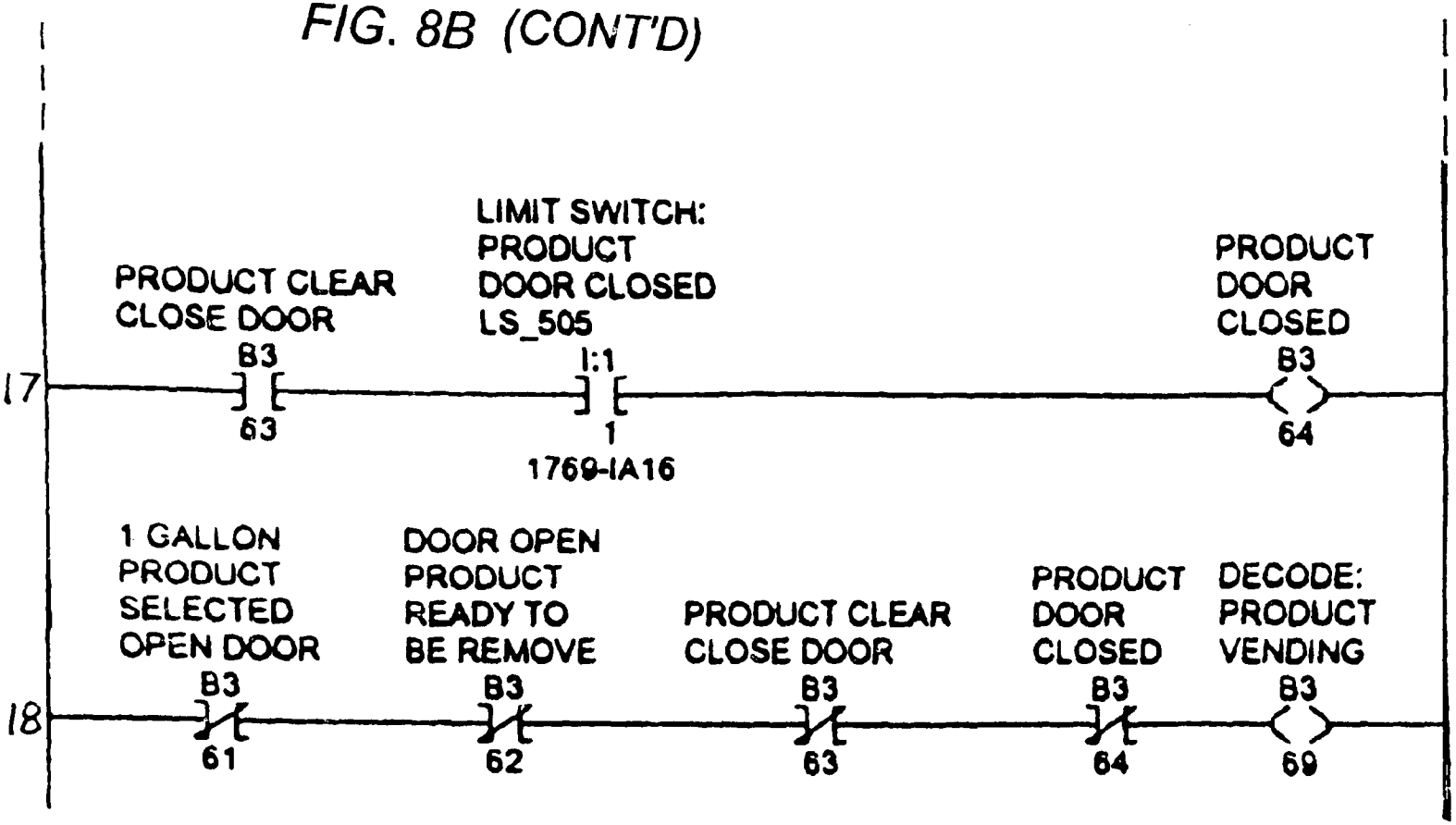
Figure 8C:
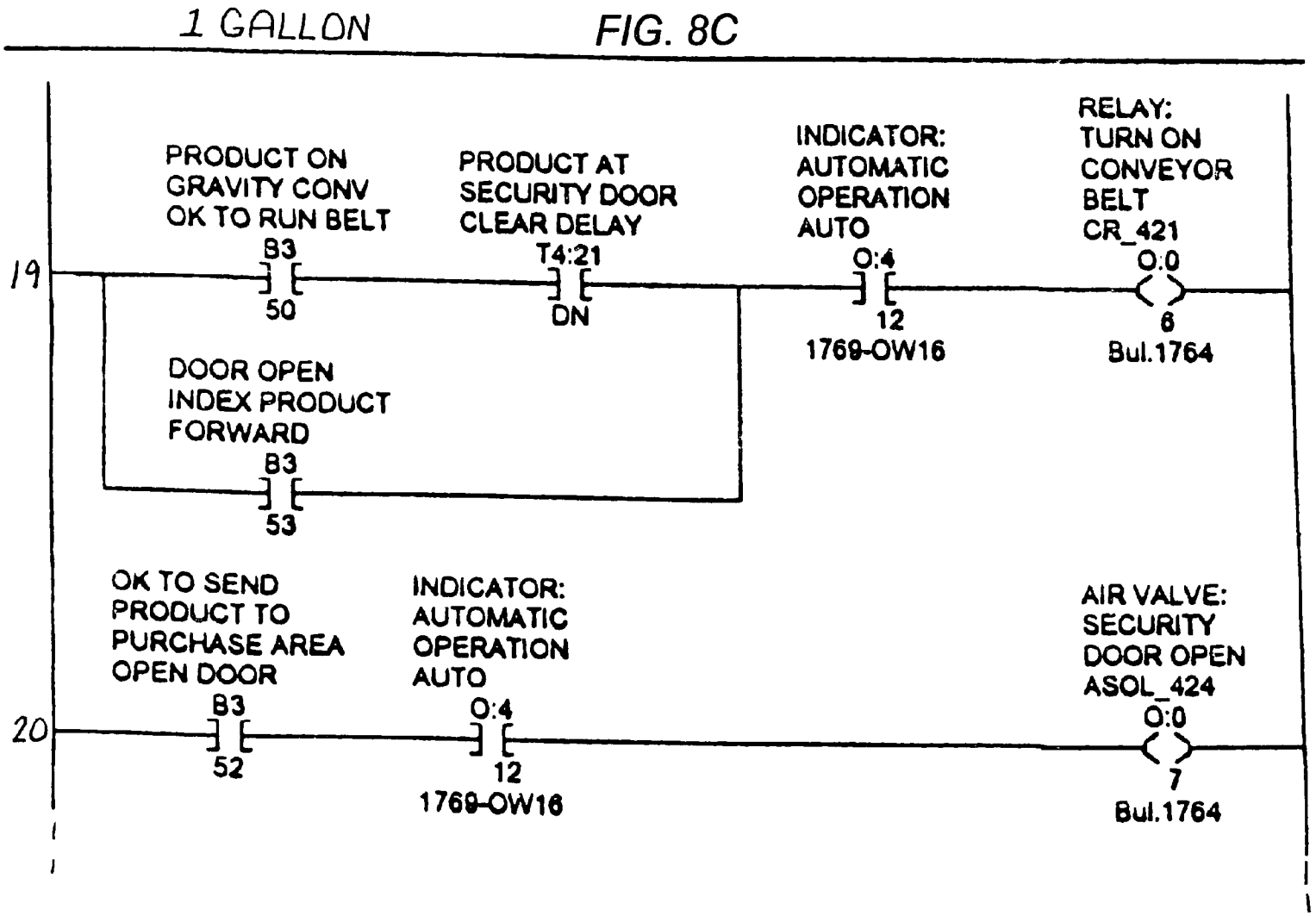
Figure 8C:
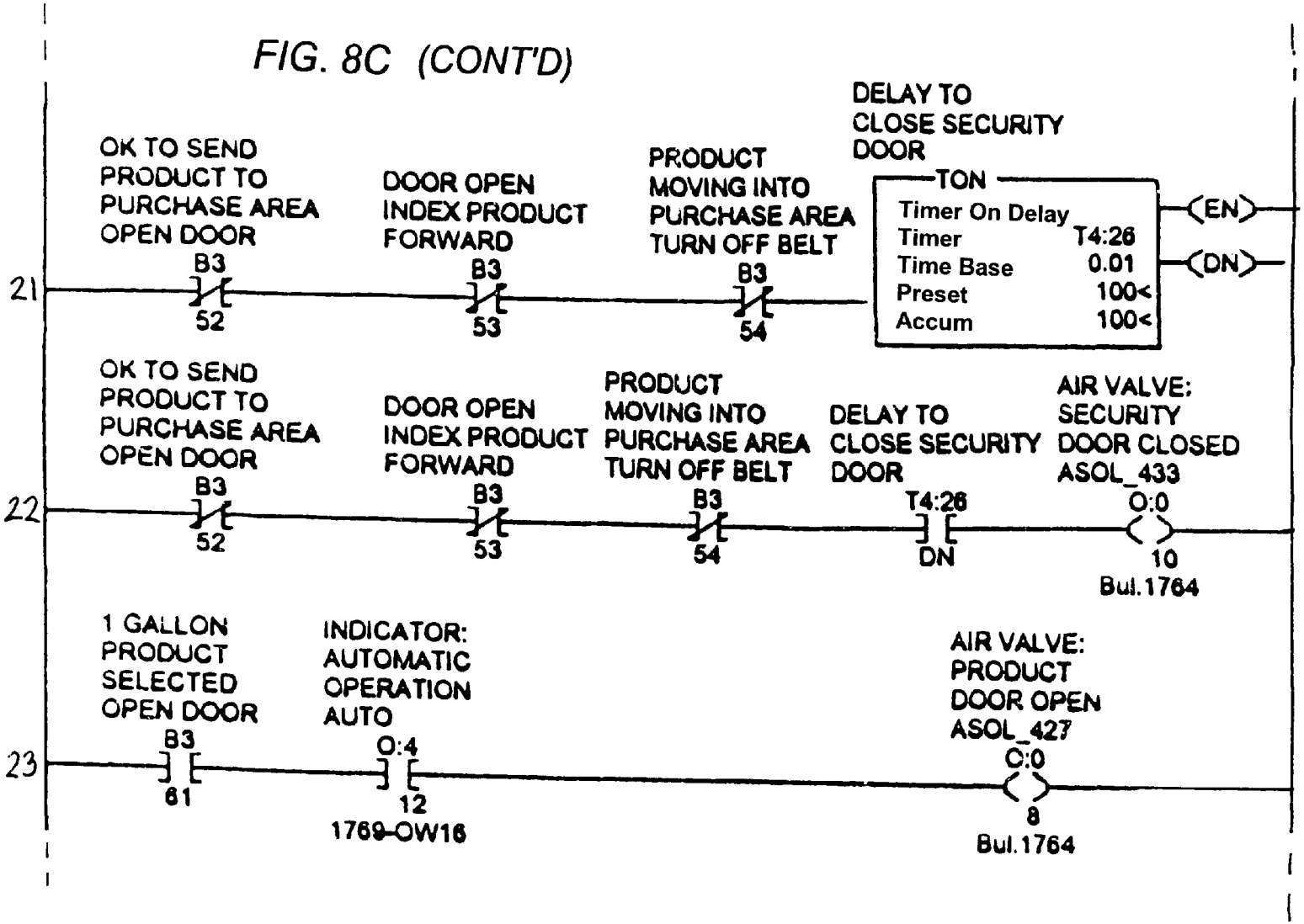
Figure 8C:
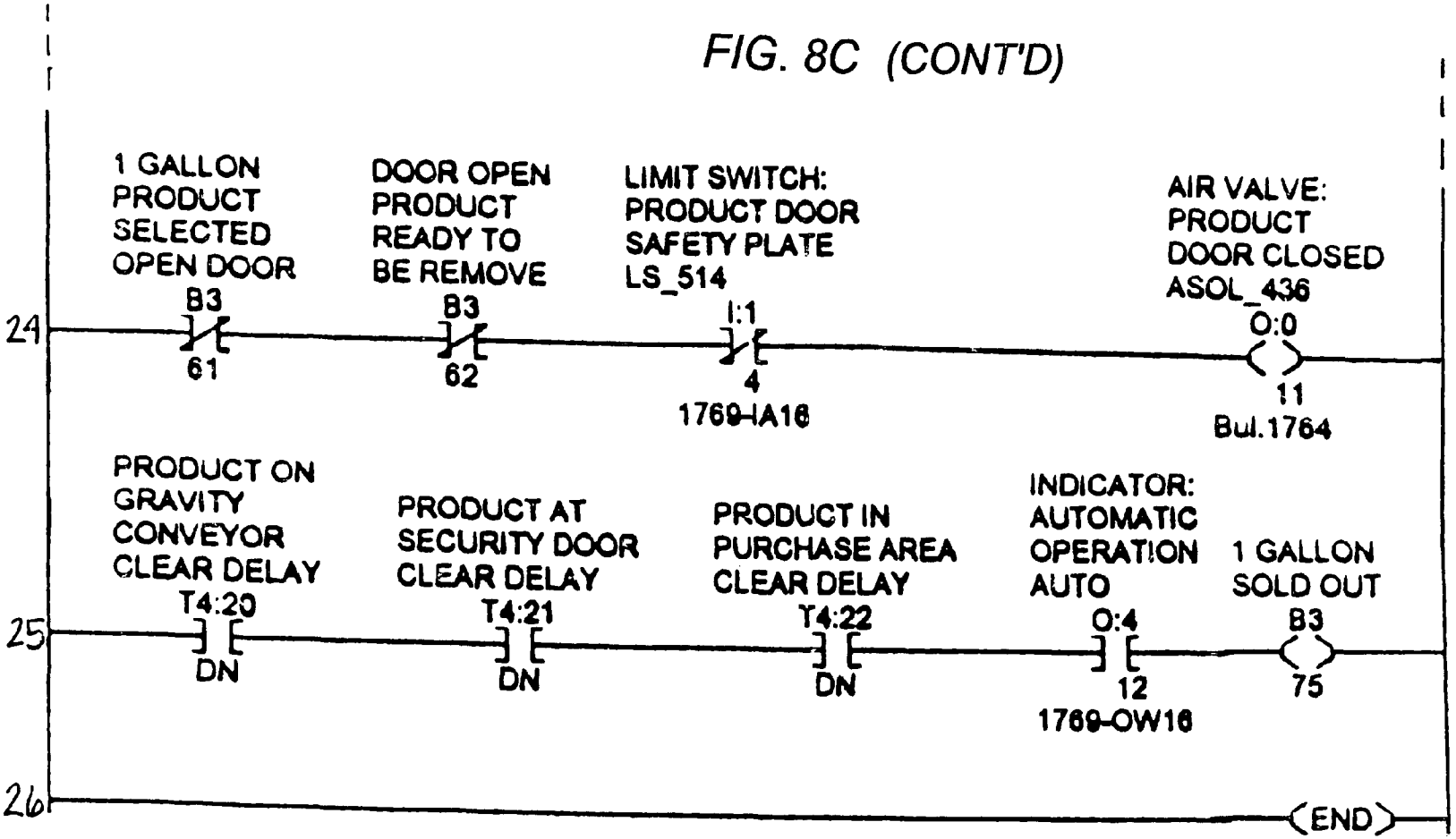

FIGS. 8A-8C illustrate a circuit diagram for the operation for dispensing a one gallon water bottle by the dispensing apparatus system 30 of the present invention. For example, the product may be placed by gravity or any suitable mechanical means on a conveyor belt if not already on the conveyor belt. The product then moves along the conveyor belt to a door of the dispensing member and into the product purchase area.

In operation of moving the one gallon product from the storage area to the product purchase area in the dispensing member, various signals and/or indicators may be received and sent throughout the dispensing apparatus system 30. For example, these signals and/or indicators may include, but are not limited to the following: product on gravity conveyor; automatic operation auto; product on gravity conveyor clear delay; product at security door; product at security door clear delay; product in purchase area; product in purchase area clear delay; product on gravity conveyor blocked delay; product moving into purchase area; product at security door with door closed; product on gravity conveyor okay to run belt; security door closed; product door closed; product vending; door open index product forward; okay to send product to purchase area open door; product in place stop belt; okay to close security door; security door closed cycle complete; one gallon product selected open door; product in purchase area ready to vend; one gallon product selection relay from machine; one gallon product sold out; door open product ready to be removed; product door open; product clear close door; product in purchase area clear delay; product door closed; air valves security door open; air valves security door closed; air valves product door open; air valves product door closed; push button start; delay to activate product vend simulator; signal from machine one gallon product selected; delay to drop out selection relays; one gallon product selection relay from machine, and/or any other suitable signal or indicator.

Figure 9A:
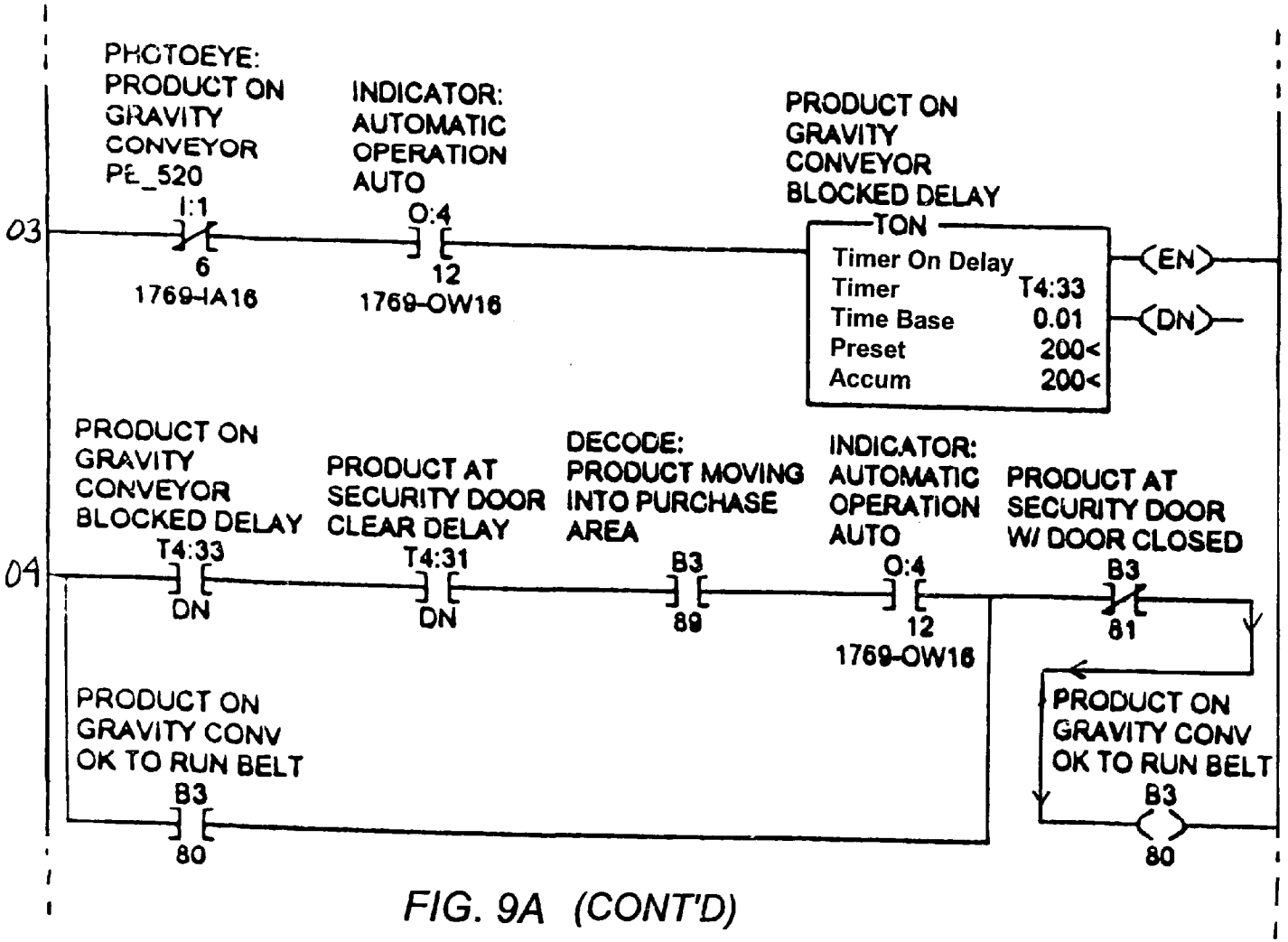
FIGS. 9A-9C illustrate a circuit diagram of a dispensing apparatus system of the present invention for dispensing 3 gallon bottles.
Figure 9A:
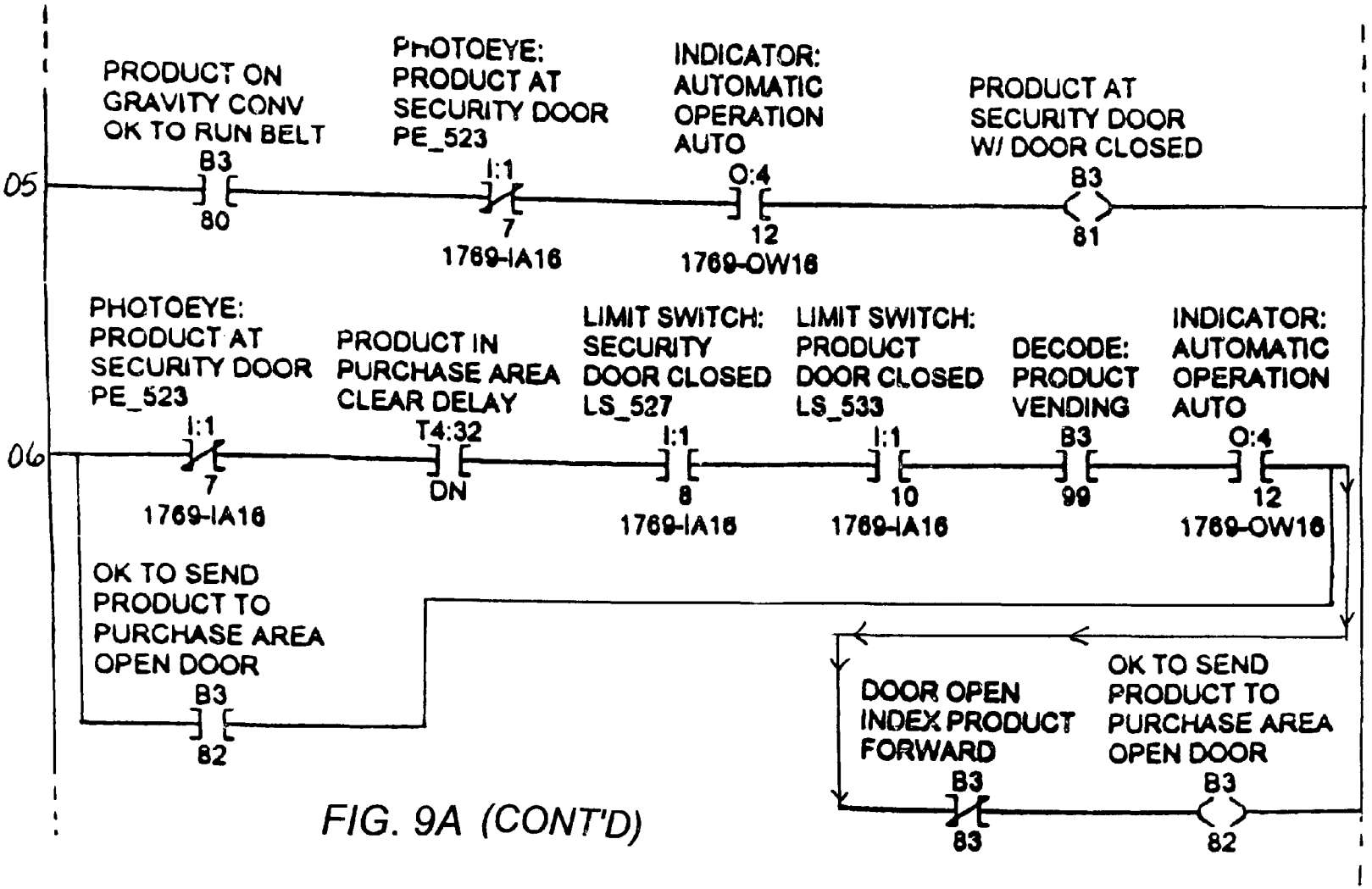
Figure 9A:
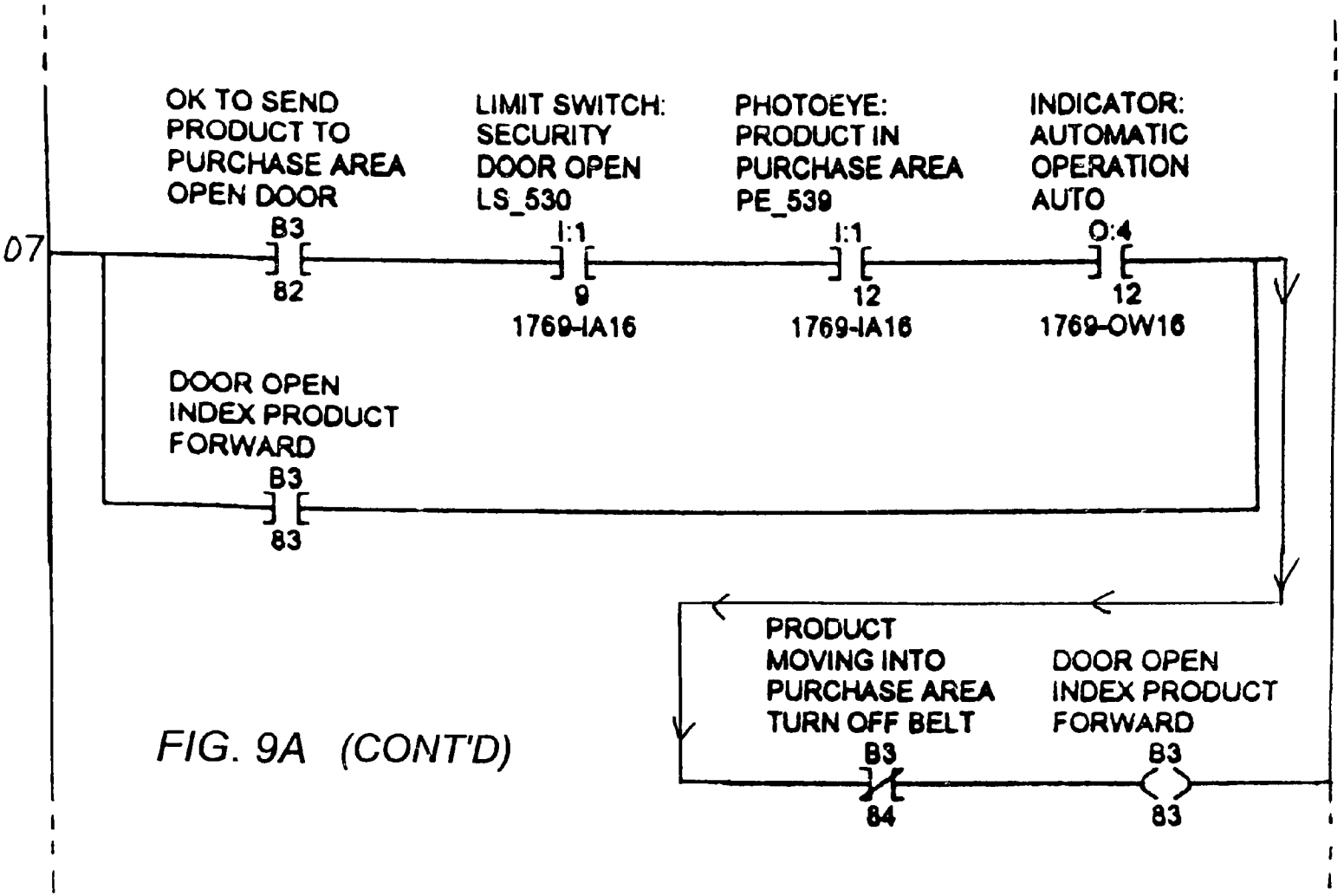
Figure 9A:
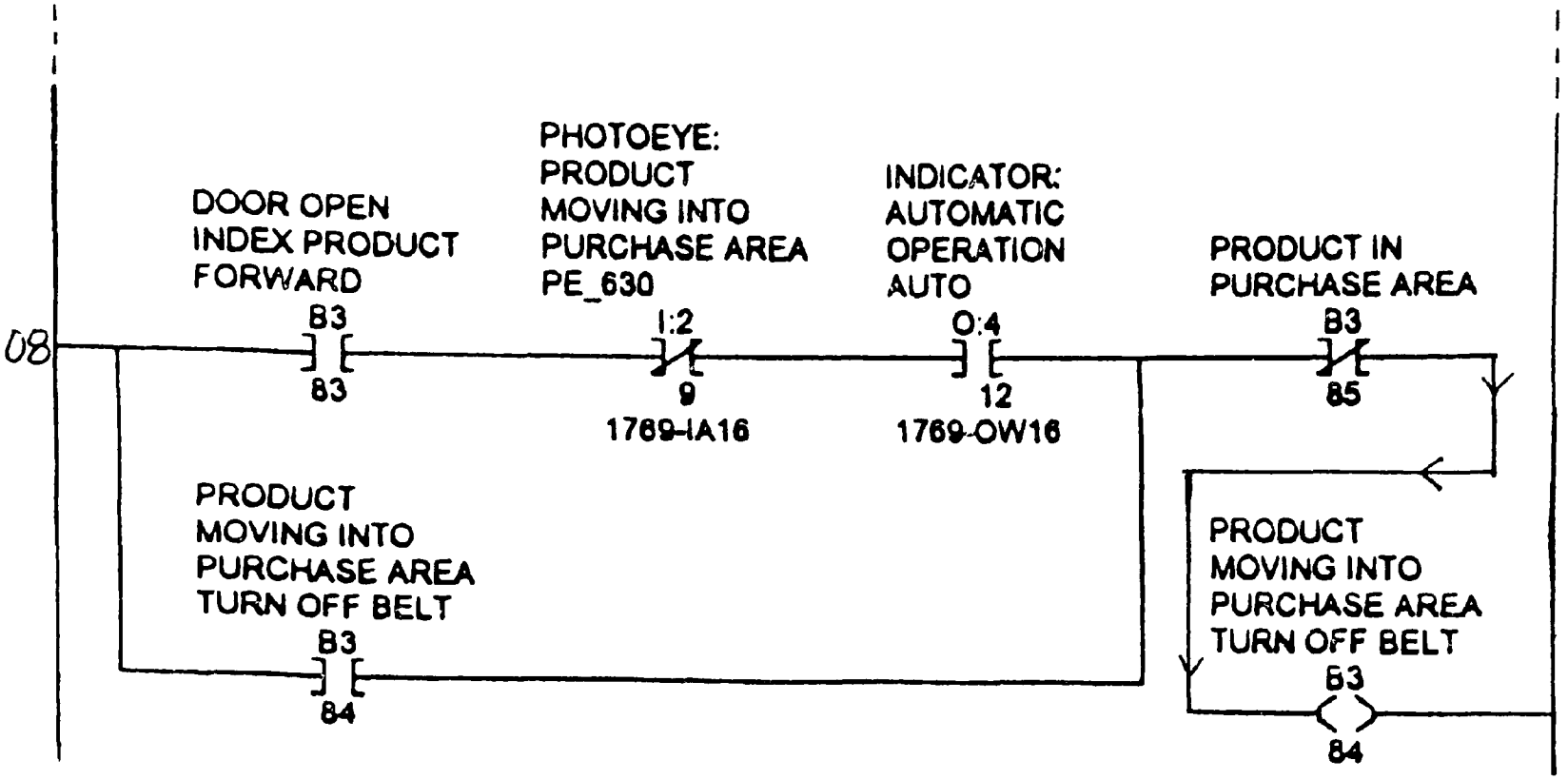
Figure 9B:
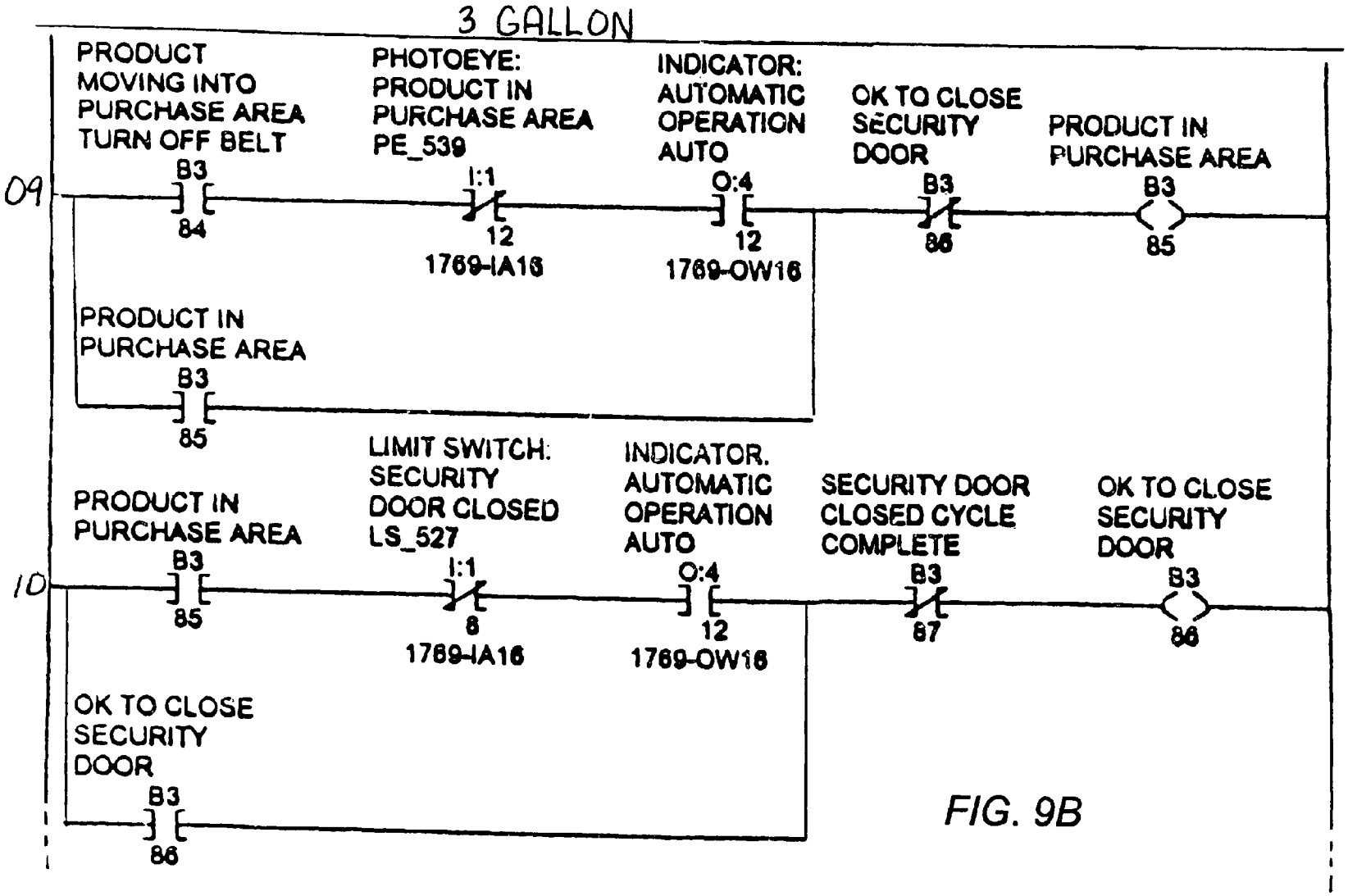
Figure 9B:
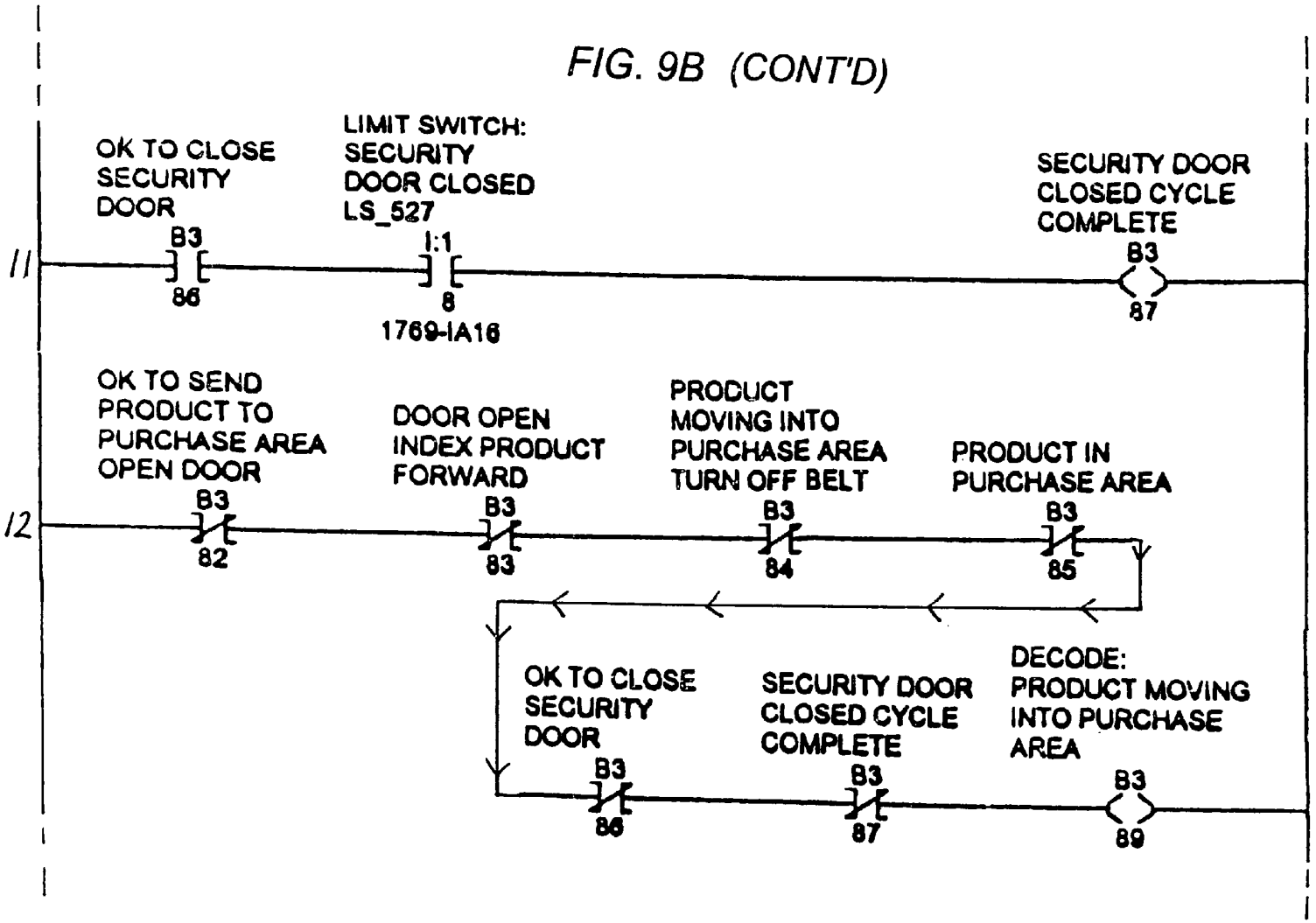
Figure 9B:
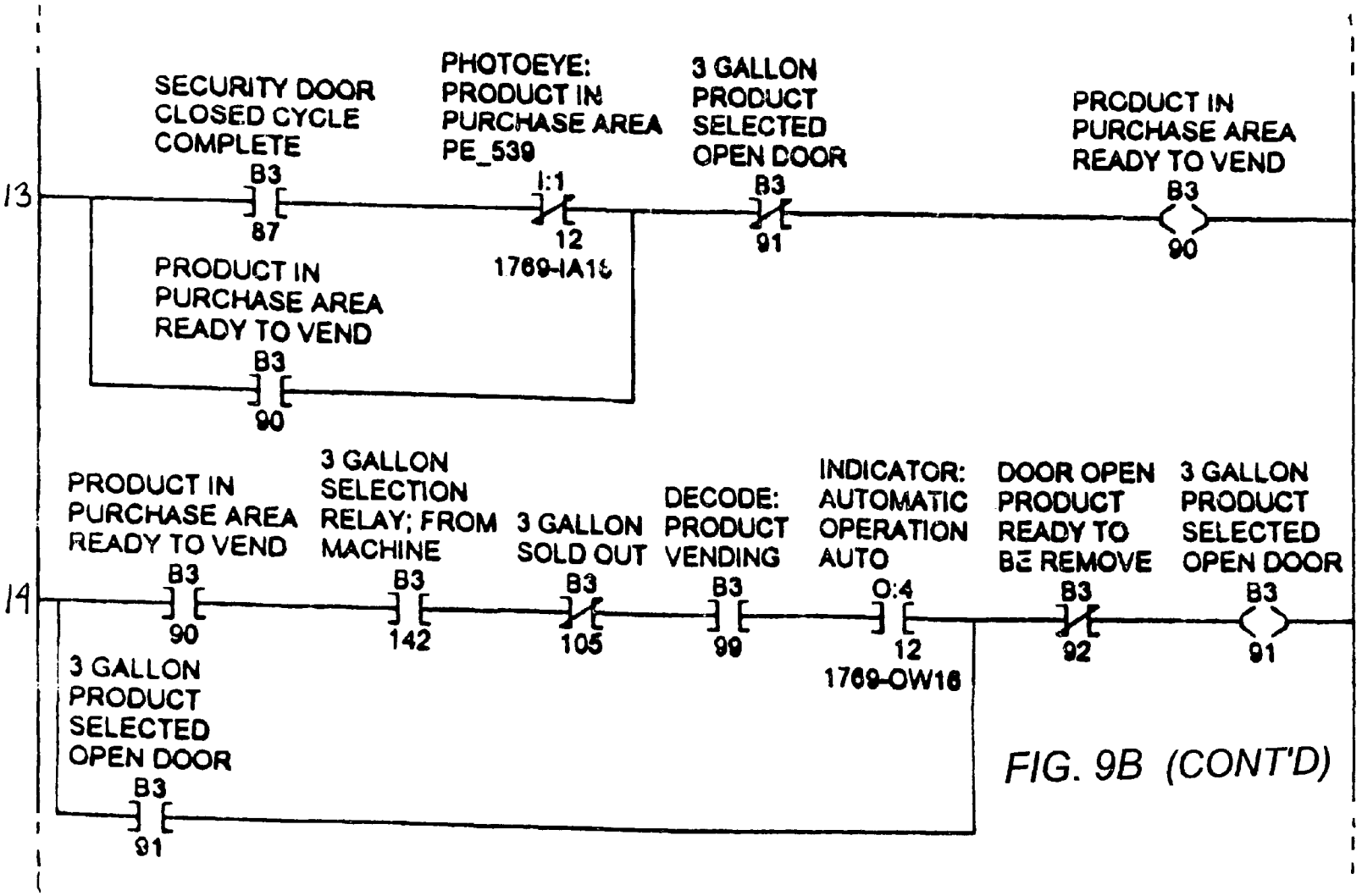
Figure 9B:
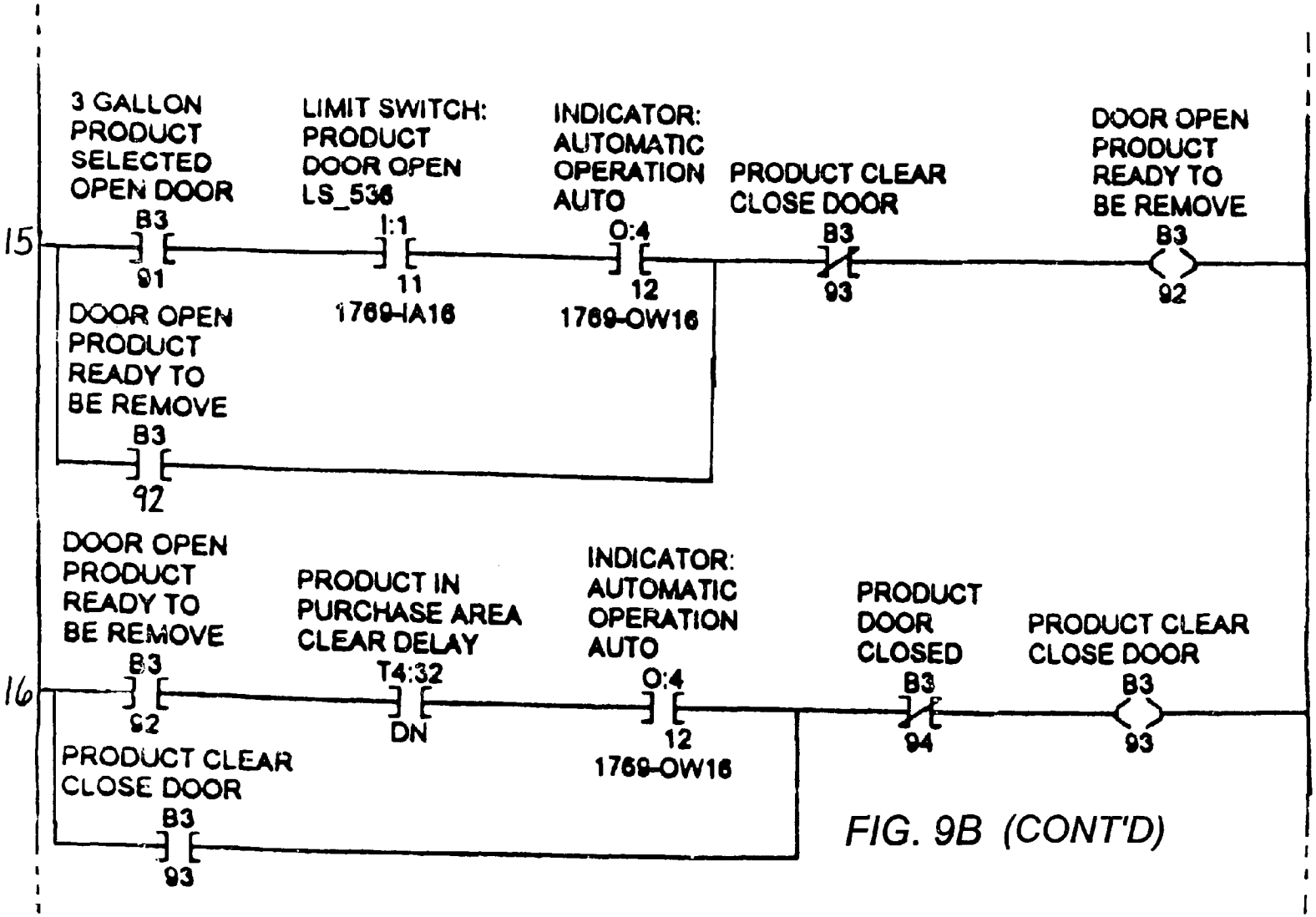
Figure 9B:
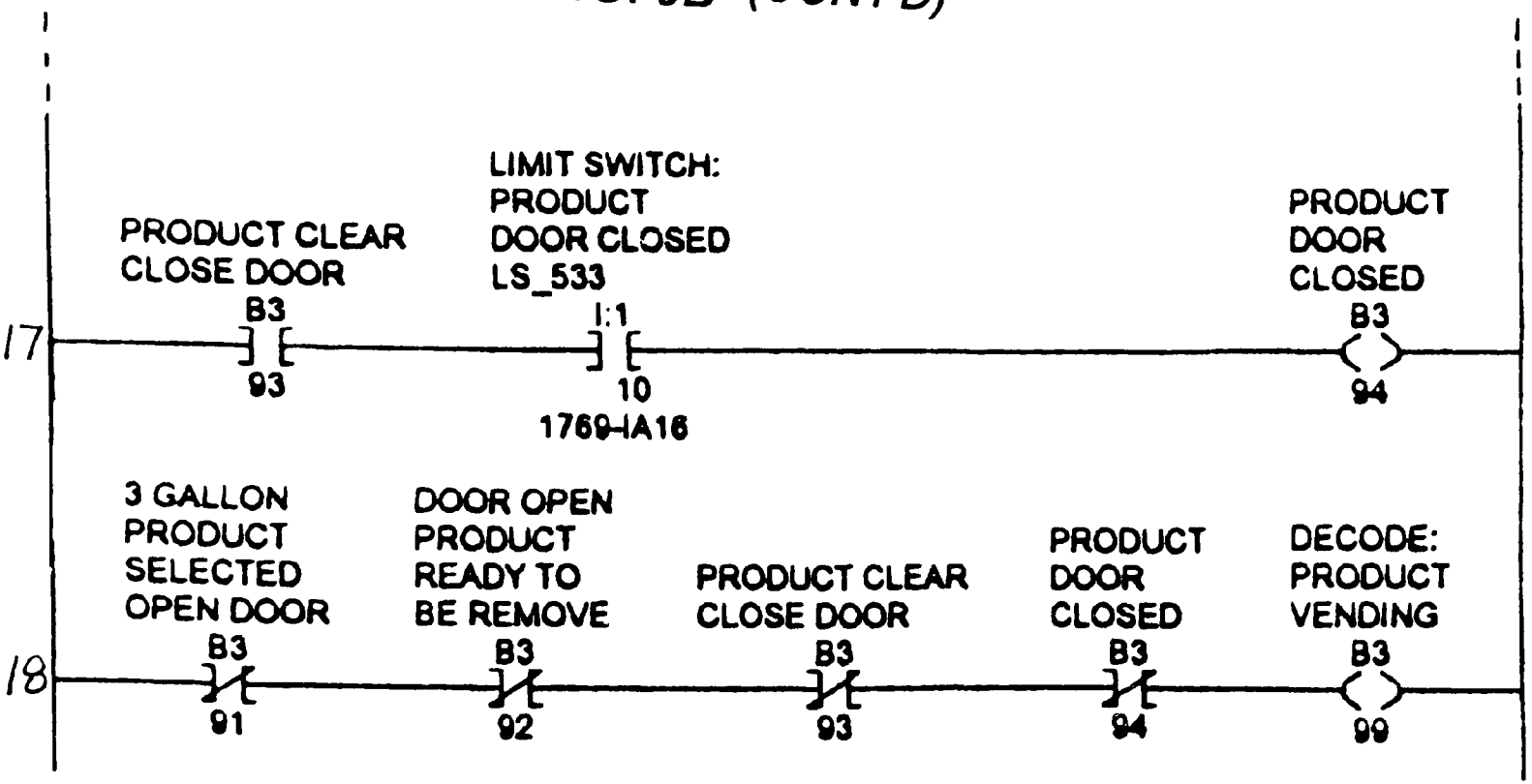
Figure 9C:
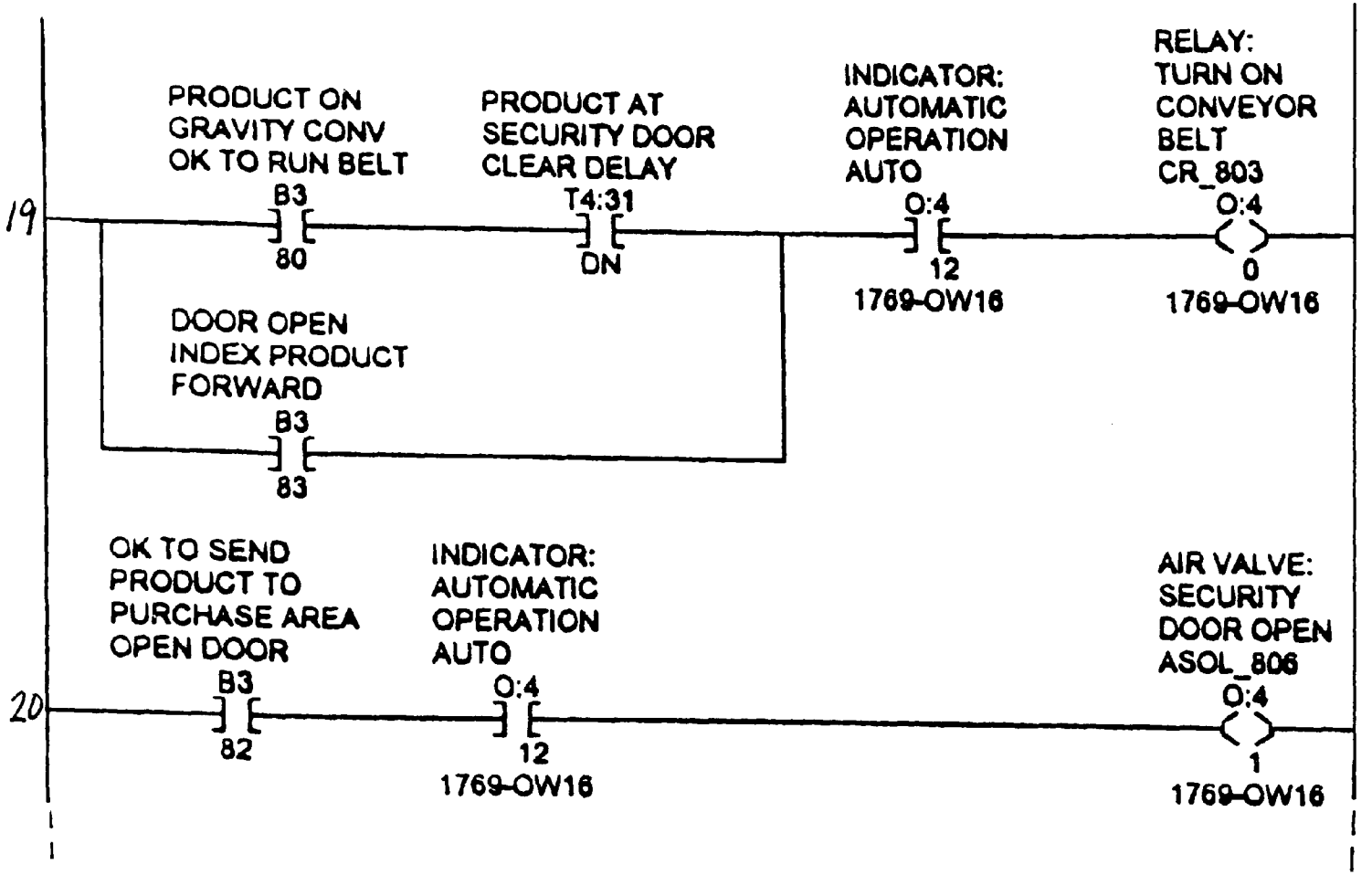
Figure 9C:
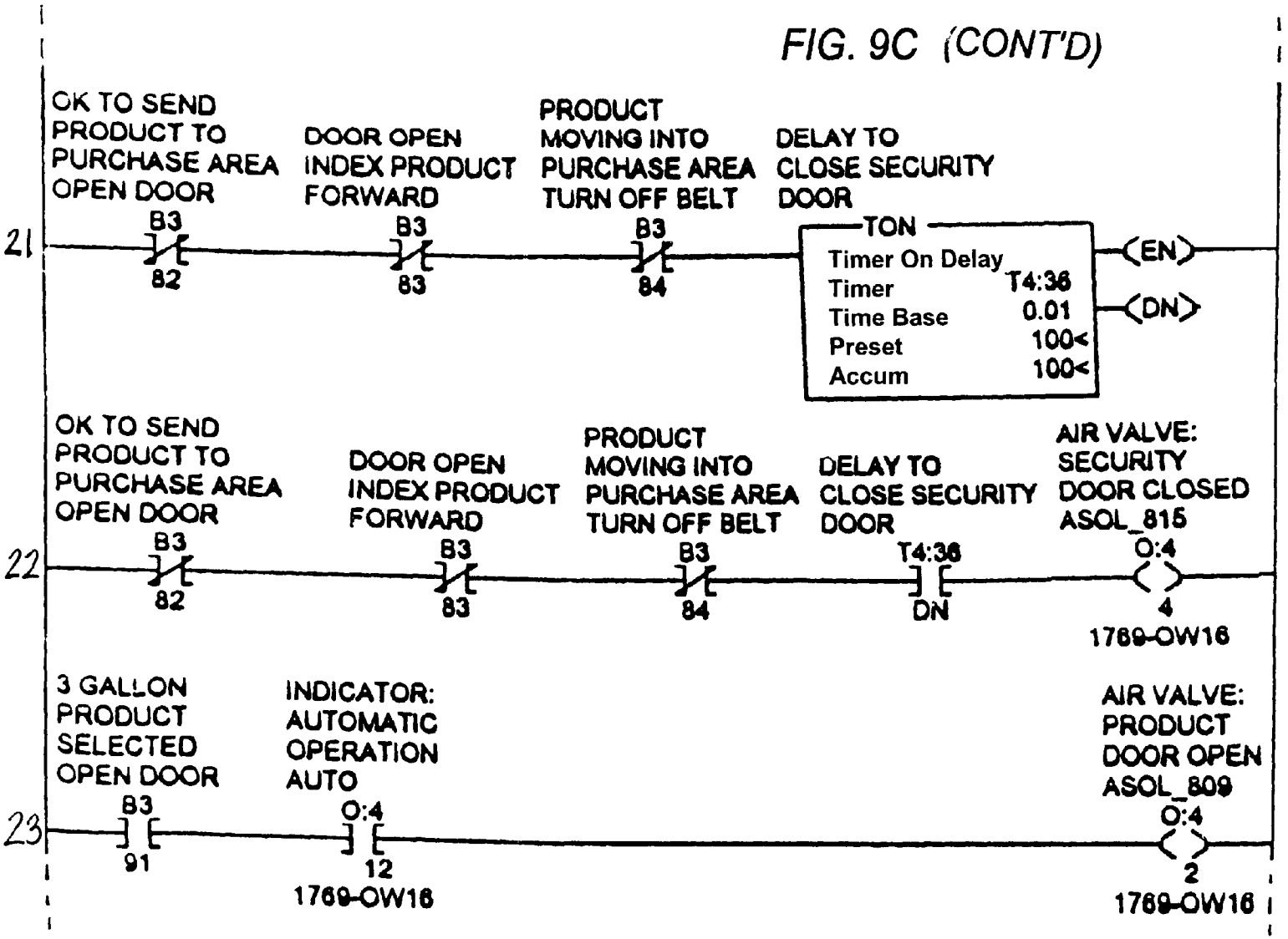
Figure 9C:
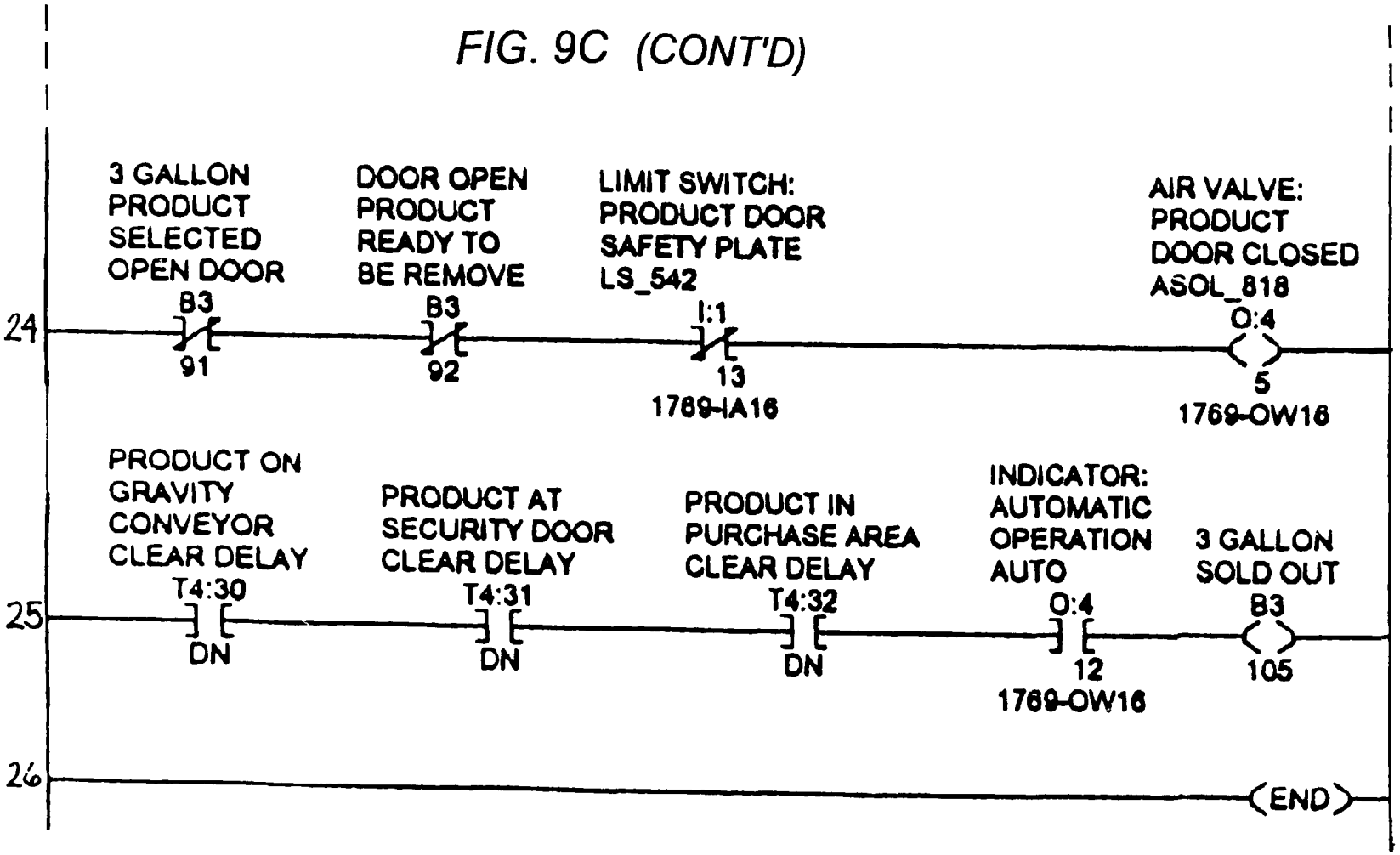

FIGS. 9A-9C illustrate a circuit diagram for the operation for dispensing a 3 gallon water bottle by the dispensing apparatus system 30 of the present invention. For example, the product is placed by gravity or mechanical means on a conveyor belt if not already on the conveyor belt. The product then moves along the conveyor belt to a door of the dispensing member and into the product purchase area.

In operation of moving the 3 gallon product from the storage area to the product purchase area in the dispensing member, various codes and/or signals may be received and sent throughout the dispensing apparatus system 30. For example, these signals and/or indicators may include, but are not limited to, the following: product on gravity conveyor; automatic operation auto; product on gravity conveyor clear delay; product at security door; product at security door clear delay; product in purchase area; product in purchase area clear delay; product on gravity conveyor blocked delay; product moving into purchase area; product at security door with door closed; product on gravity conveyor okay to run belt; security door closed; product door closed; product vending; door open index product forward; okay to send product to purchase area open door; product in place stop belt; okay to close security door; security door closed cycle complete; 3 gallon product selected open door; product in purchase area ready to vend; 3 gallon product selection relay from machine; 3 gallon product sold out; door open product ready to be removed; product door open; product clear close door; product in purchase area clear delay; product door closed; air valves security door open; air valves security door closed; air valves product door open; air valves product door closed; push button start; delay to activate product vend simulator; signal from 3 gallon product selected; delay to drop out selection relays; 3 gallon product selection relay from machine, and/or any other suitable signal or indicator.

Figure 10A:
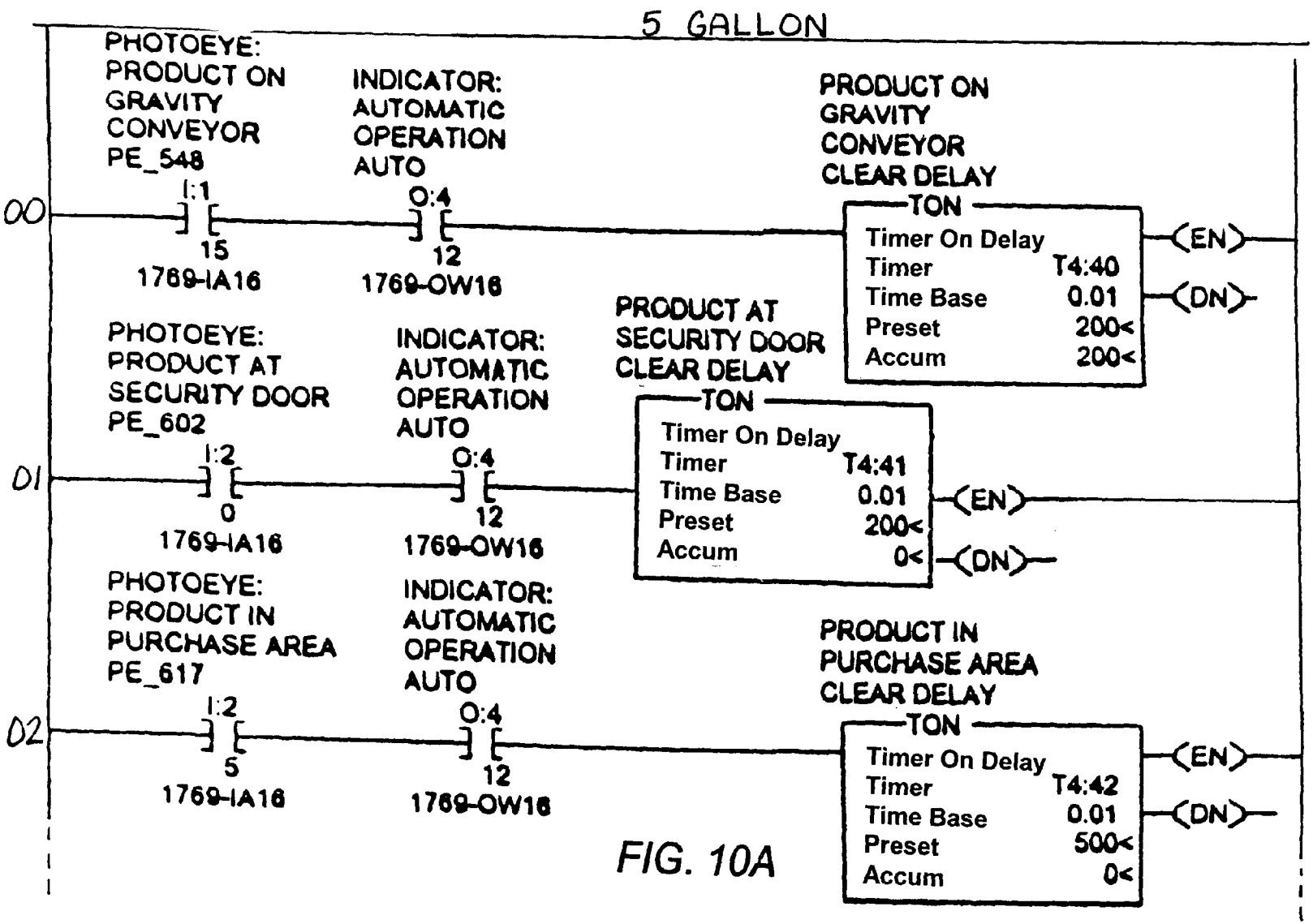
FIGS. 10A-10C illustrate a circuit diagram of a dispensing system apparatus of the present invention for dispensing 5 gallon bottles.
Figure 10A:
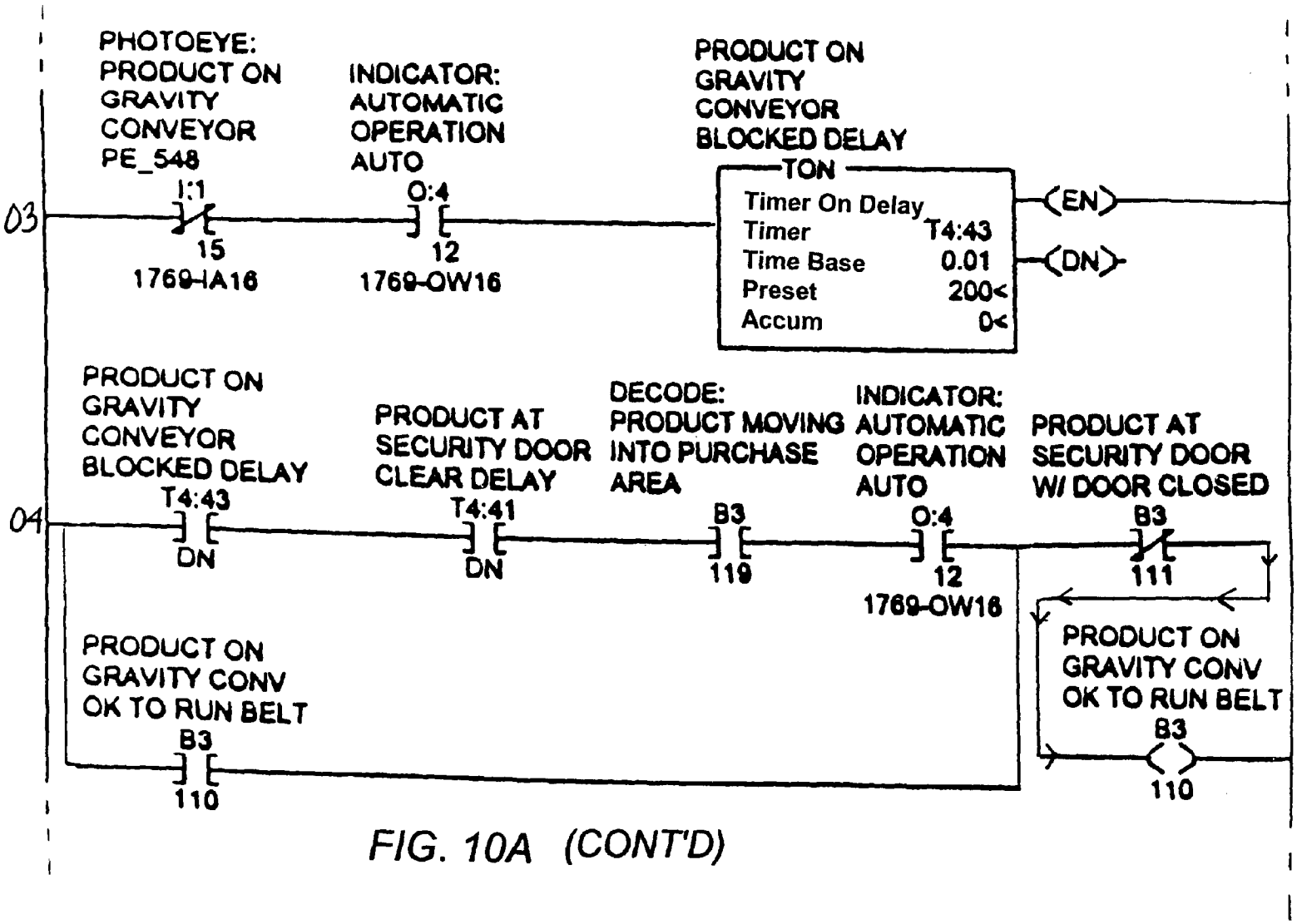
Figure 10A:
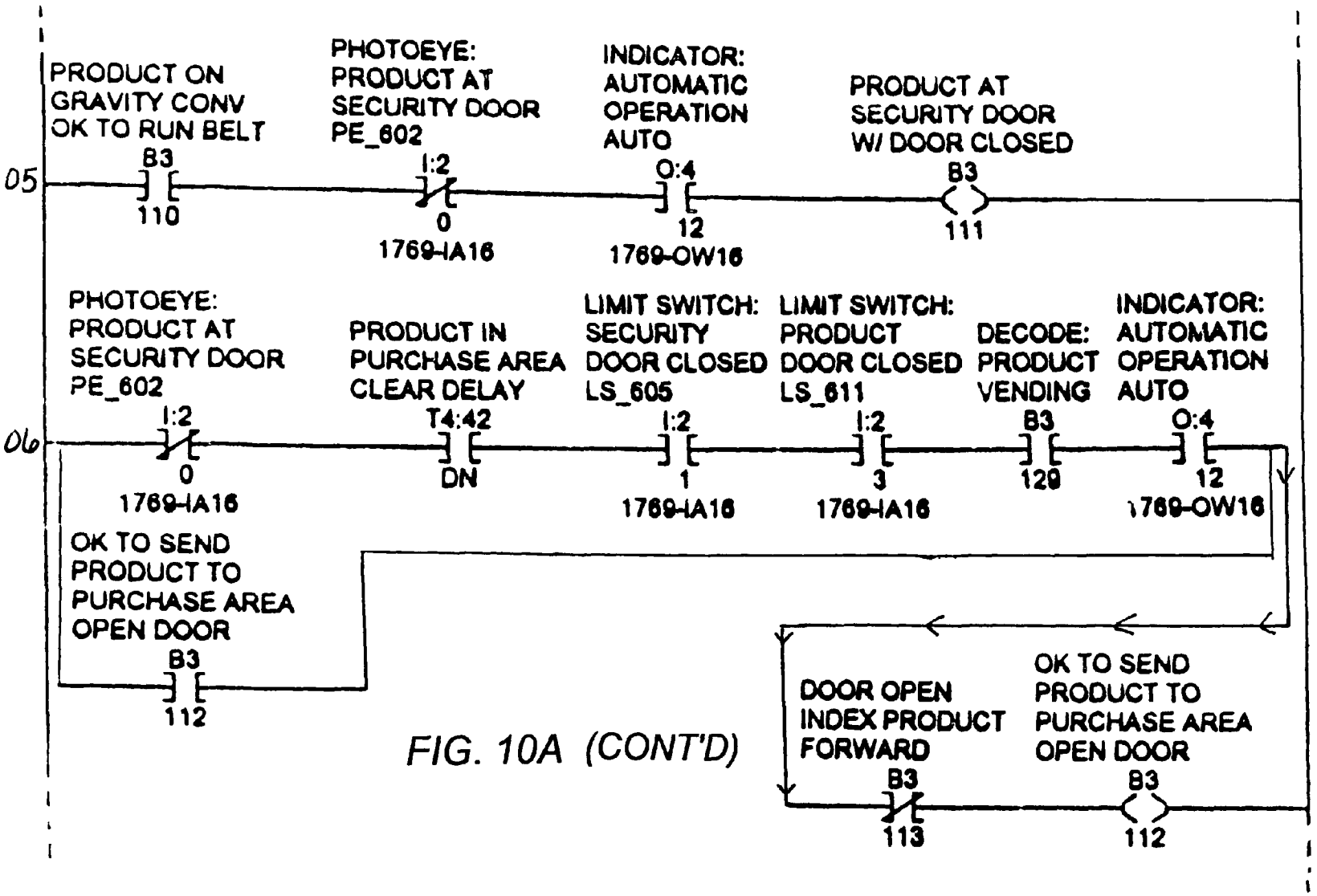
Figure 10A:
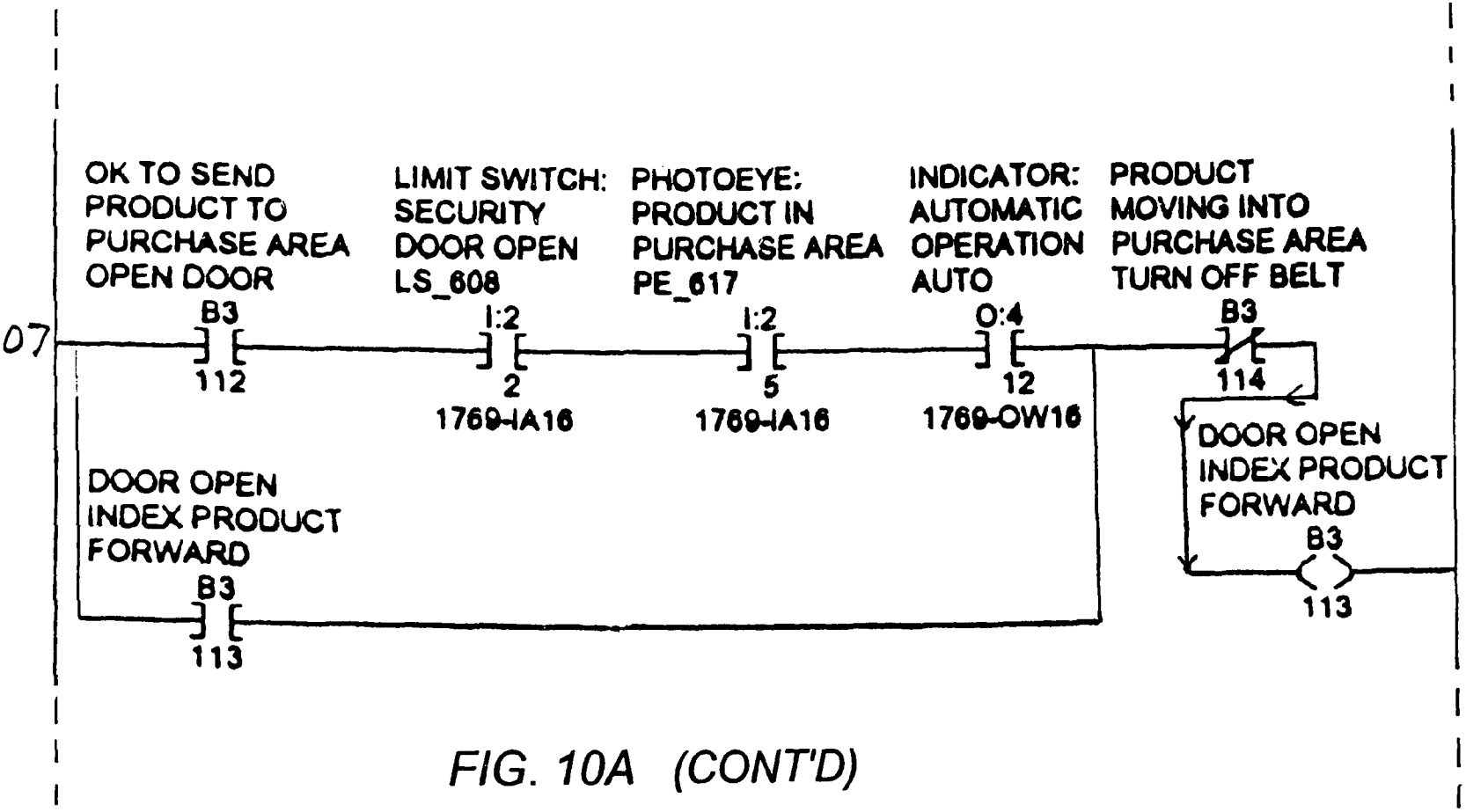
Figure 10A:
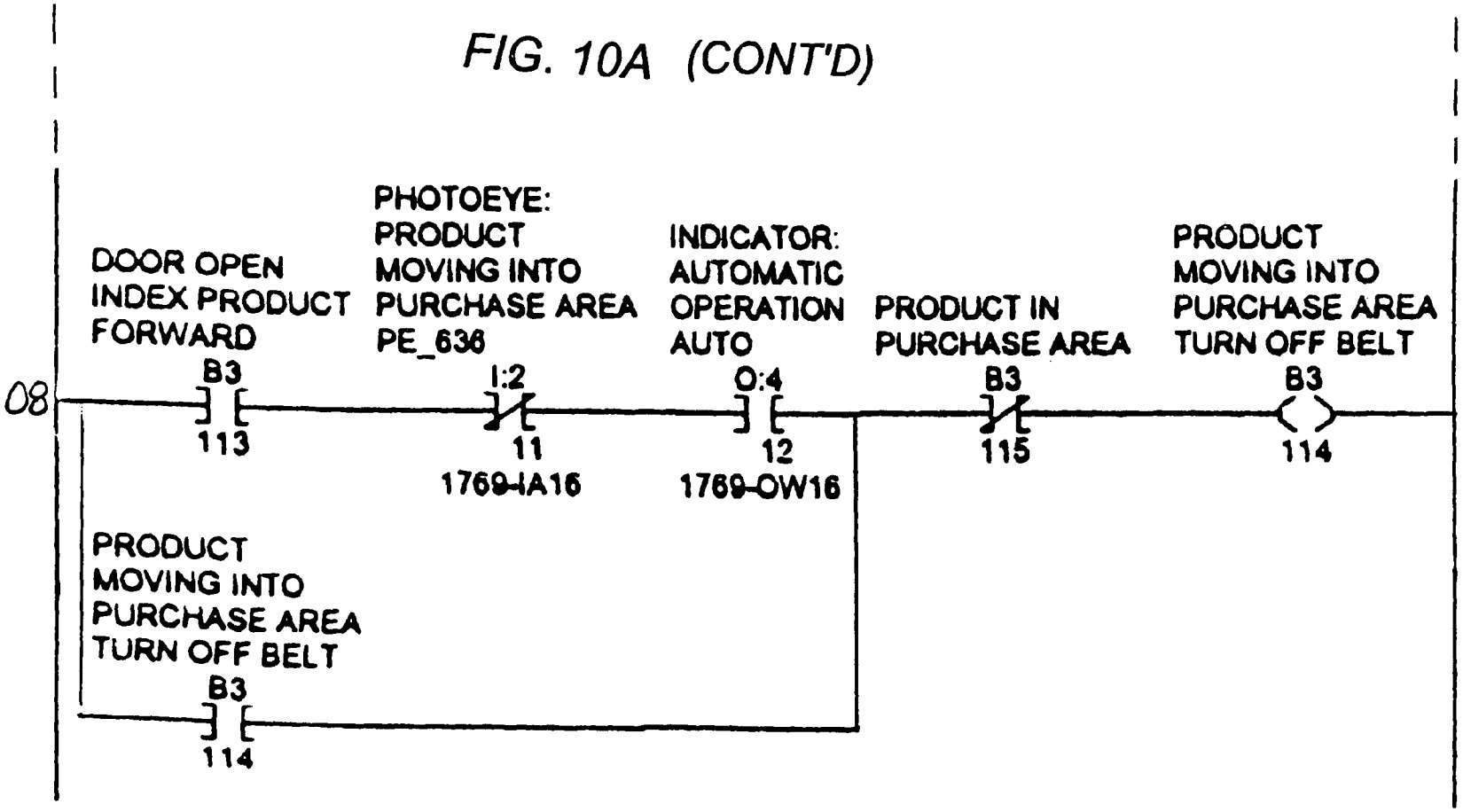
Figure 10B:
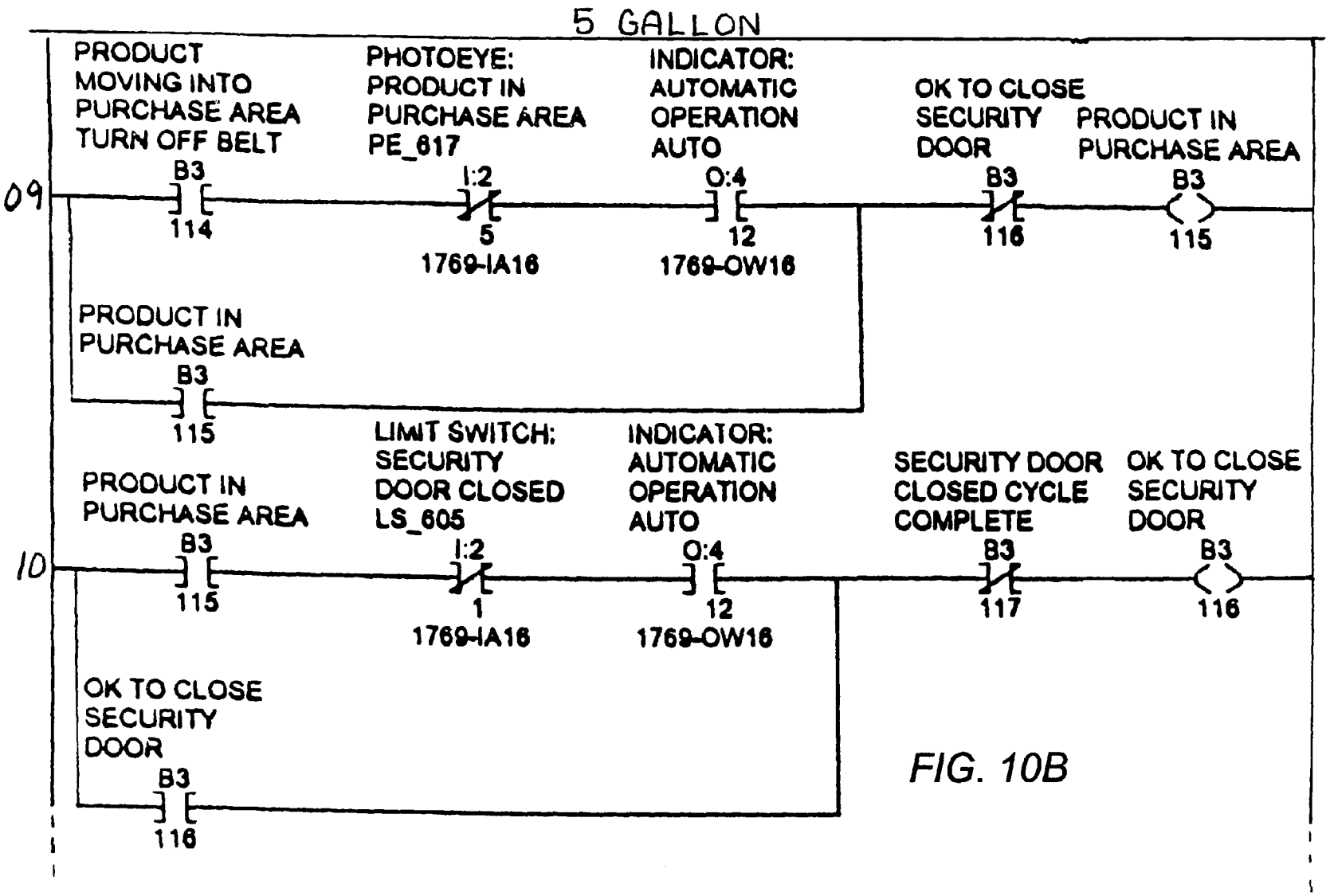
Figure 10B:
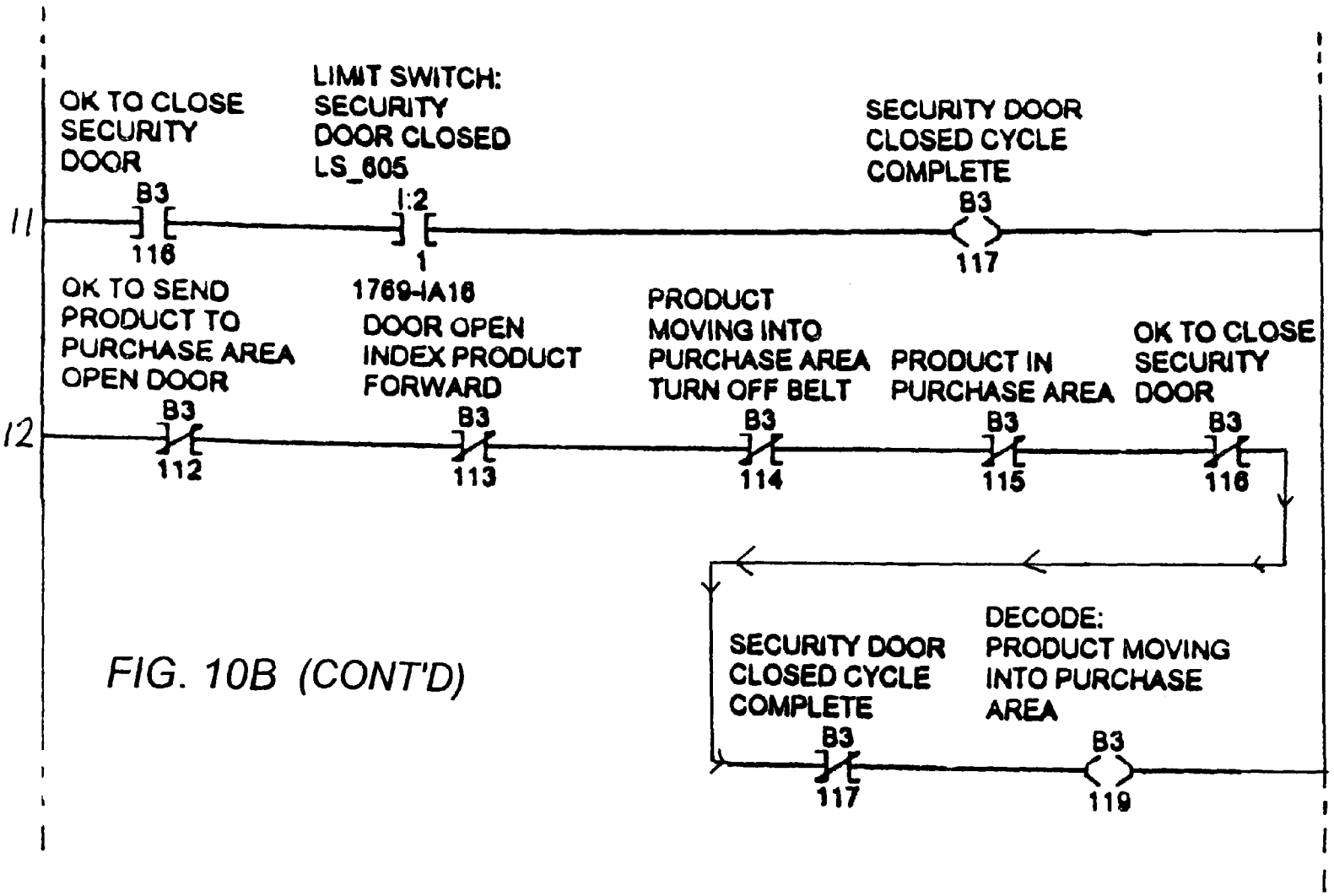
Figure 10B:
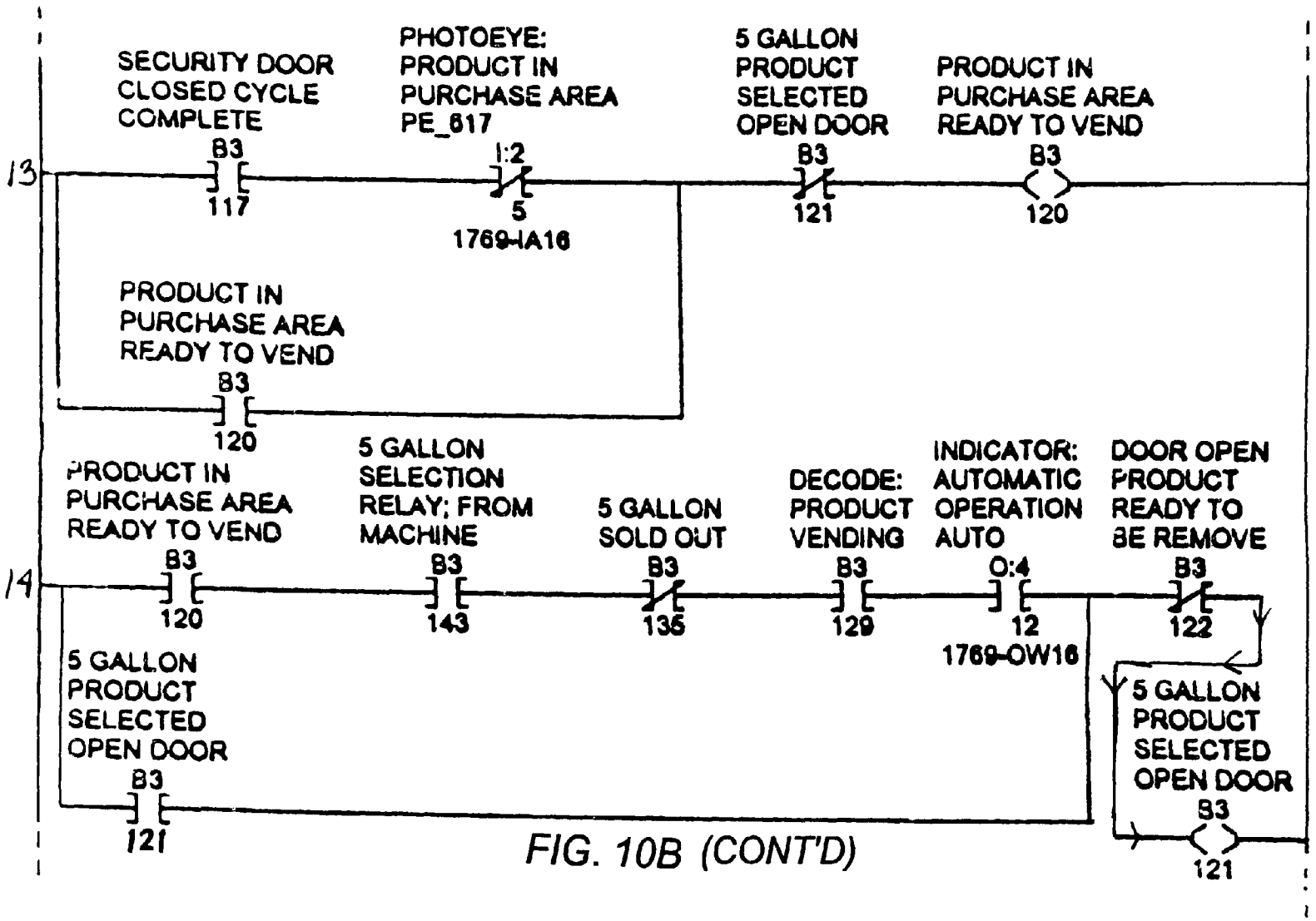
Figure 10B:
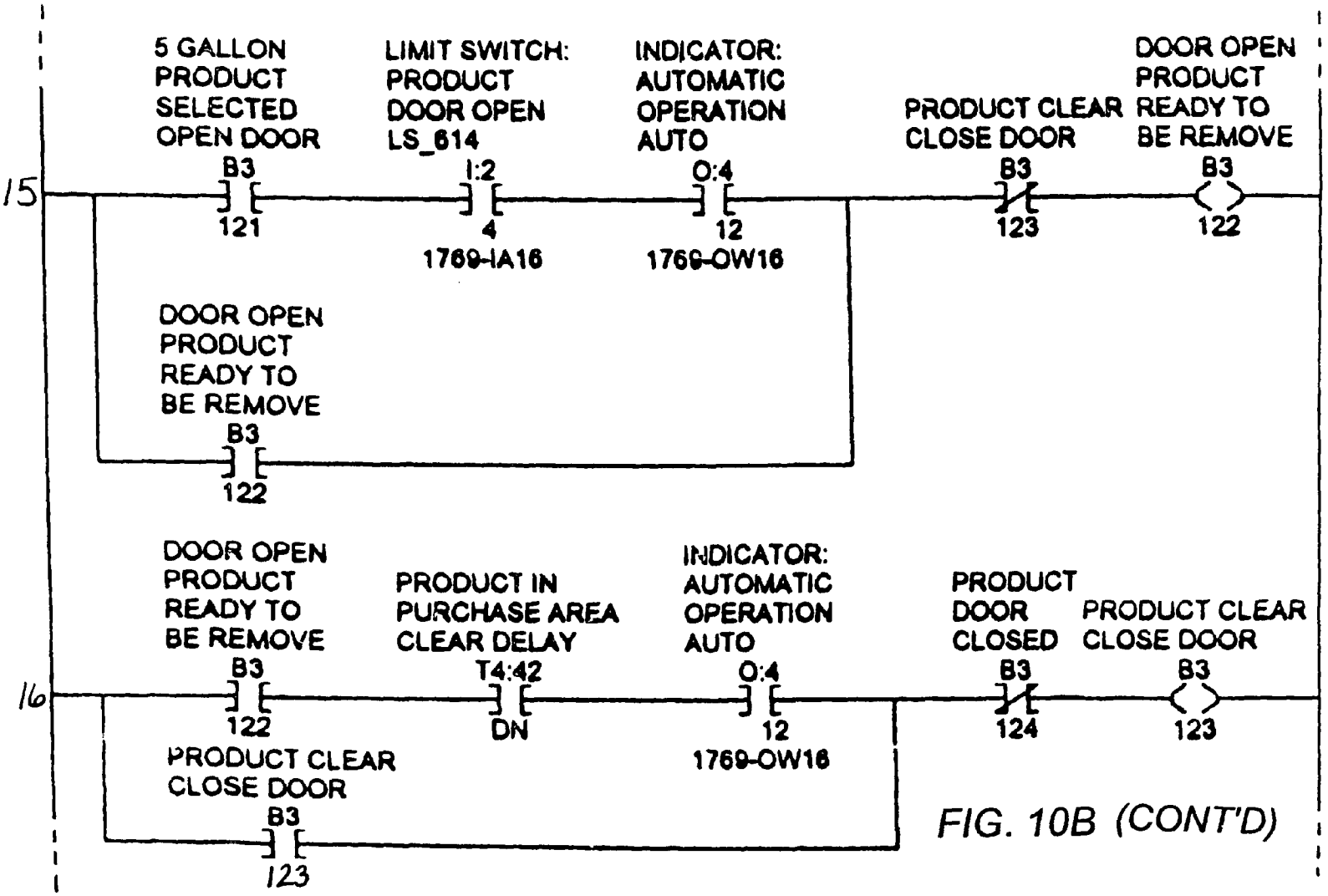
Figure 10B:
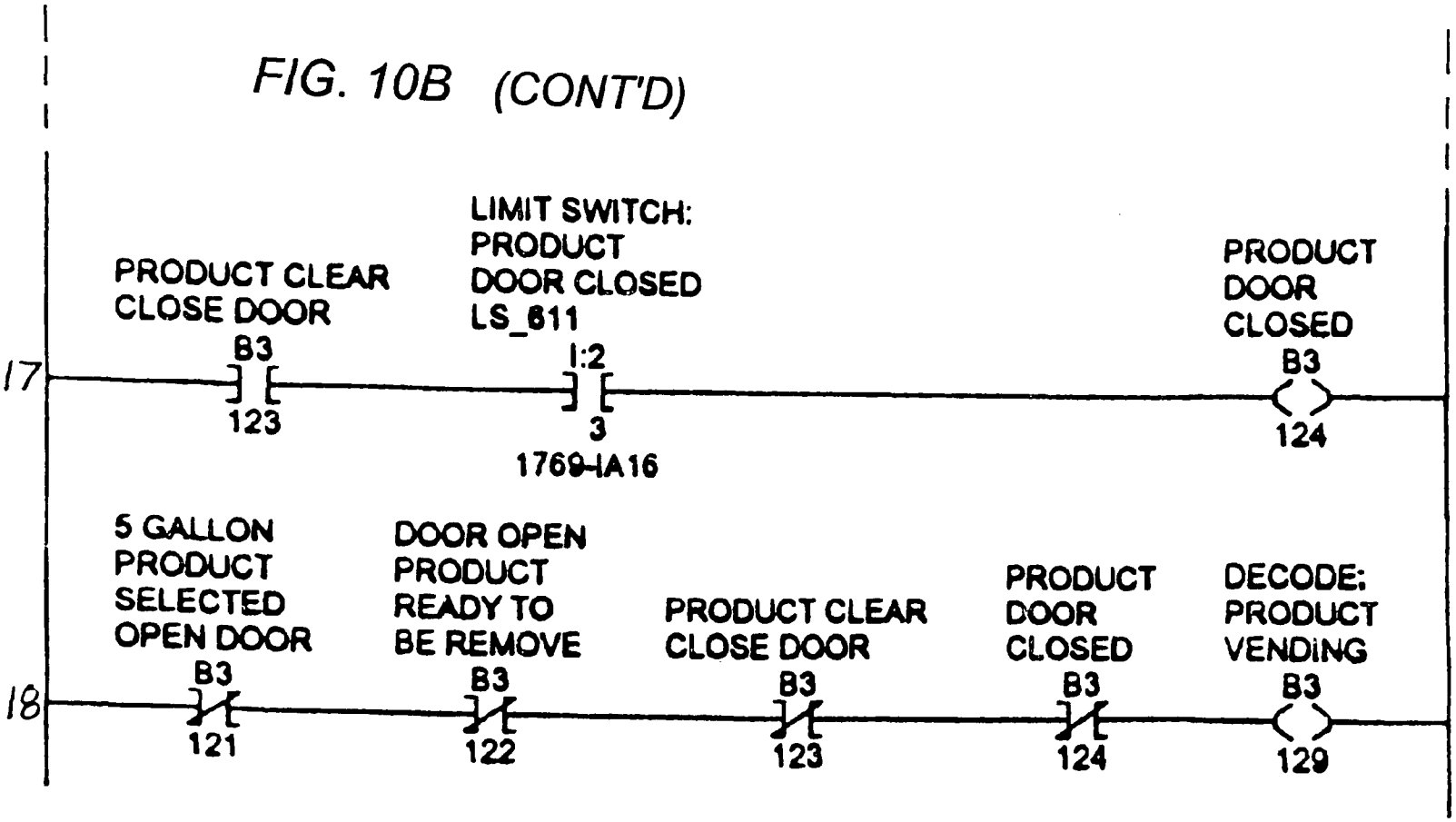
Figure 10C:
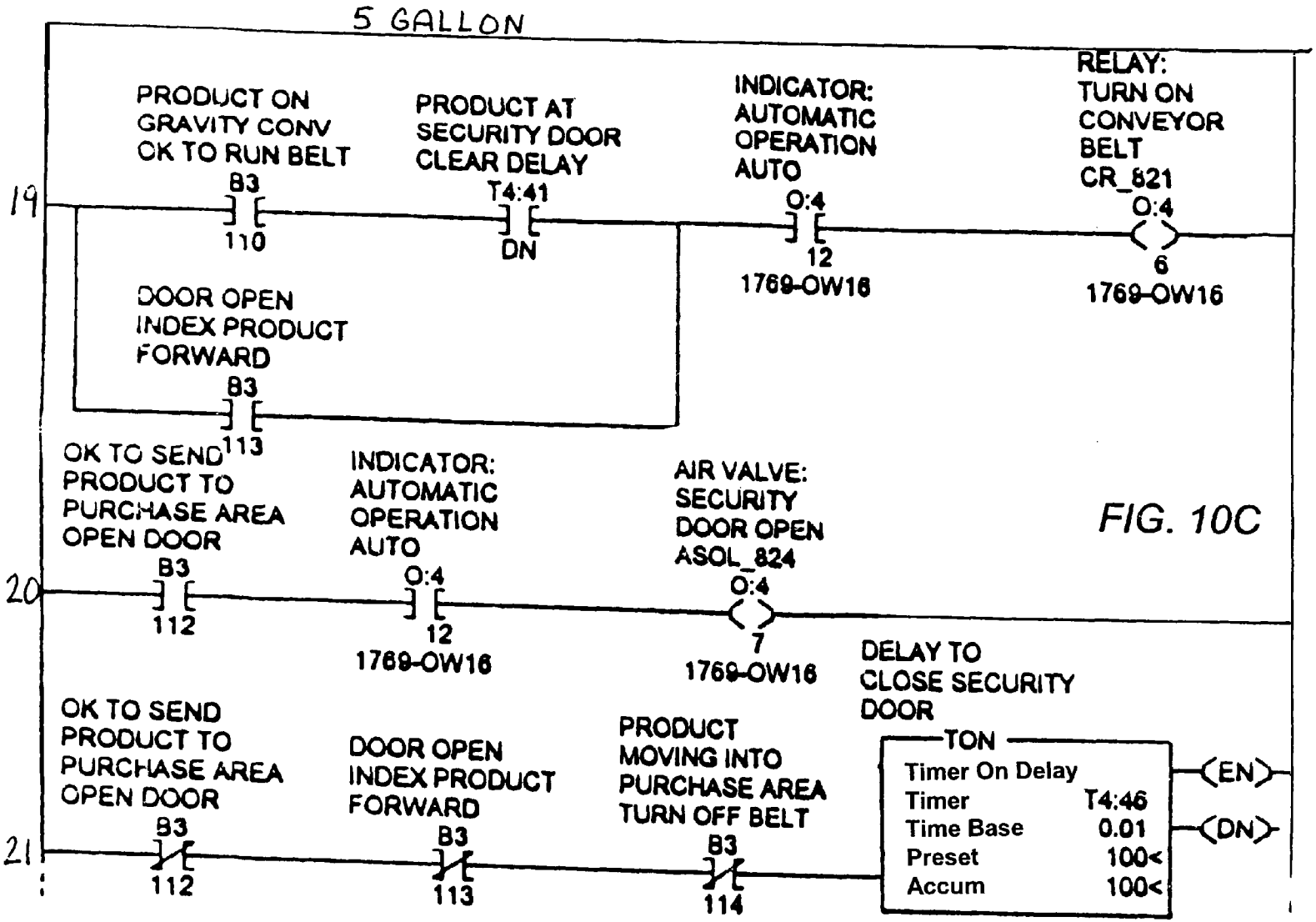
Figure 10C:
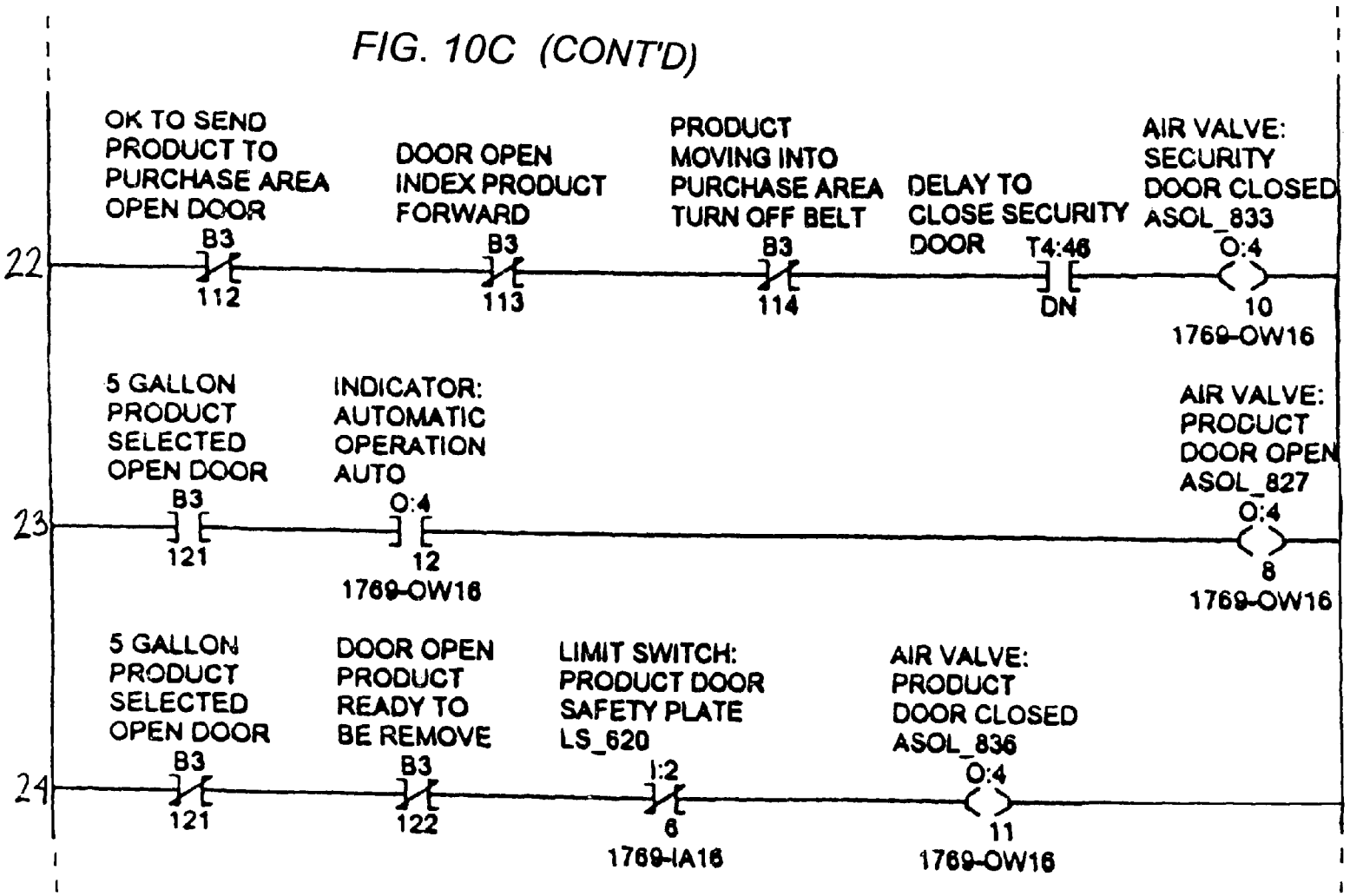
Figure 10C:
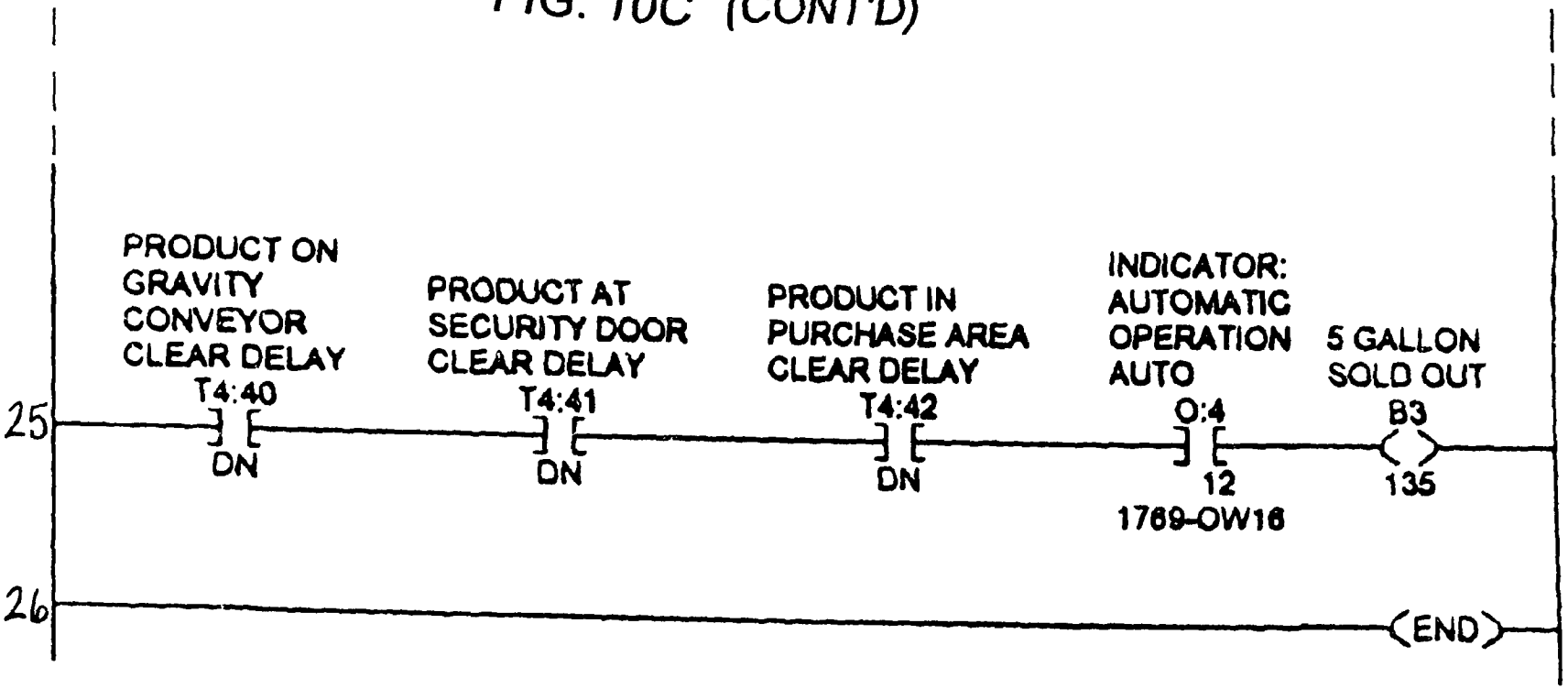
Figure 11A:
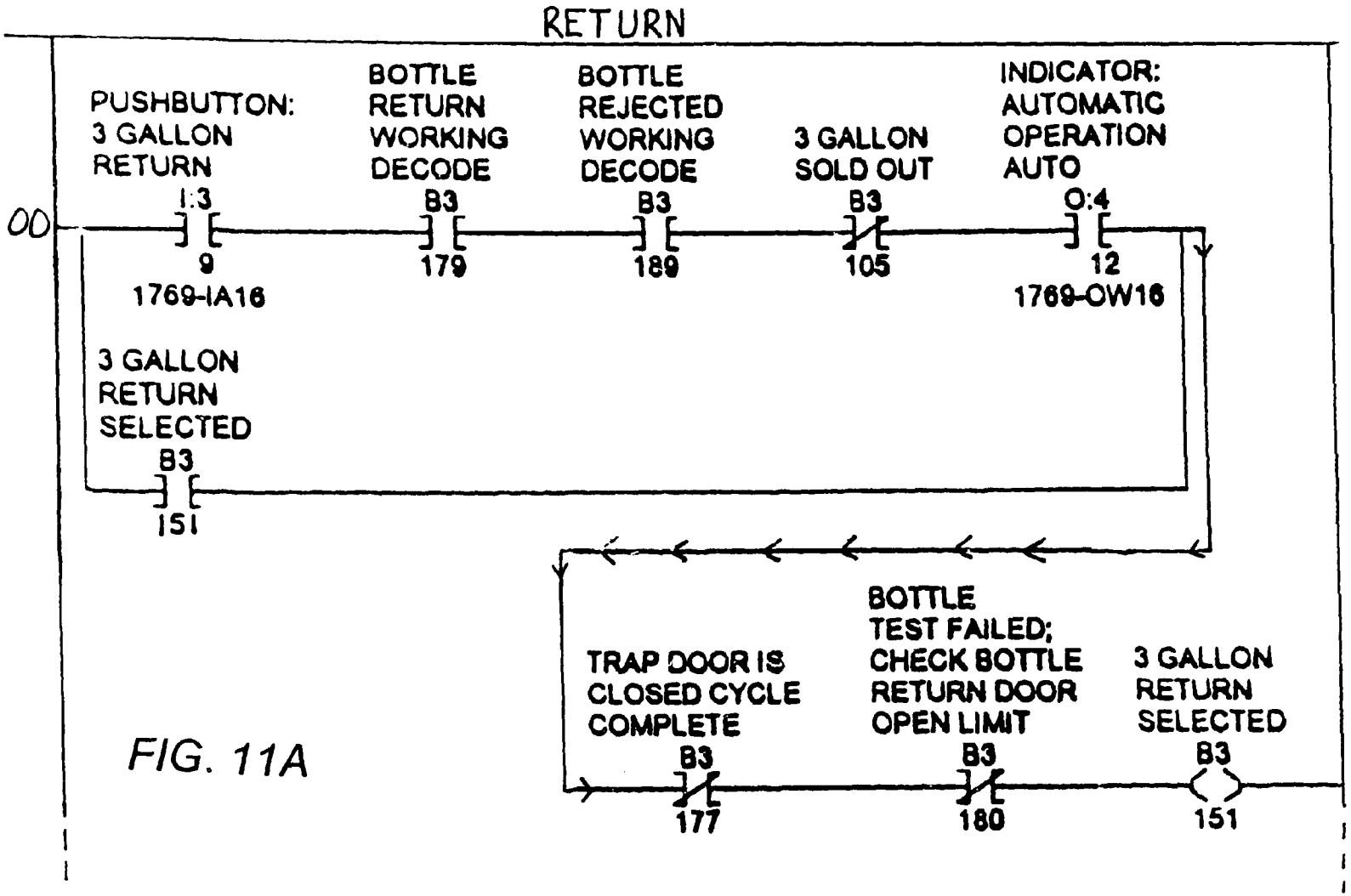
Figure 11A:
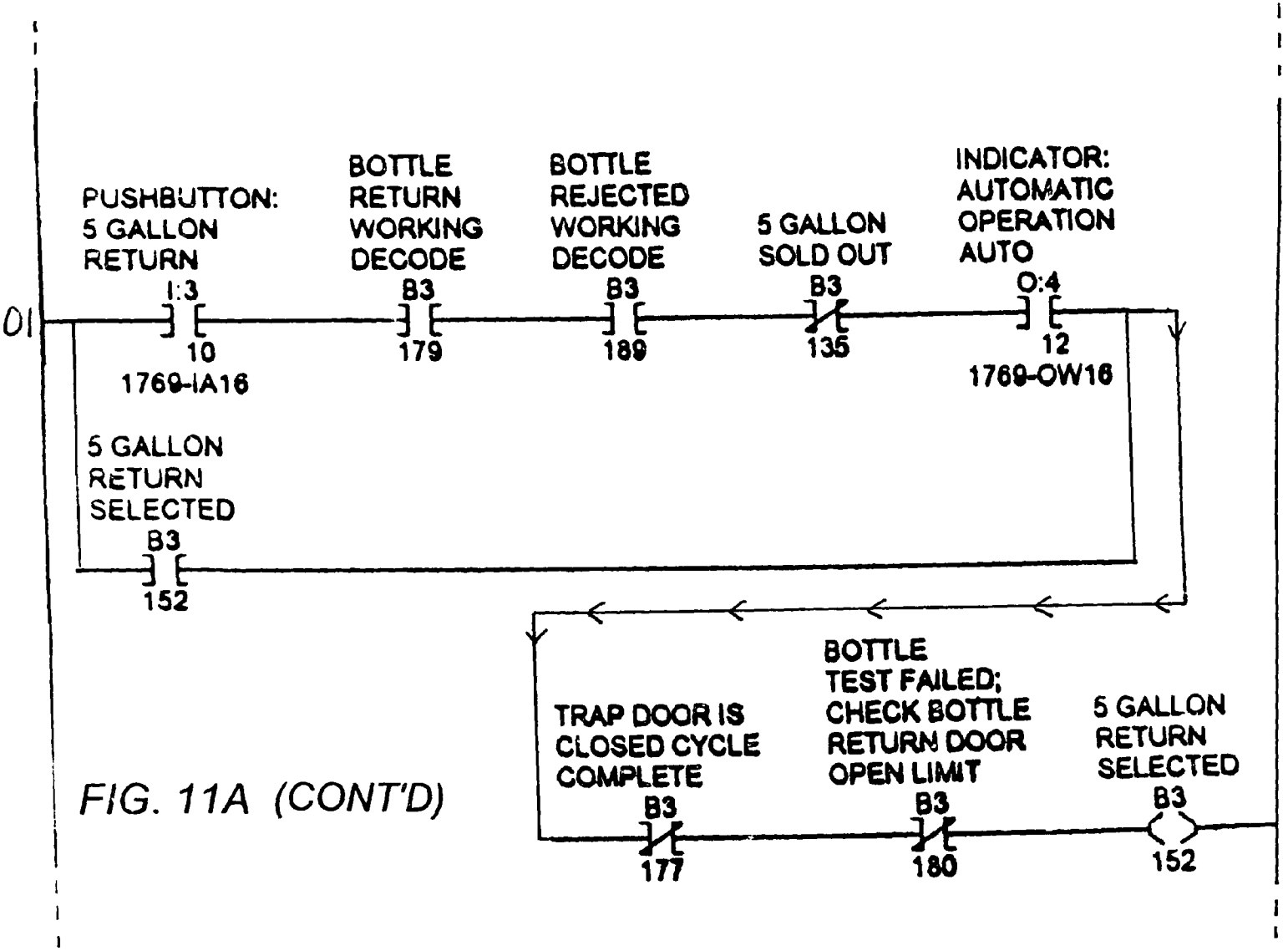
Figure 11A:
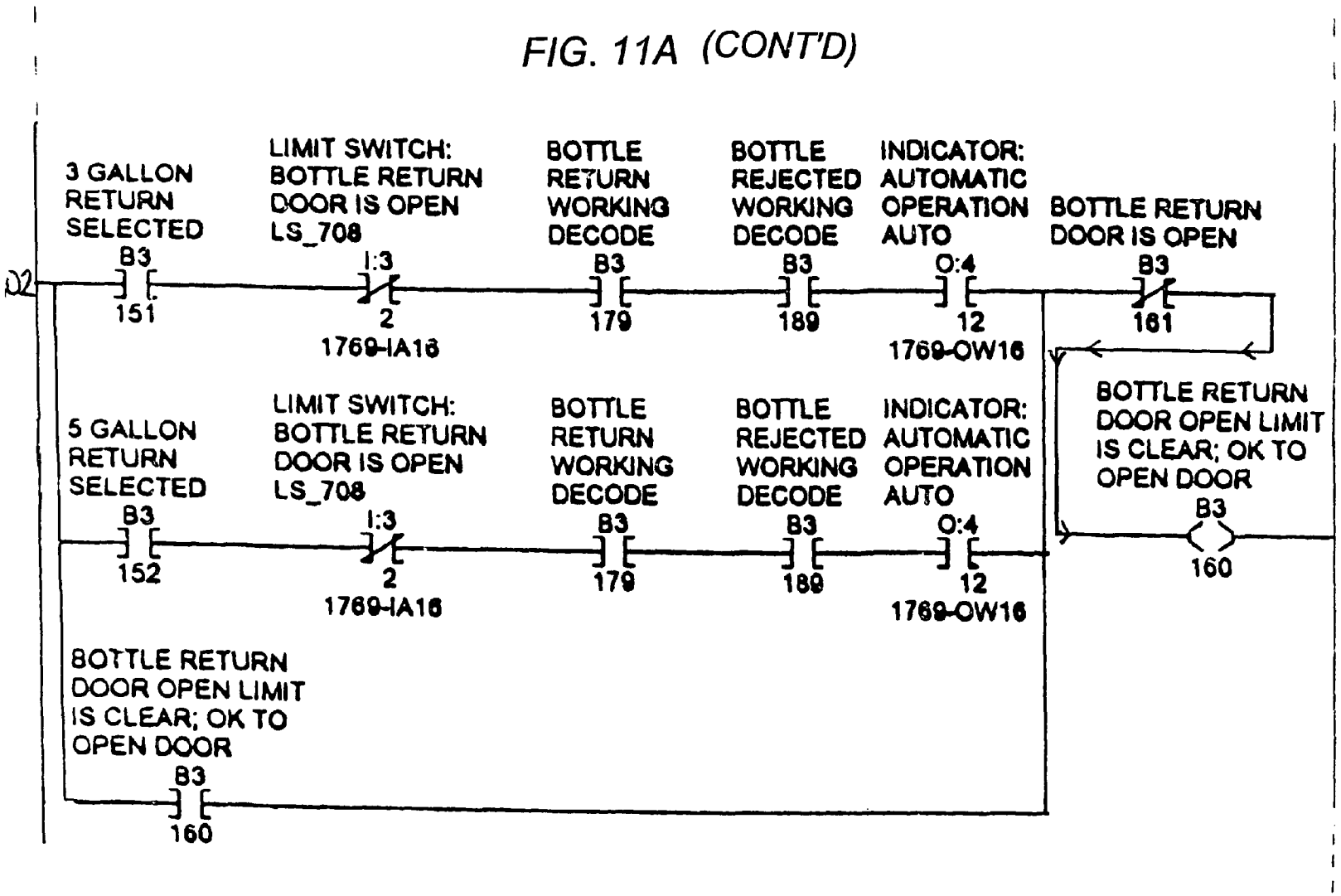
Figure 11A:
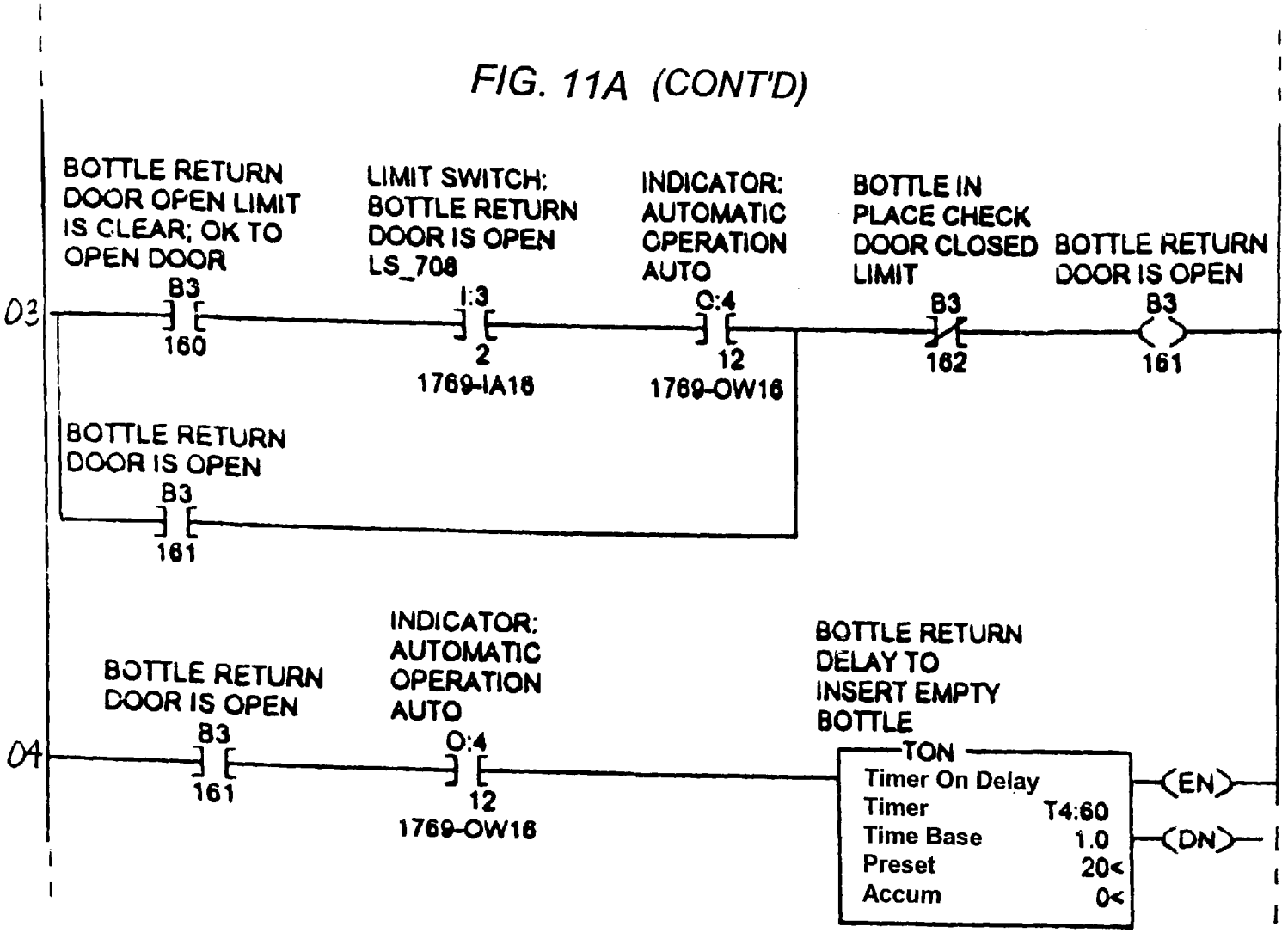
Figure 11A:
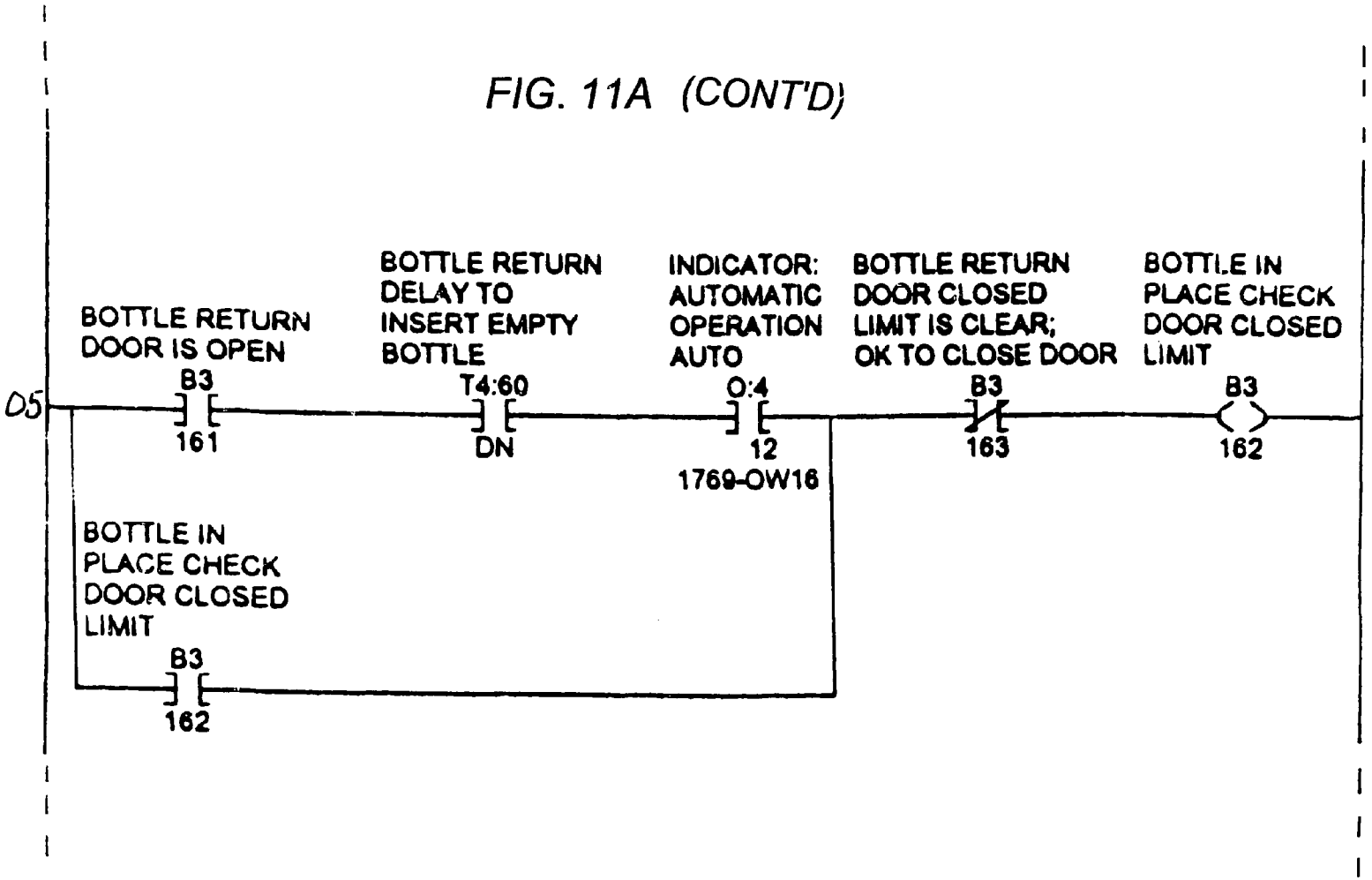
Figure 11A:
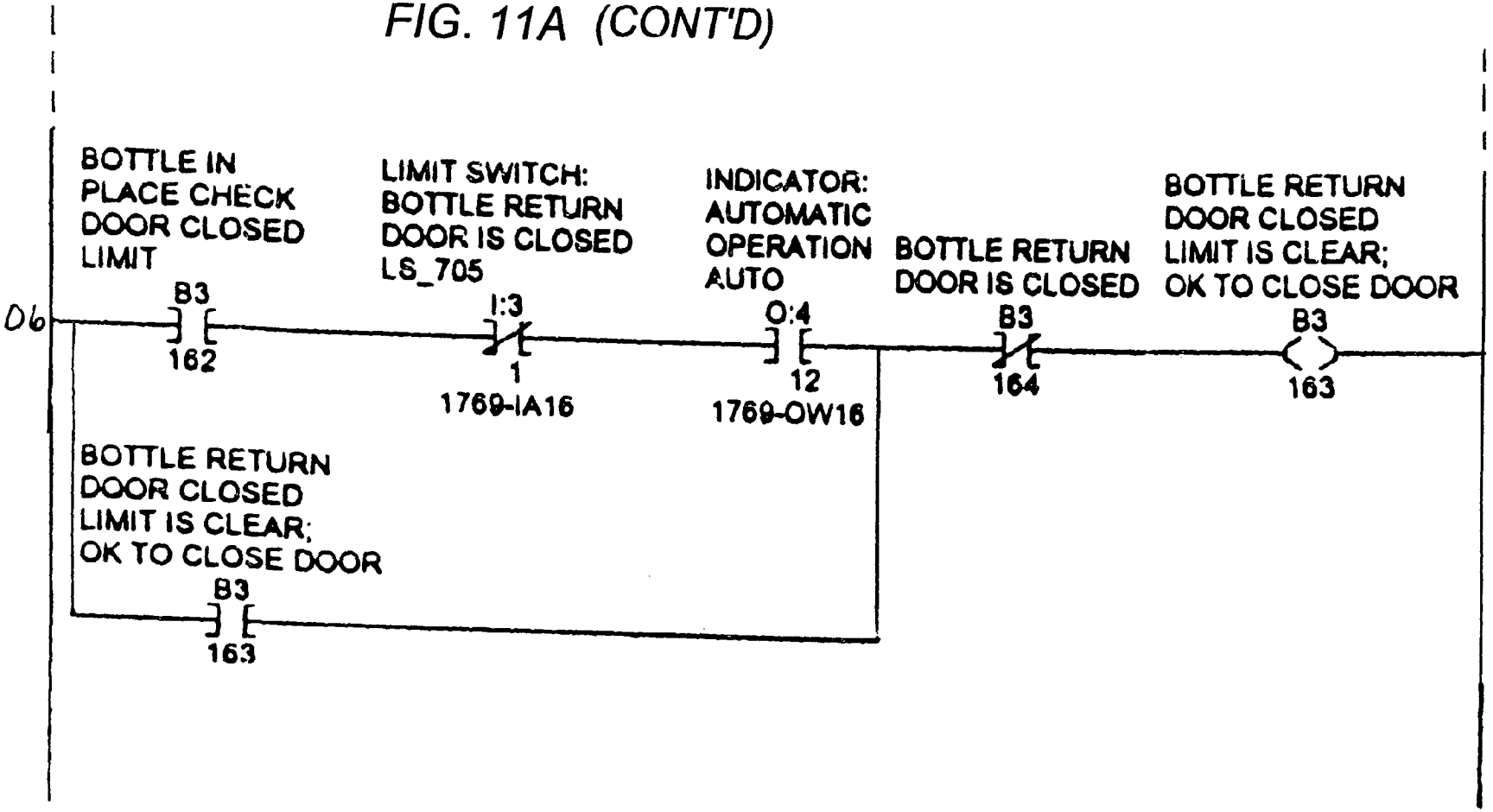
Figure 11B:
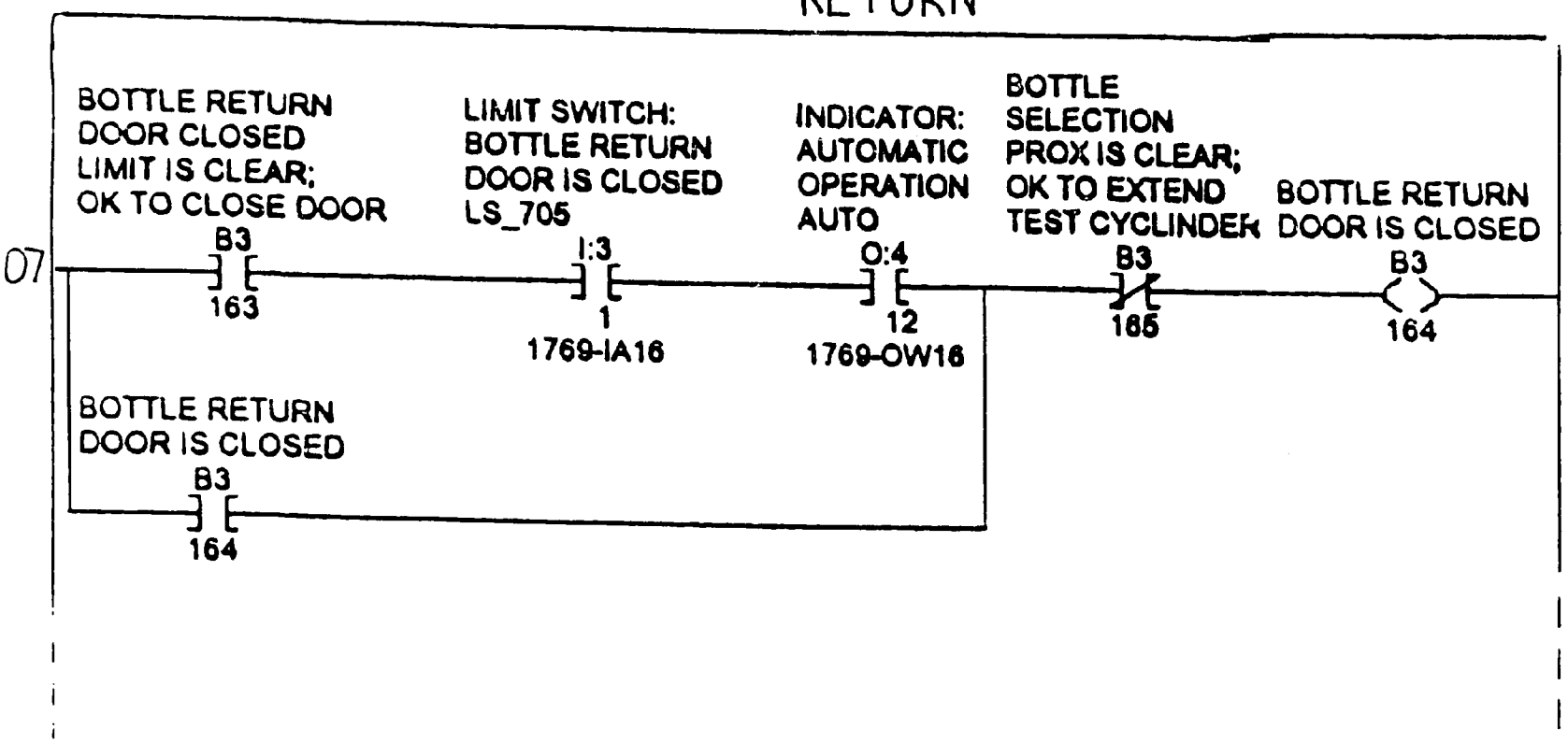
Figure 11B:
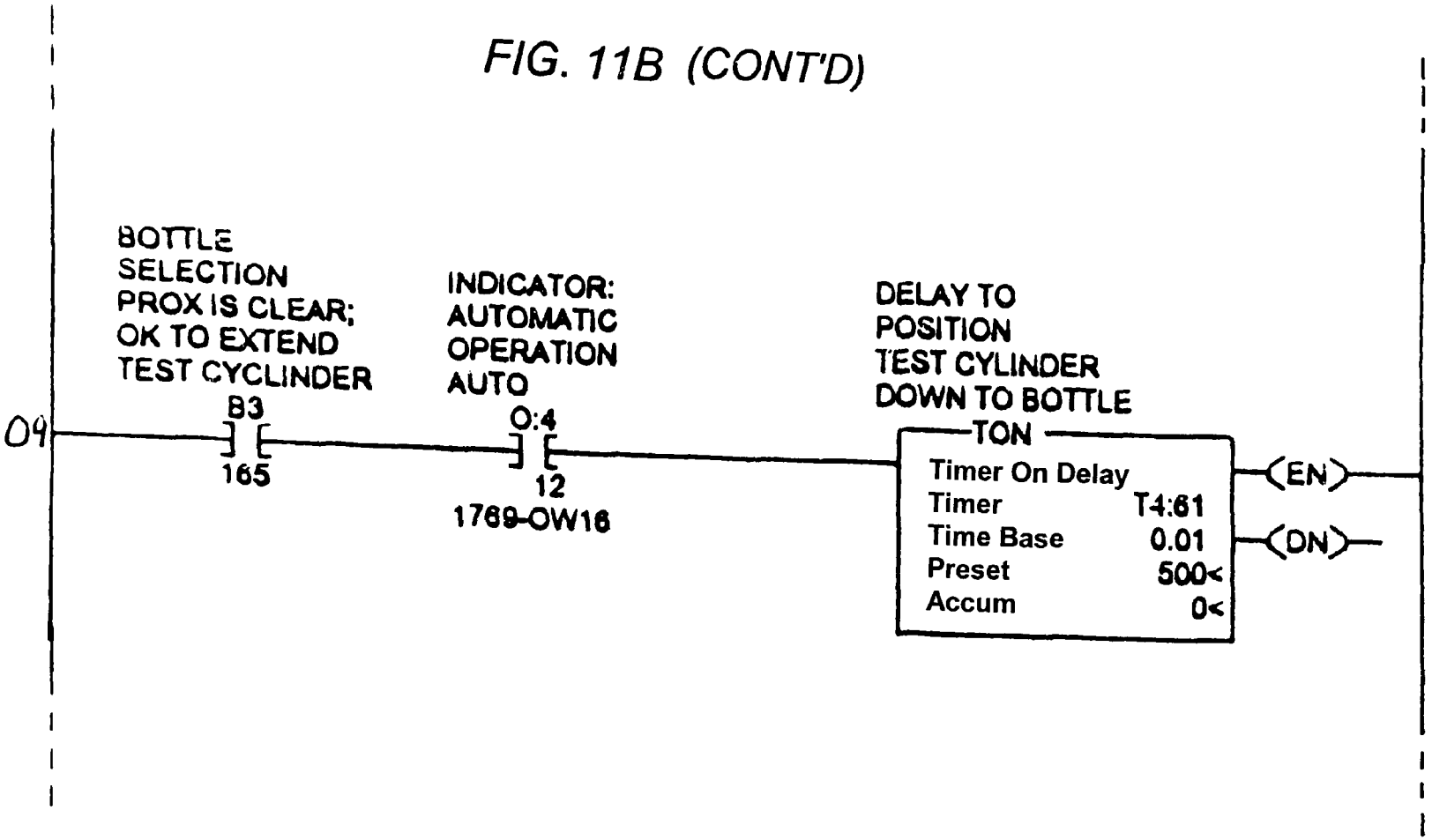
Figure 11B:
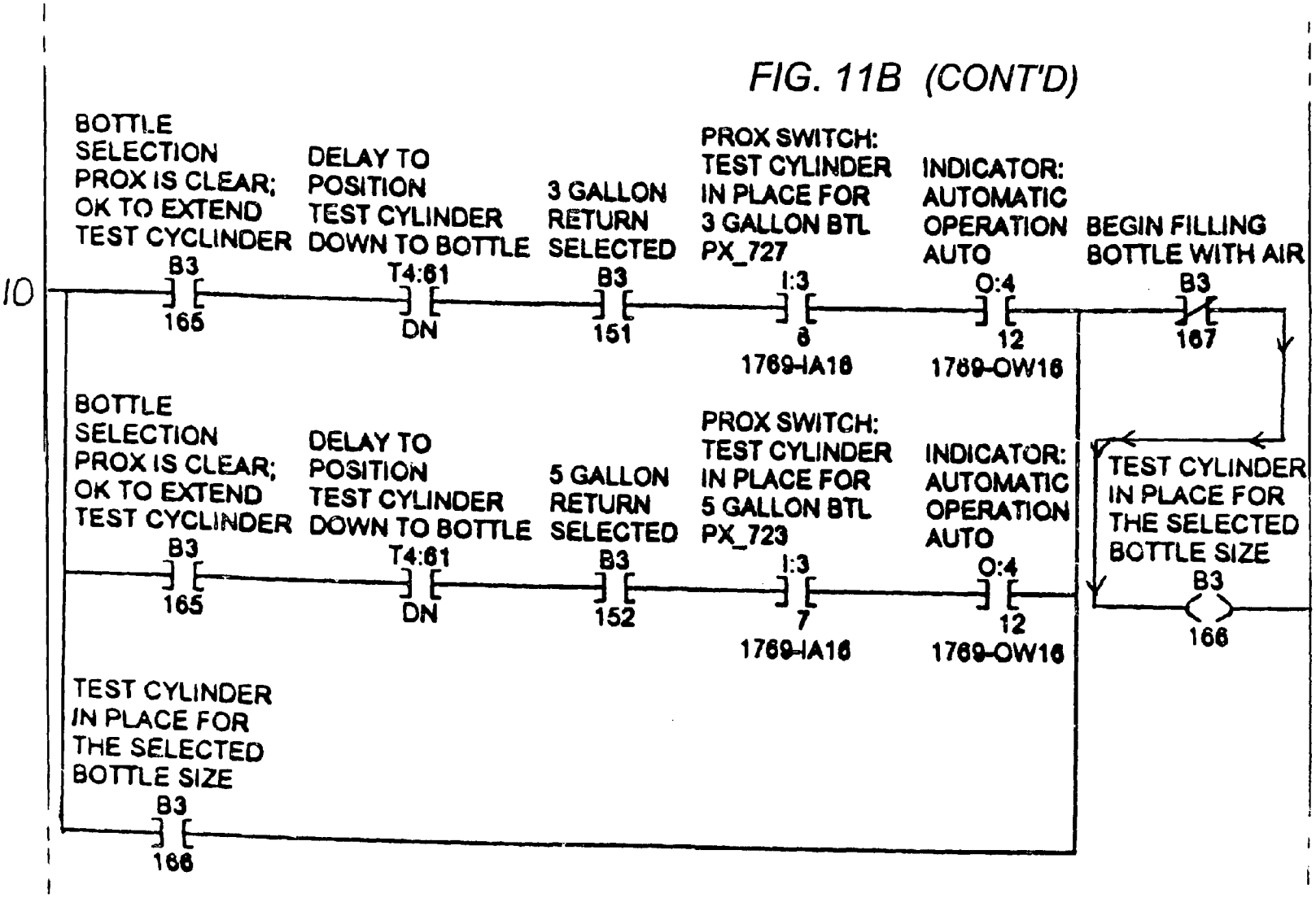
Figure 11C:
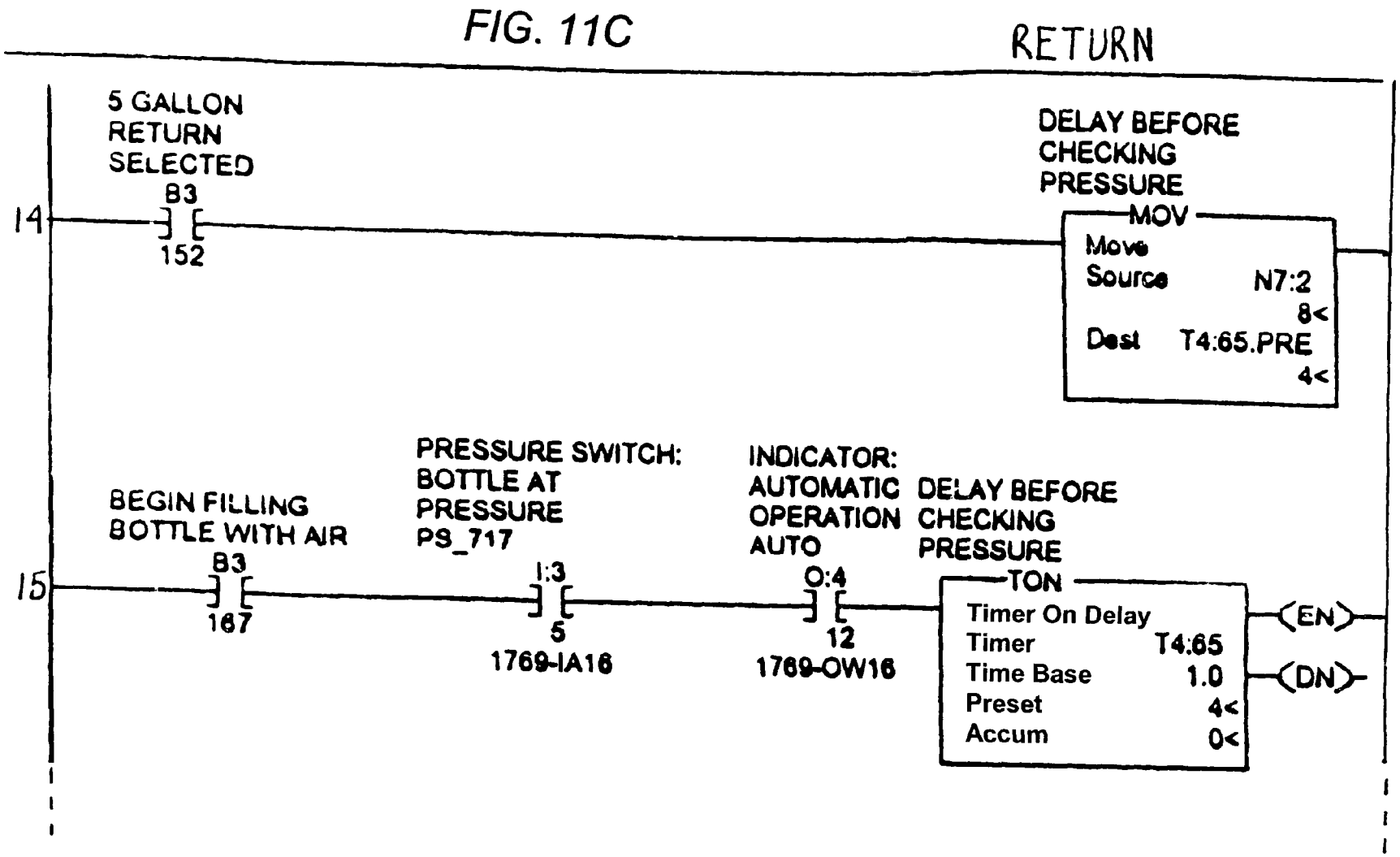
Figure 11C:
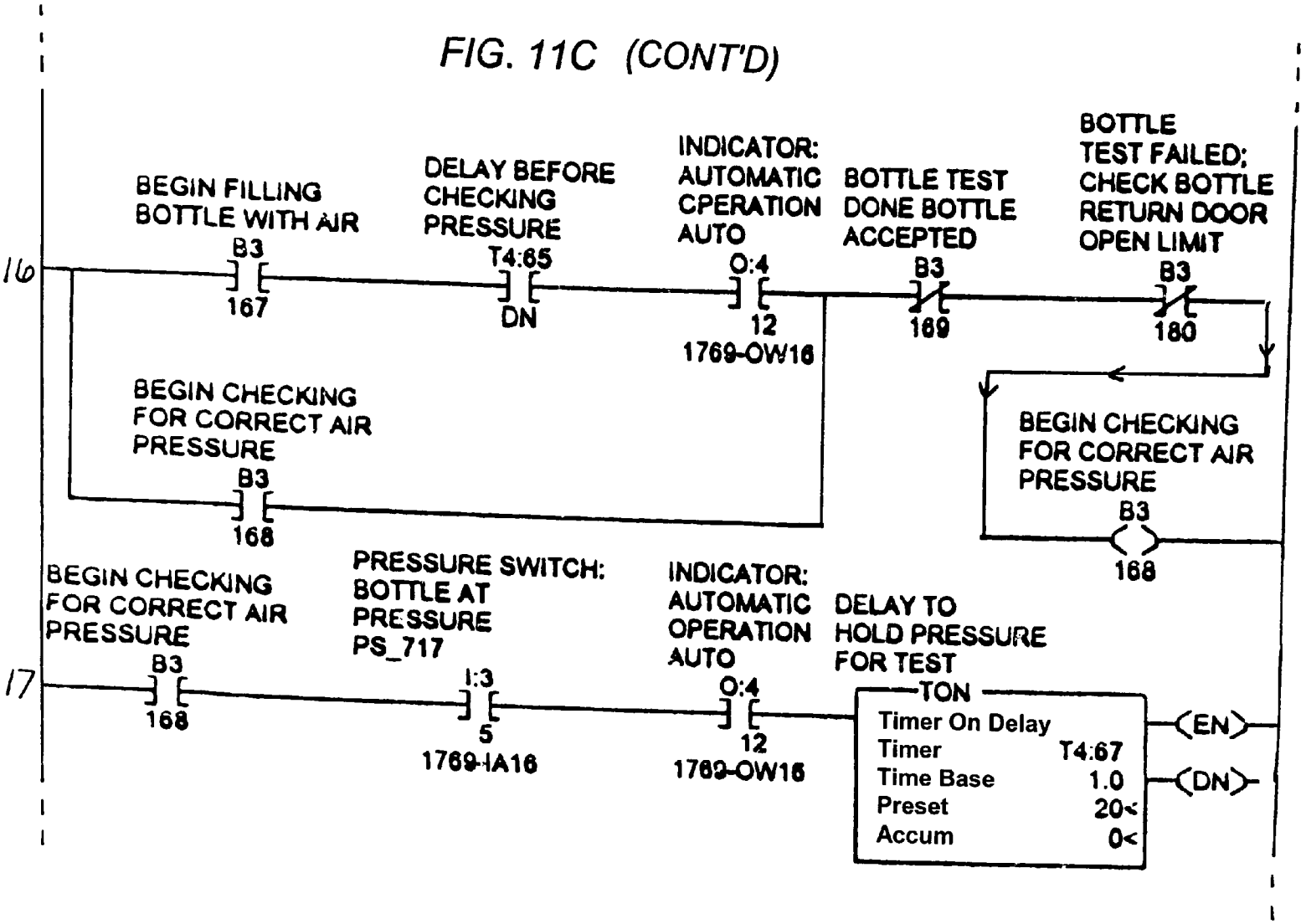
Figure 11C:
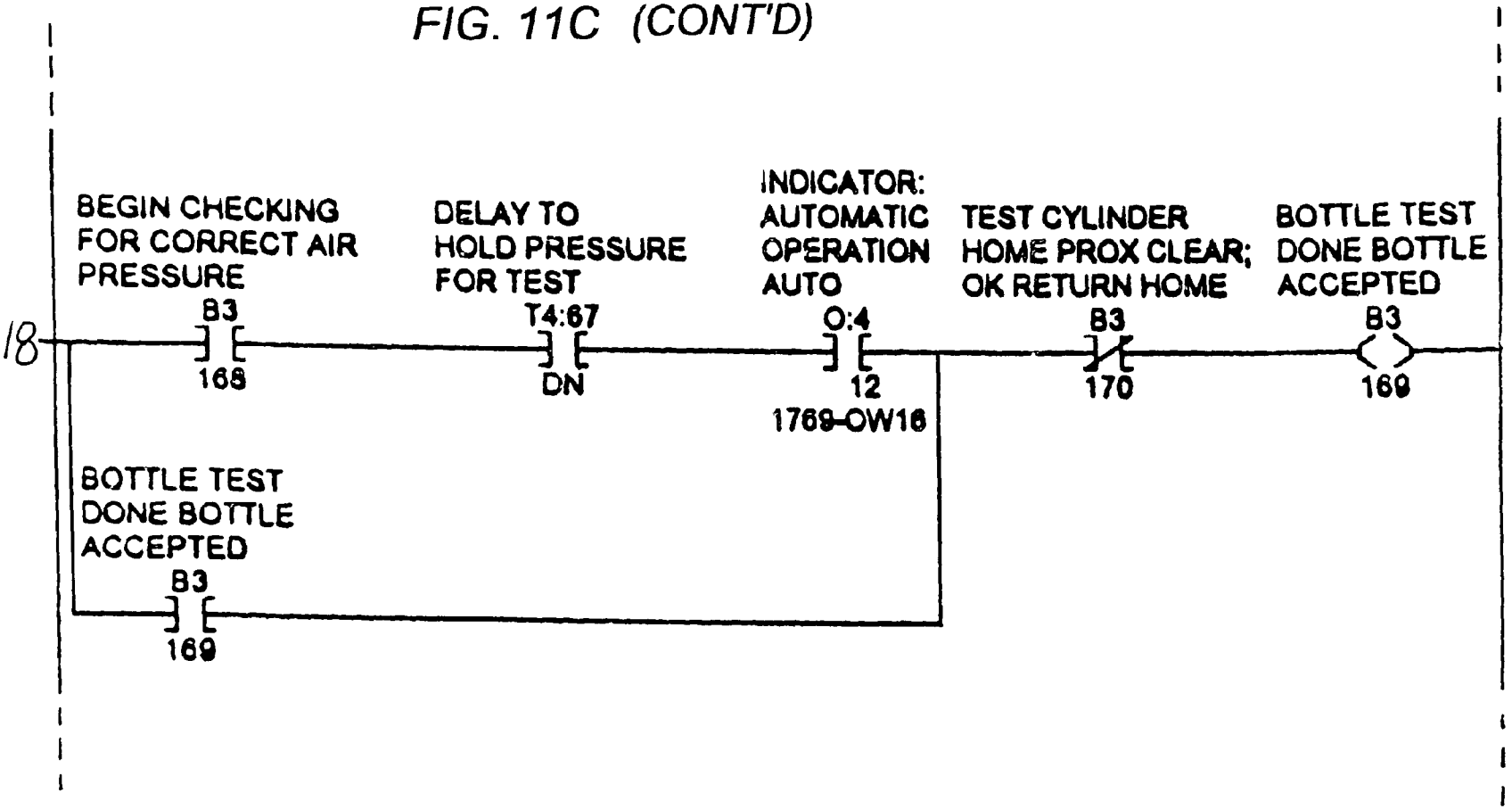
Figure 11C:
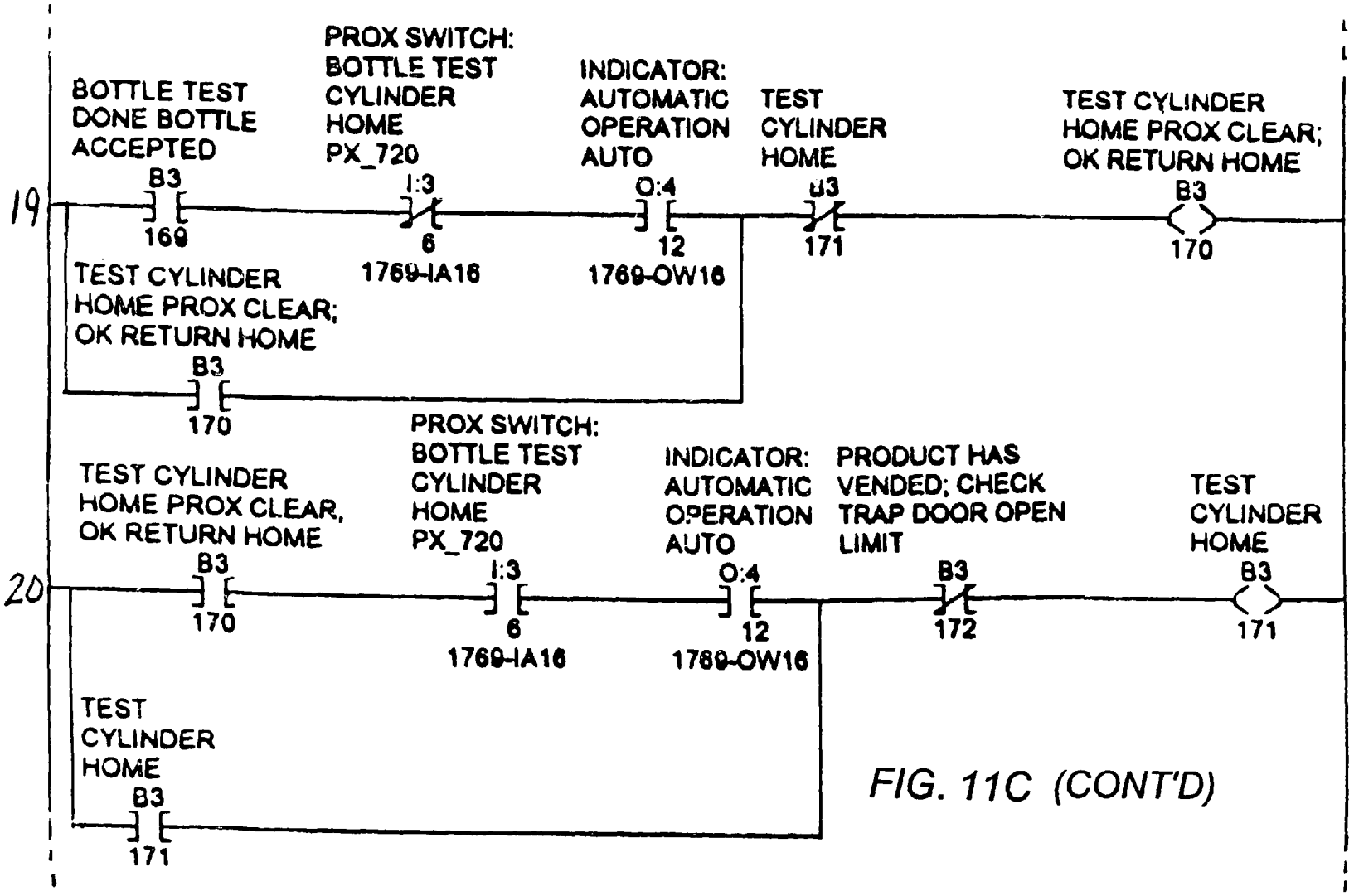
Figure 11C:
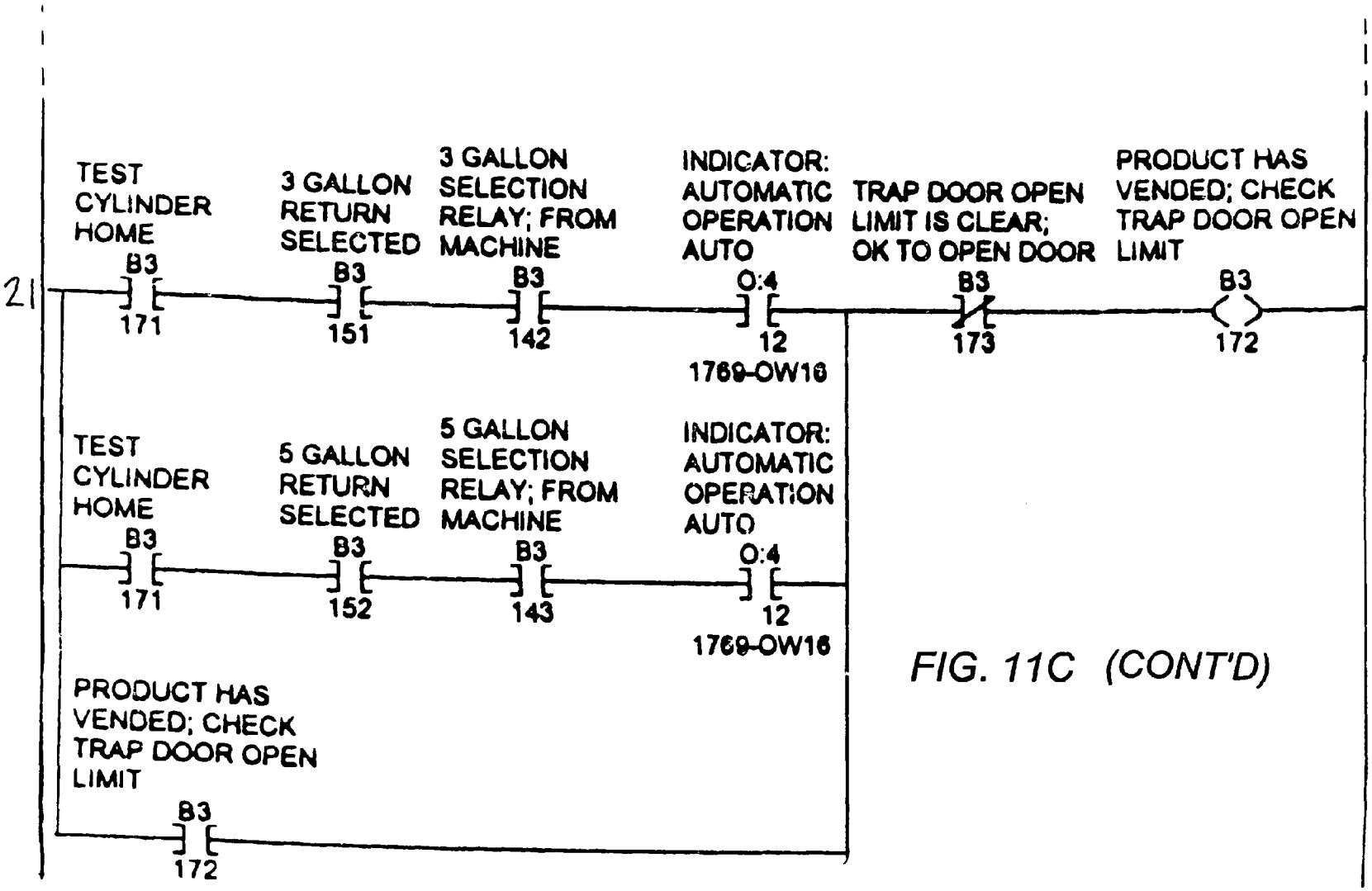
Figure 11D:
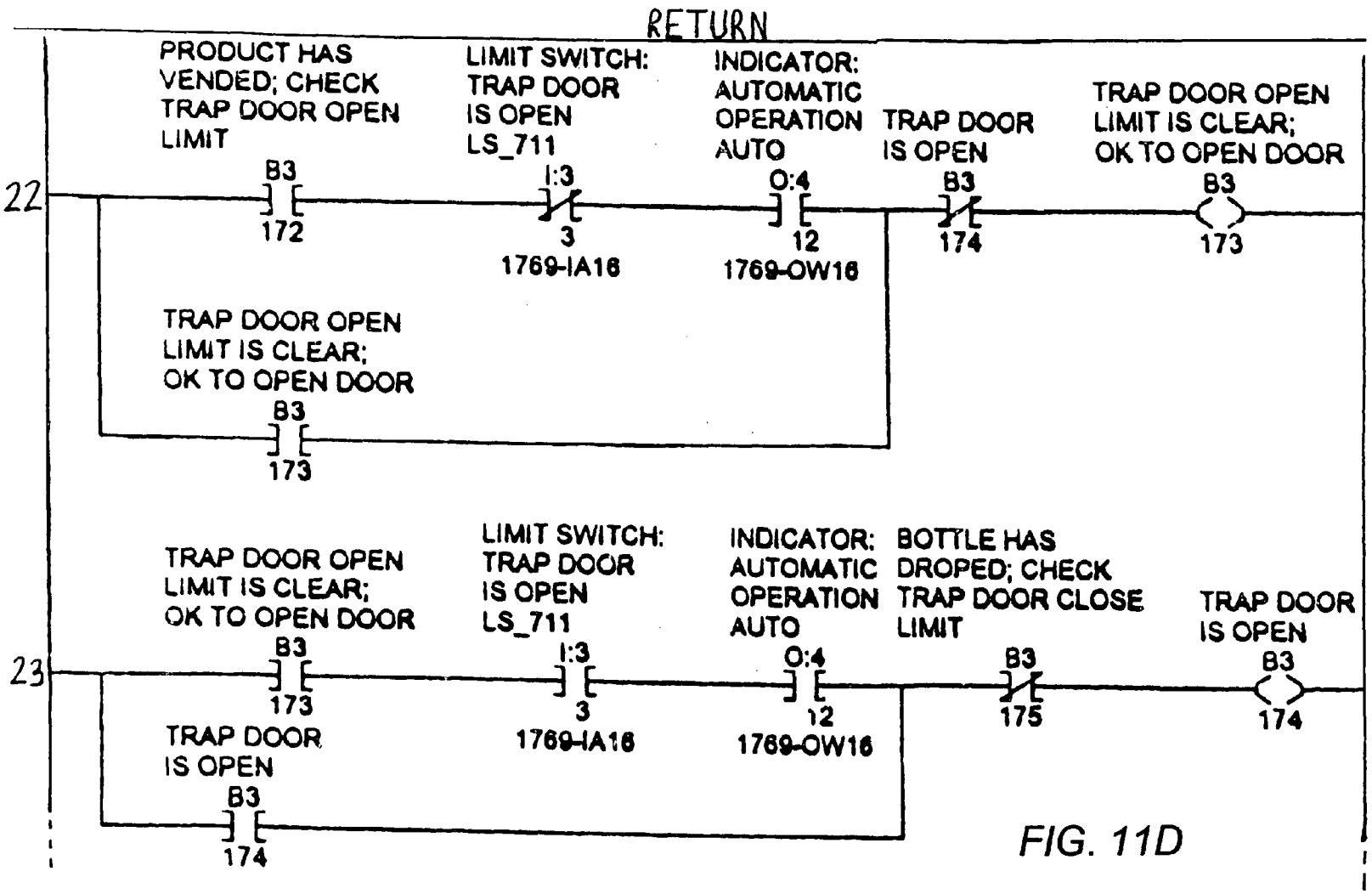
Figure 11D:
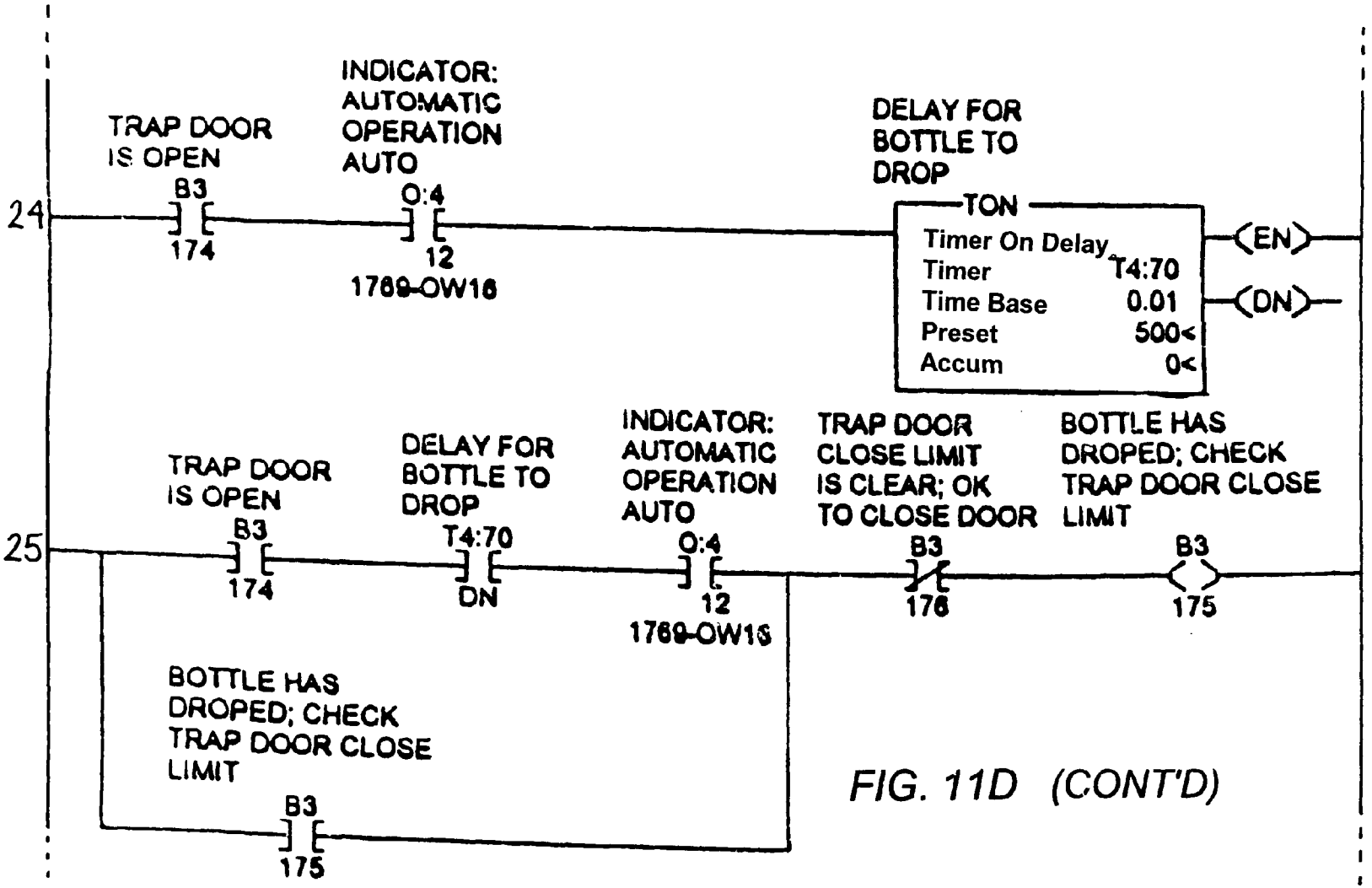
Figure 11D:
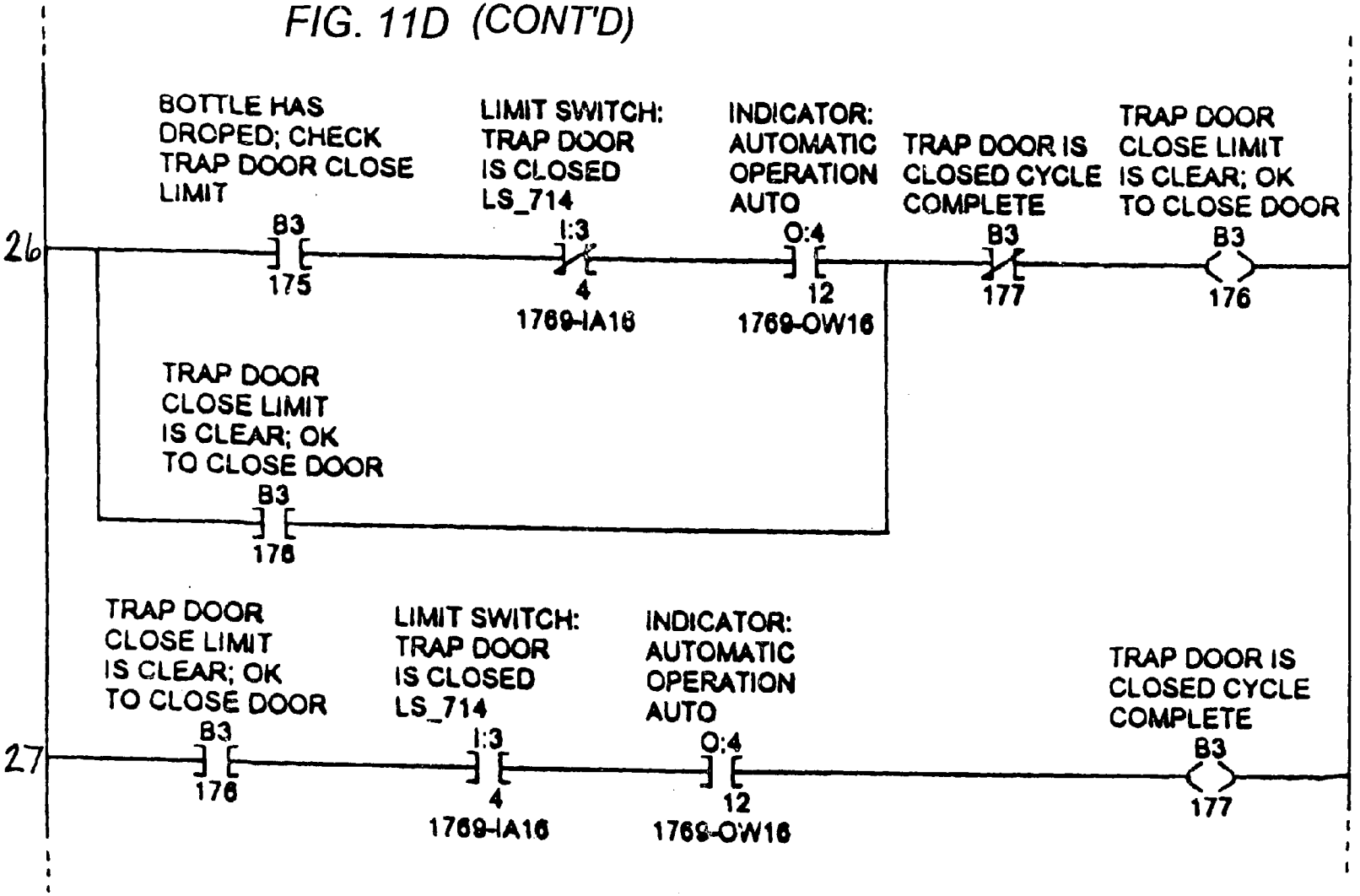
Figure 11D:
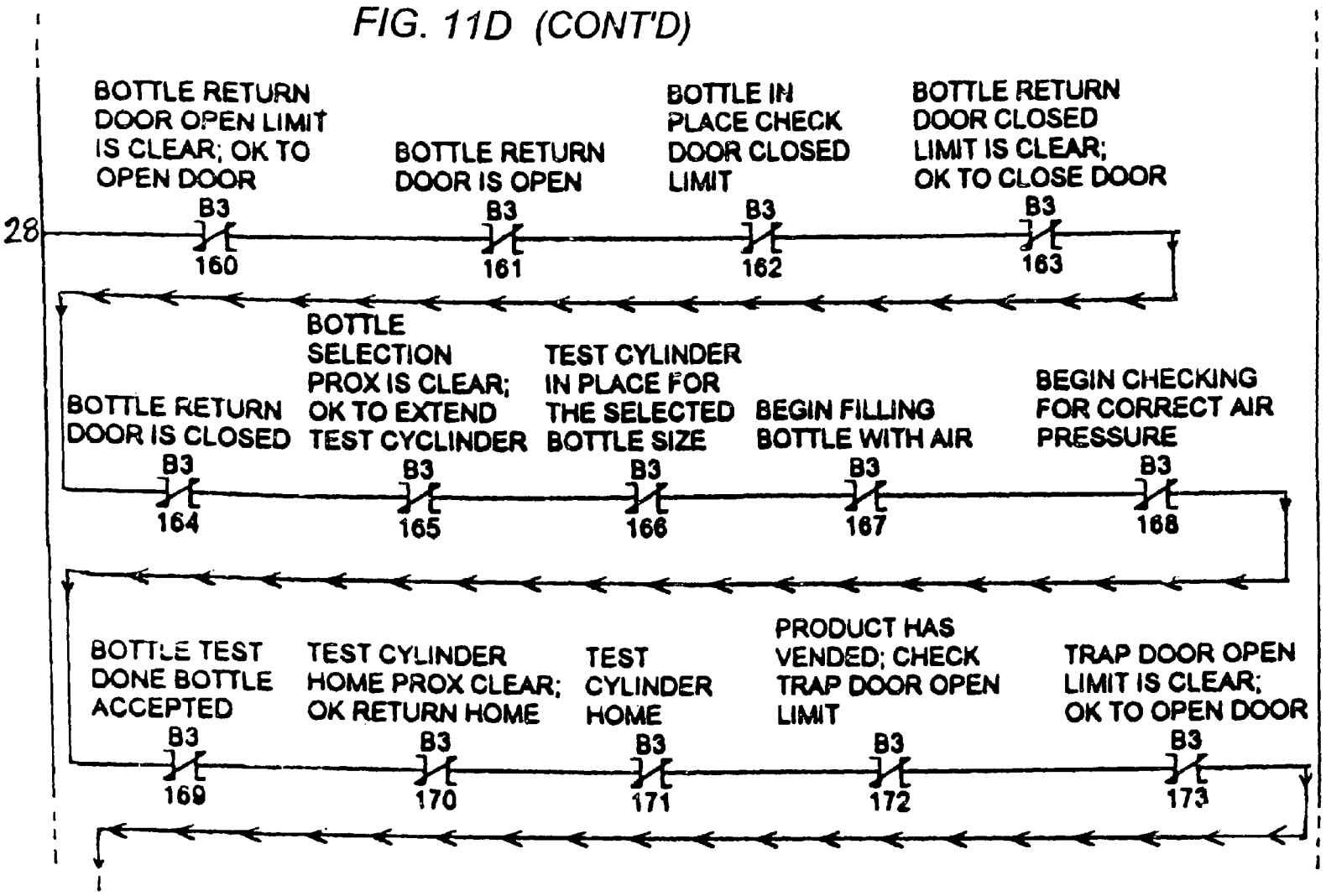
Figure 11D:
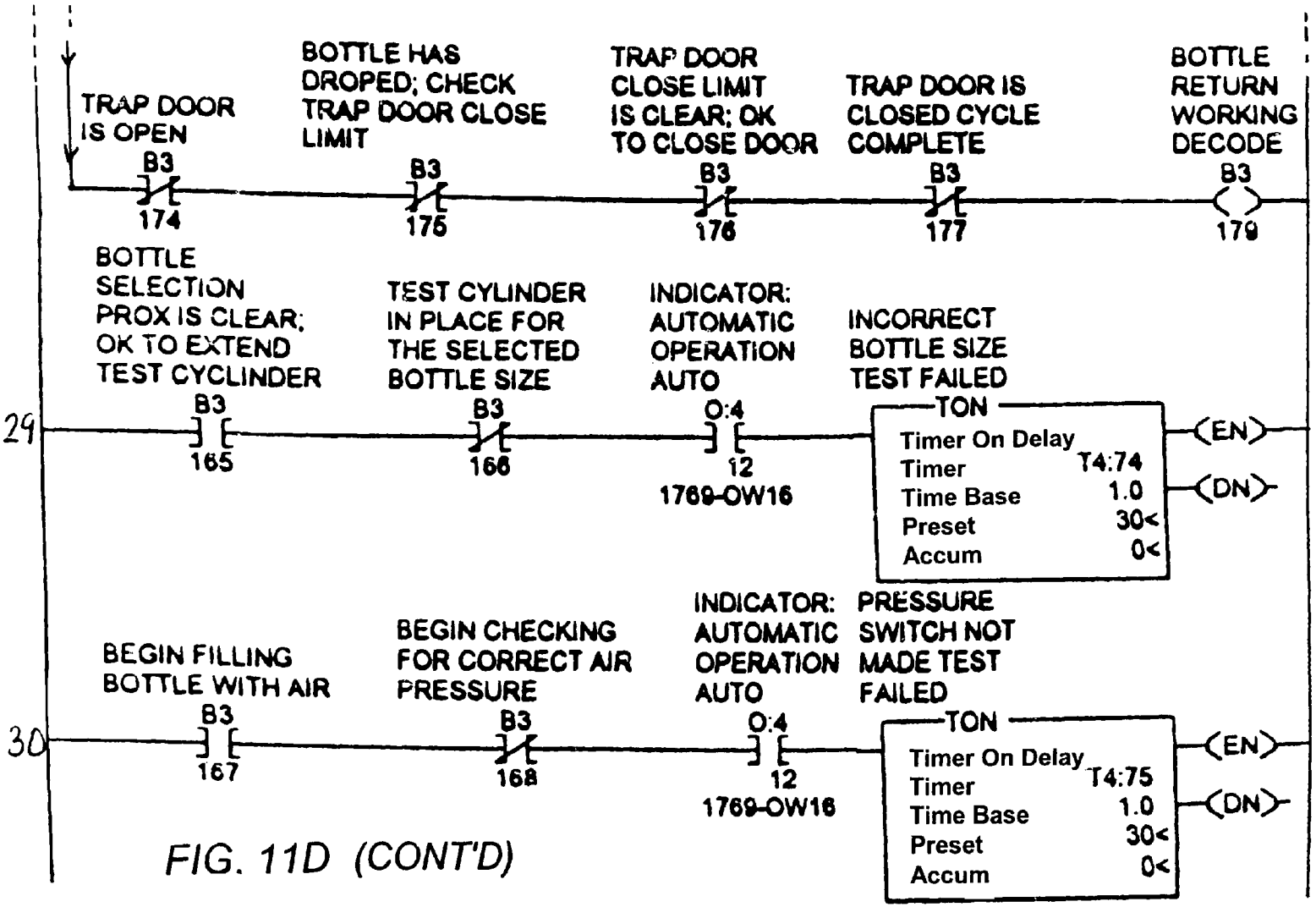
Figure 11E:
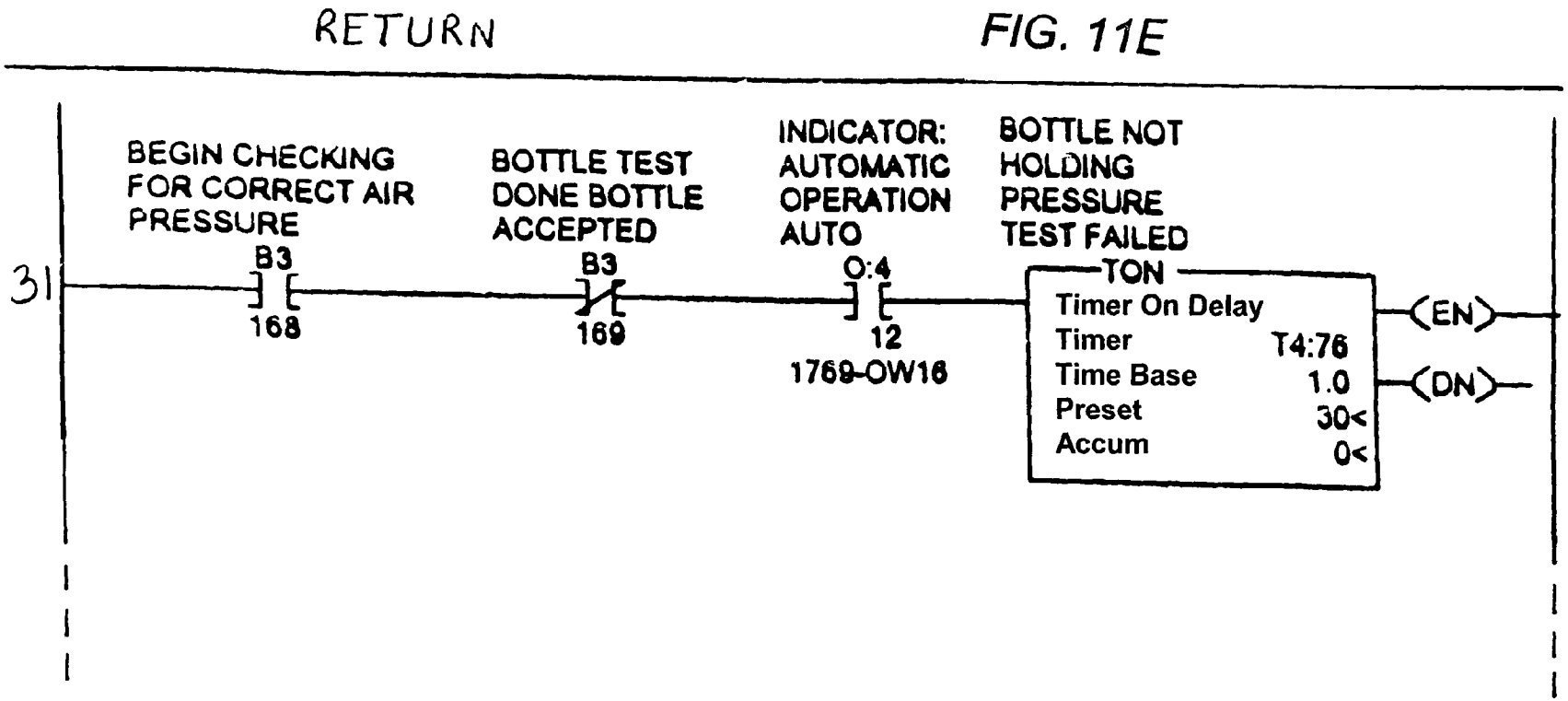
Figure 11E:
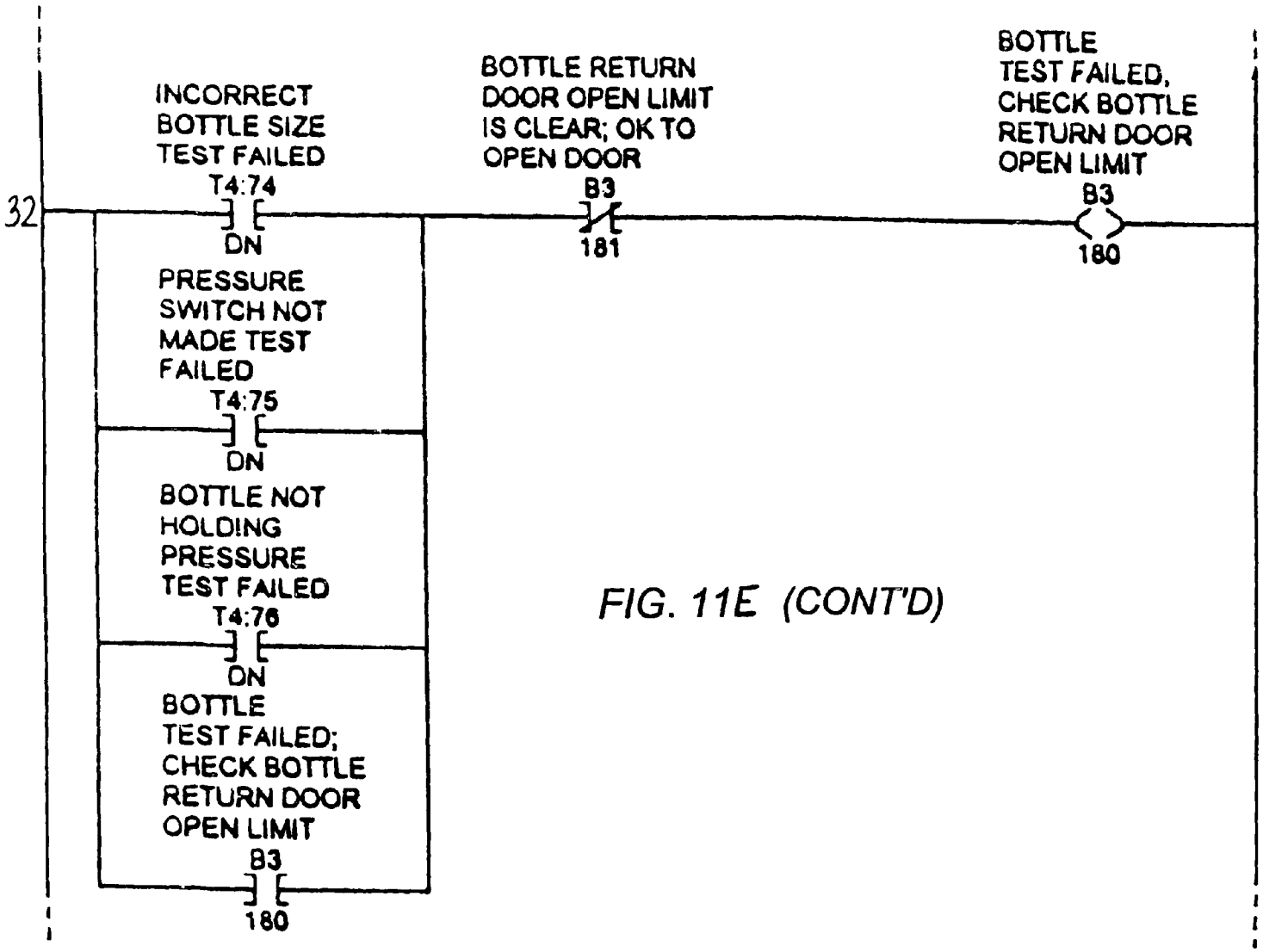
Figure 11E:
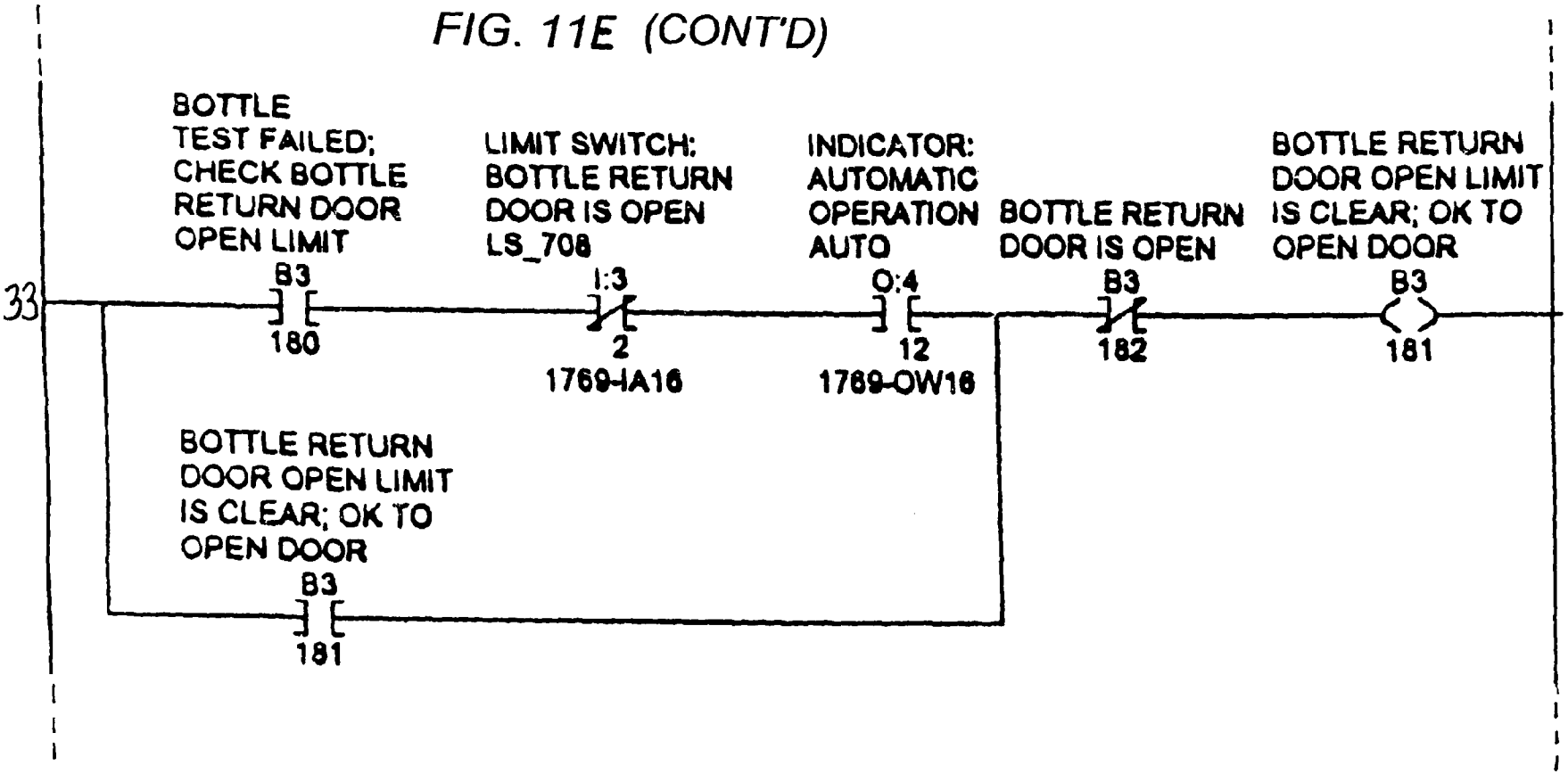
Figure 11E:
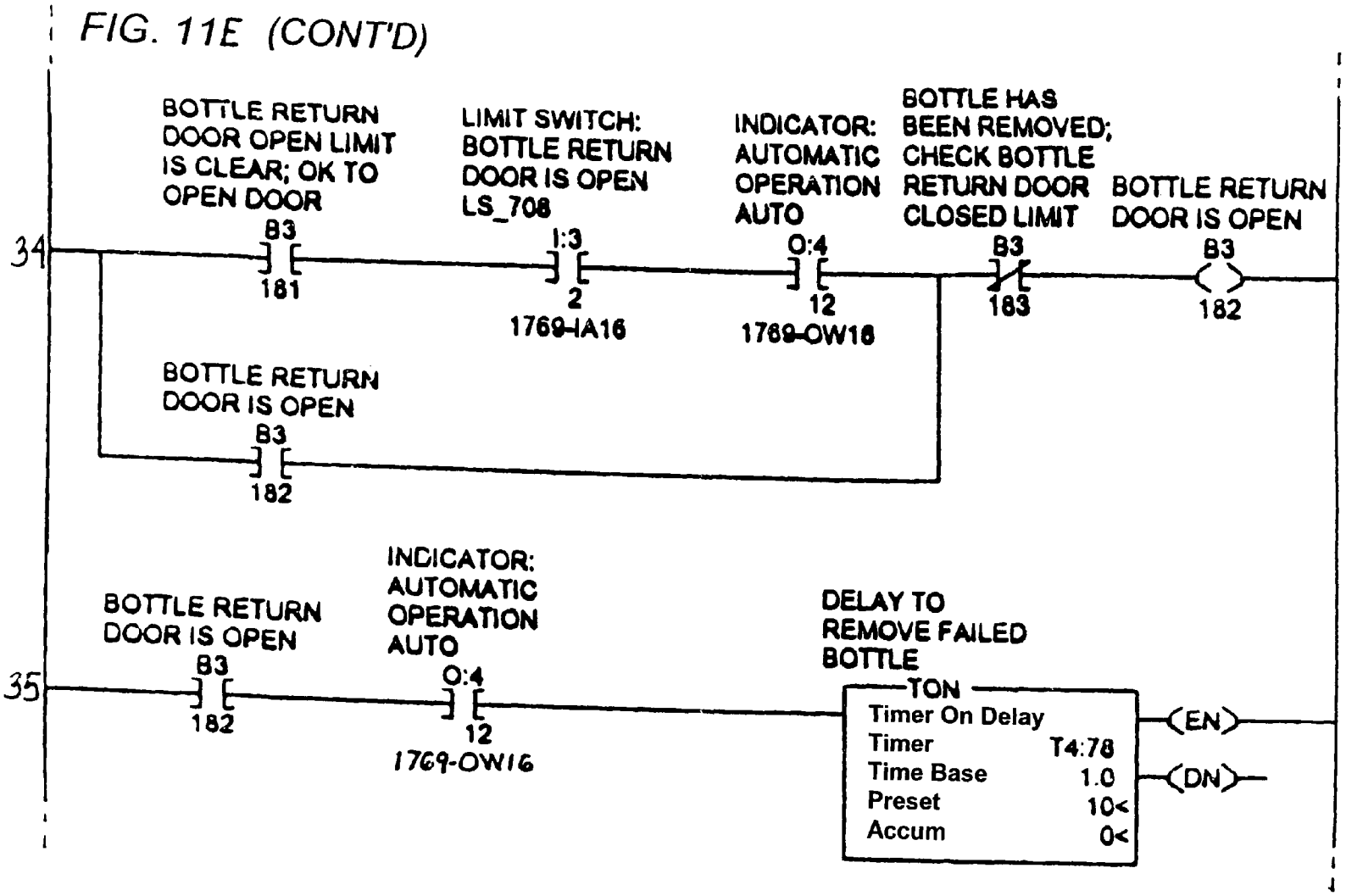
Figure 11E:
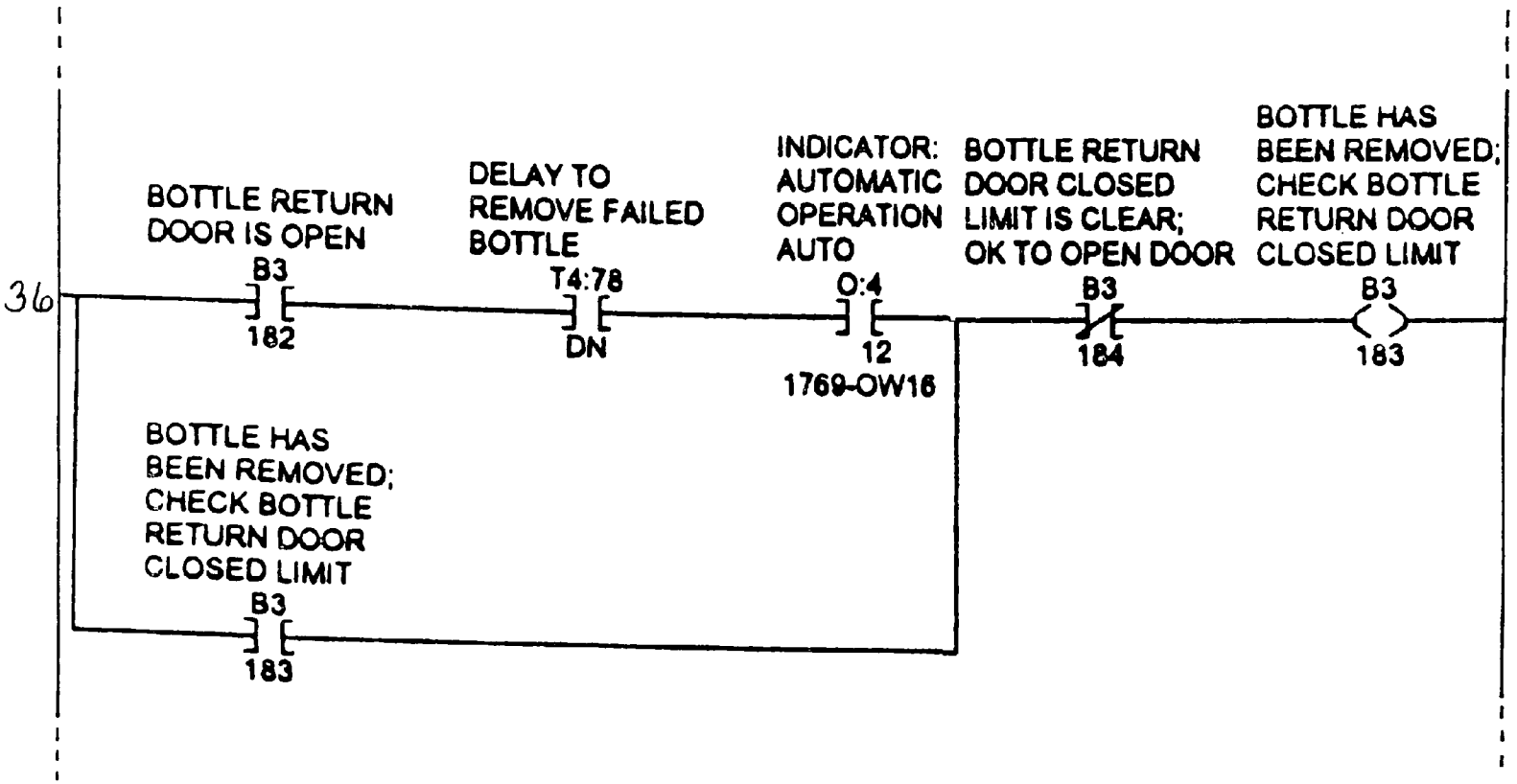
Figure 11E:
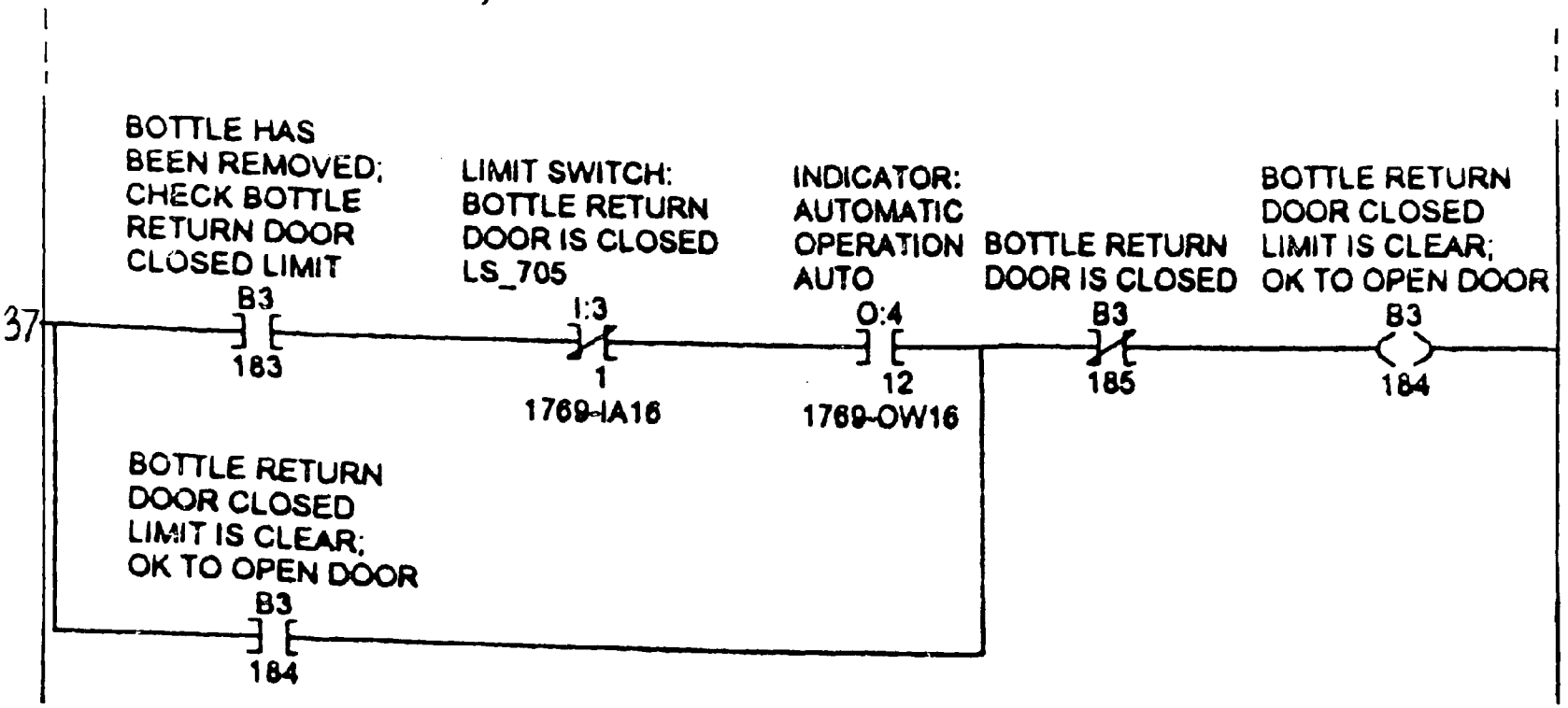
Figure 11F:
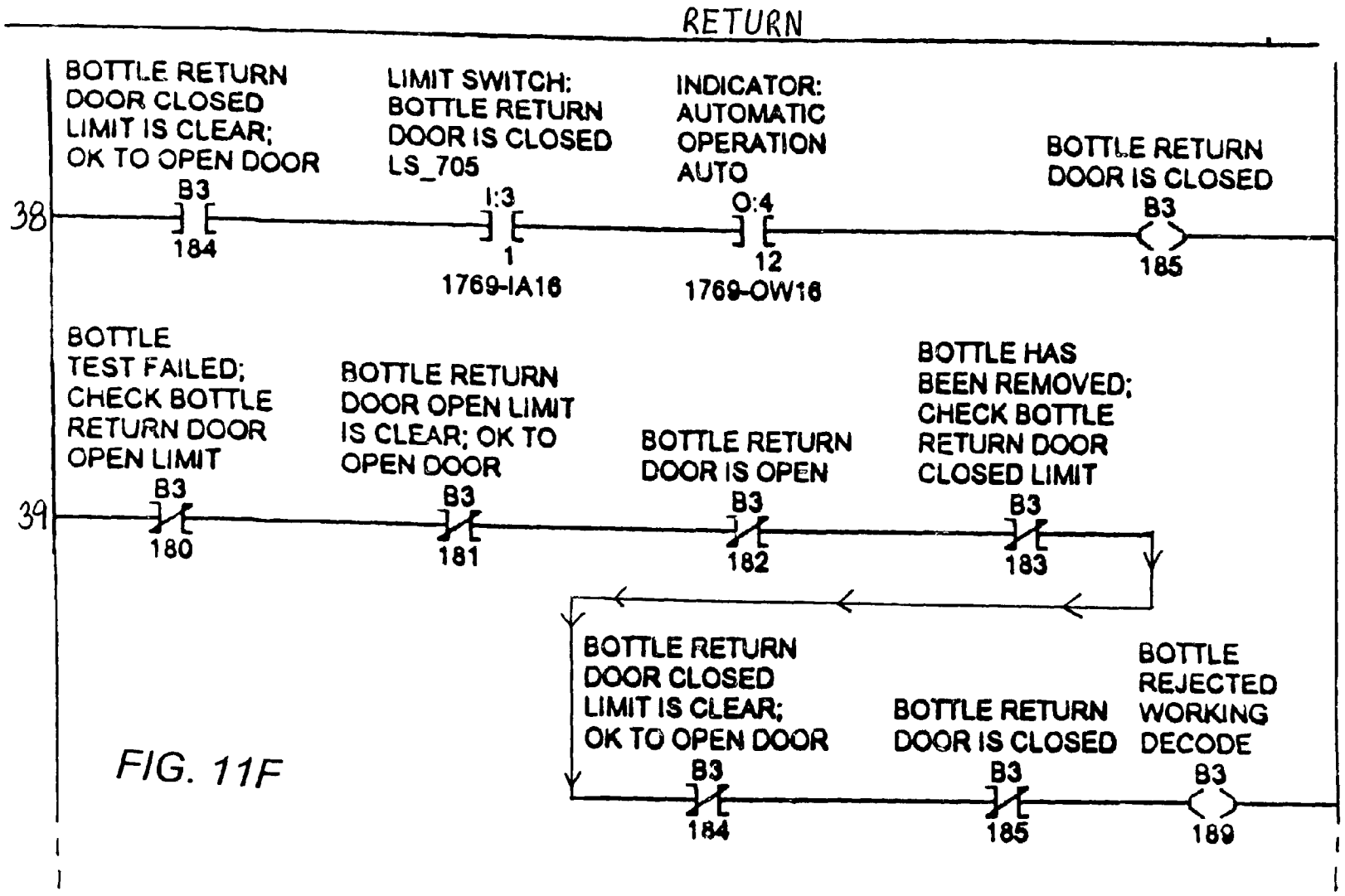
Figure 11F:
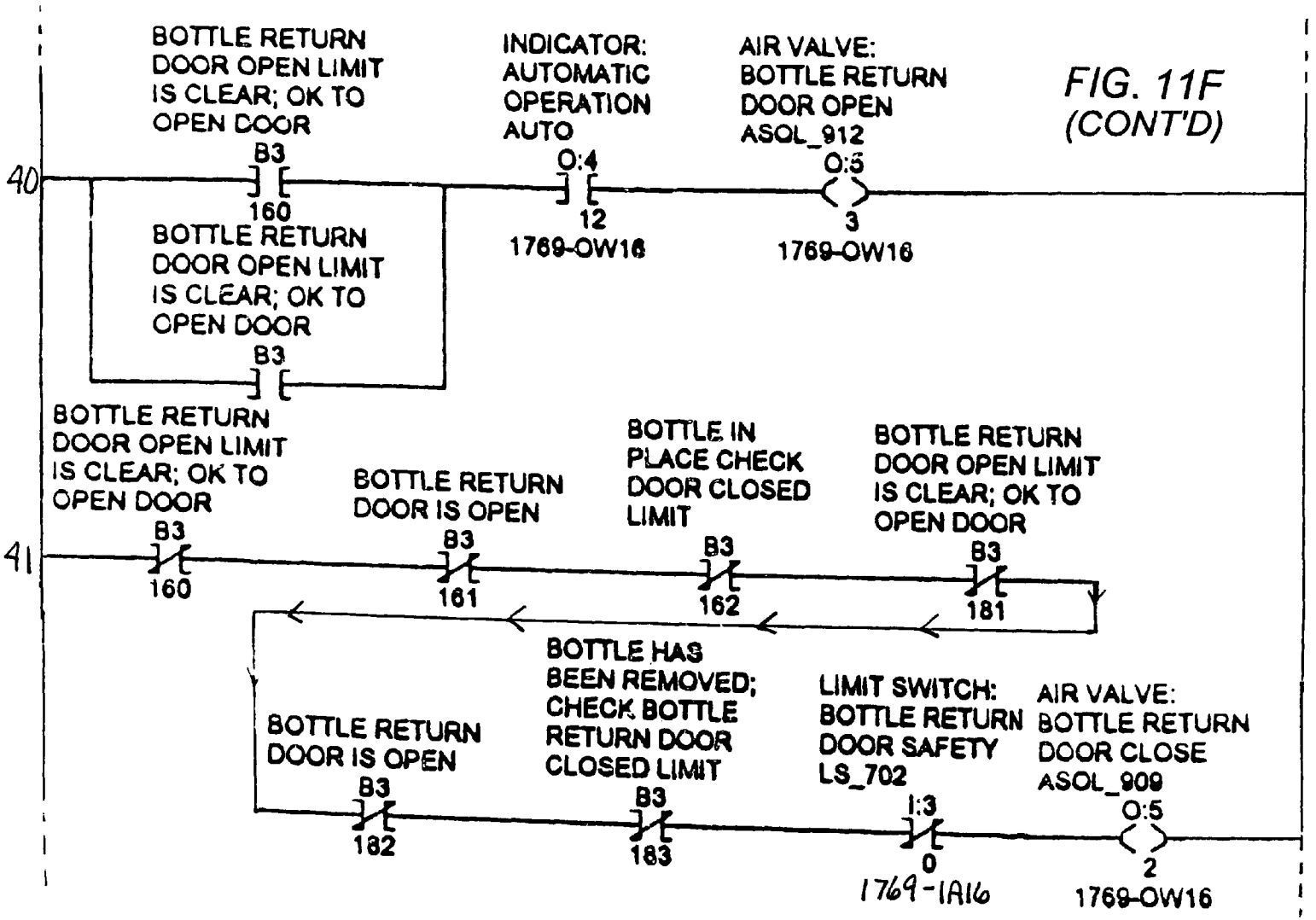
Figure 11F:
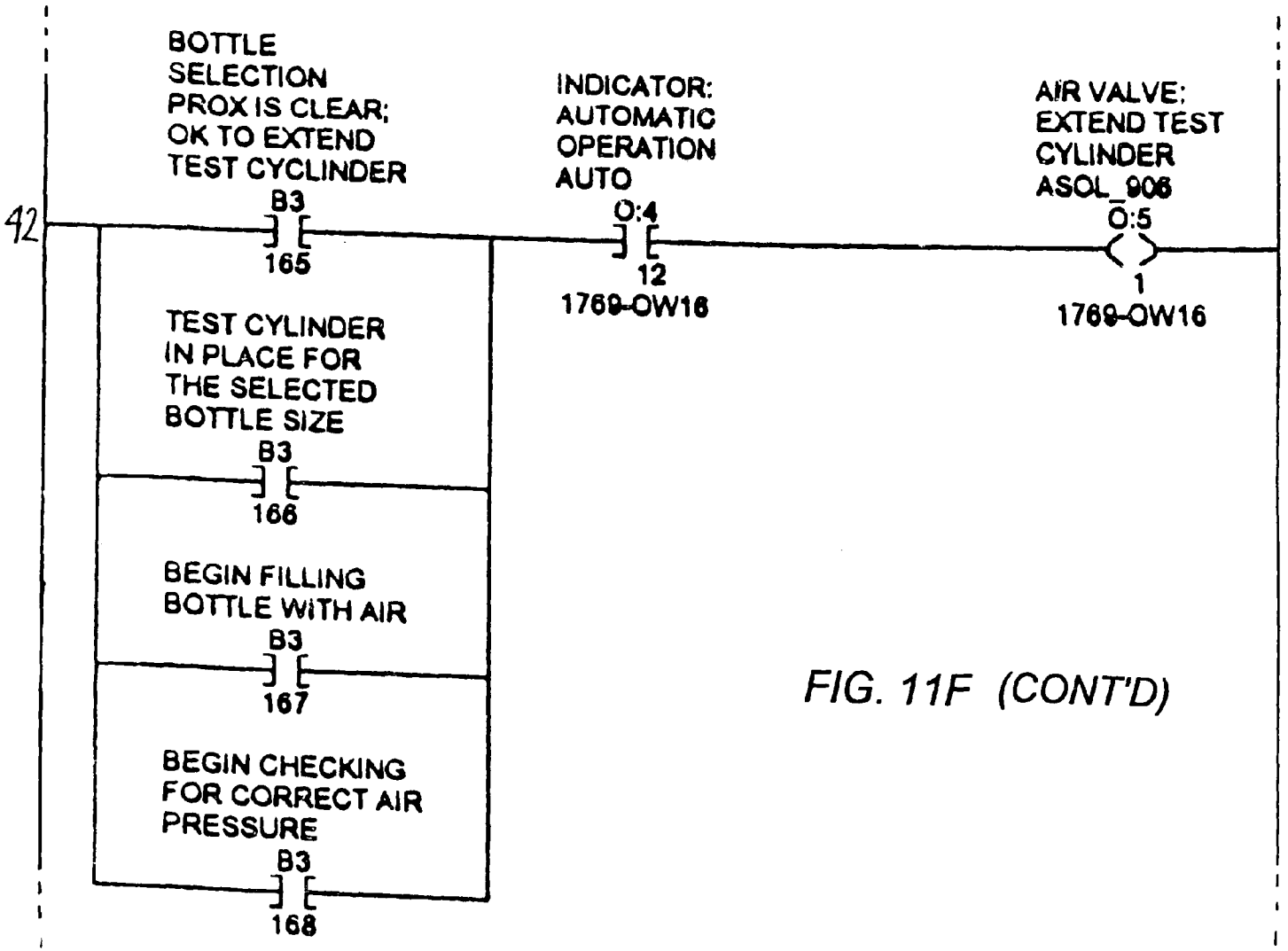
Figure 11F:
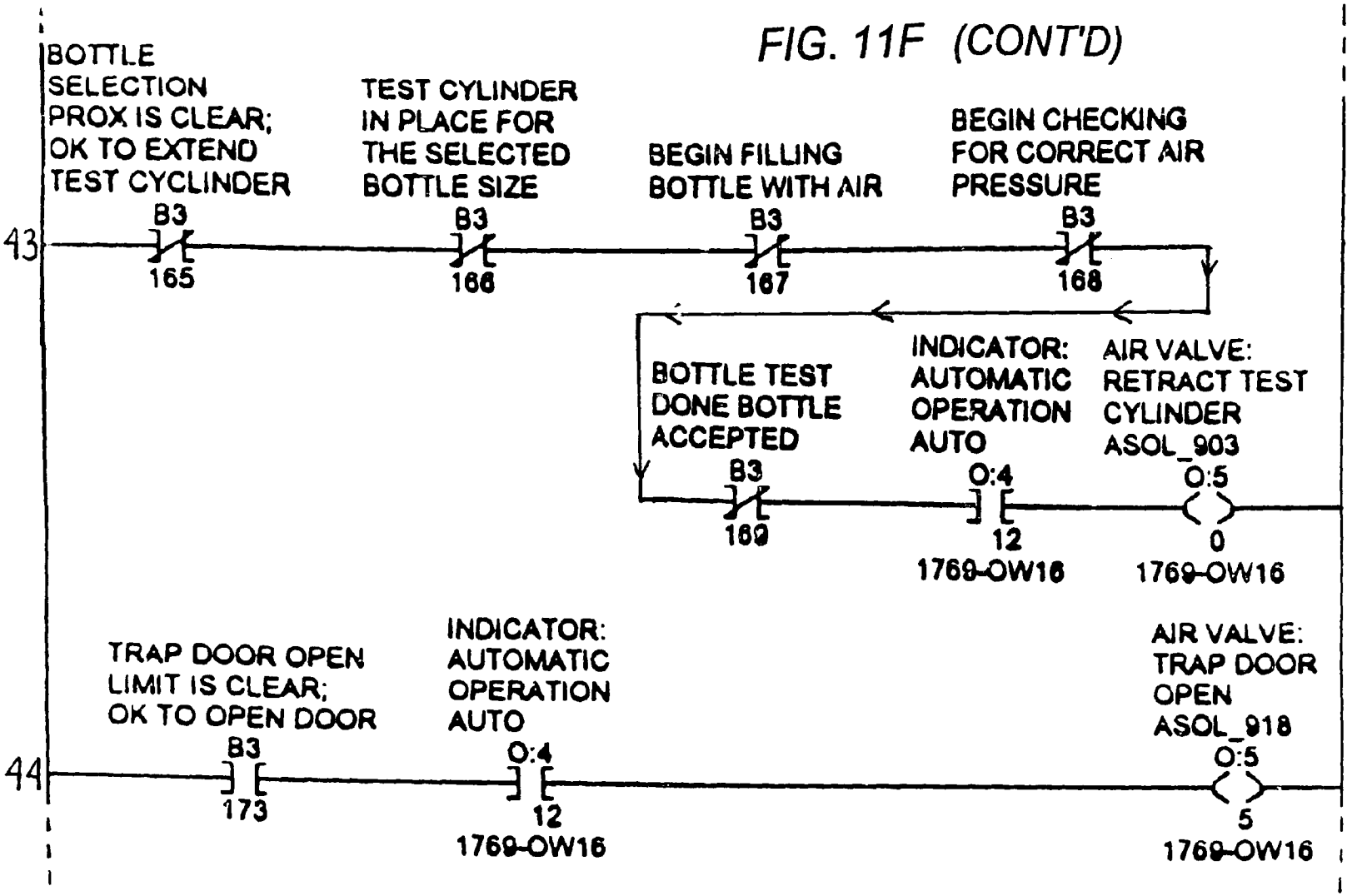
Figure 11F:
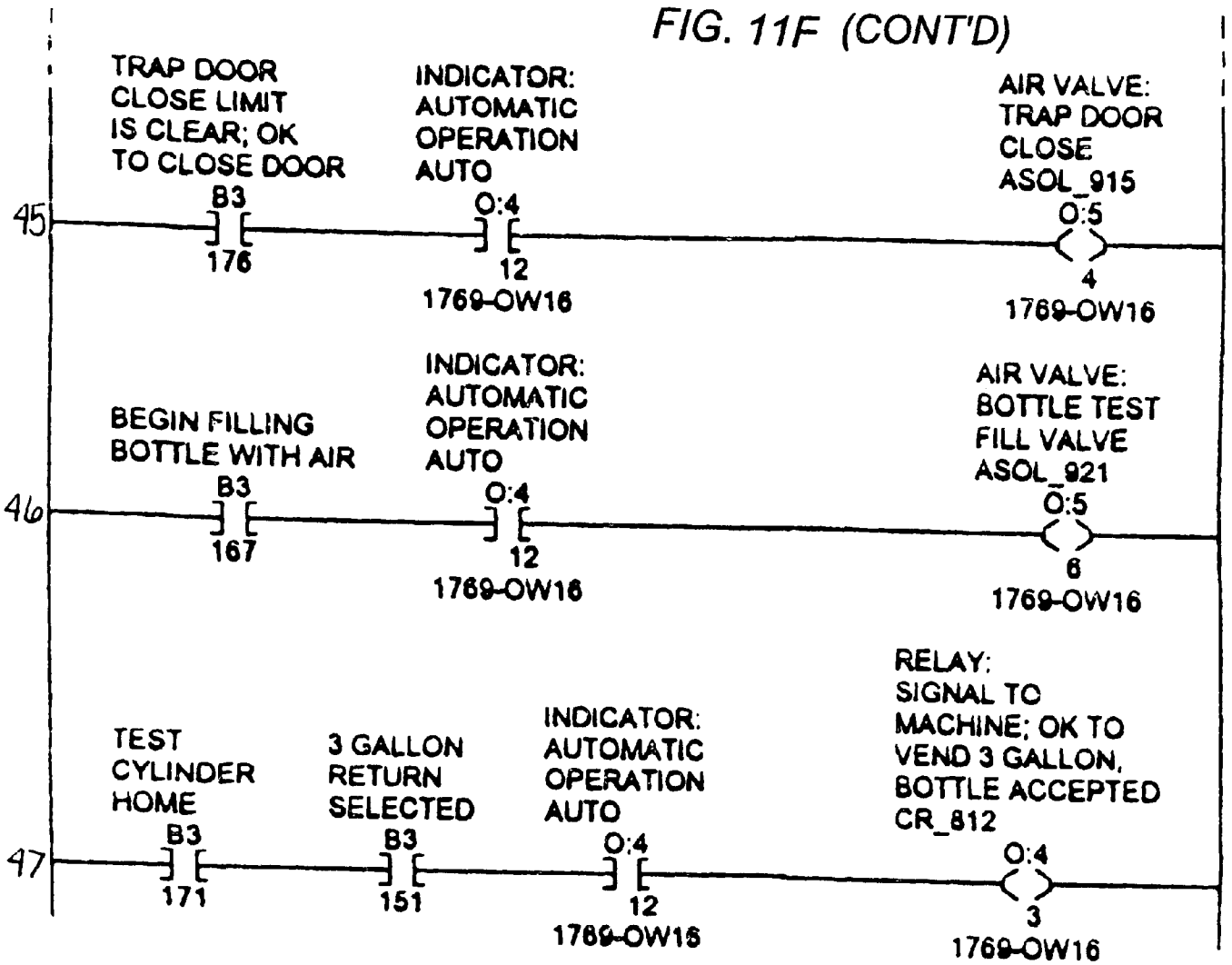
Figure 13:
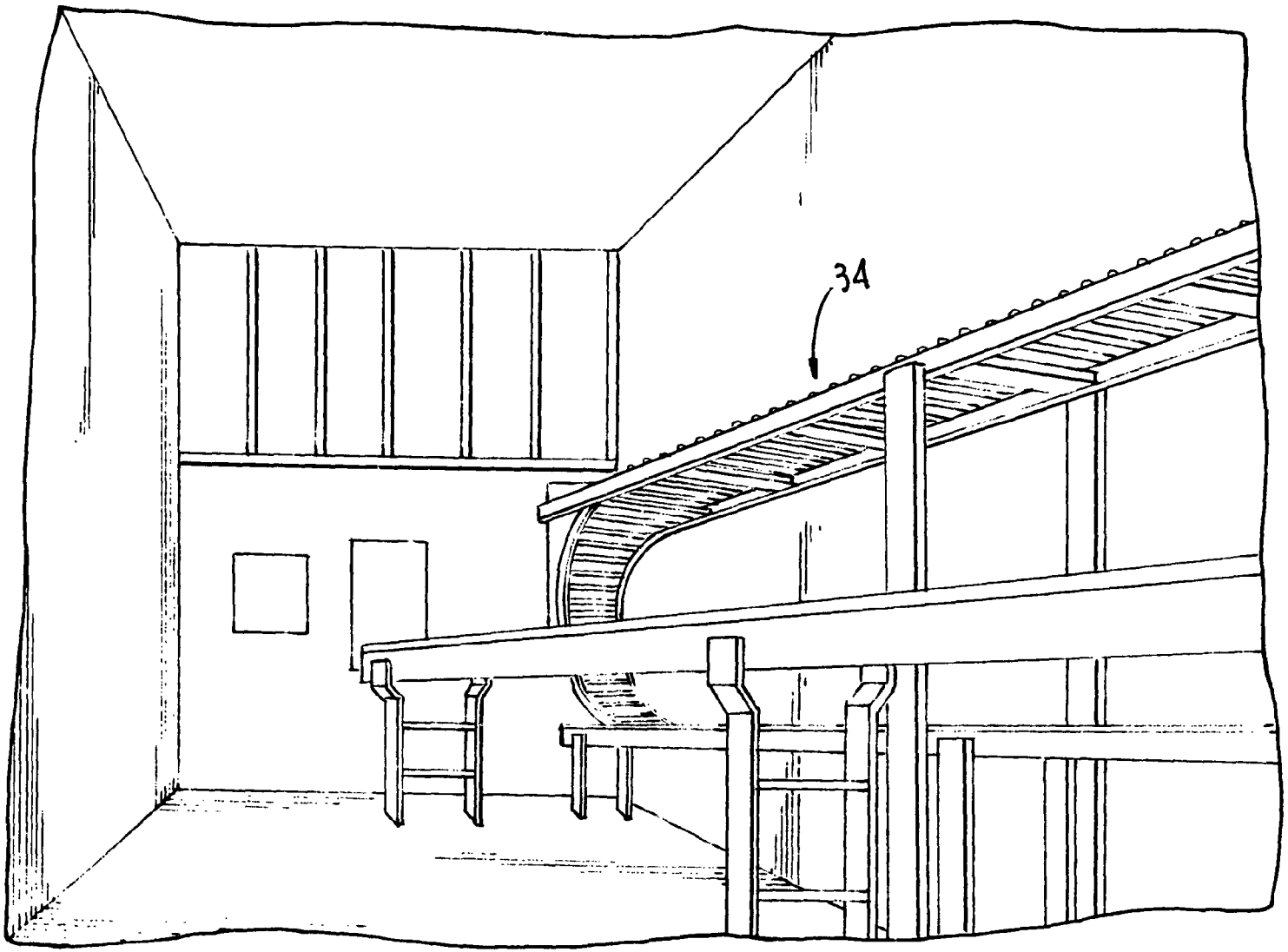
FIG. 13 illustrates an embodiment of a conveyor system of the present invention.

FIGS. 10A-10C illustrate a circuit diagram for the operation for dispensing a 5 gallon water bottle by the dispensing apparatus system 30 of the present invention. For example, the product may be placed by gravity or mechanical means on a conveyor belt if not already on the conveyor belt. The product then moves along the conveyor belt to a door of the dispensing member and into the product purchase area.

In operation of moving the 5 gallon product from the storage area to the product purchase area in the dispensing member, various signals and/or indicators may be received and sent throughout the dispensing apparatus system 30. For example these signals and/or indicators may include, but are not limited to, the following: product on gravity conveyor; automatic operation auto; product on gravity conveyor clear delay; product at security door; product at security door clear delay; product in purchase area; product in purchase area clear delay; product on gravity conveyor blocked delay; product moving into purchase area; product at security door with door closed; product on gravity conveyor okay to run belt; security door closed; product door closed; product vending; door open index product forward; okay to send product to purchase area open door; product in place stop belt; okay to close security door; security door closed cycle complete; 5 gallon product selected open door; product in purchase area ready to vend; 5 gallon product selection relay from machine; 5 gallon product sold out; door open product ready to be removed; product door open; product clear close door; product in purchase area clear delay; product door closed; air valves security door open; air valves security door closed; air valves product door open; air valves product door closed; push button start; delay to activate product vend simulator; signal from machine 5 gallon product selected; delay to drop out selection relays; 5 gallon selection relay from machine, and/or any suitable signal or indicator.

FIGS. 11A-11G illustrate a circuit diagram for the operation of returning empty bottles in the dispensing apparatus system 30 of the present invention. This circuit includes various signals and/or indicators including, but not limited to, the following: push button-3 gallon return; 3 gallon return selected; bottle return working; bottle rejected working; 3 gallon sold out; automatic operation auto; trap door is closed cycle complete; bottle test failed-check bottle return door open limit; push button-5 gallon return; 5 gallon sold out; 5 gallon return selected; bottle return door is open; bottle return door open limit is clear-okay to open door; bottle in place check door closed limit; bottle return delay to insert empty bottle; bottle return door limit is clear-okay to close door; bottle return door is closed; bottle selection prox is clear-okay to extend test cylinder; prox switch test cylinder in place for 3 gallon bottle; test cylinder in place for the selected bottle size; bottle test failed-check bottle return door open limit; prox switch test cylinder in place for 5 gallon bottle; delay to position test cylinder down to bottle; begin filling bottle with air; test cylinder in place for the selected bottle size; delay to begin filling bottle with air; begin checking for correct air pressure; delay before checking pressure; pressure switch-bottle at pressure; bottle test done-bottle accepted; delay to hold pressure for test; test cylinder home prox clear-okay return home; prox switch bottle test cylinder home; test cylinder home; product has vended-check trap door open limit; 3 gallon selection relay from machine; 5 gallon selection relay from machine; trap door open limit is clear-okay to open door; limit switch trap door is open; trap door is open; bottle has dropped-check trap door close limit; delay for bottle to drop; limit switch trap door is closed; bottle return door open limit is clear-okay to open door; bottle return door is closed limit to clear-okay to close door; incorrect bottle size test failed; pressure switch not made test failed; bottle test done bottle accepted; bottle not holding pressure test failed; limit switch bottle return door is open; bottle has been removed-check bottle return door closed limit; delay to remove failed bottle; air valve bottle return door open; limit switch bottle return door safety; air valve bottle return door closed; air valve extend test cylinder; air valve retract test cylinder, and/or any other suitable signal or indicator.

The components of the dispensing apparatus system of the present invention may be constructed and arranged out of any suitable material or combination of materials including, but not limited to, plastic, metal, synthetic material, combination thereof or any other suitable material.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. An automatic dispensing apparatus system for dispensing at least one predetermined object, comprising:

a housing constructed and arranged to house a plurality of predetermined objects in a storage area to be selected by a customer at the point of purchase and not contained in storage compartments prepackaged by a merchant;

a plurality of dispensing members, each having a body and a door;

a conveyor system constructed and arranged to transport at least one of the plurality of predetermined objects from the storage area to at least one of the plurality of dispensing members, wherein the conveyor system is operatively positioned in the housing;

a plurality of selection members constructed and arranged to select a type, size and/or quantity of the predetermined objects to be dispensed to the customer; and a payment member for paying for the predetermined objects selected.

2. The automatic dispensing apparatus system of claim 1, further comprising an inventory monitoring member for monitoring the type, size and/or quantity of predetermined objects sold.

3. The automatic dispensing apparatus system of claim 1, wherein the plurality of predetermined objects include various types and sizes of products including at least one of: food, produce, beverages, paper products, household products or combinations thereof.

4. The automatic dispensing apparatus system of claim 1, wherein the conveyor system includes a plurality of conveyor belts having a plurality of legs providing support to the plurality of conveyor belts.

5. The automatic dispensing apparatus system of claim 4, wherein each of the plurality of conveyor belts extend from the plurality of predetermined objects in the storage area to a corresponding dispensing member of the plurality of dispensing members.

6. The automatic dispensing apparatus system of claim 1, wherein the plurality of selection members includes a plurality of predetermined object selection buttons.

7. The automatic dispensing apparatus system of claim 1, further comprising:

an intermediate security door along the conveyor system between the storage area and the plurality of predetermined dispensing members.

8. A method of automatically dispensing at least one predetermined object, comprising:

selecting a desired type, size and quantity of at least one predetermined object from a plurality of selection members;

paying for the desired type, size and quantity of the at least one predetermined object at a payment member with cash or a credit card;

dispensing and transporting the at least one predetermined object from a storage area and along a conveyor system to a predetermined dispensing member;

opening a door of the predetermined dispensing member when the at least one predetermined object reaches a predetermined distance from the door of the predetermined dispensing member and payment for the predetermined object is received;

advancing the at least one predetermined object through an opening formed by the opening of the door of the predetermined dispensing member to a customer; and closing the door of the predetermined dispensing member.

9. The method of automatically dispensing a predetermined object of claim 8, wherein the at least one predetermined object includes various types and sizes of products including at least one of: food, produce, beverages, paper products, household products or combinations thereof.

10. A method of automatically dispensing at least one predetermined object, comprising:

selecting a desired type, size and quantity of at least one predetermined object from a plurality of selection members;

paying for the desired type, size and quantity of the at least one predetermined object at a payment member with cash or a credit card;

dispensing and transporting the at least one predetermined object from a storage area and along a conveyor system to a predetermined dispensing member;

opening a door of the predetermined dispensing member when the at least one predetermined object reaches a predetermined distance from the door of the predetermined dispensing member and payment for the predetermined object is received;

advancing the at least one predetermined object through an opening formed by the opening of the door of the predetermined dispensing member to a customer;

closing the door of the predetermined dispensing member; and providing at least one signal thereby providing activation, the at least one signal including at least one of: product on gravity conveyor; automatic operation auto; product on gravity conveyor clear delay; product at security door; product at security door clear delay; product in purchase area; product in purchase area clear delay; product on gravity conveyor blocked delay; product moving into purchase area; product at security door with door closed; product on gravity conveyor okay to run belt; security door closed; product door closed; product vending; door open index product forward; okay to send product to purchase area open door; product in place stop belt; okay to close security door; security door closed cycle complete; first product selected open door; second product selected open door; third product selected open door; fourth product selected open door; product in purchase area ready to vend; first product selection relay from machine; second product selection relay from machine; third product selection relay from machine; fourth product selection relay from machine; first product sold out; second product sold out; third product sold out; fourth product sold out; door open product ready to be removed; product door open; product clear close door; product in purchase area clear delay; product door closed; air valves security door open; air valves security door closed; air valves product door open; air valves product door closed; push button start; delay to activate product vend simulator; signal from machine first product selected; signal from machine second product selected; signal from machine third product selected; signal from machine fourth product selected; delay to drop out selection relays; first product selection relay from machine; second product selection relay from machine; third product selection relay from machine; and/or fourth product selection relay from machine.

* * * * *